US007706699B2

(12) United States Patent
Taguchi et al.

(10) Patent No.: US 7,706,699 B2
(45) Date of Patent: Apr. 27, 2010

(54) TONER CONTAINER AND IMAGE FORMING APPARATUS

(75) Inventors: Nobuyuki Taguchi, Kanagawa (JP); Masayuki Yamane, Kanagawa (JP); Hideo Yoshizawa, Kanagawa (JP); Takeroh Kurenuma, Kanagawa (JP); Takayuki Tamaki, Kanagawa (JP); Seiji Terazawa, Shizuoka (JP); Masashi Hasegawa, Shizuoka (JP); Fumie Satoh, Shizuoka (JP); Teruo Hitosugi, Shizuoka (JP); Takashi Hisazumi, Shizuoka (JP); Goro Katsuyama, Kanagawa (JP)

(73) Assignee: Ricoh Co., Ltd., Tokyo (JP)

( * ) Notice: Subject to any disclaimer, the term of this patent is extended or adjusted under 35 U.S.C. 154(b) by 632 days.

(21) Appl. No.: 11/567,601
(22) Filed: Dec. 6, 2006

(65) Prior Publication Data

US 2007/0177886 A1 Aug. 2, 2007

Related U.S. Application Data

(63) Continuation-in-part of application No. PCT/JP2006/308820, filed on Apr. 27, 2006.

(60) Provisional application No. 60/850,675, filed on Oct. 11, 2006.

(30) Foreign Application Priority Data

| | | |
|---|---|---|
| Apr. 27, 2005 | (JP) | 2005-129866 |
| Jun. 20, 2005 | (JP) | 2005-179200 |
| Jun. 21, 2005 | (JP) | 2005-180082 |
| Jun. 21, 2005 | (JP) | 2005-180153 |
| Jun. 22, 2005 | (JP) | 2005-181371 |
| Jun. 30, 2005 | (JP) | 2005-191090 |
| Jul. 7, 2005 | (JP) | 2005-198355 |
| Aug. 1, 2005 | (JP) | 2005-223438 |
| Oct. 18, 2005 | (JP) | 2005-302636 |
| Oct. 26, 2005 | (JP) | 2005-311112 |
| Oct. 26, 2005 | (JP) | 2005-311787 |
| Oct. 28, 2005 | (JP) | 2005-315311 |
| Nov. 30, 2005 | (JP) | 2005-346038 |
| Jan. 30, 2006 | (JP) | 2006-021362 |
| Feb. 2, 2006 | (JP) | 2006-026258 |
| Feb. 7, 2006 | (JP) | 2006-029859 |

(51) Int. Cl.
*G03G 15/00* (2006.01)

(52) U.S. Cl. ..... 399/12; 399/13; 399/119; 399/262

(58) Field of Classification Search ..... 399/9, 399/12, 13, 107, 110, 111, 119, 120, 252, 399/258, 262

See application file for complete search history.

(56) References Cited

U.S. PATENT DOCUMENTS 5,184,181 A 2/1993 Kurando et al.

(Continued)

FOREIGN PATENT DOCUMENTS

EP 0 616 268 A1 9/1994

(Continued)

OTHER PUBLICATIONS

"Background of Developing Toner Container for Ricoh ImagioMP series Multifunctional System", Ricoh Company, Ltd., 2 pages (with English translation).

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A toner container includes a longitudinal container body, a held portion, and an electric component. The longitudinal container body has a first end and a second end distal to the first end in a length direction of the container body. The held portion is attached to the first end of the container body and configured to be detachably attached to the toner-container holder. The held portion includes a toner outlet for discharging the toner. The electric component electrically communicates with a component in the main body to detect whether the toner container is operatively set in the toner-container holder. The electric component is attached to the held portion such that when the held portion is attached to the toner-container holder the electric component is located above the toner outlet with respect to a vertical direction.

23 Claims, 89 Drawing Sheets

U.S. PATENT DOCUMENTS

| | | | | |
|---|---|---|---|---|
| 5,381,217 | A | 1/1995 | Ishida | |
| 5,441,177 | A | 8/1995 | Yanagisawa | |
| 5,515,143 | A | 5/1996 | Shiotani | |
| 5,765,079 | A | 6/1998 | Yoshiki et al. | |
| 5,794,108 | A | 8/1998 | Yoshizawa et al. | |
| 5,828,935 | A | 10/1998 | Tatsumi et al. | |
| 5,867,757 | A | 2/1999 | Okazaki | |
| 5,970,290 | A | 10/1999 | Yoshiki et al. | |
| 5,991,584 | A | 11/1999 | Meyer et al. | |
| 6,104,902 | A | 8/2000 | Meyer et al. | |
| 6,169,864 | B1 | 1/2001 | Baxendell et al. | |
| 6,256,459 | B1 | 7/2001 | Hasegawa et al. | |
| 6,256,470 | B1 | 7/2001 | Taniyama et al. | |
| 6,298,208 | B1 | 10/2001 | Kawamura et al. | |
| 6,526,243 | B2 | 2/2003 | Kim et al. | |
| 6,591,077 | B2 | 7/2003 | Yanagisawa et al. | |
| 6,628,915 | B2 | 9/2003 | Muramatsu et al. | |
| 6,678,492 | B1 | 1/2004 | Terazawa et al. | |
| 6,701,112 | B2 | 3/2004 | Kusano et al. | |
| 6,785,497 | B1 | 8/2004 | Hasebe | |
| D500,076 | S | 12/2004 | Takuwa | |
| 6,859,634 | B2 | 2/2005 | Itoh et al. | |
| 6,882,817 | B2 | 4/2005 | Kita | |
| 6,917,779 | B2 | 7/2005 | Fujimori et al. | |
| D532,037 | S | 11/2006 | Tsuda et al. | |
| 7,133,629 | B2 | 11/2006 | Kita | |
| 7,162,189 | B2 | 1/2007 | Tsuda et al. | |
| 7,221,891 | B2 | 5/2007 | Matsumoto et al. | |
| 7,245,852 | B2 | 7/2007 | Takuwa | |
| 7,248,824 | B2 | 7/2007 | Takami | |
| 7,277,664 | B2 | 10/2007 | Katsuyama et al. | |
| 7,313,349 | B2 | 12/2007 | Suzuki et al. | |
| 7,346,299 | B2 | 3/2008 | Muramatsu et al. | |
| 7,398,038 | B2 | 7/2008 | Tsuda et al. | |
| 7,450,891 | B2 | 11/2008 | Maramatsu et al. | |
| 7,480,476 | B2 | 1/2009 | Hosokawa et al. | |
| 7,515,855 | B2 | 4/2009 | Katsuyama et al. | |
| 7,536,139 | B2 | 5/2009 | Katsuyama et al. | |
| D598,949 | S | 8/2009 | Kurenuma et al. | |
| 7,577,379 | B2 | 8/2009 | Kita et al. | |
| D599,845 | S | 9/2009 | Kurenuma et al. | |
| 7,590,374 | B2 | 9/2009 | Takami | |
| 7,593,674 | B2 | 9/2009 | Matsumoto et al. | |
| D602,985 | S | 10/2009 | Yoshizawa | |
| 7,603,054 | B2 | 10/2009 | Katsuyama et al. | |
| 2002/0114646 | A1 | 8/2002 | Sudo et al. | |
| 2003/0198488 | A1 | 10/2003 | Wang et al. | |
| 2003/0202823 | A1* | 10/2003 | Tamura | 399/227 |
| 2003/0219263 | A1 | 11/2003 | Tsuzuki | |
| 2004/0131390 | A1 | 7/2004 | Kita | |
| 2004/0131392 | A1 | 7/2004 | Matsumoto et al. | |
| 2004/0184841 | A1* | 9/2004 | Tsuda et al. | 399/258 |
| 2004/0223790 | A1 | 11/2004 | Hosokawa et al. | |
| 2004/0228641 | A1* | 11/2004 | Rommelmann et al. | 399/12 |
| 2004/0247344 | A1 | 12/2004 | Fujii et al. | |
| 2005/0041998 | A1 | 2/2005 | Fujii et al. | |
| 2005/0226655 | A1 | 10/2005 | Katsuyama et al. | |
| 2005/0226656 | A1 | 10/2005 | Tsuda et al. | |
| 2005/0254841 | A1* | 11/2005 | Tomitaka | 399/12 |
| 2006/0034642 | A1 | 2/2006 | Taguchi et al. | |
| 2006/0099012 | A1 | 5/2006 | Kita et al. | |
| 2006/0120762 | A1 | 6/2006 | Katsuyama | |
| 2006/0210319 | A1 | 9/2006 | Katsuyama | |

FOREIGN PATENT DOCUMENTS

| | | | |
|---|---|---|---|
| JP | 05-107918 | | 4/1993 |
| JP | 05107918 | A * | 4/1993 |
| JP | 6-149047 | | 5/1994 |
| JP | 6-266227 | | 9/1994 |
| JP | 7-2389 | | 1/1995 |
| JP | 2000-172060 | | 6/2000 |
| JP | 2000-310901 | | 11/2000 |
| JP | 2000-338758 | | 12/2000 |
| JP | 2001-5286 | | 1/2001 |
| JP | 2001-22230 | | 1/2001 |
| JP | 2001-42626 | | 2/2001 |
| JP | 3178749 | | 4/2001 |
| JP | 2001-154473 | | 6/2001 |
| JP | 2001-235932 | | 8/2001 |
| JP | 2001-235937 | | 8/2001 |
| JP | 2001-242692 | | 9/2001 |
| JP | 2002-31943 | | 1/2002 |
| JP | 2002-174947 | | 6/2002 |
| JP | 2002-287497 | | 10/2002 |
| JP | 2002-302169 | | 10/2002 |
| JP | 2002-307737 | | 10/2002 |
| JP | 2003-233248 | | 8/2003 |
| JP | 2003-255686 | | 9/2003 |
| JP | 2004-4559 | | 1/2004 |
| JP | 2004-18138 | | 1/2004 |
| JP | 2004-161371 | | 6/2004 |
| JP | 2004-161373 | | 6/2004 |
| JP | 2004-287404 | | 10/2004 |
| JP | 3628539 | | 12/2004 |
| JP | 2005-31109 | | 2/2005 |
| JP | 2005-203370 | | 7/2005 |
| JP | 2005-345773 | | 12/2005 |

* cited by examiner

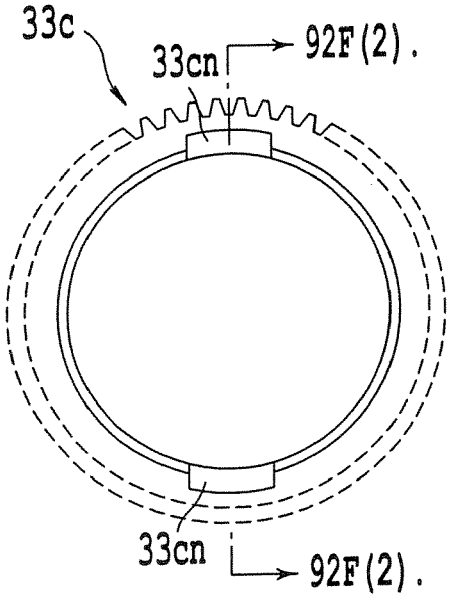
Fig.92F(1)
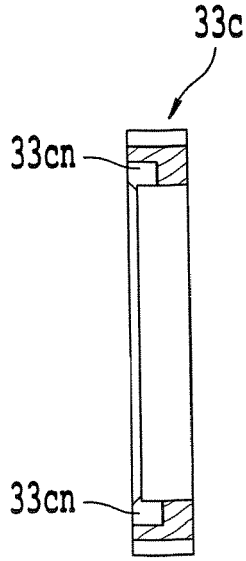
Fig.92F(2)
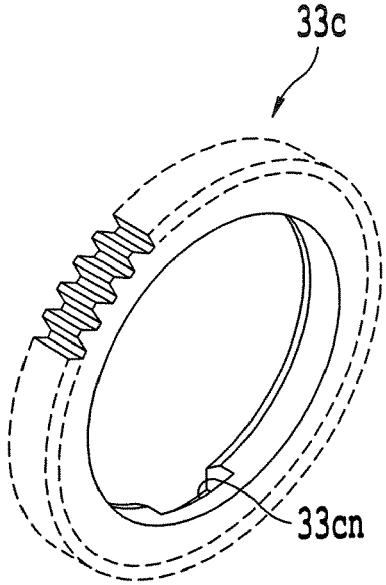
Fig.92F(3)

TONER CONTAINER AND IMAGE FORMING APPARATUS

CROSS-REFERENCE TO RELATED APPLICATIONS

This application claims the benefit of U.S. Provisional Application Ser. No. 60/850,675, filed Oct. 11, 2006 and entitled "Toner Container and Image Forming Device" which is incorporated herein by reference.

The inventions in this application are related to the inventions disclosed in the following Japanese patent applications: 2005-129866 filed Apr. 27, 2005, 2005-179200 filed Jun. 20, 2005, 2005-180082 filed Jun. 21, 2005, 2005-180153 filed Jun. 21, 2005, 2005-181371 filed Jun. 22, 2005, 2005-191090 filed Jun. 30, 2005, 2005-198355 filed Jul. 7, 2005, 2005-223438 filed Aug. 1, 2005, 2005-302636 filed Oct. 18, 2005, 2005-311112 filed Oct. 26, 2005, 2005-311787 filed Oct. 26, 2005, 2005-315311 filed Oct. 28, 2005, 2005-346038 filed Nov. 30, 2005, 2006-021362 filed Jan. 30, 2006, 2006-026258 filed Feb. 2, 2006, and 2006-029859 filed Feb. 7, 2006, and PCT patent application PCT/JP2006/308820 filed Apr. 27, 2006, each of which is incorporated herein by reference and may be utilized with any embodiment or feature disclosed herein.

BACKGROUND OF THE INVENTION

1. Field of the Invention

The present invention generally relates to a toner container detachably attached to the main body of an image forming apparatus to supply toner to be used in the image forming process, and the image forming apparatus including the same.

2. Description of the Related Art

In conventional image forming apparatuses using an electrophotographic system such as copying machines, printers, facsimiles, or multifunction products provided with these functions, a cylindrical toner container for supplying toner to a developing device is known (see, for example, Patent document 1).

In Patent document 1 and the like, a toner container (toner bottle) replaceably installed in a toner-container holder (bottle holder) of the main body of the image forming apparatus mainly includes a container body and a held portion (cap portion). A spiral-shaped projection is provided along the inner circumferential surface of the container body, and the toner contained in the container body is conveyed toward an opening through rotation of the container body. The held portion communicates with the opening of the container body, and it is non-rotatably held by the toner-container holder, i.e., it does not rotate with the container body. The toner output from the opening of the container body is discharged from a toner outlet provided in the held portion. Thereafter, the toner discharged from the toner outlet of the held portion is supplied to the developing device.

The toner container configured in the above manner can reduce toner stain upon replacement of the toner container as compared with toner containers (see, for example, Patent document 2) each of which has no held portion and directly supplies toner from the opening of the container body to the developing device. More specifically, because the toner outlet of the held portion is opened or closed in synchronization with part of attachment/detachment operation (rotating operation) of the toner container, such trouble that the user's hands become stained with toner by touching the toner outlet can be suppressed. Further, the toner outlet is formed downwardly in the lower part of the toner container in the vertical direction, and when the toner container is getting empty, the amount of toner near the toner outlet can be reduced due to the drop by its own weight. Therefore, the toner stain in the toner outlet upon replacement of the toner container is reduced.

More specifically, in Patent document 1 and the like, when the toner container is to be attached to the toner-container holder in the main body of the apparatus, at first, a main-body cover (stack portion) is opened upwardly and the toner-container holder is exposed. Then, the toner container is placed on the toner-container holder from the upper side thereof. Thereafter, a handle integrally provided to the held portion is held, so that the held portion is rotated (rotating operation). With this operation, an engaging portion formed in the end face of the held portion is engaged with a positioning member of an apparatus body, and the position of the toner container in the toner-container holder is fixed. Furthermore, the toner outlet provided in the held portion is moved to the lower part in response to the rotation of the held portion, and a shutter opens the toner outlet downwardly so as to resist the biasing force of a spring.

On the other hand, Patent document 3 or the like discloses a toner storage container (toner container) having a bag container and a cap member. A toner outlet of the cap member is opened/closed in synchronization with a partial operation (rotating operation of an open/close folder) of the attachment/detachment operation of the main body provided a screw pump, for the purpose of reducing toner stain (toner scatter) occurring upon the attachment/detachment operation.

More specifically, when the toner storage container is attached to the apparatus body, at first, an open/close holder (open/close folder) is rotated around a hinge and the upper side of the open/close holder is exposed. Then, the toner storage container is set in the open/close holder. Thereafter, the open/close holder with the toner storage container set therein is rotated (rotating operation) around the hinge. With this operation, an engaging portion provided on both side faces of a cap member so as to sandwich the toner outlet is engaged with a positioning member of the apparatus body, and the position of the toner-container holder in the apparatus body is fixed. Furthermore, a plug member (shutter member) is pushed by a nozzle (toner conveying pipe) in response to the rotation of the open/close holder so as to resist the biasing force of a spring, to open the toner outlet sealed by a packing (G seal).

In the toner storage container described in Patent document 3 or the like, the plug member is pushed by the nozzle (toner conveying pipe) in synchronization with the opening operation of the open/close holder to open the toner outlet sealed by the packing. It can thereby be expected to obtain the effect of reducing the occurrence of toner stain.

However, there is a disadvantage such that the toner amount of the toner storage container cannot be increased, which leads to an increase in the replacement frequency of the toner storage container. More specifically, the toner storage container has a bag container which contains toner and is provided along the vertical direction as its longitudinal direction. Therefore, if the toner amount is desired to be increased, the height of the toner storage container is inevitably increased. This causes the height of the open/close holder to be increased, to affect the layout in the height of the whole image forming apparatus. Therefore, the toner amount of the toner storage container cannot be increased so much, and the replacement frequency thereby increases more as compared with the toner containers (of which longitudinal direction is the horizontal direction) according to Patent document 1 and the like.

In conventional image forming apparatuses using an electrophotographic system such as copying machines, printers, facsimiles, or multifunction products provided with these functions, a cylindrical toner bottle for supplying toner to a developing device is known (see, for example, Patent document 4).

In Patent document 4 or the like, a toner bottle replaceably provided in the main body of the image forming apparatus mainly includes a bottle body (container body) and a case (container supply unit). A spiral-shaped projection is provided in the inner circumferential surface of the bottle body, and the toner contained in the bottle body is conveyed toward an opening through rotation of the bottle body. The case communicates with the opening of the bottle body, and is held by the main body of the image forming apparatus without following the rotation of the bottle body. The toner discharged from the opening of the bottle body is discharged from the toner outlet (toner supply port) provided in the case. Thereafter, the toner discharged from the toner outlet of the case is supplied to the developing device.

The toner bottle configured in the above manner allows improvement of the operability/workability for the user to replace toner bottles, as compared with the toner bottle (see, for example, Patent document 5) which has no case provided therein and directly supplies the toner from the opening of the bottle body to the developing device. More specifically, because the toner outlet of the case is opened/closed in synchronization with attachment/detachment operation of the toner bottle, such trouble that the user's hands become stained with toner by touching the toner outlet can be suppressed.

On the other hand, Patent document 4 discloses a technology for a toner bottle including a bottle body and a case, in which to prevent such a failure as toner leakage from a gap between the bottle body and the case, a seal member (seal) for sealing a gap between mutually opposite areas of the bottle body and the case is provided around the opening of the bottle body. Further, another technology of using a concave-shaped seal member is disclosed.

Patent document 1: Japanese Patent Application Laid-Open No. 2004-287404

Patent document 2: Japanese Patent Application Laid-Open No. 2000-338758

Patent document 2: Japanese Patent Application Laid-Open No. 2004-161371

Patent document 4: Japanese Patent Application Laid-Open No. 2000-214669

Patent document 5: Japanese Patent Application Laid-Open No. 2003-233248

Each of the toner containers (toner container including a container body and a held portion) disclosed in Patent document 1 or the like has features such that there is less toner stain upon replacement of the toner containers and the replacement frequency can be reduced because the toner amount in the toner container can be increased.

However, when the user, the seller, the distributor, and the manufacturer stock the toner containers (which are not yet used before being set in the image forming apparatus), and if the toner container is stood on a horizontal plane (an arbitrary plane for placing) with the held portion directed vertically downward, the toner on the side of the held portion may sometimes be aggregated.

In other words, when the held portion is directed downward, the toner is deposited on the side of the held portion by its own weight, which may lead to toner aggregation. If the toner container with the toner aggregated on the side of the held portion is set in the image forming apparatus, the toner is insufficiently discharged from the toner outlet, which also causes the toner not to be supplied sufficiently to the developing device. Furthermore, if a toner lump is produced caused by the toner aggregation, this may cause a failure in toner conveyance or an abnormal image.

These problems quite often occur especially when the toner container with the held portion directed vertically downward is left standing for a long time or under high-temperature and high-humidity environments.

The present invention has been achieved to solve at least the conventional problems, and it is an object to provide a toner container and an image forming apparatus in which toner is never aggregated on the side of its held portion when the toner container is stocked.

Each of the toner containers disclosed in Patent document 1 or so has less toner stain in the toner outlet as compared with that in Patent document 2 or so, and therefore, it can be expected to obtain the effect of preventing such trouble that the user's hands become stained with toner by touching the toner outlet. However, the toner containers in Patent document 1 or so are disadvantages in terms of operability/workability upon its attachment/detachment (replacement).

A first disadvantage is such that the attachment/detachment operation to/from the toner-container holder is implemented with a plurality of operations. More specifically, the attachment/detachment operation of the toner container includes the plurality of operations such as an operation of opening/closing the main-body cover, an operation of placing/removing the toner container on/from the toner-container holder, and an operation of rotating the held portion.

A second disadvantage is such that it is difficult for the user to check that the operation is performed properly nearly until the completion of the attachment operation. More specifically, the user cannot feel certain that the operation is correct at the point in time when the operation of opening the main-body cover and the operation of placing the toner container on the toner-container holder are complete. Thereafter, by rotating the held portion to fix the position of the held portion, the user gains a click feeling of the held portion, and feels certain that no erroneous operation is done.

A third disadvantage is such that the upper side of the toner-container holder is restricted in terms of layout. More specifically, to place the toner container on the toner-container holder from the upper side, the operation of opening/closing the main-body cover in the vertical direction is needed. Therefore, it is necessary to ensure space required for layout to open/close the main-body cover and place/remove the toner container. This causes reduction in operability/workability in attachment and detachment of the toner container when a scanner (document reader) or the like is provided above the toner-container holder.

On the other hand, in the toner storage container described in Patent document 3 or the like, the plug member is pushed by the nozzle in response to the opening operation of the open/close holder, to open the toner outlet sealed by the packing. Therefore, the effect of reducing occurrence of toner stain can be expected. However, the toner storage container according to Patent document 3 or the like also has some disadvantages in terms of operability/workability upon its attachment/detachment.

A first disadvantage is such that the toner amount of the toner storage container cannot be increased and the frequency of replacement of the toner storage container therefore increases. The toner storage container has a longitudinal bag container for containing toner. The bag container is arranged so that it stands vertically. Therefore, if the capacity of the bag container is to be increased, the height of the toner storage container needs to be increased. This causes the height of the open/close holder to be increased, to affect the layout in the height of the whole image forming apparatus. Therefore, the toner amount of the toner storage container cannot be increased so much, and the replacement frequency increases thereby as compared with the toner containers (in which the horizontal direction is set as the longitudinal direction) according to Patent document 1 and the like.

A second disadvantage is such that it is difficult for the user to feel certain that no erroneous operation is done. More specifically, because the plug member opens/closes the toner outlet in synchronization with the open/close operation of the open/close holder, it is difficult for the user to feel if the toner outlet is actually opened or closed because the user does not touch the toner storage container during the operation.

The present invention has been achieved to solve at least the conventional problems, and it is an object of the present invention to provide a toner container with high operability/workability during its replacement and capable of reliably reducing occurrence of toner stain, and an image forming apparatus including the same.

Because there has been the increasing awareness for protection of environmental resources, high recycling rates (easiness of recycling) are required for toner containers. More specifically, it is demanded that the toner container is configured to be easily filled with toner when it is newly produced, and that in addition to this feature, the toner container is configured to be easily filled with toner when it is recycled without main members of the container being disassembled.

The toner bottle described in Patent document 4 may sometimes has some advantages such that the operability/workability upon the replacement is improved as compared with that of Patent document 5, but also has some disadvantages such that toner may be leaked from a gap between the bottle body and the case after the time elapsed.

More specifically, the seal member, such as polyurethane foam bonded to an area of the case side which faces the opening, slidably contacts the opening of the rotating bottle body, to prevent leakage of the toner from the gap between the case and the bottle body. On the other hand, by rotating the bottle body which is held improperly as compared with the case which is firmly held by a holding portion of the main body of the image forming apparatus, the bottle body rotates while slightly vibrating in its radial direction (the direction orthogonal to the rotating-axis direction). Such vibrations in the radial direction of the bottle body are repeated over time, the sealing capability of the seal member gradually deteriorates. In other words, the opening is radially vibrated again and again, a deformed shape of the seal member having elasticity (shape to seal the gap) is not fixed, and the restoring force thereof deteriorates, which results in occurrence of a gap in the space which should be sealed. And the toner is leaked from the gap to the outside of the toner bottle. If the toner is leaked to the outside of the toner bottle in this manner, the toner is wasted, and the inside of the image forming apparatus is contaminated with the toner.

These problems are not negligible particularly for large-capacity toner bottles produced to reduce the running cost. In other words, to rotate such a toner bottle that the filling amount of toner is increased and the weight of the toner bottle is thereby increased, a large driving force is required. Therefore, the amount of vibration in the radial direction of the opening increases associated with an increase in the torque, uneven rotation, vibration of the bottle body. Furthermore, the operation time (life) of the toner bottle having the large capacity is increased according to the toner amount increased, which causes the time for which the vibration of the opening is affected on the seal member to be increased.

On the other hand, Patent document 4 or the like discloses a technology for forming a concave-shaped seal member with which the gap between the bottle body and the case is sealed. However, even if the seal member with elasticity is formed into the concave shape, this shape does not help control the radial vibration of the opening. The effect of directly resolving the problems cannot thereby be expected.

The present invention has been achieved to solve at least the conventional problems, and it is an object of the present invention to provide a toner bottle with high operability/workability during its replacement and without toner leakage over time even if it is increased in capacity, and an image forming apparatus using the same.

SUMMARY OF THE INVENTION

It is an object of the present invention to at least partially solve the problems in the conventional technology.

According to an aspect of the present invention, a toner container detachably attached to a toner-container holder of a main body of an image forming apparatus, includes a longitudinal container body for containing toner, the container body having a first end and a second end distal to the first end in a length direction of the container body; a held portion attached to the first end of the container body and configured to be detachably attached to the toner-container holder, the held portion including a toner outlet for discharging the toner contained in the container body; and an electric component that electrically communicates with a component in the main body to detect whether the toner container is operatively set in the toner-container holder, the electric component being attached to the held portion such that when the held portion is attached to the toner-container holder the electric component is located above the toner outlet with respect to a vertical direction.

According to another aspect of the present invention, a toner container detachably attached to a toner-container holder of a main body of an image forming apparatus, includes a longitudinal container body for containing toner, the container body having a first end and a second end distal to the first end in a length direction of the container body; a held portion that is attached to the first end of the container body and configured to be detachably attached to the toner-container holder, the held portion including a toner outlet for discharging the toner contained in the container body; and an engaging portion that attached to the held portion, and that engages with a positioning member that is provided in the toner-container holder.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 92F(1)-92F(3) show a gear which is used with the toner bottle of FIGS. 92A-92E;

DETAILED DESCRIPTION OF THE PREFERRED EMBODIMENTS

Figure 1:
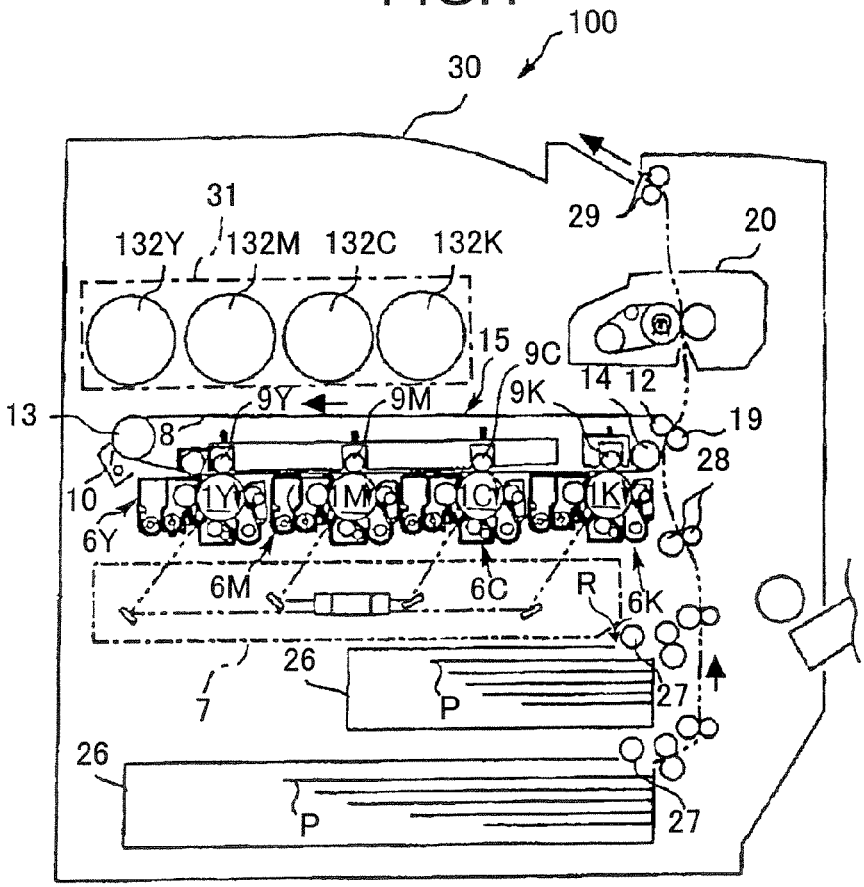
FIG. 1 is an overall schematic of an image forming apparatus according to a first embodiment of the present invention.

Exemplary embodiments of the present invention are explained in detail below with reference to the attached drawings. In the drawings, the same or an equivalent portion is assigned with the same reference letter or numeral, and explanation of the overlapping portions are simplified or omitted if not necessary.

Figure 3:
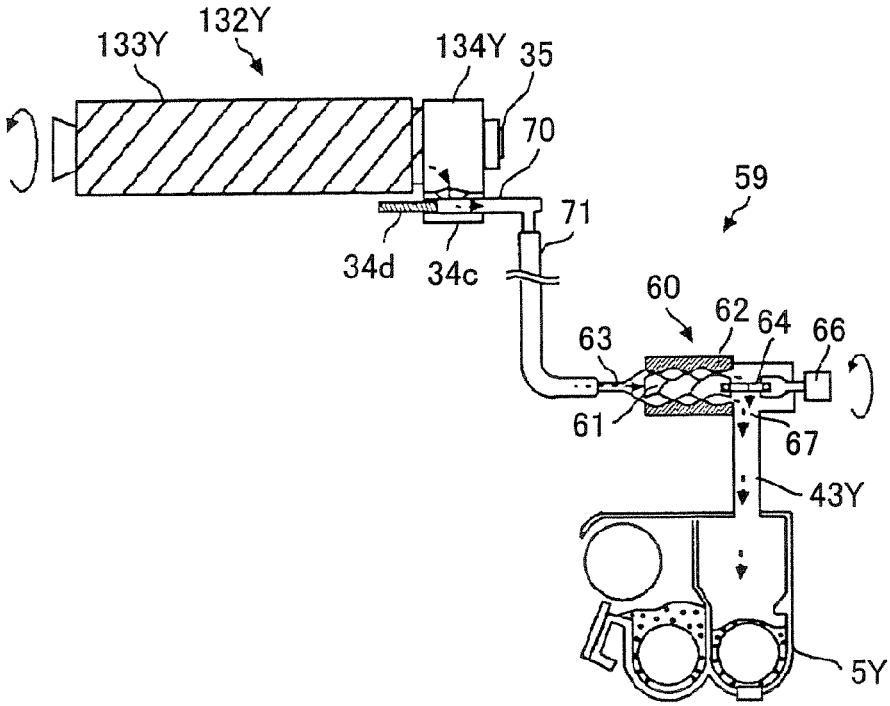
FIG. 3 is a schematic of a toner supply path in the image forming apparatus of FIG. 1.
Figure 4:
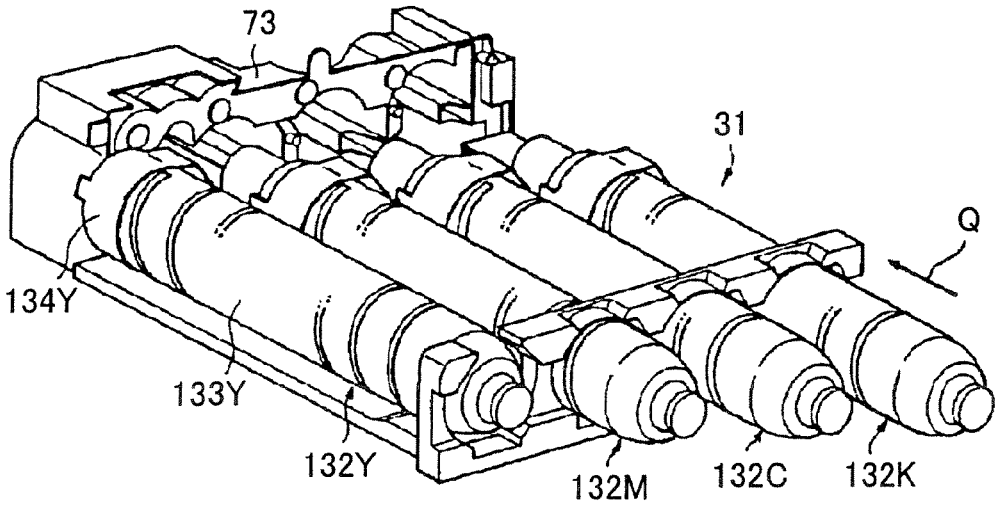
FIG. 4 is a perspective view of a toner-container holder when toner containers are set therein.

A first embodiment of the present invention is explained in detail below with reference to FIG. 1 to FIG. 14. The configuration and operation of the overall image forming apparatus are explained first with reference to FIG. 1 to FIG. 4. FIG. 1 is an overall schematic of a printer as the image forming apparatus, FIG. 2 is a cross-section of an imaging unit of the image forming apparatus, FIG. 3 is a schematic of a toner supply path thereof, and FIG. 4 is a perspective view of a part of a toner-container holder.

As shown in FIG. 1, four toner containers 132Y, 132M, 132C, and 132K correspond to colors (yellow, magenta, cyan, and black) and are detachably (replaceably) arranged in a toner-container holder 31 which is provided in the upper side of the main body of the image forming apparatus 100. Provided in the lower side of the toner-container holder 31 is an intermediate transfer unit 15. Imaging units 6Y, 6M, 6C, and 6K corresponding to the colors (yellow, magenta, cyan, and black) are arranged in a tandem manner so as to face an intermediate transfer belt 8 of the intermediate transfer unit 15.

Figure 2:
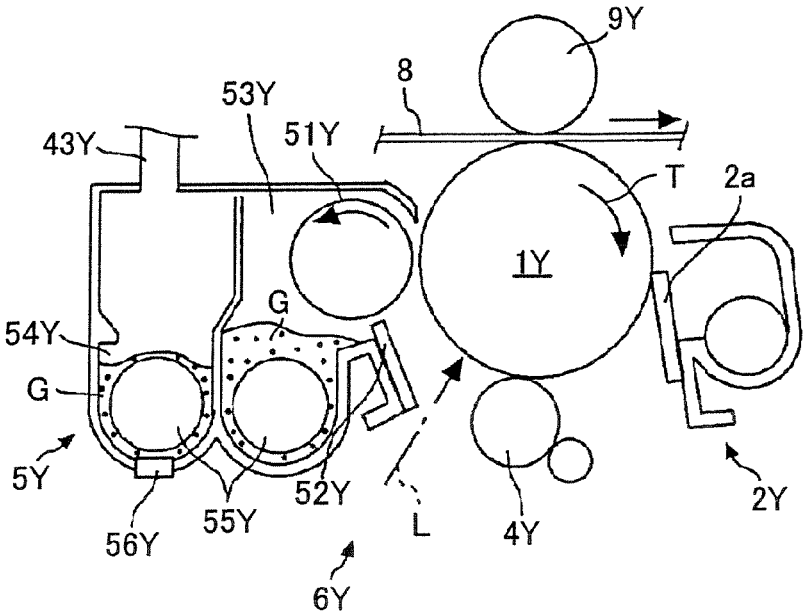
FIG. 2 is a cross-section of an imaging unit in the image forming apparatus of FIG. 1.

Referring to FIG. 2, the imaging unit 6Y corresponding to yellow includes a photosensitive drum 1Y, and also includes a charger 4Y, a developing device 5Y (developing unit), a cleaning unit 2Y, and a decharger (not shown), which are arranged around the photosensitive drum 1Y. Imaging processes (charging process, exposing process, developing process, transfer process, and cleaning process) are preformed on the photosensitive drum 1Y, and an yellow image is formed on the photosensitive drum 1Y.

The other three imaging units 6M, 6C, and 6K have almost the same configuration as the imaging unit 6Y corresponding to yellow, except different toner colors to be used, and images corresponding to the respective toner colors are formed. Hereinafter, explanation of the other three imaging units 6M, 6C, and 6K is omitted, and only the imaging unit 6Y for yellow is explained below.

Referring to FIG. 2, the photosensitive drum 1Y is made to rotate in the clockwise in FIG. 2 by a drive motor (not shown). The surface of the photosensitive drum 1Y is uniformly charged at the position of the charger 4Y (charging process). Thereafter, the surface of the photosensitive drum 1Y reaches a position of radiating a laser light L emitted from an exposing device 7 (see FIG. 1), where an exposing light is scanned to form an electrostatic latent image for yellow (exposing process).

Thereafter, the surface of the photosensitive drum 1Y reaches a position of facing the developing device 5Y, where the electrostatic latent image is developed and a yellow toner image is formed (developing process). Then, the surface of the photosensitive drum 1Y reaches a position of facing the intermediate transfer belt 8 and a primary-transfer bias roller 9Y, where the toner image on the photosensitive drum 1Y is transferred to the intermediate transfer belt 8 (primary transfer process). At this time, a slight amount of non-transferred toner remains on the photosensitive drum 1Y.

Thereafter, the surface of the photosensitive drum 1Y reaches a position of facing the cleaning unit 2Y, where the non-transferred toner remaining on the photosensitive drum 1Y is mechanically collected by a cleaning blade 2*a* (cleaning process). The surface of the photosensitive drum 1Y finally reaches a position of facing the decharger (not shown), where the residual potential on the photosensitive drum 1Y is removed.

The imaging processes are performed on the other imaging units 6M, 6C, and 6K in the same manner as those of the yellow imaging unit 6Y. In other words, the laser light L based on image information is radiated from the exposing device 7 provided in the lower side of the imaging unit toward each photosensitive drum of the imaging units 6M, 6C, and 6K. More specifically, the exposing device 7 emits the laser light L from its light source, and radiates the laser light L onto the photosensitive drum through a plurality of optical elements while scanning the laser light L by a polygon mirror which is rotated. Then, respective color toner images formed on the photosensitive drums through the developing process are superposedly transferred on the intermediate transfer belt 8. In this manner, a color image is formed on the intermediate transfer belt 8.

Referring to FIG. 1, the intermediate transfer unit 15 includes the intermediate transfer belt 8, four primary-transfer bias rollers 9Y, 9M, 9C, and 9K, a secondary-transfer backup roller 12, a cleaning backup roller 13, a tension roller 14, and an intermediate-transfer cleaning unit 10. The intermediate transfer belt 8 is stretched and supported by three rollers 12 to 14, and is endlessly moved in the direction of an allow (i.e., in the direction shown by the arrow) in FIG. 1 by the rotation of the roller 12.

The four primary-transfer bias rollers 9Y, 9M, 9C, and 9K sandwich the intermediate transfer belt 8 with the photosensitive drum 1Y and photosensitive drums 1M, 1C, and 1K, to form each primary transfer nip. And the transfer bias inverse to the polarity of toner is applied to the primary-transfer bias rollers 9Y, 9M, 9C, and 9K. Then, the intermediate transfer belt 8 moves along the arrow direction and sequentially passes through the primary transfer nips of the primary-transfer bias rollers 9Y, 9M, 9C, and 9K. In this manner, the toner images for the colors on the photosensitive drums 1Y, 1M, 1C, and 1K are sequentially superposed on the intermediate transfer belt 8 to perform primary transfer.

Thereafter, the intermediate transfer belt 8 with the toner images for the colors superposedly transferred reaches the position of facing a secondary transfer roller 19. At this position, the secondary-transfer backup roller 12 sandwiches the intermediate transfer belt 8 with the secondary transfer roller 19 to form a secondary transfer nip. The four-color toner images formed on the intermediate transfer belt 8 are transferred to a transferred material P such as a transfer paper conveyed to the position of the secondary transfer nip. At this time, non-transferred toner which has not been transferred to the transferred material P remains on the intermediate transfer belt 8.

Thereafter, the intermediate transfer belt 8 reaches the position of the intermediate-transfer cleaning unit 10, where the non-transferred toner on the intermediate transfer belt 8 is collected. In this manner, a series of the transfer process performed on the intermediate transfer belt 8 is completed.

The transferred material P conveyed to the position of the secondary transfer nip is conveyed thereto from a paper feed unit 26 provided in the lower side of the apparatus body 100 through a paper feed roller 27 and a registration roller pair 28. More specifically, the transferred material P such as transfer paper is stored in plurality in the paper feed unit 26. When the paper feed roller 27 is made to rotate in the counterclockwise of FIG. 1, the uppermost transferred material P is fed to the rollers of the registration roller pair 28.

The transferred material P conveyed to the registration roller pair 28 once stops at the position of a roller nip between the registration roller pair 28 that stops its rotation. Then, the registration roller pair 28 is rotated in synchronization with the color images on the intermediate transfer belt 8, and the transferred material P is conveyed toward the secondary transfer nip. In this manner, a desired color image is transferred to the transferred material P.

The transferred material P with the color image transferred at the position of the secondary transfer nip is conveyed to the position of a fixing unit 20, where the color image transferred to the surface of the transferred material P is fixed on the transferred material P under heat and pressure by a fixing roller and a pushing roller. Thereafter, the transferred material P is ejected to the outside the apparatus through rollers of a paper-discharge roller pair 29. The transferred material P ejected to the outside the apparatus by the paper-discharge roller pair 29 is sequentially stacked on the stack portion 30, as an output image. In this manner, a series of the imaging forming processes in the image forming apparatus is completed.

The configuration and the operation of the developing device in the imaging unit are explained in further detail below with reference to FIG. 2. The developing device 5Y includes a developing roller 51Y that faces the photosensitive drum 1Y, a doctor blade 52Y that faces the developing roller 51Y, two conveyor screws 55Y provided in developer storage units 53Y and 54Y, and the density detection sensor 56Y for detecting toner density in the developer. The developing roller 51Y includes a magnet fixed inside thereof and a sleeve rotating around the magnet. Two-component developer G containing carrier and toner is stored in the developer storage units 53Y and 54Y. The developer storage unit 54Y communicates with a toner conveying pipe 43Y through the opening formed in the upper side of the developer storage unit 54Y.

The developing device 5Y configured in the above manner operates as follows. The sleeve of the developing roller 51Y rotates in the arrow direction of FIG. 2. The developer G carried on the developing roller 51Y by the magnetic field formed by the magnet moves along the developing roller 51Y associated with rotation of the sleeve.

The developer G in the developing device 5Y is controlled so that the proportion (toner density) of the toner in the developer is in a predetermined range. More specifically, the toner contained in the toner container 132Y is supplied to the developer storage unit 54Y through a toner supply device 59 (see FIG. 3) according to toner consumption in the developing device 5Y. It is noted that each configuration and operation of the toner supply device 59 and the toner container 132Y are explained in detail later.

Thereafter, the toner supplied to the developer storage unit 54Y circulates (movement in the vertical direction on the paper of FIG. 2) in the two developer storage units 53Y and 54Y while being mixed with the developer G and stirred. The toner in the developer G is attracted to the carrier by frictional charge with the carrier, and is carried on the developing roller 51Y together with the carrier by the magnetic force formed on the developing roller 51Y.

The developer G carried on the developing roller 51Y is conveyed in the arrow direction (counterclockwise) of FIG. 2 to reach the position of the doctor blade 52Y. At this position, the amount of developer is made appropriate, and then the developer G on the developing roller 51Y is conveyed to the position (developing region) of facing the photosensitive drum 1Y. The toner is attracted to the latent image formed on the photosensitive drum 1Y by the electric field formed in the developing region. Then, the developer G remaining on the developing roller 51Y reaches the upper side of the developer storage unit 53Y associated with the rotation of the sleeve, where the developer G is separated from the developing roller 51Y.

The toner supply device 59 that leads the toner contained in the toner container 132Y (agent storage container) to the developing device 5Y is explained in detail below with reference to FIG. 3. For easy understanding, FIG. 3 depicts changed arrangement of the toner container 32Y, toner supply paths 43Y, 60, 70, and 71, and the developing device 5Y. Actually, in FIG. 3, the longitudinal direction of the toner container 32Y and part of the toner supply path is arranged in the vertical direction on the paper (see FIG. 1).

Referring to FIG. 4, the toner in the toner containers 132Y, 132M, 132C, and 132K arranged in the toner-container holder 31 of the apparatus body 100 is supplied to each of the developing devices if necessary through the toner supply paths provided for each toner color according to each toner consumption in the developing devices for the colors. The four toner supply paths have almost the same configuration as one other except different toner color used for each imaging process.

More specifically, the toner container 132Y is set in the toner-container holder 31 of the apparatus body 100, and a nozzle 70 of the toner-container holder 31 is connected to a held portion 134Y (cap) of the toner container 132Y. A plug member 34*d* (open/close member) of the toner container 132Y opens the toner outlet (supply port) of the held portion 34Y in this state. This allows the toner contained in a container body 133Y of the toner container 132Y to be conveyed into the nozzle 70 through the toner outlet.

On the other hand, the other end of the nozzle 70 is connected to one end of a tube 71 as a conveyor tube (71). The tube 71 is made of flexible material excellent in toner resistance, and the other end thereof is connected to a screw pump 60 (Mohno pump) of the toner supply device 59. The tube 71 being the conveyor tube (71) is formed so that its internal diameter is 4 to 10 mm. The material of the tube 71 is allowed to use a rubber material such as polyurethane, nitrile, EPDM, and silicone, and a resin material such as polyethylene, and nylon. Such a flexible tube 71 is used to enhance flexibility in layout of the toner supply path, thus downsizing of the image forming apparatus.

The screw pump 60 is a suction-type uniaxial eccentric screw pump, and includes a rotor 61, a stator 62, a suction port 63, a universal joint 64, and a motor 66. The rotor 61, the stator 62, and the universal joint 64 are accommodated in a casing (not shown). The stator 62 is a female screw member made of an elastic material such as rubber, and a spiral-shaped groove with double pitch is formed along the inside of the stator 62. The rotor 61 is a male screw member in which an axis made of a rigid material such as metal is spirally formed, and is rotatably inserted in the stator 62. One end of the rotor 61 is rotatably joined to the motor 66 through the universal joint 64. In the first embodiment, the spiral direction (turning direction) and the rotational direction of the rotor 61 are set so as to match the spiral direction (turning direction) and the rotational direction of the projection 33*b* formed in the container body 133Y of the toner container 132Y.

The screw pump 60 configured in the above manner generates suction force at the suction port 63 (air in the tube 71 is sent out to generate a negative pressure in the tube 71) by rotating the rotor 61 of the stator 62 by the motor 66 in a predetermined direction (counterclockwise when viewed from the upstream side in the toner conveying direction). This allows the toner in the toner container 132Y with the air to be sucked to the suction port 63 through the tube 71. The toner sucked to the suction port 63 is sent into a gap between the stator 62 and the rotor 61 and is fed to the other end side along the rotation of the rotor 61. The toner fed is discharged from a feed port 67 of the screw pump 60, to be supplied to the developing device 5Y through the toner conveying pipe 43Y (movement in the arrow direction indicated by a dotted line in FIG. 3). In the first embodiment, the rotor 61 of the screw pump 60 is made to rotate in the counterclockwise viewed from the upstream side in the toner conveying direction. The spiral direction (turning direction) of the rotor 61 is set to be a rightward direction. This setting and rotation of the rotor 61 cause a spiral air flow spiraling in clockwise to be created in the screw pump 60.

The toner container is explained below with reference to FIG. 5 to FIG. 7. As explained with reference to FIG. 1 and FIG. 4, the four substantially cylindrical toner containers 132Y, 132M, 132C, and 132K (toner bottles) are detachably provided in the toner-container holder 31. The toner containers 132Y, 132M, 132C, and 132K are replaced with new ones when they come to the end of their lives (when almost all of toner contained is consumed and the container becomes empty). The toner of each color contained in the toner containers 132Y, 132M, 132C, and 132K is supplied as necessary to each developing device of the imaging units 6Y, 6M, 6C, and 6K through each toner supply path explained with reference to FIG. 3.

Figure 5:
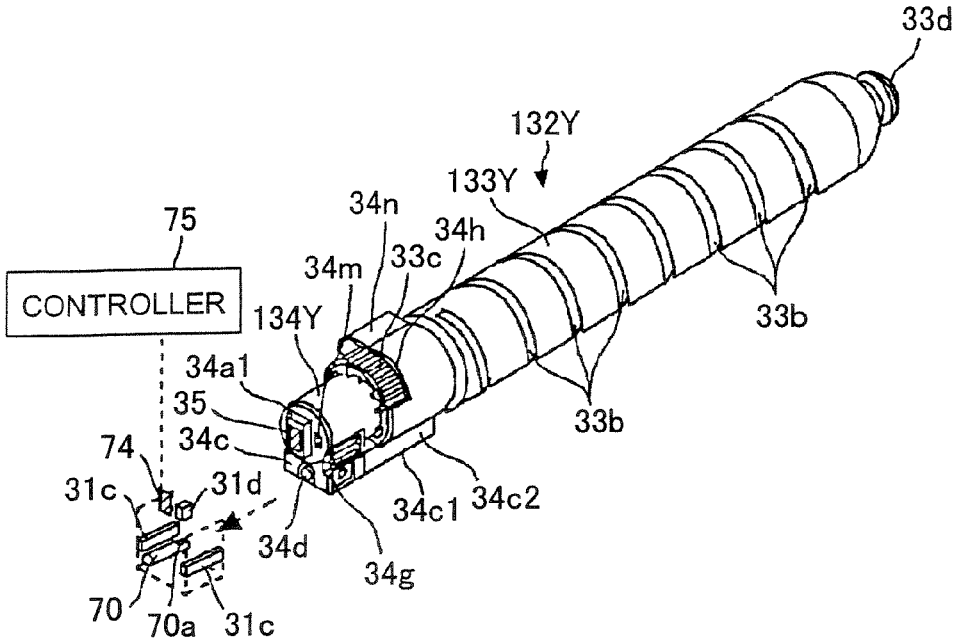
FIG. 5 is a perspective view of a toner container to be set in the toner-container holder.

FIG. 5 is a perspective view of the toner container 132Y. FIG. 6 is a cross-section of a head side (the side where the held portion 134Y is provided) of the toner container 132Y. FIG. 7 is a schematic of the toner container 132Y of FIG. 6 when viewed from the M direction in FIG. 6. The other three toner containers 132M, 132C, and 132K have almost the same configuration as the toner container 132Y containing yellow toner, except different toner colors contained and locations of a concave portion 34*m* and a convex portion 34*n*. Hereinafter, explanation of the other three toner containers 132M, 132C, and 132K is omitted, and only the toner container 132Y containing yellow toner is explained below.

As shown in FIG. 5, the toner container 132Y (toner bottle) mainly includes the container body 133Y (toner holder) and the held portion 134Y (bottle cap, cap portion) provided in the head thereof. In the first embodiment, the held portion 134Y is formed into the shape obtained by adding the protrusion portion being a rectangle to the cylinder, but the protrusion portion may be formed into any shape of a hemisphere, a cone, and a shape obtained by cutting off the apex of a cone by a plane parallel with its bottom or a like so as to prevent the container body 133Y from being erected.

Figure 6:
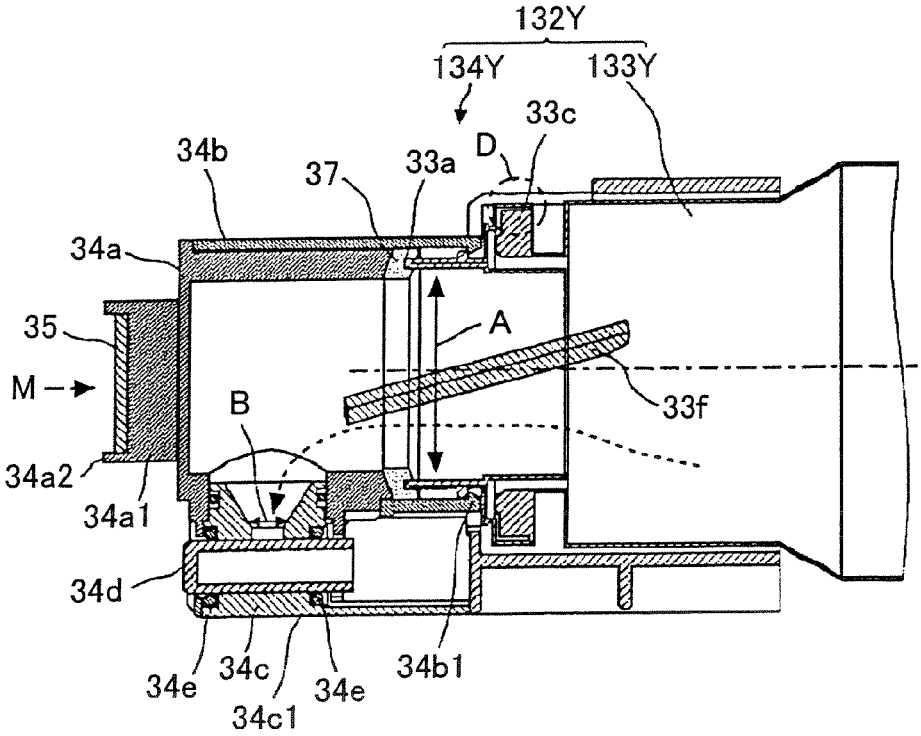
FIG. 6 is a cross-section of the head side of the toner container of FIG. 5.

The head of the container body 133Y includes a gear 33*c* integrally rotating with the container body 133Y, and an opening A (see FIG. 6). The opening A is provided in the head of the container body 133Y (front end position when it is attached), and is used to discharge the toner contained in the container body 133Y into the space (cavity) of the held portion 134Y.

The gear 33*c* is engaged with a drive gear (not shown) of a drive unit provided in the toner-container holder 31 of the apparatus body 100, to rotate the container body 133Y around a rotating axis (indicated by a chain line of FIG. 6). More specifically, the gear 33*c* is exposed from a notched portion 34*h* formed in the held portion 134Y and engaged with the drive gear 31*g* of the apparatus body 100 in an engagement position D shown in FIG. 6 and FIG. 7. Part of the held portion 134Y excluding the notched portion 34*h* serves as a guide member which covers part (portion not exposed from the notched portion 34*h*) of the gear 33*c*. It is thereby possible to reduce contamination of the gear 33*c* with the toner.

Referring to FIG. 5, a gripper 33*d* is provided in an rear end portion (bottom) of the container body 133Y so that the user can grip it for attachment/detachment of the toner container 132Y. A spiral-shaped projection 33*b* is provided along the inner circumferential surface of the container body 133Y (spiral-shaped groove when viewed from the outer peripheral side). The spiral-shaped projection 33*b* is used to discharge the toner from the opening A by rotating the container body 133Y in a predetermined direction. The container body 133Y configured in this manner can be manufactured by blow molding after the gear 33*c* provided on its circumferential surface is formed by injection molding. The toner container 132Y according to the first embodiment has a stirring member 33*f* rotating together with the container body 133Y provided in the opening A. The stirring member 33*f* is a rod-shaped member or a plate member which is extended from the space in the held portion 134Y toward the container body 133Y and is provided at an angle to the rotating axis (indicated by the chain line in FIG. 6). Rotation of the stirring member 33*f* together with the container body 133Y allows improvement of toner discharging capability from the opening A.

In the first embodiment, the container body 133Y of the toner container 132Y is made to rotate in the counterclockwise viewed from the upstream side in the toner conveying direction. Moreover, the spiral direction (turning direction) of the projection 33*b* in the container body 133Y is set to a rightward direction. With this setting, the rotation of the container body 133Y causes a spiral air flow spiraling in clockwise to be created in the toner container 132Y (the same direction as the rotational direction of the spiral air flow created in the screw pump 60).

Referring to FIG. 5 and FIG. 6, the held portion 134Y includes a cap main portion 34*a*, a cap cover 34*b*, a holder 34*c*, the plug member 34*d* as the open/close member, packing 34*e*, and an ID chip (electronic component) 35. Referring to FIG. 5 and FIG. 7, an engaging portion 34*g* (groove portion) with which a positioning member 31*c* of the toner-container holder 31 is engaged is provided on both sides of the held portion 134Y. The concave portion 34*m* into which a fitting member 31*d* of the toner-container holder 31 is fitted is provided on the end face of the held portion 134Y. The convex portion 34*n* fitting into another fitting member (not shown) of the toner-container holder 31 is provided on the circumferential surface of the held portion 134Y. Further, the notched portion 34*h* from which a part of the gear 33*c* is exposed is provided on the upper side of the held portion 134Y.

The held portion 134Y communicates with the container body 133Y through the opening A, and discharges the toner discharged from the opening A, from the toner outlet B (movement along the arrow direction indicated by the dotted line of FIG. 6). In the first embodiment, the cavity (space) formed inside the held portion 134Y is almost cylindrically formed. The toner discharge path (vertical path) from the almost cylindrical cavity formed inside the held portion 134Y up to the toner outlet B is formed in a mortar shape. With this shape, the toner delivered through the rotation of the container body 33Y is temporarily stacked in the mortar, and the suction force of the screw pump 60 on the side of the apparatus body 100 is transmitted to the toner efficiently stacked. Therefore, toner conveyance capability of the toner which is discharged from the toner outlet B and moves along the inside of the tube 71 is improved.

The held portion 134Y does not follow the rotation of the container body 133Y, but is held in a non-rotating manner by a holding portion 73 (see FIG. 4 and FIG. 8) of the toner-container holder 31 while the engaging portion 34*g* is engaged with the positioning member 31*c*. In this manner, the engaging portion 34*g* serves as an assist element to mechanically assist the attachment operation (or attachment/detachment operation) of the toner container 132Y to the toner-container holder 31 (to assist it on the hardware side). In the application of this invention, the expression "to mechanically assist the attachment operation of the toner container to the toner-container holder" means an assistant operation performed so that the insertion operation or the positioning operation is facilitated when the toner container is attached to the toner-container holder to fix the position thereof. Therefore, the mechanical assist element includes the engaging portion 34*g* for being engaged with the positioning member 31*c*, the concave portion 34*m* and the convex portion 34*n* explained later, and a baffle member of the toner container (not shown).

In the first embodiment, the engaging portion 34*g* as the assist element is provided in the upper side in the vertical direction with respect to the toner outlet B (or plug member 34*d*). With this configuration above, even if the toner scatters from the toner outlet B to the outside of the toner container 132Y, the scattered toner hardly reaches the position of the engaging portion 34*g* (or the positioning member 31*c*). It is therefore possible to reduce a failure in engagement between the engaging portion 34*g* and the positioning member 31*c* because of the engaging portion 34*g* (or the positioning member 31*c*) becoming stained with the scattered toner.

In the first embodiment, the engaging portion 34*g* being the assist element is provided in an upper side higher than the toner outlet B in the vertical direction and comparatively closer to the toner outlet B. More specifically, the engaging portion 34*g* is provided in an upper side higher than the toner outlet B in the vertical direction and in a lower side lower than the ID chip 35 (information recorded chip) in the vertical direction. With this configuration, even if there is large rattle between the engaging portion 34*g* and the positioning member 31*c*, or even if the held portion 134Y is deformed due to environmental changes, the nozzle 70 and the plug member 34*d* are hardly displaced, and such a failure that the nozzle 70 does not push the plug member 34*d* can be reduced.

The cap cover 34*b* of the held portion 134Y is bonded to the circumferential surface of the cap main portion 34*a*. A claw 34*b*1 is provided at the front of the cap cover 34*b*. The claw 34*b*1 is engaged with an engaging member formed in the head of the container body 133Y, and the container body 133Y is thereby held relatively rotatably with respect to the held portion 134Y. To smoothly rotate the container body 33Y, the claw 34*b*1 of the held portion 134Y and the engaging member of the container body 133Y are engaged with each other by maintaining appropriate clearance therebetween.

A seal member 37 is adhered to the surface of the held portion 134Y that faces a front end 33*a* around the opening A of the container body 133Y. The seal member 37 is used for sealing the gap which is around the opening A and is between the surfaces of the container body 133Y and the held portion 134Y that mutually face each other, and is made of an elastic material such as polyurethane foam.

The holder 34*c* is provided in the lower side of the held portion 134Y. Provided in the holder 134*c* is the plug member 34*d* (shutter) as the open/close member for opening/closing the toner outlet B in synchronization with the attachment/detachment operation of the toner container 132Y. The packing 34*e* such as G seal is provided on the both sides of the plug member 34*d* to prevent toner leakage from near the plug member 34*d*. Although it is not shown in the figure, by setting the toner container 132Y in the toner-container holder 31, a lever (biasing member) for biasing the plug member 34*d* in the direction of closing the toner outlet B is engaged with the right side of the plug member 34*d*. Furthermore, the engaging portion between the holder 34*c* and the cap 34*a* is provided with the packing such as the O-ring to prevent toner leakage from both of the gaps.

The ID chip 35 of the held portion 134Y is configured to face a communication circuit 74 (terminal) of the toner-container holder 31 with a predetermined distance therebetween, in synchronization with the attachment operation of the toner container 132Y to the toner-container holder 31. The ID chip (electronic component) 35 may be an IC chip processed to a tag or a label used by, for example, RFID (Radio Frequency Identification: non-contact automatic recognizing technology using radio waves). More specifically, the ID chip 35 is provided on a protrusion portion 34*a*1 of the held portion 134Y that protrudes in the direction (i.e., in the direction shown by the arrow in FIG. 5) in which the held portion 34Y is attached to the toner-container holder 31, and which is provided on the plane orthogonal to the attachment direction. In other words, the toner container 132Y is attached to the toner-container holder 31 so that the ID chip 35 is located more forward than the toner outlet B. The ID chip 35 performs non-contact communication (radio communication) with the communication circuit 74 of the apparatus body while the held portion 134Y is held in the toner-container holder 31. The protrusion portion 34*a*1 provided in the held portion 134Y has a wall portion 34*a*2 to cover the periphery of the ID chip 35. By covering the ID chip 35 with the wall portion 34*a*2, the scattered toner is hardly deposited on the ID chip 35.

The ID chip 35 previously stores various types of information related to the toner container 132Y. On the other hand, the communication circuit 74 of the toner-container holder 31 exchanges the information by radio with the ID chip 35 while the toner container 132Y is set in the toner-container holder 31. More specifically, the information stored in the ID chip 35 is transmitted to a controller 75 (see FIG. 5) of the apparatus body 100 through the communication circuit 74, or the information for the apparatus body 100 acquired by the controller 75 is transmitted to the ID chip 35 and stored therein.

The ID chip 35 stores information regarding toner such as toner colors, serial numbers of toner (production lot), and dates of toner production, and information regarding recycling of the toner container 132Y such as number of times of recycling, dates of recycling, and recycling manufacturers. The ID chip 35 stores information regarding the toner container. When the toner container 132Y is set in the toner-container holder 31, the information stored in the ID chip 35 is transmitted to the controller 75 of the apparatus body 100 through the electric circuit 74. The apparatus body 100 is optimally controlled based on these pieces of information. For example, if the toner color is different from the toner color that should be set in the toner-container holder, the operation of the toner supply device 59 can be stopped, or imaging conditions can be changed according to the serial number or the recycling manufacturer.

In this manner, the ID chip 35 serves as an assist element to electrically assist (assist on the software side) the attachment operation (or the attachment/detachment operation) of the toner container 132Y to the toner-container holder 31. The expression "to electrically assist the attachment operation of the toner container to the toner-container holder" in this application indicates the communication operation performed to detect (detection of setting) whether the toner container is operatively set in the toner-container holder, upon being set or thereafter. Therefore, communication of information on the toner container which is not directly related to the attachment operation indicates that it is not the one "to electrically assist the attachment operation".

In the first embodiment, the ID chip 35 being the assist element is provided in the upper side vertically with respect to the toner outlet B (or the plug member 34*d*). Furthermore, the ID chip 35 is provided on the protrusion portion 34*a*1 protruded from the toner outlet B (or the plug member 34*d*), which is surrounded by the wall portion 34*a*2. Therefore, even if the toner scatters from the toner outlet B (or the plug member 34*d*) to the outside of the toner container 132Y, the scattered toner hardly reaches the position of the ID chip 35 (or the communication circuit 74). In other words, such trouble as communication trouble between the ID chip 35 and the communication circuit 74 and leakage caused by the ID chip 35 (or the communication circuit 74) becoming stained with the scattered toner can be reduced.

Provided in the holder 34*c* of the held portion 134Y are the sliding portions 34*c*1 and 34*c*2 for sliding along the toner-container holder 31 in synchronization with the attachment/ detachment to/from the toner-container holder 31. More specifically, a first sliding portion 34*c*1 is a flat portion formed so as to be parallel with a sliding face 31*a* (which is an upward surface; see FIG. 8) of the toner-container holder 31, the flat portion being provided in the bottom of the held portion 134Y with which the attachment/detachment is operated. Furthermore, a second sliding portion 34*c*2 is a flat portion formed so as to be parallel with a sliding face (which is a side face) of the toner-container holder 31, the flat portion being provided in the side portion of the held portion 134Y with which the attachment/detachment is operated. Therefore, the sliding portions 34*c*1 and 34*c*2 of the toner container 132Y slide along the toner-container holder 31, which enables positioning of a rotation angle of the toner container 132Y.

Figure 7:
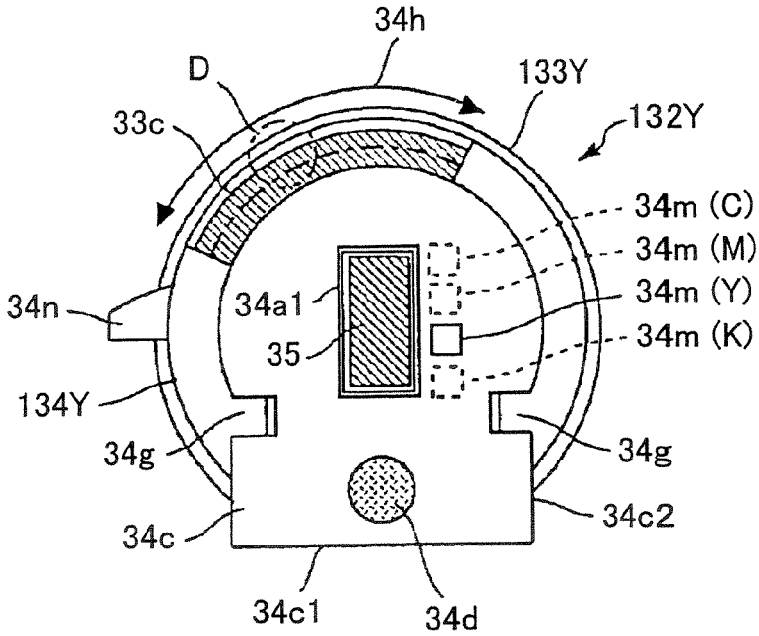
FIG. 7 is a front view of the toner container of FIG. 6 when viewed from the M direction.

Referring to FIG. 5 and FIG. 7, the concave portion 34*m* fitted with the fitting member 31*d* of the toner-container holder 31 is provided in a portion which is an end face of the held portion 134Y and is near the protrusion portion 34*a*1. The concave portion 34*m* is formed so as to be fitted with the corresponding fitting member 31*d* when the attachment operation to the toner-container holder 31 is correct (when the toner-container holder 31 is attached to the normal position). Therefore, the sliding portions 34*c*1 and 34*c*2 of the toner container 132Y complete to slide along the toner-container holder 31, which enables positioning of the toner container 132Y in the longitudinal direction.

More specifically, as shown in FIG. 7, positions of the concave portions 34*m* are differently arranged from one another according to each color of toner contained in the toner containers (container bodies). The concave portion 34*m* (C) of the toner container corresponding to cyan and a corresponding fitting member (not shown) of the toner-container holder are arranged in the uppermost side, and the concave portion 34*m* (M) of the toner container corresponding to magenta and a corresponding fitting member (not shown) of the toner-container holder are arranged in the upper side of the middle stage. The concave portion 34*m* (Y) of the toner container corresponding to yellow and a corresponding fitting member 31*d* of the toner-container holder are arranged in the lower side of the middle stage, and the concave portion 34*m* (K) of the toner container corresponding to black and a corresponding fitting member (not shown) of the toner-container holder are arranged in the lowermost side. This configuration allows prevention of such a failure that a toner container for an inappropriate color (e.g., toner container for yellow) is set in a toner-container holder for a predetermined color (e.g., cyan toner-container holder) and this causes a desired color image not to be formed.

Likewise, referring to FIG. 5 and FIG. 7, a convex portion 34*n* with which another fitting member (not shown) is fitted is provided on the circumferential surface of the held portion 134Y. Like to the concave portion 34*m*, the convex portion 34*n* fitted into a corresponding fitting member when the toner container is properly attached to the toner-container holder 31. It is configured that positions of the convex portions 34*n* are arranged differently from one other according to each color of toner contained in the toner container (container body). Such a configuration as above allows prevention of miss-setting of the toner container in the toner-container holder, similarly to the concave portion 34*m*.

In this manner, the concave portion 34*m* and the convex portion 34*n* provided in the held portion 134Y serve as assist elements to mechanically assist the attachment operation of the toner container 132Y to the toner-container holder 31. In the first embodiment, the concave portion 34*m* and the convex portion 34*n* being assist elements are provided in the upper side vertically with respect to the toner outlet B (or the plug member 34*d*). Therefore, even if the toner scatters from the toner outlet B (or the plug member 34*d*) to the outside of the toner container 132Y, the scattered toner hardly reaches the position of the concave portion 34*m* and the convex portion 34*n* (or the fitting member). In other words, such trouble as fitting trouble between the concave portion 34*m* or the convex portion 34*n* and the fitting member caused by the concave portion 34*m* and the convex portion 34*n* (or the fitting member) becoming stained with the scattered toner can be reduced.

In the first embodiment, as toner contained in the toner container 132Y, spherical toner having an average sphericity of 0.90 or more is used. The spherical toner is excellent in fluidity because of its shape, and therefore, the toner can be efficiently and reliably conveyed without blocking the toner supply path such as the tube 71. The sphericity of a toner particle is defined by the following equation.

Sphericity=(Circumferential length of circle having the same area as project area of a particle)/(Circumferential length of a projected image of the particle)

Therefore, when the sphericity is 1.00, the toner particle is perfectly spherical. The average sphericity of toner can be measured by a typical equipment such as Flow Particle Image Analyzer "FPIA-2100" (Manufactured by Toa-Iyo Electric, Co. Ltd.).

Figure 8:
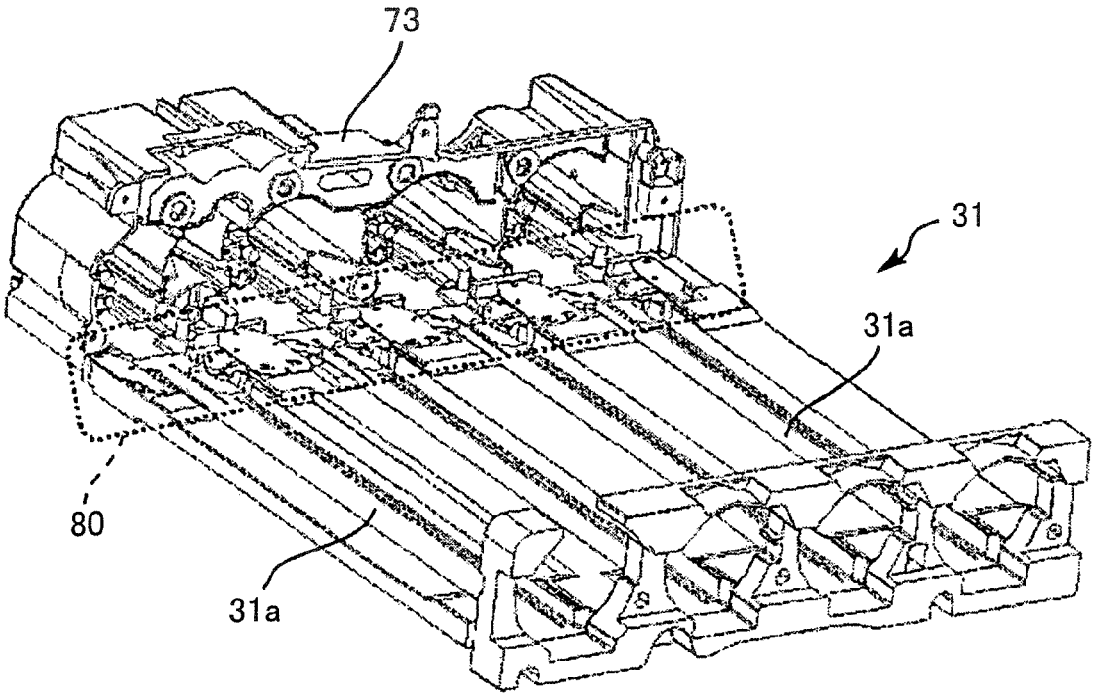
FIG. 8 is a perspective view of the toner-container holder when the toner containers are not set therein.
Figure 9:
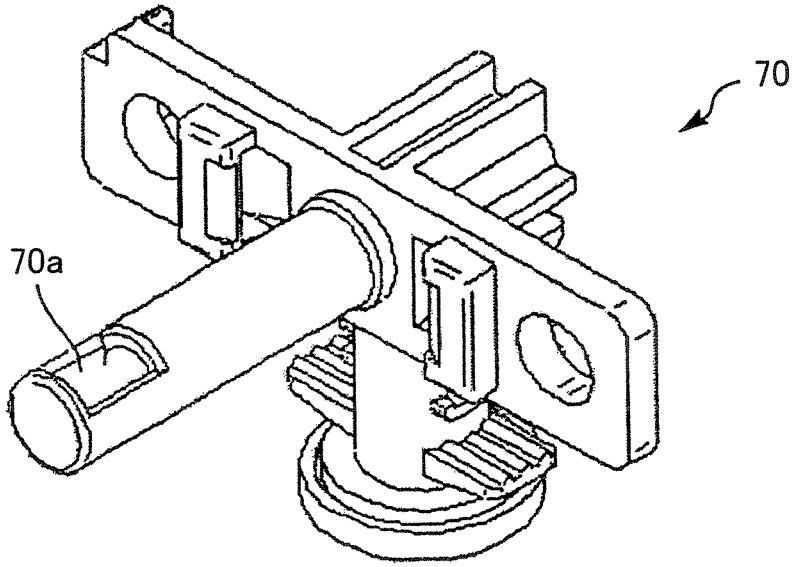
FIG. 9 is a perspective view of a nozzle.

The configuration of the toner-container holder 31 is explained below with reference to FIG. 8 and FIG. 9. Referring to FIG. 8, the toner-container holder 31 includes the sliding faces 31*a* each along which a sliding portion in each held portion of the four toner containers 132Y, 132M, 132C, and 132K slides; the holding portion 73 for fixing the positions of the holders 34*c* of the held portions; the nozzles 70; drive units (not shown) each for transmitting a rotational driving force to the container body; the communication circuits 74; arm pairs 80 for biasing the held portion toward the holding portion 73 in synchronization with the attachment operation of the toner container; and levers (biasing members) 76 each for biasing the plug member 34*d* in the direction in which the toner outlet B of the toner container is closed.

The holding portion 73 holds the held portions of the toner containers 132Y, 132M, 132C, and 132K each in the non-rotating manner. The holding portion 73 includes sliding faces contacting the holder 34*c*, and a contact face contacting a part of the cap cover 34*b*. Provided in the sliding faces (side faces) of the holding portion 73 are the positioning members 31*c* for positioning in synchronization with the attachment operation of the held portion 34Y (see FIG. 5). The positioning member 31*c* is a convex portion extended along the attachment/detachment direction of the toner container 132Y. Furthermore, the communication circuit 74 and the fitting member 31*d* are provided on the surface of the holding portion 73 in its rear side. The nozzle 70 as shown in FIG. 9 is arranged in the holding portion 73 for each toner color. Provided in the nozzle 70 is a toner supply port 70*a* communicating with the toner outlet B which is formed in the held portion 134Y of the toner container 132Y.

Figure 10:
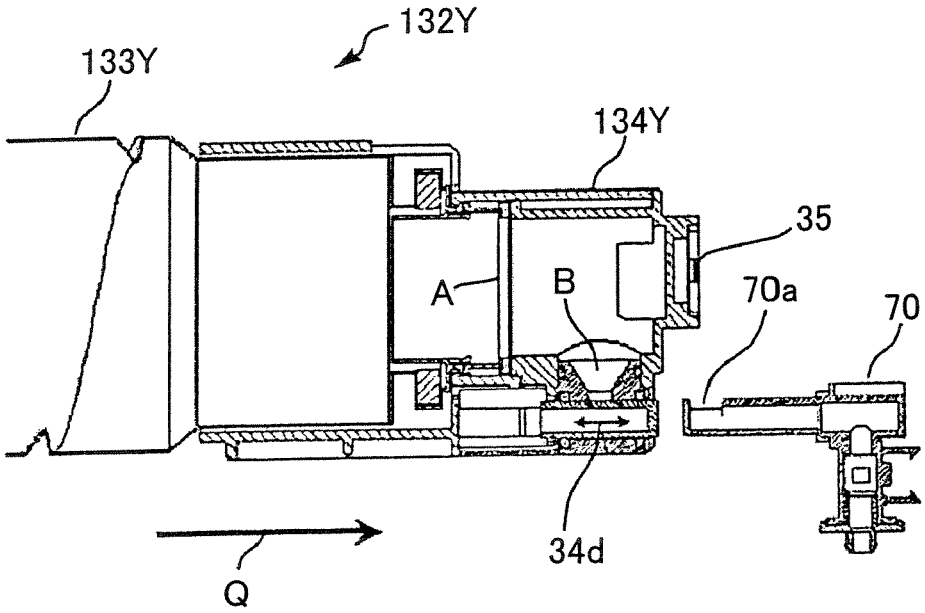
FIG. 10 is a schematic of how the toner container is attached to the toner-container holder.
Figure 11:
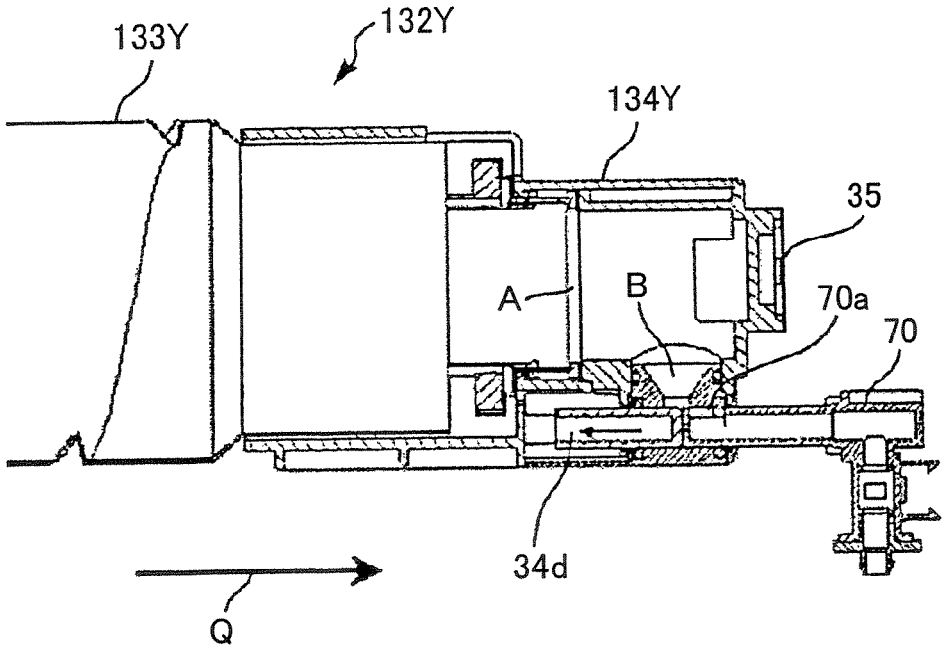
FIG. 11 is a schematic of the attachment of the toner container following the state of FIG. 10.
Figure 12:
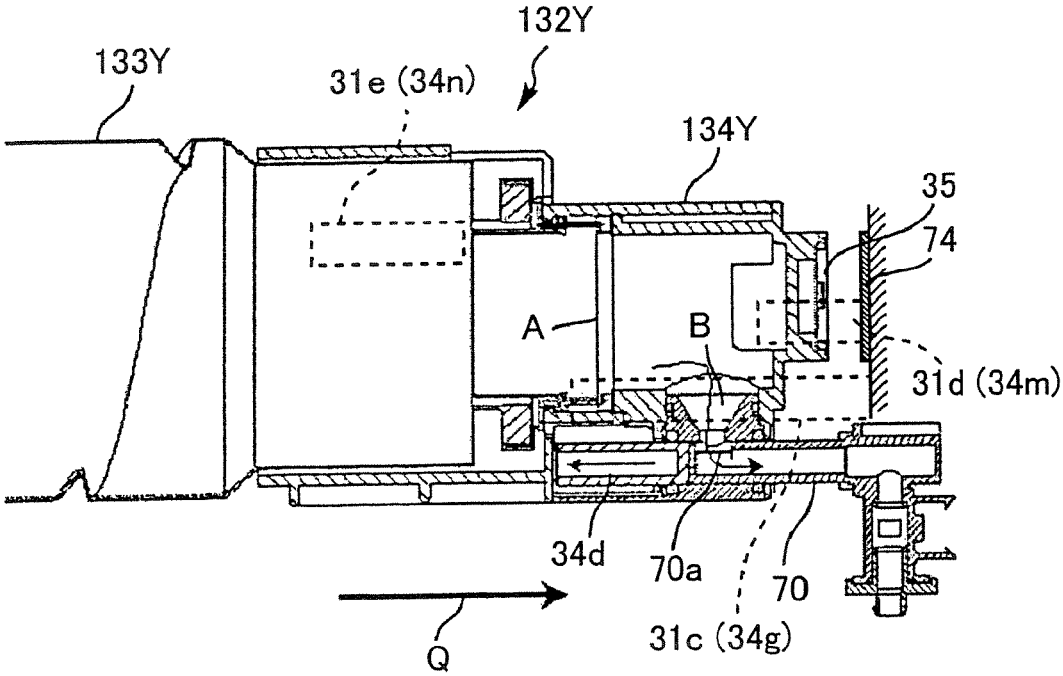
FIG. 12 is a schematic of the toner container attached to the toner-container holder.

The attachment/detachment operation of the toner container 132Y to/from the toner-container holder 31 is explained below with reference to FIG. 10 to FIG. 12. FIG. 10 is a schematic of how the toner container 132Y for yellow is attached to the toner-container holder 31 when viewed from the longitudinal direction (movement in the direction of an arrow Q). FIG. 11 is a schematic of how the attachment of the toner container 132Y is progressed (when the toner outlet B starts to be opened) when viewed from the longitudinal direction. FIG. 12 is a schematic of the toner container 132Y attached to the toner-container holder 31 (when the opening of the toner outlet B is completed) when viewed from the longitudinal direction.

When the toner container 132Y is attached to the toner-container holder 31 of the apparatus body 100, at first, the main-body cover (not shown) provided on the front face (the near side on the paper of FIG. 1) of the main body of the image forming apparatus 100 is opened to expose the toner-container holder 31 to the front side. Then, referring to FIG. 10, the toner container 132Y is pushed into the toner-container holder 31 (movement in the direction of the arrow Q). More specifically, the toner container 132Y is attached to the toner-container holder 31 along the longitudinal direction of the container body 133Y (or the toner container 132Y) so that the held portion 134Y becomes the head of the container body 133Y.

At this time, the sliding portion 34*c*1 slides along the sliding face 31*a* of the toner-container holder 31 at the head side of the toner container 132Y, and while sliding, the toner container 132Y is pushed into the toner-container holder 31 with good balance by the user gripping the gripper 33*d* on the rear side of the toner container 132Y.

Thereafter, when the holder 34*c* of the toner container 132Y reaches the holding portion 73 of the toner-container holder 31, positioning of the held portion 134Y is started while the second sliding portions 34*c*2 are sliding along the sliding faces (side faces) in addition to the sliding of the first sliding portion 34*c*1 along the sliding face 31*a*. More specifically, the engaging portions 34*g* (assist elements) of the held portion 134Y and the positioning members 31*c* of the toner-container holder 31 start to be engaged with each other.

Thereafter, when the attachment operation of the toner container 132Y is further progressed, the plug member 34*d* starts to open the toner outlet B while the engaging portion 34*g* and the positioning member 31*c* are engaged with each other (the state as shown in FIG. 11). More specifically, the plug member 34*d* is pushed by the nozzle 70 associated with insertion of the front end of the nozzle 70 into the hole of the holder 34*c*. At this time, the arm pairs 80 bias the held portion 134Y of the toner container 132Y toward the holding portion 73 (biasing in the direction of the arrow Q)

Then, referring to FIG. 12, the position of the held portion 34Y is fixed at the position where the holder 34*c* butts against the holding portion 73 (reference position for butting), and at the same time, the plug member 34*d* fully opens the toner outlet B and the gear 33*c* of the toner container 132Y is engaged with the drive gear 31*g* of the drive unit of the toner-container holder 31. The ID chip 35 as an electronic substrate faces the communication circuit 74 in the position of enabling radio communication. Furthermore, the concave portion 34*m* and the convex portion 34*n* for securing non-compatibility of toner containers are fitted in the fitting members 31*d* and 31*e* of the apparatus body. The toner outlet B of the toner container 132Y communicates with the toner supply port 70*a* of the nozzle 70, and the attachment operation of the toner container 132Y is completed.

When the toner container 132Y is to be taken out (removed) from the toner-container holder 31 of the apparatus body 100, the operation is performed in the reverse of the attachment. In this case, the nozzle 70 also separates from the holder 34*c* in synchronization with the operation such that the toner container 132Y separates from the holding portion 73, and the plug member 34*d* is moved to the position of closing the toner outlet B by the biasing force of the levers (biasing members). In this manner, the detachment operation of the toner container 132Y is completed by one action (except the open/close operation of the main-body door) such that the sliding portion 34*c*1 of the toner container 132Y slides along the sliding face 31*a*.

The toner container 132Y according to the first embodiment includes the held portion 134Y with the toner outlet B provided vertically downward, and the toner outlet B is provided in the lower side lower than the opening A in the vertical direction. And after the plug member 34*d* is surely positioned in synchronization with the attachment operation, the plug member 34*d* is pushed by the nozzle 70 to open the toner outlet B sealed by the packing 34*e*. Therefore, there is less toner stain in the toner outlet B, and such trouble that the user's hands become stained with the toner by touching the toner outlet B is prevented. Moreover, even if the toner is leaked from the toner outlet B, the toner stain in those, such as the ID chip 35, the engaging portion 34*g*, the concave portion 34*m*, and the convex portion 34*n*, is reduced to enable maintenance of their respective functions, because the ID chip 35, the engaging portion 34*g*, the concave portion 34*m*, and the convex portion 34*n* which serve as the assist elements are provided in the upper side in the vertical direction with respect to the toner outlet B (direction in which the toner leaked flies against gravity).

The attachment/detachment operation of the toner container 132Y to/from the toner-container holder 31 is performed by one action associated with sliding of the sliding portion 34*c*1, and therefore, the operability/workability upon replacement of the toner container 132Y is improved. Particularly, by providing the sliding portion 34*c*1 in the bottom of the held portion 34Y, the sliding portion 34*c*1 slides along the sliding face 31*a* while supporting the toner container 132Y. Moreover, the attachment operation of the toner container 132Y is performed by starting to slide the sliding portion 34*c*1 while the user directly grips the gripper 33*d*, starting positioning of the held portion 134Y together with biasing by the arm pairs 80, starting insertion of the nozzle 70, and finishing the positioning of the held portion 134Y, the insertion of the nozzle 70, and the connection to the drive unit as soon as the sliding is finished. Therefore, the user gains a click feeling when the held portion 134Y is positioned at the same time when the sliding of the held portion 134Y (attachment operation by one action) is progressed, and feels certain that no erroneous operation occurs in the attachment operation.

Furthermore, the toner container 132Y is not set in the toner-container holder 31 (apparatus body 100) from the upper side thereof, but the attachment/detachment is performed from the front face of the toner-container holder 31 (apparatus body 100), thus, enhancing the flexibility of layout for the upper side of the toner-container holder 31. For example, even if a scanner (document reader) is disposed right above the toner-container holder, the operability/workability upon attachment/detachment of the toner container 132Y does not deteriorate. Moreover, the flexibility of layout for the engagement position D between the gear 33*c* of the toner container 132Y and the drive gear 31*g* of the apparatus body 100 is also enhanced. The toner container 132Y is set in the apparatus body 100 with its longitudinal direction as the horizontal direction, and therefore, the toner capacity of the toner container 132Y is increased to enable reduction in the replacement frequency without any effect on the layout in the height direction of the whole image forming apparatus 100.

As explained above, in the image forming apparatus according to the first embodiment, the assist elements (ID chip 35, engaging portion 34*g*, concave portion 34*m*, and convex portion 34*n*) for mechanically or electrically assist the attachment operation to the toner-container holder 31 are provided in the upper side in the vertical direction with respect to the toner outlet B. Therefore, even if the toner scatters from the toner outlet B to the outside, the scattered toner hardly reaches the positions of the assist elements (ID chip 35, engaging portion 34*g*, concave portion 34*m*, and convex portion 34*n*). Consequently, the operability upon the attachment/detachment operation of the toner container 132Y can be improved without reduction in the functions of the assist elements (ID chip 35, engaging portion 34*g*, concave portion 34*m*, and convex portion 34*n*). The "assist element" in the toner container 132Y is not limited to the ID chip 35, the engaging portion 34*g*, the concave portion 34*m*, and the convex portion 34*n*, and therefore, the present invention is applicable to any "assist element" on which scattered toner is desired not to be deposited.

Figure 13:
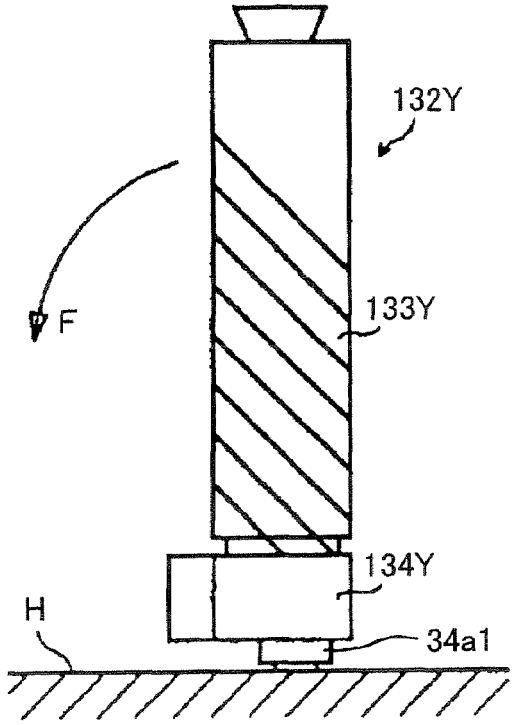
FIG. 13 is a schematic of how the held portion of the toner container is directed vertically downward to face a horizontal plane.

The configuration of the most characteristic toner container in the first embodiment is explained below with reference to FIG. 13. FIG. 13 is a schematic of how the held portion 134Y of the toner container 132Y is directed vertically downward to face a horizontal plane H (which is an arbitrary plane, outside the image forming apparatus, where the toner container 132Y is stood). Because the image forming apparatus cannot operate if the toner container 132Y set in the toner-container holder 31 runs out of toner, many users stock new toner containers 132Y for future use. During the stock, to inhibit the toner container 132Y from being stocked in such a manner that the side of the held portion 134Y is directed downward with respect to the container body 133Y, the standing inhibiting unit is provided in the toner container 132Y according to the first embodiment. In other words, as shown in FIG. 13, because the toner container 132Y according to the first embodiment includes the standing inhibiting unit, the toner container 132Y cannot be stood on the horizontal plane H with the held portion 134Y directed vertically downward. Therefore, there is a psychological effect that the user will hesitate to stand it in the above manner because the toner container 132Y may lose a balance and fall down in the direction of an arrow F. Consequently, there is an effect of preventing the user from standing the toner container 132Y on the horizontal plane with the held portion 134Y directed vertically downward.

More specifically, the toner container 132Y according to the first embodiment is configured so that the area of the contact area (protrusion portion 34*a*1) of the held portion 134Y, which contacts the horizontal plane H, is made smaller than the area of the project plane (the area of the cross section orthogonal to the rotating axis) of the container body 133Y projected to the horizontal plane H in such a manner that the held portion 134Y is directed vertically downward (state of FIG. 13). Based on the configuration above, there is a psychological effect that the user will hesitate to stand it in this manner because the toner container 132Y, which is stood with the held portion 134Y directed vertically downward, may lose its balance and may easily fall down even if it is stood on the horizontal plane H.

As previously explained, the wall portion 34*a*2 is formed around the protrusion portion 34*a*1, and the ID chip 35 (electronic component), of which periphery is covered with the wall portion 34*a*2, is provided on the protrusion portion 34*a*1 so as not to be directly contacted with the horizontal plane H. Therefore, the contact area contacting the horizontal plane is strictly the wall portion 34*a*2 of the protrusion portion 34*a*1.

The ID chip 35 provided on the protrusion portion 34*a*1 also serves as the standing inhibiting unit for inhibiting the toner container 132Y from being stood on the horizontal plane H with the held portion 134Y directed vertically downward. In other words, because the ID chip 35 is an electronic component to communicate with the communication circuit of the apparatus body 100, it looks weak for shock. Therefore, there is a psychological effect that the user will hesitate to stand the toner container 132Y on the horizontal plane H with the held portion 134Y directed vertically downward, by providing the ID chip 35 on the area of the held portion which faces the horizontal plane H (when the held portion 134Y is directed vertically downward).

Furthermore, the toner container 132Y according to the first embodiment is configured so that the center (geometrical center of gravity of the area of the contact area) of the contact area (protrusion portion 34*a*1) of the held portion 134Y which contacts the horizontal plane H is displaced with respect to the center (rotating axis of the container body 133Y) of the project plane of the container body 133Y, which is projected to the horizontal plane H, in such a manner that the held portion 134Y is directed vertically downward (state of FIG. 13). Based on the configuration above, there is a psychological effect that the user will hesitate to stand it in this manner because the toner container 132Y, which is stood on the horizontal plane with the held portion 134Y directed vertically downward, may lose its balance even if it is placed on the horizontal plane H, and may easily fall down with slight shock. When the toner container 132Y (container body 133Y) is filled with toner (not yet used), the gravity is in the upper side higher as compared with that not filled with toner (in use) if the toner container 132Y is tried to be stood thereon with the held portion 134Y directed downward. Therefore, it is further difficult to maintain the toner container 132Y to be stood thereon with the held portion 134Y directed downward, which makes it possible to further enhance the effect of preventing the toner container 132Y from being stood on the horizontal plane H with the held portion 134Y directed vertically downward during stock of the toner container 132Y not yet used.

Furthermore, in the toner container 132Y according to the first embodiment, the seal 37 being an elastic element provided between the container body 133Y and the held portion 134Y serves as the standing inhibiting unit. In other words, by interposing the seal 37, which is flexible, between the container body 133Y and the held portion 134Y, the container body 133Y is unsteady and becomes easily unstable even if the toner container 132Y is tried to be properly stood on the horizontal plane H with the held portion 134Y directed vertically downward (state of FIG. 13). As a result, there is a psychological effect that the user will hesitate to stand it thereon in that manner because the toner container 132Y may easily fall down in the direction of the arrow F.

The toner container 132Y according to the first embodiment is configured so that it can be laid on the horizontal plane with its longitudinal direction as the horizontal direction (which is the same posture as that when it is attached to the apparatus body 100). More specifically, the bottom of the holder 34*c* provided in the held portion 134Y is formed into a flat face, so that the toner container 132Y can be laid on the horizontal plane with this face downward. With the configuration above, the user does not try to stand the toner container 132Y thereon with the held portion 134Y directed downward with respect to the container body 133Y, but naturally lays the toner container 132Y thereon with the longitudinal direction as the horizontal direction.

As explained so far, the image forming apparatus according to the first embodiment is provided with the standing inhibiting unit in the held portion 134Y to inhibit the toner container 132Y from being stood on the horizontal plane H with the held portion 134Y directed vertically downward with respect to the container body 133Y. Consequently, it is possible to prevent toner aggregation in the side of the held portion 134Y during stock of the toner container 132Y. Therefore, the toner is discharged from the toner outlet B of the toner container 132Y set in the main body of the image forming apparatus 100, which can prevent such a failure as occurrence of a failure in toner supply to the developing device 5Y or as occurrence of an abnormal image.

Figure 14:
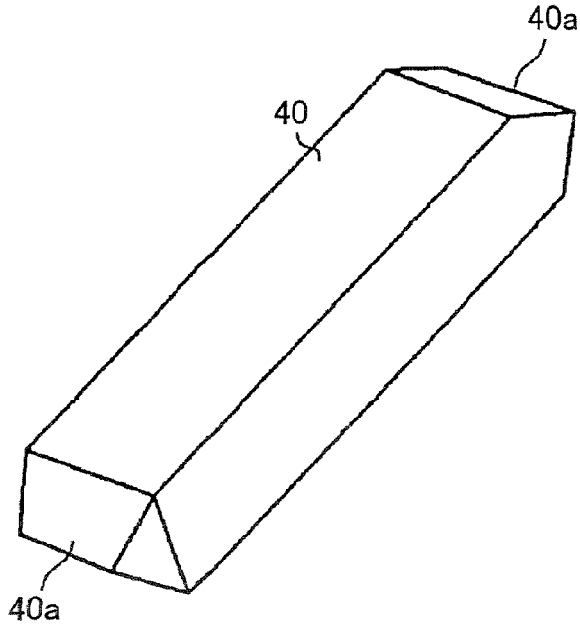
FIG. 14 is a perspective view of a package for storing the toner container inside thereof.

A package 40 for packing the toner container 132Y is explained in detail below with reference to FIG. 14. FIG. 14 is a perspective view of a package for storing the toner container inside thereof. When the toner container 132Y stored in the package 40 is distributed, it is sometimes left standing in the package 40 and stocked.

The package 40 according to the first embodiment is configured so as not to be stood on the horizontal plane with the longitudinal direction of the toner container packed therein as the vertical direction. More specifically, the end face of the package 40 in the longitudinal direction is formed into an angular head 40*a*. Based on the configuration above, the package 40 with the toner container 132Y stored therein is prevented from being stood thereon with the held portion 134Y directed vertically downward, which makes it possible to reliably prevent toner aggregation in the side of the held portion 134Y during the stock of the toner container 132Y. In the first embodiment, however, the end face of the package 40 in the longitudinal direction is formed into the angular head 40*a*, but it may be formed into a slope or a sphere. In this case also, the same effect as explained above can be obtained.

The packing density (packing volume/whole volume) of toner contained in the container body 133Y of the toner container 132Y is preferably set to 0.7 or less (more preferably 0.6 or less). If the packing density of the toner exceeds 0.7, toner conveying capability with the projection 33*b* is reduced even if the container body 133Y is rotated. As a result, the toner cannot be conveyed to the held portion 134Y, which results in reduction in the toner amount to be discharged from the toner outlet B. However, if the packing density of the toner exceeds 0.6, a lump may easily occur in the toner having been conveyed to the held portion 134Y even if the packing density is 0.7 or less. When the toner is discharge by using a screw pump, the toner discharge capability may deteriorate because toner lumps may get into the toner outlet B. Thus, it is more preferable that the packing density of the toner be set to 0.6 or less.

A manufacturing method of recycling the toner container 132Y is explained below. The toner container 132Y according to the first embodiment can be reused by subjecting used products (toner containers with no toner after used in the image forming apparatus) to a recycling process.

More specifically, there are two manufacturing methods of recycling toner containers as follows. According to a first manufacturing method of recycling, a removal process is first provided to remove the held portion 134Y from the container body 133Y of the toner container 132Y recovered. Thereafter, a filling process is provided to fill the inside of the container body 133Y with toner (or two-component developer). Lastly, a fixing process is provided to fix the held portion 134Y to the container body 133Y. According to a second manufacturing method of recycling, a machining process is first provided to form a through hole in a part (e.g., gripper 33*d*) of the container body 133Y. Then, a filling process is provided to fill the inside of the container body 133Y with toner through the through hole. Lastly, a sealing process is provided to seal the through hole (e.g., the process of bonding the seal member to the through hole). By recycling the toner container 132Y in this manner, environment resources can be effectively used.

As explained above, the image forming apparatus according to the first embodiment is provided with the protrusion portion 34*a*1 being the standing inhibiting unit in the held portion 134Y to inhibit the toner container 132Y from being stood on the horizontal plane H with the held portion 134Y directed vertically downward with respect to the container body 133Y. Consequently, it is possible to prevent toner aggregation in the side of the held portion 134Y during stock of the toner container 132Y. Furthermore, in the first embodiment, the gripper 33*d* of the container body 133Y causes a psychological effect to be produced. The psychological effect due to the gripper 33*d* causes the user to prevent the toner container 132Y from being stood on the horizontal plane H with the container body 133Y directed vertically downward with respect to the held portion 134Y. Therefore, the toner is prevented from being aggregated in the side of the gripper 33*d* (rear end side) of the container body 133Y, and this causes the user to automatically lay the toner container 132Y on the horizontal plane H with the longitudinal direction as the horizontal direction, as described above.

In the first embodiment, only the toner is contained in each container body of the toner containers 132Y, 132M, 132C, and 132K, but in the case of the image forming apparatus that supplies two-component developer containing toner and carrier to each developing device, the two-component developer can also be contained in each container body of the toner containers 132Y, 132M, 132C, and 132K. Even in this case, the same effect as that of the first embodiment can be obtained.

In the first embodiment, the projection 33*b* is integrally formed in the inner circumferential surface of the container body 133Y, and the container body 133Y is made to rotate. On the other hand, a coil or a screw may also be rotatably held inside the container body 133Y, and the container body 133Y is not rotated but the coil or the screw can be rotated by the gear 33*c*. In this case also, the same effect as that of the first embodiment can be obtained.

In the first embodiment, the suction-type screw pump 60 for sending air to the inside of the tube 71 is provided in the toner supply device. At the same time, a discharge-type screw pump for sending air to the inside of the tube 71 can also be provided in the toner supply device. Even in these cases, the same effect as that of the first embodiment can be obtained.

Figure 15:
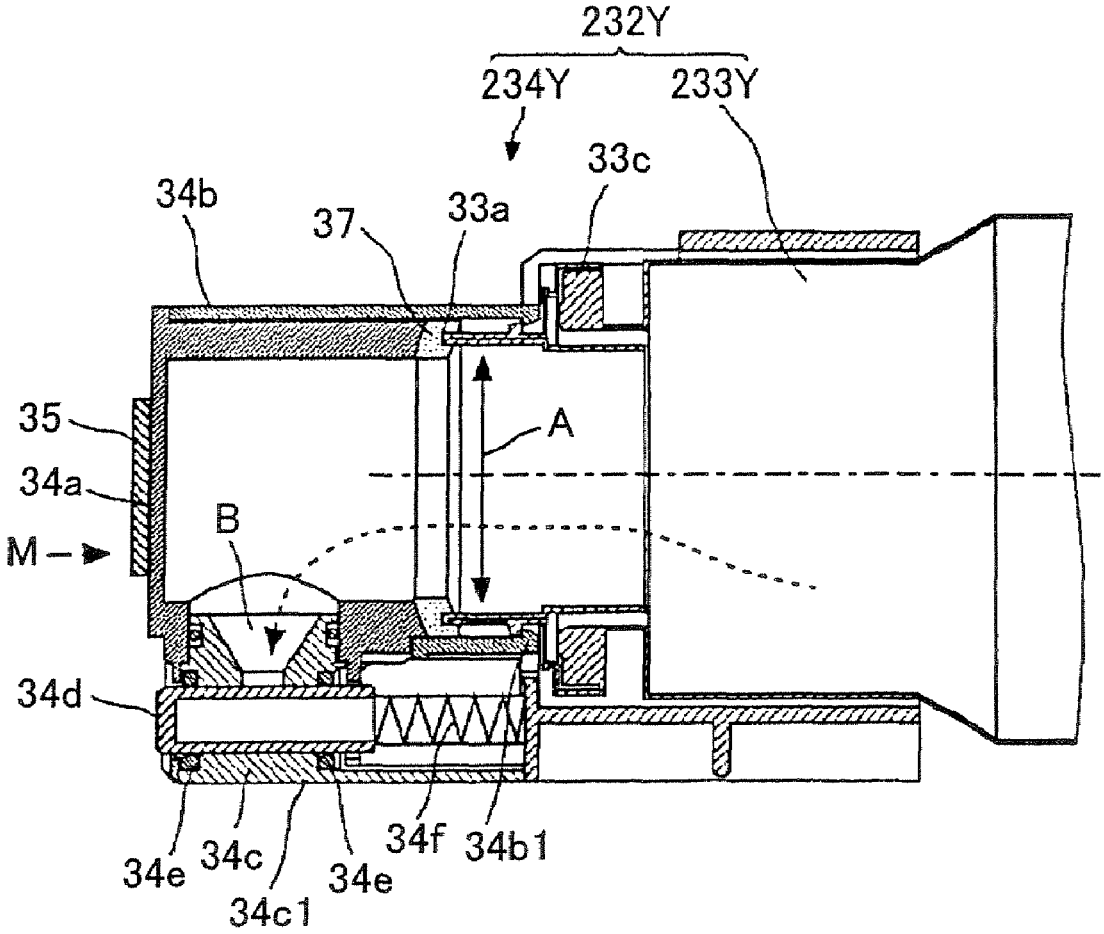
FIG. 15 is a cross-section of the head side of a toner container according to a second embodiment of the present invention.

A second embodiment of the present invention is explained in detail below with reference to FIG. 15 to FIG. 18. FIG. 15 is a cross-section of the head side of a toner container according to the second embodiment, which corresponds to that of FIG. 6 according to the first embodiment.

Referring to FIG. 15, a toner container 232Y according to the second embodiment is different from that of the first embodiment in a point that a compression spring 34*f* as a biasing member is provided in a held portion 234Y. More specifically, the compression spring 34*f* (biasing member) for biasing the plug member 34*d* in the direction of closing the toner outlet B is provided on the right-hand side of the plug member 34*d*. The ID chip 35 as an electronic component (storage unit) is configured so as to directly contact the communication circuit 74 of the apparatus body. The protrusion portion as the standing inhibiting unit is not provided in the held portion 234Y, but the ID chip 35 and the seal 37 serve as the standing inhibiting unit.

The ID chip 35 of the held portion 234Y is configured so as to come in contact with or separate from the communication circuit 74 (connection terminal) of the toner-container holder 31 in synchronization with the attachment/detachment operation of the toner container 232Y to/from the toner-container holder 31. More specifically, the ID chip 35 is provided on a location which is the plane of the held portion 234Y orthogonal to the attachment/detachment direction (the arrow direction of FIG. 16A and FIG. 16B) with respect to the toner-container holder 31, and which faces the communication circuit 74 upon the attachment/detachment operation.

As explained above, the ID chip 35 comes in contact with the communication circuit 74 provided in the apparatus body 100 in synchronization with the attachment/detachment operation (linear operation) of the toner container 232Y by one action, and this improves contact performance between the ID chip 35 and the communication circuit 74. More specifically, the surface of the ID chip 35 comes in contact linearly with the communication circuit 74 fixed in the apparatus body 100 (toner-container holder 31), and this prevents, before occurring, such a failure that the ID chip 35 comes in contact unevenly with the communication circuit 74 to cause contact failure, or that part of the ID chip 35 and the communication circuit 74 is worn out to give damage to some components.

In the second embodiment, the ID chip 35 is provided in the held portion 234Y so as to be located in the upper side higher than the position where the plug member 34*d* is provided (upper side in the posture when the toner container 232Y is set in the toner-container holder 31). Because the ID chip 35 is provided in the vertically upper side higher than the plug member 34*d*, even if the toner in the toner container 232Y is leaked from near the plug member 34*d*, such a failure that the toner is adhered to the ID chip 35 to cause an erroneous operation is reduced.

Figure 16A:
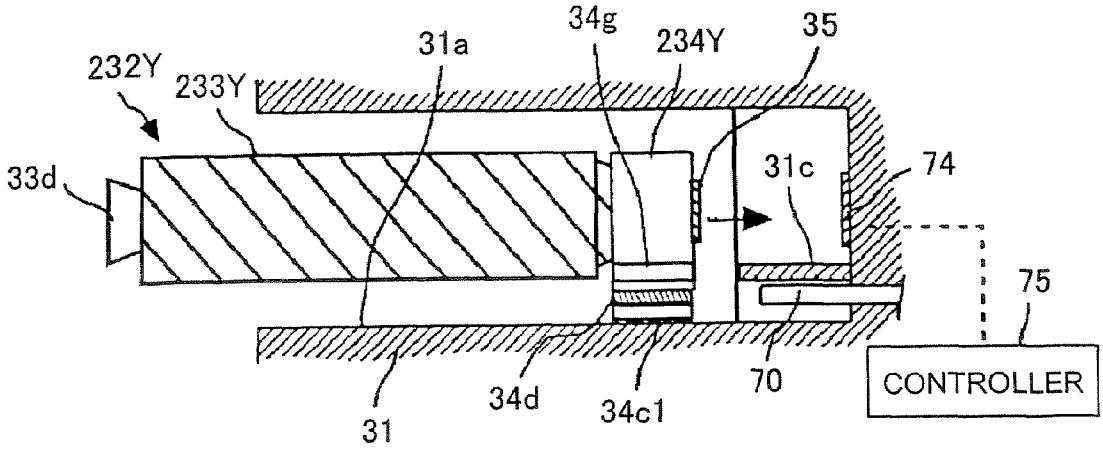
FIG. 16A is a schematic of how the toner container of FIG. 15 is attached to the toner-container holder.
Figure 16B:
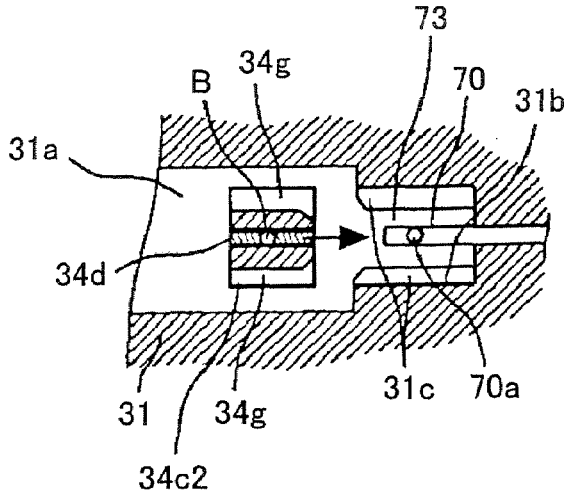
FIG. 16B is a schematic of how the toner container of FIG. 15 is attached to the toner-container holder.
Figure 17A:
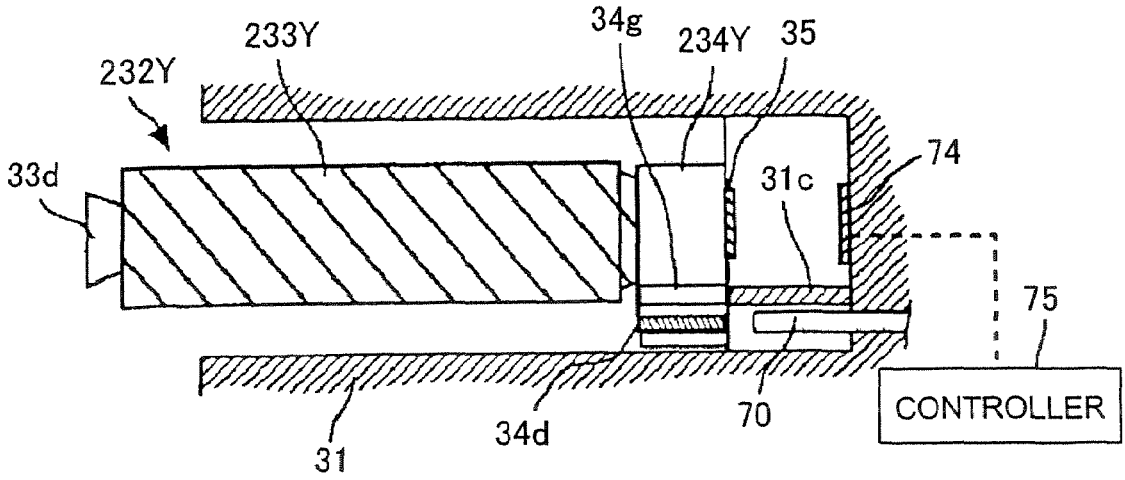
FIG. 17A is a schematic of the attachment of the toner container following the state of FIG. 16A.
Figure 17B:
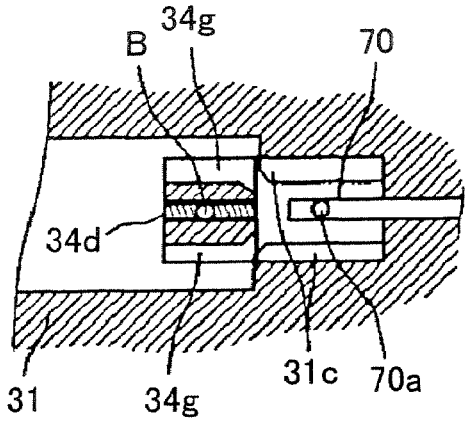
FIG. 17B is a schematic of the attachment of the toner container following the state of FIG. 16B.
Figure 18A:
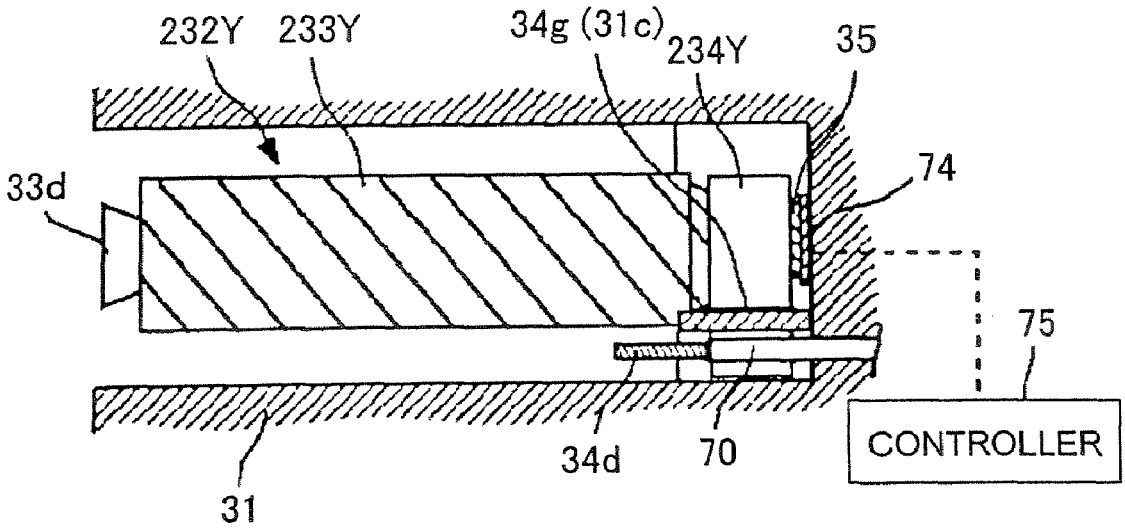
FIG. 18A is a schematic of the toner container attached to the toner-container holder.
Figure 18B:
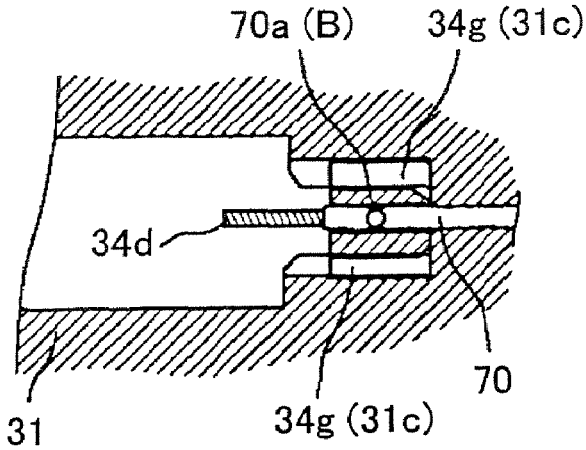
FIG. 18B is a schematic of the toner container attached to the toner-container holder.

The attachment/detachment operation of the toner container 232Y to/from the toner-container holder 31 is explained below with reference to FIG. 16 to FIG. 18. FIG. 16A is a schematic of how the toner container 232Y for yellow is attached to the toner-container holder 31 (movement in the arrow direction) when viewed from the longitudinal direction, and FIG. 16B is a schematic of a portion around the holder 34*c* of the held portion 234Y in that state when viewed from the upper side. FIG. 17A is a schematic of how the attachment of the toner container 232Y is progressed (positioning of the held portion 234Y is started) when viewed from the longitudinal direction, and FIG. 17B is a schematic of a portion around the holder 34*c* in that state when viewed from the upper side. FIG. 18A is a schematic of the toner container 232Y attached to the toner-container holder 31 (attachment is completed) when viewed from the longitudinal direction, and FIG. 18B is a schematic of a portion of the holder 34*c* in that state when viewed from the upper side.

When the toner container 232Y is attached to the toner-container holder 31 of the apparatus body 100, at first, the main-body cover (not shown) provided on the front face (the near side on the paper of FIG. 1) of the main body of the image forming apparatus 100 is opened to expose the toner-container holder 31 to the front side. Then, referring to FIG. 16A and FIG. 16B, the toner container 232Y is pushed into the toner-container holder 31 (movement in the arrow direction). More specifically, the toner container 232Y is attached to the toner-container holder 31 along the longitudinal direction of the container body 233Y (or the toner container 232Y) so that the held portion 234Y is located as the head of the container body 233Y.

At this time, the first sliding portion 34*c*1 slides along the sliding face 31*a* of the toner-container holder 31 at the head side of the toner container 232Y, and while sliding, the toner container 232Y is pushed into the toner-container holder 31 with good balance by the user gripping the gripper 33*d* on the rear side of the toner container 232Y.

Referring to FIG. 17A and FIG. 17B, when the holder 34*c* of the toner container 232Y reaches the holding portion 73 of the toner-container holder 31, the positioning of the held portion 234Y is started while the second sliding portions 34*c*2 are sliding along the sliding faces 31*b* in addition to the sliding of the first sliding portion 34*c*1 along the sliding face 31*a*. More specifically, the engaging portion 34*g* of the held portion 234Y and the positioning member 31*c* of the toner-container holder 31 start to be engaged with each other.

Then, the attachment operation of the toner container 232Y is further progressed, and the plug member 34*d* starts to open the toner outlet B while the engaging portions 34*g* and the positioning members 31*c* are engaged with each other. That is, the front end of the nozzle 70 is inserted into the hole of the holder 34*c*, and at the same time, the plug member 34*d* is pushed by the nozzle 70. As shown in FIG. 18A and FIG. 18B, the position of the held portion 234Y is fixed at the position where the holder 34*c* butts against the holding portion 73 (reference position for butting), and at the same time, the plug member 34*d* fully opens the toner outlet B, and the ID chip 35 is connected to the communication circuit 74. This allows, on the hardware side, the toner outlet B of the toner container 232Y and the toner supply port 70*a* of the nozzle 70 to communicate with each other, and on the software side, information to be exchanged between the ID chip 35 and the controller 75, and the attachment operation of the toner container 232Y is completed.

As explained above, in the second embodiment, the connection operation between the ID chip 35 of the toner container 232Y and the communication circuit 74 of the toner-container holder 31 is completed by one action (except the open/close operation of the main-body door) such that the sliding portion 34*c*1 of the toner container 232Y slides along the sliding face 31*a*. More specifically, while the sliding portion 34*c*1 of the toner container 232Y is caused to be sliding along the sliding face 31*a*, the positioning operation of the held portion 234Y (toner container 232Y) is started in synchronization with the sliding, and then, the insertion operation of the nozzle 70 is started, and finally, the ID chip 35 and the communication circuit 74 are connected to each other. With this connection, the surface of the ID chip 35 positioned comes in contact with the communication circuit 74 fixed in the apparatus body 100 (toner-container holder 31), and this prevents such a failure, before occurring, that the ID chip 35 comes in contact unevenly with the communication circuit 74 to cause contact failure, or that part of the ID chip 35 and the communication circuit 74 is worn out associated with their contacting/separating operation, to give damage to some components.

Movement of the nozzle 70 to the inside or to the outside of the holder 34*c* and movement of the plug member 34*d* to the inside or to the outside of the holder 34*c* are performed when both of the members slidably contact the lip of the packing 34*e* of the holder 34*c*. Therefore, such a failure that toner is leaked from the holder 34*c* due to insertion or removal of the nozzle 70 is prevented.

When the toner container 232Y is to be taken out (removed) from the toner-container holder 31 of the apparatus body 100, the operation is performed in the reverse of the attachment. In this case, the nozzle 70 also separates from the holder 34*c* in synchronization with the operation such that the toner container 232Y separates from the holding portion 73, and the plug member 34*d* is moved to the position for closing the toner outlet B by the biasing force of the compression spring 34*f*. At the same time, the ID chip 35 also separates from the communication circuit 74. In this manner, the detachment operation of the ID chip 35 from the communication circuit 74 and the detachment operation of the toner container 232Y are completed by one action (except the open/ close operation of the main-body door) such that the sliding portion 34*c*1 of the toner container 232Y slides along the sliding face 31*a*.

The toner container 232Y according to the second embodiment includes the held portion 234Y with the toner outlet B provided in the lower side in the direction of gravity, and after the plug member 34*d* is surely positioned in synchronization with the attachment operation, the plug member 34*d* is pushed by the nozzle 70, to open the toner outlet B sealed with the packing 34*e*. Therefore, there is less toner stain in the toner outlet B, and such trouble that the user's hands become stained with toner by touching the toner outlet B is prevented.

The attachment/detachment operation of the toner container 232Y to/from the toner-container holder 31 is performed by one action associated with the sliding of the sliding portion 34*c*1, and therefore, the operability/workability upon replacement of the toner container 232Y is improved. Particularly, by providing the sliding portion 34*c*1 in the bottom of the held portion 234Y, the sliding portion 34*c*1 slides along the sliding face 31*a* while supporting the toner container 232Y. Furthermore, the attachment operation of the toner container 232Y is performed by starting to slide the sliding portion 34*c*1 while the user directly grips the gripper 33*d*, starting positioning of the held portion 234Y while sliding, starting insertion of the nozzle 70, and finishing the positioning of the held portion 234Y, the insertion of the nozzle 70, and the connection of the ID chip 35 as soon as the sliding is finished. Therefore, the user gains a click feeling when the held portion 234Y is positioned at the same time when the sliding of the held portion 234Y (attachment operation by one action) is progressed, and feels certain that no erroneous operation occurs in the attachment operation.

Furthermore, the toner container 232Y is not set in the toner-container holder 31 (apparatus body 100) from the upper side thereof, but the attachment/detachment is performed from the front face of the toner-container holder 31 (apparatus body 100), thus, enhancing the flexibility of layout for the upper side of the toner-container holder 31. For example, even if a scanner (document reader) is disposed right above the toner-container holder, the operability/workability upon attachment/detachment of the toner container 232Y does not deteriorate. The toner container 232Y is set in the apparatus body 100 with the longitudinal direction as the horizontal direction, and therefore, the toner capacity of the toner container 232Y is increased without any effect on the layout in the height direction of the whole image forming apparatus 100, which allows reduction in the replacement frequency.

As explained above, the image forming apparatus according to the second embodiment is provided with the standing inhibiting unit in the held portion 234Y for inhibiting the toner container 232Y from being stood on the horizontal plane H with the held portion 234Y directed vertically downward with respect to the container body 233Y. Consequently, it is possible to prevent toner aggregation in the side of the held portion 234Y during stock of the toner container 232Y. Furthermore, in the second embodiment, the ID chip 35 storing information for the toner container 232Y is provided in the held portion 234Y so as to come in contact with and separate from the communication circuit 74 in synchronization with the attachment/detachment operation of the toner container 232Y to/from the toner-container holder 31. Therefore, the ID chip 35 and the communication circuit 74 are surely and smoothly contacted with and separated from each other. This allows improvement of the operability/workability upon replacement of the toner container 232Y even on the software side in addition to the hardware side, and the occurrence of toner stain is surely reduced.

Figure 19:
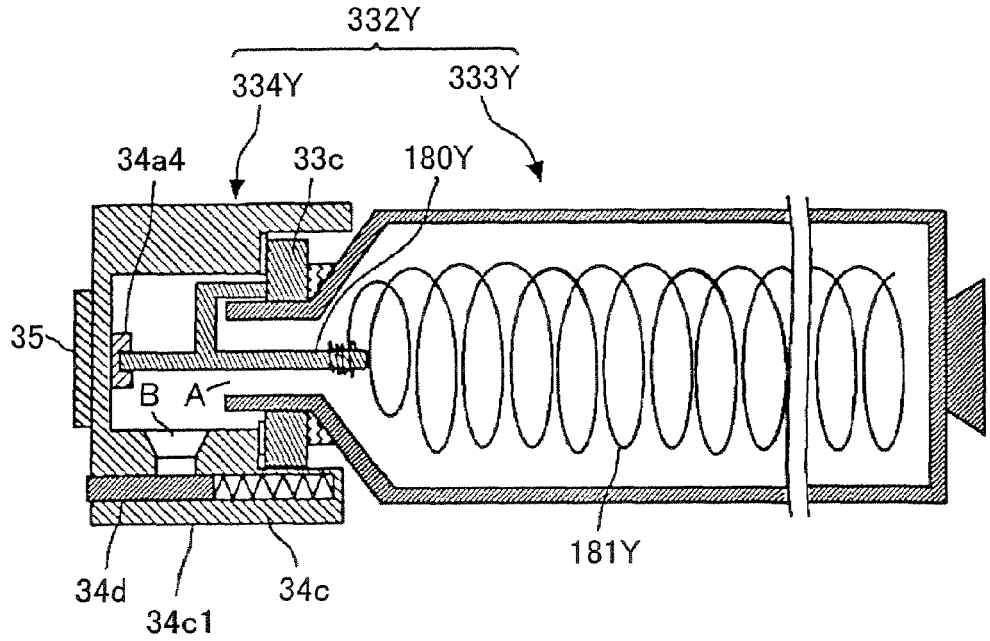
FIG. 19 is a cross-section of a toner container according to a third embodiment of the present invention.

A third embodiment of the present invention is explained in detail below with reference to FIG. 19. FIG. 19 is a cross-section of a toner container according to the third embodiment. The toner container according to the third embodiment has some points that a container body 333Y with a held portion 334Y is held by the toner-container holder 31 in the non-rotating manner, and that a coil 181Y as the conveyor member is provided in the toner container, and these points are different from the embodiments in which the container body rotates to convey the toner contained therein to the opening A.

As shown in FIG. 19, a toner container 332Y mainly includes the container body 333Y and the held portion 334Y. The opening A is provided in the head of the container body 333Y, and the gear 33*c* is rotatably provided around the outer periphery of the opening A. The gear 33*c* is engaged with the drive gear of the apparatus body 100 to rotate the coil 181Y.

A rotating axis 180Y is integrally formed with the gear 33*c*, and the spiral-shaped coil 181Y is connected to the rotating axis 180Y. One end of the rotating axis 180Y is supported by a bearing portion 34*a*4 of the held portion 334Y. The coil 181Y is extended from the opening A over the rear end (bottom) in the container body 333Y. The gear 33*c* rotates around the container body 333Y to rotate the rotating axis 180Y and the coil 181Y.

Therefore, the toner contained in the container body 333Y is conveyed toward the opening A by the toner conveying force of the coil 181Y. Because the outer diameter of the coil 181Y is smaller than the internal diameter of the container body 333Y, the toner conveying force can be exerted on the toner near the rotational central axis which is far from the inner circumferential surface of the container body 333Y. Furthermore, the coil 181Y is comparatively flexible in shape and only one end thereof is supported, thus, the position is swaying during rotation. This can totally exert the toner conveying force from the inner circumferential surface of the container body 333Y over the rotational central axis. Therefore, even if the large amount of toner is contained in the container body 333Y and toner aggregation occurs therein due to environmental changes or "being left too long", the aggregation state is weakened by the toner conveying force due to the coil 181Y, and reduction in the toner amount to be discharged can thereby be prevented.

The toner container 332Y according to the third embodiment, similarly to those of the embodiments, is also provided with the standing inhibiting unit for inhibiting the toner container 332Y from being stood on the horizontal plane H with the held portion 334Y directed vertically downward with respect to the container body 333Y.

As explained above, in the third embodiment, similarly to the embodiments, the toner container 332Y is inhibited from being stood on the horizontal plane H with the held portion 334Y directed vertically downward with respect to the container body 333Y, and this allows prevention of toner aggregation in the side of the held portion 334Y during stock of the toner container 332Y. Although the coil 181Y is used as the conveyor member in the third embodiment, a screw can also be used as the conveyor member. In this case, the same effect as that of the third embodiment can also be obtained.

Figure 20:
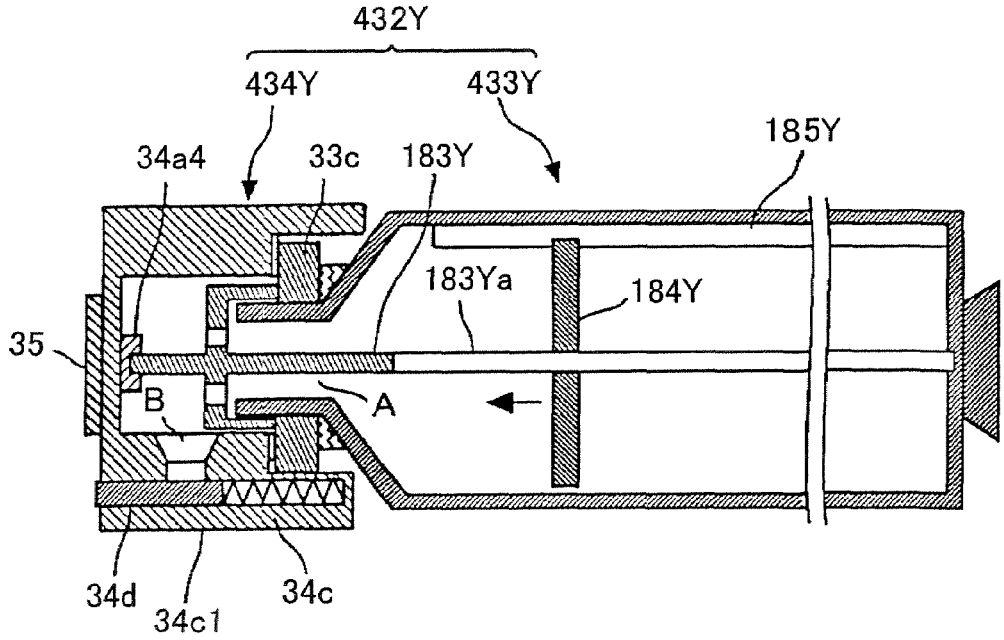
FIG. 20 is a cross-section of a toner container according to a fourth embodiment of the present invention.
Figure 21:
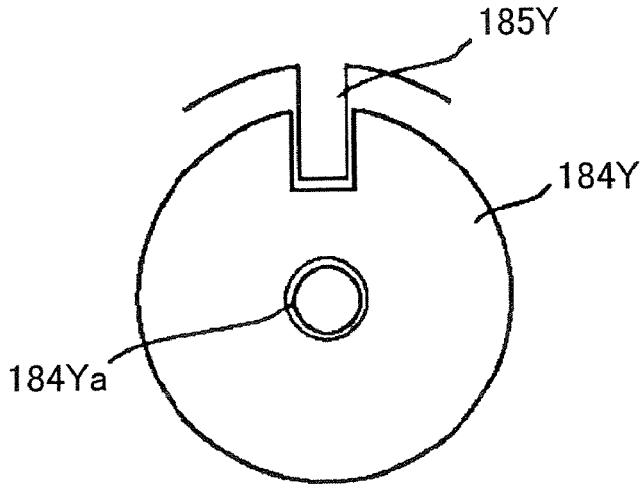
FIG. 21 is a front view of a plate member set in the toner container of FIG. 20.

A fourth embodiment of the present invention is explained in detail below with reference to FIG. 20 and FIG. 21. FIG. 20 is a cross-section of a toner container according to the fourth embodiment, which corresponds to FIG. 19 according to the third embodiment. The toner container according to the fourth embodiment is different from the third embodiment in that a plate member 184Y is used as the conveyor member.

As shown in FIG. 20, a toner container 432Y mainly includes a container body 433Y and a held portion 434Y. The opening A is provided in the head of the container body 433Y, and the gear 33*c* is rotatably provided around the outer periphery of the opening A. The gear 33*c* is engaged with the drive gear of the apparatus body 100 to be rotated, similarly to the third embodiment.

A threaded rod 183Y is integrally formed with the gear 33*c*, and the plate member 184Y is provided on the threaded rod 183Y. More specifically, a male screw portion 183Ya of the threaded rod 183Y is screwed with a female screw portion 184Ya in the plate member 184Y (see FIG. 21). Referring to FIG. 21, a notched portion is formed on the plate member 184Y, and this notched portion is engaged with a guide portion 185Y which is protruded from the inner circumferential surface of the container body 433Y.

Referring to FIG. 20, the threaded rod 183Y is supported at its one end by a bearing portion 34*a*4 of the held portion 434Y, and is supported at the other end by a bearing portion provided in the rear side of the container body 433Y. The gear 33*c* is made to rotate around the container body 433Y, and the threaded rod 183Y is also integrally rotated thereby. With the rotation, the plate member 184Y engaged with the threaded rod 183Y moves along the screw feeding direction (movement in the arrow direction toward the opening A) while being guided by the guide portion 185Y (without being rotated following the threaded rod 183Y). The speed of the movement of the plate member 184Y is set comparatively slowly in accordance with the speed of toner consumption of the container body 433Y.

In this manner, the toner contained in the container body 433Y is conveyed to the opening A side by the toner conveying force of the plate member 184Y. Here, the outer diameter of the plate member 184Y is formed so as to be slightly smaller than the internal diameter of the container body 433Y, and the toner conveying force can be exerted on even the toner near the rotational central axis A which is far from the inner circumferential surface of the container body 433Y. Therefore, even if the large amount of toner is contained in the container body 433Y and toner aggregation occurs therein due to environmental changes or "being left too long", the aggregation state is weakened by the toner conveying force due to the plate member 184Y, and reduction in the toner amount to be discharged can thereby be prevented.

The toner container 432Y according to the fourth embodiment, similarly to those of the embodiments, is also provided with the standing inhibiting unit for inhibiting the toner container 432Y from being stood on the horizontal plane H with the held portion 434Y directed vertically downward with respect to the container body 433Y.

As explained above, in the fourth embodiment, similarly to the embodiments, the toner container 432Y is inhibited from being stood on the horizontal plane H with the held portion 434Y directed vertically downward with respect to the container body 433Y, and this allows prevention of toner aggregation in the side of the held portion 434Y during stock of the toner container 432Y.

A fifth embodiment of the present invention is explained in detail below. The configuration and the operation of the overall image forming apparatus are the same as those of FIG. 1 to FIG. 4, and therefore, explanation thereof is omitted by referring to the explanation with reference to FIG. 1 to FIG. 4. In the fifth embodiment, a screw pump is connected to the tube 71, but a diaphragm-type air pump can also be connected to the tube 71.

The toner container is explained below with reference to FIG. 22 to FIG. 24. As explained with reference to FIG. 1 to FIG. 4, the four substantially cylindrical toner containers 132Y, 132M, 132C, and 132K are detachably set in the toner-container holder 31, but instead of these containers, toner containers 532Y, 532M, 532C, and 532K (toner bottles) are detachably set therein. The toner containers 532Y, 532M, 532C, and 532K are respectively replaced with new ones when they come to the end of their lives (when almost all of toner contained in a container is consumed and the container becomes empty). The toner of the colors respectively contained in the toner containers 532Y, 532M, 532C, and 532K is supplied as necessary to each developing device of the imaging units 6Y, 6M, 6C, and 6K through each toner supply path as explained with reference to FIG. 3.

Figure 22:
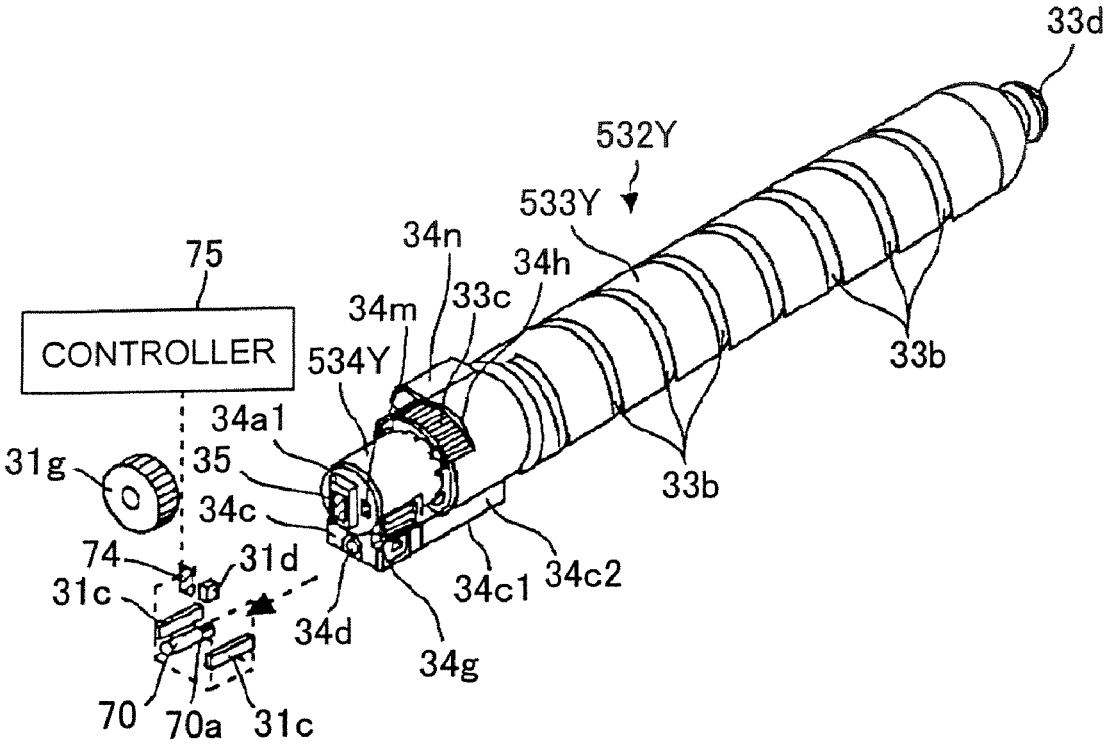
FIG. 22 is a perspective view of a toner container to be set in the toner-container holder according to a fifth embodiment of the present invention.

FIG. 22 is a perspective view of the toner container 532Y. FIG. 23 is a cross-section of the head side (the side where a held portion 534Y is provided) of the toner container 532Y. FIG. 24 is a schematic of the toner container 532Y of FIG. 23 when viewed from the direction of the arrow M. The other three toner containers 532M, 532C, and 532K have almost the same configuration as the toner container 532Y containing yellow toner, except different toner colors contained and the positions of the concave portion 34*m* and the convex portion 34*n*. Hereinafter, explanation of the other three toner containers 532M, 532C, and 532K is omitted, and only the toner container 532Y containing yellow toner is explained below.

As shown in FIG. 22, the toner container 532Y mainly includes a container body 533Y and the held portion 534Y (bottle cap) provided in the head thereof. The head of the container body 533Y includes the gear 33*c* integrally rotating with the container body 533Y, and the opening A (see FIG. 23). The opening A is provided in the head of the container body 533Y (front end position when it is attached), and is used to discharge the toner contained in the container body 533Y into the space (cavity) of the held portion 534Y.

Figure 23:
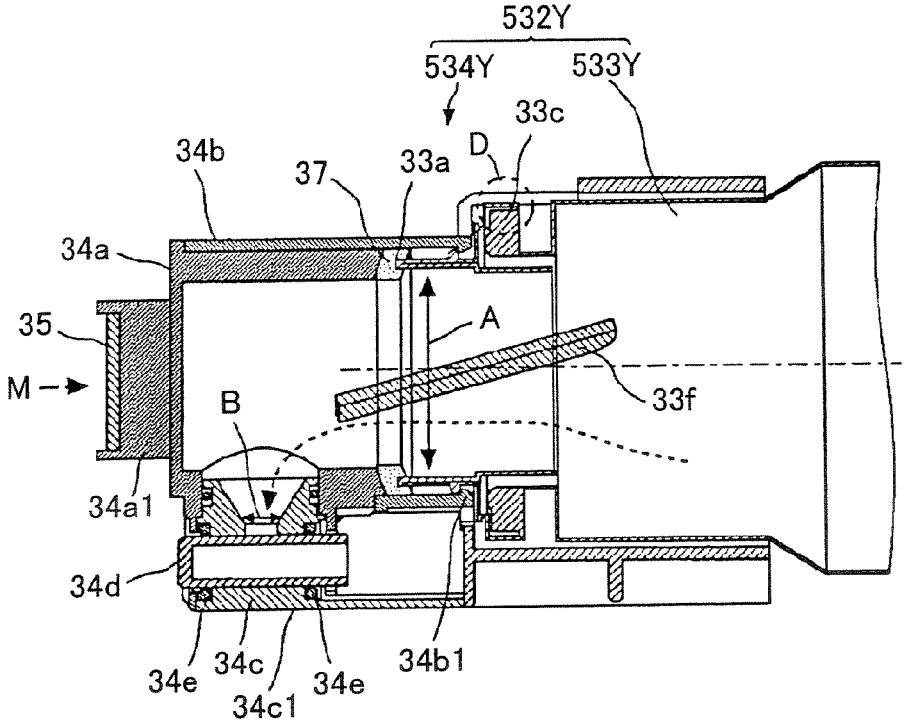
FIG. 23 is a cross-section of the head side of the toner container of FIG. 22.

The gear 33*c* is engaged with the drive gear 31*g* of the drive unit provided in the toner-container holder 31 of the apparatus body 100, to rotate the container body 533Y around its rotating axis (indicated by a chain line of FIG. 23). More specifically, the gear 33*c* is exposed from the notched portion 34*h* formed in the held portion 534Y and engaged with the drive gear 31*g* of the apparatus body 100 in the engagement position D shown in FIG. 23 and FIG. 24. The driving force is transmitted from the drive gear 31*g* to the gear 33*c*, and the container body 533Y is thereby rotated in the direction indicated by U of FIG. 24. In the fifth embodiment, the drive gear 31*g* and the gear 33*c* are spur gears.

Figure 24:
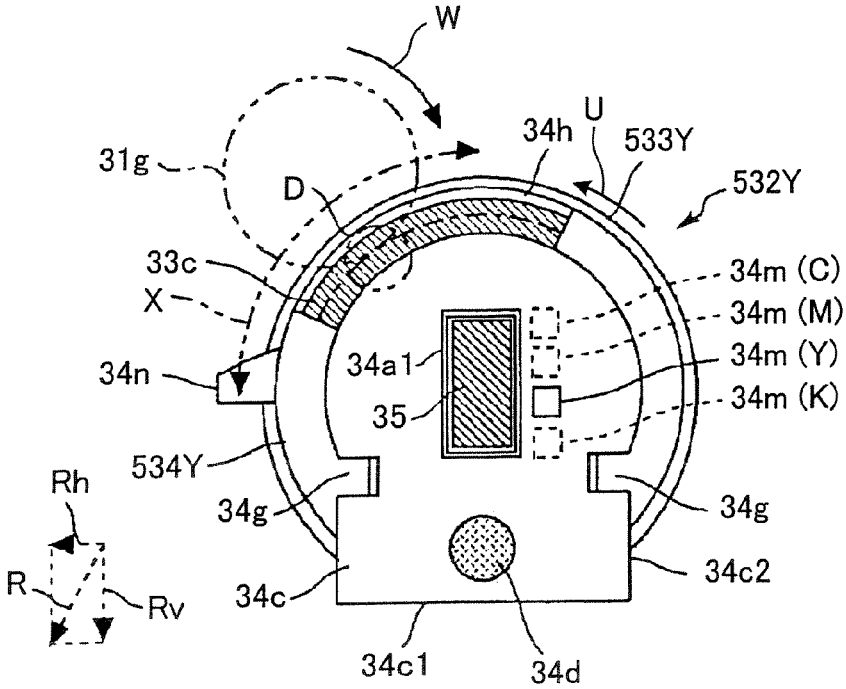
FIG. 24 is a front view of the toner container of FIG. 23 when viewed from the direction M.

In the fifth embodiment, the toner container 532Y and the apparatus body 100 are configured so that the held portion 534Y (or the container body 533Y) is biased downwardly by the force applied from the drive gear 31*g* to the gear 33*c* when the drive gear 31*g* rotates in the direction indicated by W of FIG. 24 (mainly during toner supply). More specifically, referring to FIG. 24, the gear 33*c* and the drive gear 31*g* are engaged with each other in any position in a range from the uppermost portion of the gear 33*c* over a position thereof turning ¼ rotation. In other words, the engagement position D between the gear 33*c* and the drive gear 31*g* is provided in a range X from the uppermost portion of the gear 33*c* to the downstream side thereof turning ¼ rotation (which does not include the uppermost portion and the position of the gear 33*c* turning ¼ rotation).

Based on the configuration above, component force Rv acting downward in the vertical direction is produced in force R such that the drive gear 31*g* vertically acts on a gear surface of the gear 33*c* (component force Rh acting in the horizontal direction is also produced). The held portion 534Y is biased vertically downward by the component force Rv acting vertically downward, to bring the sliding portion 34*c*1, which serves as the contact portion, into contact with the bottom of the holding portion of the toner-container holder 31 (sliding portion 34*c*1 undergoes the reaction of the component force Rv). Furthermore, the held portion 534Y is horizontally biased by the component force Rh acting horizontally, to bring the sliding portions 34*c*2, which serve as contact portions, into contact with the respective side faces of the holding portion of the toner-container holder 31 (sliding portions 34*c*2 undergo the reaction of the component force Rh). Therefore, even if rotation and non-rotation of the drive gear 31*g* are repeatedly performed (toner supply operation), the held portion 534Y does not largely and vertically move, and the seal capability for the nozzle 70 communicating with the toner outlet B is thereby maintained, thus preventing toner scattering from near the toner outlet B. However, if the engagement position D is not in the range X, the component force Rv acting vertically downward is not produced, or is small even if produced, and hence, the effect cannot be obtained.

Referring to FIG. 22, the gripper 33*d* is provided in the rear end portion (bottom) of the container body 533Y so that the user can grip it for attachment/detachment of the toner container 532Y. The spiral-shaped projection 33*b* is provided in the inner circumferential surface of the container body 533Y (spiral-shaped groove when viewed from the outer circumferential side). The spiral-shaped projection 33*b* is used to discharge the toner from the opening A by rotating the container body 533Y in a predetermined direction. The container body 533Y configured in this manner and the gear 33*c* provided in its circumferential surface can be manufactured by blow molding. The toner container 532Y according to the fifth embodiment has a stirring member 33*f* rotating together with the container body 533Y, provided in the opening A. The stirring member 33*f* is a rod-shaped member which is extended from the space in the held portion 534Y toward the container body 533Y and is provided at an angle to the rotating axis (indicated by the chain line in FIG. 23). Rotation of the stirring member 33*f* together with the container body 533Y allows improvement of the capability of discharging the toner from the opening A.

In the fifth embodiment, the container body 533Y of the toner container 532Y is made to rotate in the counterclockwise when viewed from the upstream side in the toner conveying direction. Moreover, the spiral direction (turning direction) of the projection 33*b* in the container body 533Y is set to a rightward direction. This setting and the rotation of the container body 533Y cause a spiral air flow spiraling in clockwise to be created in the toner container 532Y (the same direction as the rotational direction of the spiral air flow created in the screw pump 60).

Referring to FIG. 22 and FIG. 23, the held portion 534Y includes the cap 34*a*, the cap cover 34*b*, the holder 34*c*, the plug member 34*d* as the open/close member, the packing 34*e*, and the ID chip 35. Referring to FIG. 22 and FIG. 24, the engaging portion 34*g* (groove portion) with which the positioning member 31*c* of the toner-container holder 31 is engaged is provided on both sides of the held portion 534Y. The concave portion 34*m* in which the fitting member 31*d* of the toner-container holder 31 is fitted is provided on the end face of the held portion 534Y. The convex portion 34*n* fitting into another fitting member (not shown) of the toner-container holder 31 is provided on the circumferential surface of the held portion 534Y. Further, the notched portion 34*h* from which a part of the gear 33*c* is exposed is provided on the upper side of the held portion 534Y.

The held portion 534Y communicates with the container body 533Y through the opening A, and discharges the toner discharged from the opening A, from the toner outlet B (movement along the arrow direction indicated by the dotted line of FIG. 23). In the fifth embodiment, the cavity (space) formed inside the held portion 534Y is almost cylindrical. The toner discharge path (vertical path) from the almost cylindrical cavity formed inside the held portion 534Y up to the toner outlet B is formed into a mortar shape. With this shape, the spiral air flow created in the container body 533Y by the rotation of the container body 533Y is not disappeared but maintained, and the toner is thereby efficiently delivered toward the toner outlet B. Therefore, the toner conveyance capability of the toner which is discharged from the toner outlet B and moves along the inside of the tube 71 is improved.

The held portion 534Y does not follow the rotation of the container body 533Y, but is held in the non-rotating manner by the holding portion 73 (see FIG. 8) of the toner-container holder 31 while the engaging portions 34*g* are engaged with the positioning members 31*c*. The cap cover 34*b* of the held portion 534Y is bonded to the circumferential surface of the cap 34*a*. The claw 34*b*1 is provided at the front of the cap cover 34*b*. The claw 34*b*1 is engaged with an engaging member formed in the head of the container body 533Y, and the container body 533Y is thereby held relatively rotatably with respect to the held portion 534Y. To smoothly rotate the container body 533Y, the claw 34*b*1 of the held portion 534Y and the engaging member of the container body 533Y are engaged with each other by maintaining appropriate clearance therebetween.

The seal member 37 is bonded to the area of the held portion 534Y that faces the front end 33*a* around the opening A of the container body 533Y. The seal 37 is used to seal the gap which is around the opening A and is between the areas of the container body 533Y and the held portion 534Y that mutually face each other, and is made of an elastic material such as polyurethane foam.

The holder 34*c* is provided in the lower side of the held portion 534Y. Provided in the holder 34*c* is the plug member 34*d* (shutter) as the open/close member for opening/closing the toner outlet B in synchronization with the attachment/detachment operation of the toner container 532Y. The packing 34*e* such as G seal is provided on both sides of the plug member 34*d* to prevent toner leakage from near the plug member 34*d*. By setting the toner container 532Y in the toner-container holder 31, a lever (biasing member) for biasing the plug member 34*d* in the direction of closing the toner outlet B is engaged with the right side of the plug member 34*d*, although this is not shown in the figure. Furthermore, the packing such as an O-ring is provided in the engaging portion between the holder 34*c* and the cap 34*a*, to prevent toner leakage from both of the gaps.

The ID chip 35 of the held portion 534Y is configured to face the communication circuit 74 of the toner-container holder 31 with a predetermined distance therebetween, in synchronization with the attachment operation of the toner container 532Y to the toner-container holder 31. More specifically, the ID chip 35 is provided on the protrusion portion 34*a*1 of the held portion 534Y which is protruded in the direction of the attachment to the toner-container holder 31 (the arrow direction of FIG. 22), the protrusion portion 34*a*1 being on the plane orthogonal to the attachment direction. The ID chip 35 performs non-contact communication (radio communication) with the communication circuit 74 of the apparatus body while the held portion 534Y is held in the toner-container holder 31.

The ID chip 35 previously stores various types of information related to the toner container 532Y. On the other hand, the communication circuit 74 of the toner-container holder 31 exchanges the information by radio with the ID chip 35 while the toner container 532Y is set in the toner-container holder 31. More specifically, the information stored in the ID chip 35 is transmitted to the controller 75 (see FIG. 22) of the apparatus body 100 through the communication circuit 74, or the information for the apparatus body 100 acquired by the controller 75 is transmitted to the ID chip 35 through the communication circuit 74 and stored therein.

The ID chip 35 stores information regarding toner such as a toner color, a serial number of toner (production lot), and a date of toner production, and information regarding recycling of the toner container 532Y such as the number of times of recycling, dates of recycling, and recycling manufacturers. When the toner container 532Y is set in the toner-container holder 31, the information stored in the ID chip 35 is transmitted to the controller 75 of the apparatus body 100 through the communication circuit 74. The apparatus body 100 is optimally controlled based on these pieces of information. For example, if the toner color is different from the toner color that should be set in the toner-container holder, the operation of the toner supply device can be stopped, or imaging conditions can be changed according to the serial number or the recycling manufacturer.

Provided in the holder 34*c* of the held portion 534Y are the sliding portions 34*c*1 and 34*c*2 for sliding along the toner-container holder 31 in synchronization with the attachment/detachment operation to/from the toner-container holder 31. More specifically, the first sliding portion 34*c*1 is a flat portion formed so as to be parallel with the sliding face 31*a* (which is an upward face; see FIG. 8) of the toner-container holder 31, the flat portion being provided in the bottom of the held portion 534Y with which the attachment/detachment is operated. Furthermore, the second sliding portion 34*c*2 is a flat portion formed so as to be parallel with the sliding face (side face) of the toner-container holder 31, the flat portion being provided in the side portion of the held portion 534Y with which the attachment/detachment is operated. As explained above, the part of the sliding portions 34*c*1 and 34*c*2 serves as a contact portion for contacting the toner-container holder 31 by the biasing force due to the drive gear 31*g*.

Referring to FIG. 22 and FIG. 24, the concave portion 34*m* fitted with the fitting member 31*d* of the toner-container holder 31 is provided in the end face of the held portion 534Y and near the protrusion portion 34*a*1. The concave portion 34*m* is formed so as to be fitted with the corresponding fitting member 31*d* when the attachment operation thereof to the toner-container holder 31 is correct (when it is attached to the normal position of the toner-container holder 31).

More specifically, as shown in FIG. 24, positions of the concave portions 34*m* are differently arranged from one another according to each color of toner contained in the toner containers (container bodies). The concave portion 34*m* (C) of the toner container corresponding to cyan and a corresponding fitting member (not shown) of the toner-container holder are arranged in the uppermost side, and the concave portion 34*m* (M) of the toner container corresponding to magenta and a corresponding fitting member (not shown) of the toner-container holder are arranged in the upper side of the middle stage. The concave portion 34*m* (Y) of the toner container corresponding to yellow and the fitting member 31*d* of the toner-container holder are arranged in the lower side of the middle stage, and the concave portion 34*m* (K) of the toner container corresponding to black and a corresponding fitting member (not shown) of the toner-container holder are arranged in the lowermost side. This configuration allows prevention of such a failure that a toner container for an inappropriate color (e.g., toner container for yellow) is set in a toner-container holder for a predetermined color (e.g., cyan toner-container holder) and this causes a desired color image not to be formed.

Likewise, referring to FIG. 22 and FIG. 24, the convex portion 34*n* fitted in another fitting member (not shown) is provided on the circumferential surface of the held portion 534Y. Similarly to the concave portion 34*m*, the convex portion 34*n* is configured to be fitted in a corresponding fitting member when the toner container is properly attached to the toner-container holder 31. It is configured (not shown) that positions of the convex portions 34*n* are arranged differently from one other according to each color of toner contained in a toner container (container body). Such a configuration as above allows prevention of miss-setting of the toner container in the toner-container holder, similarly to the concave portion 34*m*.

In the fifth embodiment, as toner contained in the toner containers 532Y, 532M, 532C, and 532K, toner formed so that the following relations hold is used, where Dv(μm) is volume average particle size and Dn(μm) is number average particle size.

$$3 \leqq Dv \leqq 8 \quad (1)$$

$$1.00 \leqq Dv/Dn \leqq 1.40 \quad (2)$$

Therefore, toner particles are selected according to an image pattern in the developing process and excellent image quality is thereby maintained, and satisfactory developing capability is maintained even if the toner is stirred for a long time in the developing device. Moreover, the toner can be efficiently and reliably conveyed without blocking the toner supply path such as the tube 71. The volume average particle size and the number average particle size of toner can be measured by using a typical device such as a Coulter Counter type particle size distribution measuring device "Coulter Counter-TA-II" (manufactured by Coulter Electronics Limited) or "Coulter Multisizer II" (manufactured by Coulter Electronics Limited).

Furthermore, in the fifth embodiment, as toner contained in the toner containers 532Y, 532M, 532C, and 532K, substantially spherical toner is used, the toner being formed so that a shape factor SF-1 is in a range of 100 to 180 and a shape factor SF-2 is in a range of 100 to 180. This allows suppression of reduction in cleaning performance while high transfer efficiency is maintained. Moreover, the toner can be efficiently and reliably conveyed without blocking the toner supply path such as the tube 71. Herein, the shape factor SF-1 indicates the sphericity of a toner particle, and it is determined by the following equation.

$$SF\text{-}1=(M^2/S)\times(100\pi/4)$$

In the equation, M is the maximum particle size (the largest particle size in uneven particle sizes) in a project plane of the toner particle, and S is a project area of the toner particle. Therefore, the toner particle whose shape factor SF-1 is 100 is perfectly spherical, and the degree of sphericity lowers as it becomes greater than 100.

The shape factor SF-2 indicates the irregularities of a toner particle, and it is determined by the following equation.

$$SF\text{-}2=(N^2/S)\times(100/4\pi)$$

In the equation, N is a circumferential length in the project plane of the toner particle, and S is the project area of the toner particle. Therefore, the toner particle whose shape factor SF-2 is 100 has no irregularities, and the irregularities become larger as it becomes greater than 100. The shape factor SF-1 and the shape factor SF-2 are obtained by photographing a toner particle by a scanning electron microscope "S-800" (manufactured by Hitachi, Ltd.) and analyzing the photograph of the toner particle obtained, by an image analyzer "LUSEX3" (manufactured by Nireco Corp.).

The configuration of the toner-container holder 31 is the same as that explained with reference to FIG. 8 and FIG. 9, and therefore, explanation thereof is omitted by referring to the explanation with reference to FIG. 8 and FIG. 9.

Figure 25:
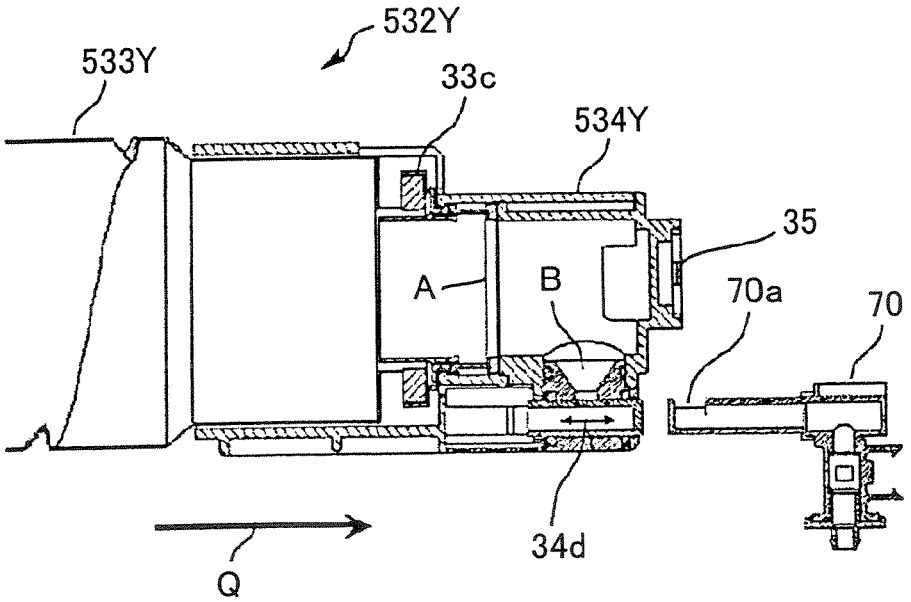
FIG. 25 is a schematic of how the toner container is attached to the toner-container holder.
Figure 26:
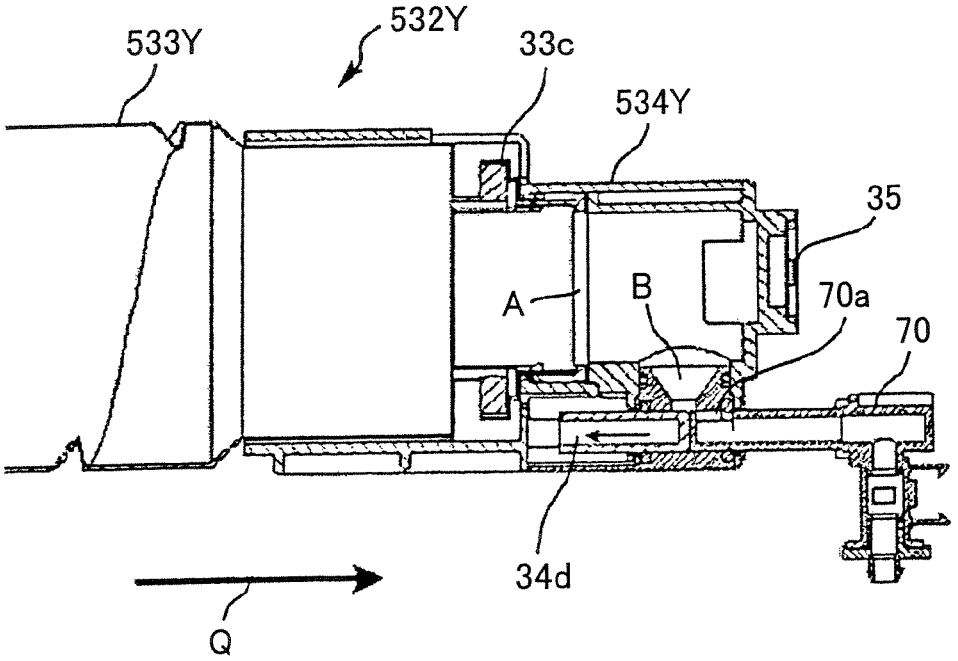
FIG. 26 is a schematic of the attachment of the toner container following the state of FIG. 25.
Figure 27:
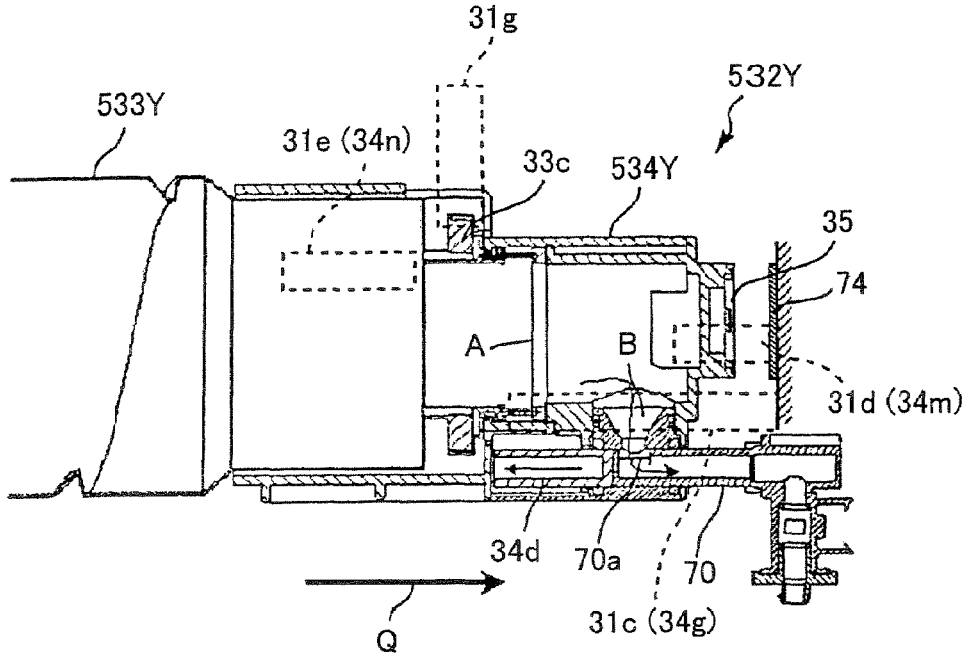
FIG. 27 is a schematic of the toner container attached to the toner-container holder.

The attachment/detachment operation of the toner container 532Y to/from the toner-container holder 31 is explained below with reference to FIG. 25 to FIG. 27. FIG. 25 is a schematic of how the toner container 532Y for yellow is attached to the toner-container holder 31 when viewed from the longitudinal direction (movement in the direction of the arrow Q). FIG. 26 is a schematic of how the attachment of the toner container 532Y is progressed (when the toner outlet B starts to be opened) when viewed from the longitudinal direction. FIG. 27 is a schematic of the toner container 532Y attached to the toner-container holder 31 (when the opening of the toner outlet B is completed) when viewed from the longitudinal direction.

When the toner container 532Y is attached to the toner-container holder 31 of the apparatus body 100, at first, the main-body cover (not shown) provided on the front face (the near side on the paper of FIG. 1) of the main body of the image forming apparatus 100 is opened to expose the toner-container holder 31 to the front side. Then, referring to FIG. 25, the toner container 532Y is pushed into the toner-container holder 31 (movement in the direction of the arrow Q). More specifically, the toner container 532Y is attached to the toner-container holder 31 along the longitudinal direction of the container body 533Y (or the toner container 532Y) so that the held portion 534Y is located as the head of the container body 533Y.

At this time, the sliding portion 34*c*1 slides along the sliding face 31*a* of the toner-container holder 31 at the head side of the toner container 532Y, and while sliding, the toner container 532Y is pushed into the toner-container holder 31 with good balance by the user gripping the gripper 33*d* on the rear side of the toner container 532Y.

Thereafter, when the holder 34*c* of the toner container 532Y reaches the holding portion 73 of the toner-container holder 31, positioning of the held portion 534Y is started while the second sliding portions 34*c*2 are sliding along the sliding faces (side faces) in addition to the sliding of the first sliding portion 34*c*1 along the sliding face 31*a*. More specifically, the engaging portions 34*g* of the held portion 534Y and the positioning members 31*c* of the toner-container holder 31 start to be engaged with each other.

Thereafter, when the attachment operation of the toner container 532Y is further progressed, the plug member 34*d* starts to open the toner outlet B while the engaging portions 34*g* and the positioning members 31*c* are engaged with each other (the state as shown in FIG. 26). More specifically, the plug member 34*d* is pushed by the nozzle 70 associated with insertion of the front end of the nozzle 70 into the hole of the holder 34*c*. At this time, the arm pairs 80 bias the held portion 534Y of the toner container 532Y toward the holding portion 73 (biasing in the direction of the arrow Q).

Then, referring to FIG. 27, the position of the held portion 534Y is fixed (engagement between the engaging portion 34*g* and the positioning member 31*c*) at the position where the holder 34*c* butts against the holding portion 73 (reference position for butting), and at the same time, the plug member 34*d* fully opens the toner outlet B and the gear 33*c* of the toner container 532Y is engaged with the drive gear 31*g* of the drive unit of the toner-container holder 31. The ID chip 35 as an electronic substrate faces the communication circuit 74 in the position where radio communication is possible. Furthermore, the concave portion 34*m* and the convex portion 34*n* for securing non-compatibility of toner containers are fitted with the fitting members 31*d* and 31*e* of the apparatus body. Then, the toner outlet B of the toner container 532Y communicates with the toner supply port 70*a* of the nozzle 70, and the attachment operation of the toner container 532Y is completed.

When the toner container 532Y is taken out (removed) from the toner-container holder 31 of the apparatus body 100, the operation is performed in the reverse of the attachment. In this case, the nozzle 70 also separates from the holder 34*c* in synchronization with the operation such that the toner container 532Y separates from the holding portion 73, and the plug member 34*d* is moved to the position for closing the toner outlet B by the biasing force of the lever (biasing member). In this manner, the detachment operation of the toner container 532Y is completed by one action (except the open/close operation of the main-body door) such that the sliding portion 34*c*1 of the toner container 532Y slides along the sliding face 31*a*.

The toner container 532Y according to the fifth embodiment includes the held portion 534Y with the toner outlet B provided vertically downward, and the toner outlet B is provided in the lower side lower than the opening A in the vertical direction. And after the plug member 34*d* is surely positioned in synchronization with the attachment operation, the plug member 34*d* is pushed by the nozzle 70, to open the toner outlet B sealed with the packing 34*e*. Therefore, there is less toner stain in the toner outlet B, and such trouble that the user's hands become stained with toner by touching the toner outlet B is prevented.

The attachment/detachment operation of the toner container 532Y to/from the toner-container holder 31 is performed by one action associated with the sliding of the sliding portion 34*c*1, and therefore, the operability/workability upon replacement of the toner container 532Y is improved. Particularly, by providing the sliding portion 34*c*1 in the bottom of the held portion 534Y, the sliding portion 34*c*1 slides along the sliding face 31*a* while supporting the toner container 532Y. Furthermore, the attachment operation of the toner container 532Y is performed by starting to slide the sliding portion 34*c*1 while the user directly grips the gripper 33*d*, starting positioning of the held portion 534Y while being biased by the arm pairs 80, starting insertion of the nozzle 70, and finishing the positioning of the held portion 534Y, the insertion of the nozzle 70, and the connection to the drive unit as soon as the sliding is finished. Therefore, the user gains a click feeling when the held portion 534Y is positioned at the same time when the sliding of the held portion 534Y (attachment operation by one action) is progressed, and feels certain that no erroneous operation occurs in the attachment operation.

Furthermore, the toner container 532Y is not set in the toner-container holder 31 (apparatus body 100) from the upper side thereof, but the attachment/detachment is performed from the front face of the toner-container holder 31 (apparatus body 100), thus, enhancing the flexibility of layout for the upper side of the toner-container holder 31. For example, even if a scanner (document reader) is disposed right above the toner supply device, the operability/workability upon attachment/detachment of the toner container 532Y does not deteriorate. The flexibility of layout for the engagement position D between the gear 33*c* of the toner container 532Y and the drive gear 31*g* of the apparatus body 100 is also enhanced. The toner container 532Y is set in the apparatus body 100 with the longitudinal direction as the horizontal direction, and therefore, the toner capacity of the toner container 532Y is increased without any effect on the layout in the height direction of the whole image forming apparatus 100, which allows reduction in the replacement frequency.

As explained above, the image forming apparatus according to the fifth embodiment is configured so that the held portion 534Y is biased downward by the force applied from the drive gear 31*g* to the gear 33*c* when the drive gear 31*g* rotates. Therefore, the operability/workability upon replacement of the toner container 532Y is high, and such trouble that the toner scatters from the toner container 532Y can be prevented even if the toner supply operation is repeated.

In the fifth embodiment, only the toner is contained in each container body of the toner containers 532Y, 532M, 532C, and 532K, but in the case of the image forming apparatus that supplies two-component developer (developer for replenishment) containing toner and carrier to each developing device, the two-component developer can also be contained in each container body of the toner containers 532Y, 532M, 532C, and 532K. Even in this case, the same effect as that of the fifth embodiment can be obtained.

A two-component developing device in this case is assumed as a developing device configured as follows. This developing device is based on a system of performing image formation while the state of toner concentration of 3 to 15 wt %, preferably 5 to 10 wt % is always maintained in the developing device, the toner concentration being a weight ratio of the toner to the two-component developer, and of supplying a developer for replenishment contained with carrier which does not deteriorate when toner is supplied by the amount of toner having been used for the image formation, to prolong the life of the developer.

This developing device includes an excessive-developer discharging mechanism for discharging some developer, which becomes excessive due to supply thereof from part of a conveyor path of the developing device, to the outside of the developing device. And with this action, the amount of developer in the developing device can be made constant.

Carrier concentration being a weight ratio of carrier in the developer for replenishment is preferably 3 wt % to 20 wt % from the viewpoint of compatibility between maintenance of a developer life and a replacement interval of the toner container to be prolonged.

In the fifth embodiment, the projection 33*b* is integrally formed in the inner circumferential surface of the container body 533Y, and the container body 533Y is made to rotate. On the other hand, a coil or a screw may also be rotatably held inside the container body 533Y, and the container body 533Y is not rotated but the coil or the screw can be rotated by the gear 33*c*. In this case also, the same effect as that of the fifth embodiment can be obtained if the held portion 534Y is biased downward by the force which the gear 33*c* rotating the coil or the screw undergoes when the drive gear 31*g* rotates.

In the fifth embodiment, the suction-type screw pump 60 for sending air to the inside of the tube 71 is provided in the toner supply device. At the same time, a discharge-type screw pump for sending air to the inside of the tube 71 can also be provided in the toner supply device. Furthermore, a diaphragm-type air pump can be provided instead of the screw pump. Even in these cases, the same effect as that of the fifth embodiment can be obtained if the held portion 534Y is biased downward by the force applied from the drive gear 31*g* to the gear 33*c* when the drive gear 31*g* rotates.

Figure 28:
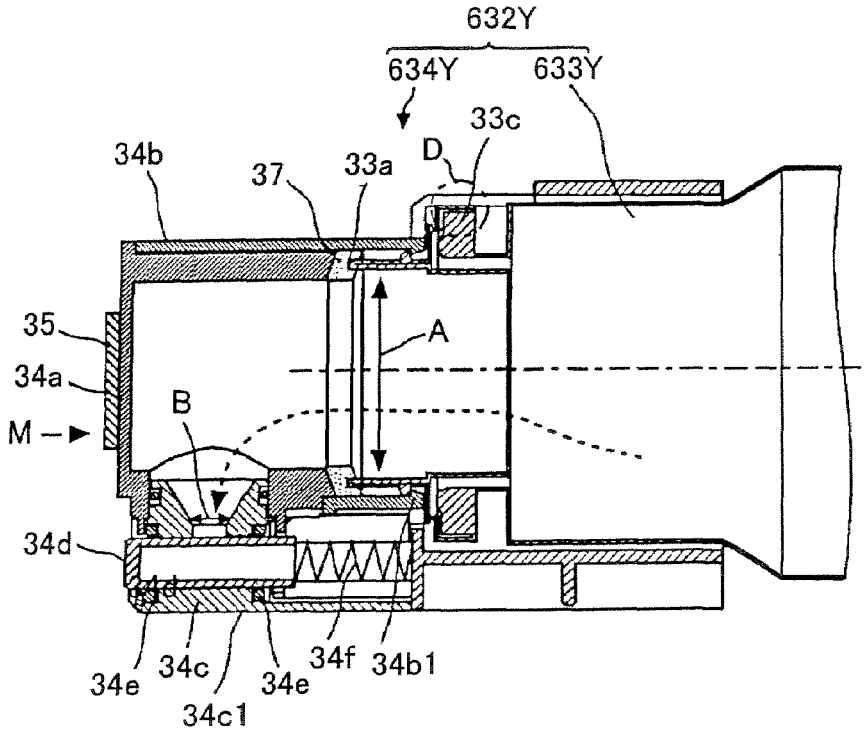
FIG. 28 is a cross-section of the head side of a toner container according to a sixth embodiment of the present invention.

A sixth embodiment of the present invention is explained in detail below with reference to FIG. 28 to FIG. 31A and FIG. 31B. FIG. 28 is a cross-section of the head side of a toner container according to the sixth embodiment, which corresponds to that of FIG. 23 according to the fifth embodiment.

Explanation is given with reference to FIG. 28. A toner container 632Y according to the sixth embodiment is different from that of the fifth embodiment in a point that the compression spring 34*f* as a biasing member is provided in a held portion 634Y. More specifically, the compression spring 34*f* (biasing member) for biasing the plug member 34*d* in the direction of closing the toner outlet B is provided on the right-hand side of the plug member 34*d*.

The ID chip 35 as an electronic component (storage unit) is configured so as to directly contact the communication circuit 74 of the apparatus body. The ID chip 35 of the held portion 634Y is configured so as to come in contact with or separate from the communication circuit 74 (connection terminal) of the toner-container holder 31 in synchronization with the attachment/detachment operation of the toner container 632Y to/from the toner-container holder 31. More specifically, the ID chip 35 is provided on a location which is the plane of the held portion 634Y orthogonal to the attachment/detachment direction (the arrow direction of FIG. 29A and FIG. 29B) with respect to the toner-container holder 31, and which faces the communication circuit 74 upon the attachment/detachment operation.

In this manner, the ID chip 35 comes in contact with the communication circuit 74 provided in the apparatus body 100 in synchronization with the attachment/detachment operation (linear operation) of the toner container 632Y by one action, and this improves contact performance between the ID chip 35 and the communication circuit 74. More specifically, the surface of the ID chip 35 comes in contact linearly with the communication circuit 74 fixed in the apparatus body 100 (toner-container holder 31), and this prevents, before occurring, such a failure that the ID chip 35 comes in contact unevenly with the communication circuit 74 to cause contact failure, or that part of the ID chip 35 and the communication circuit 74 is worn out to give damage to some components.

Figure 29A:
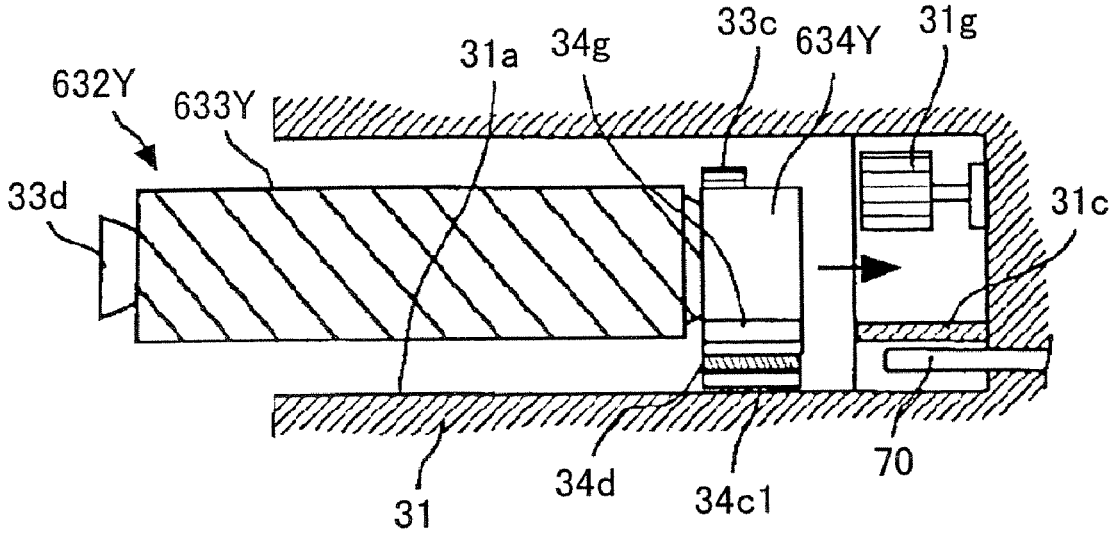
FIG. 29A is a schematic of how the toner container of FIG. 28 is attached to the toner-container holder.
Figure 29B:
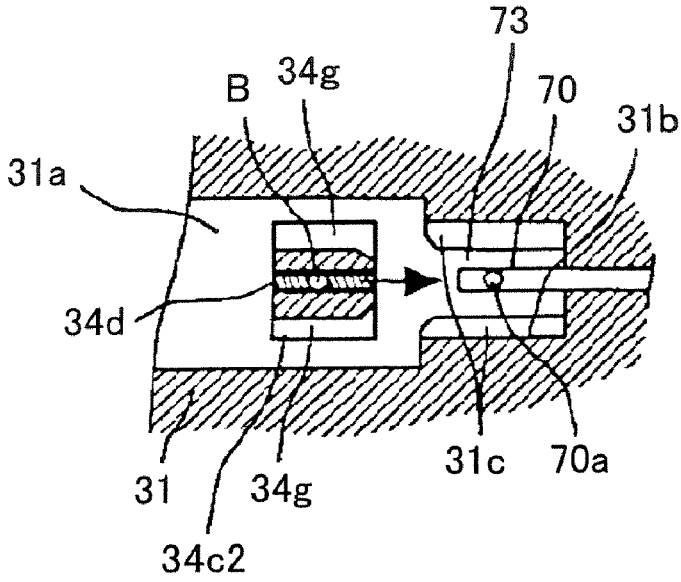
FIG. 29B is a schematic of how the toner container of FIG. 28 is attached to the toner-container holder.
Figure 30A:
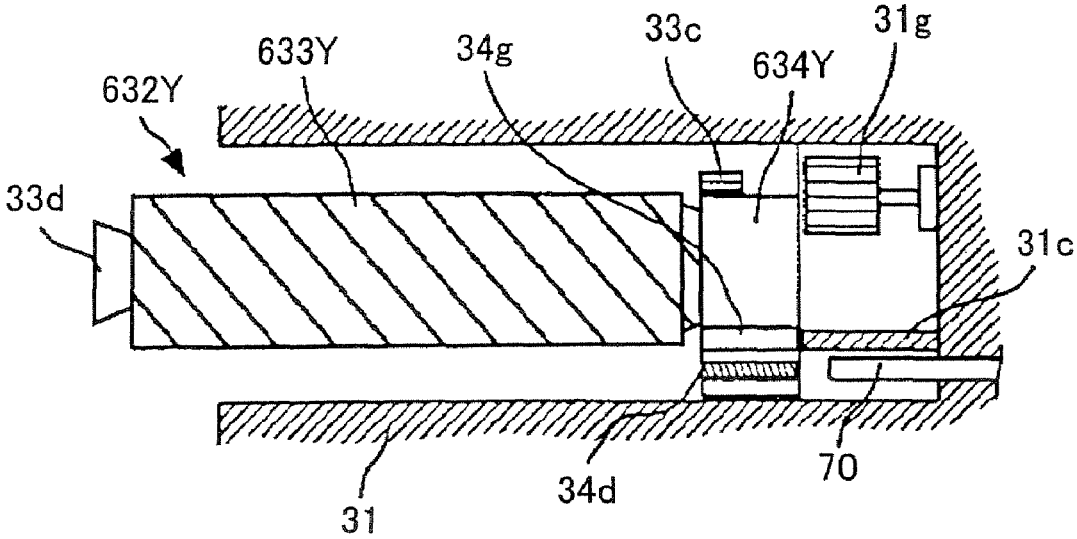
FIG. 30A is a schematic of the attachment of the toner container following the state of FIG. 29A.
Figure 30B:
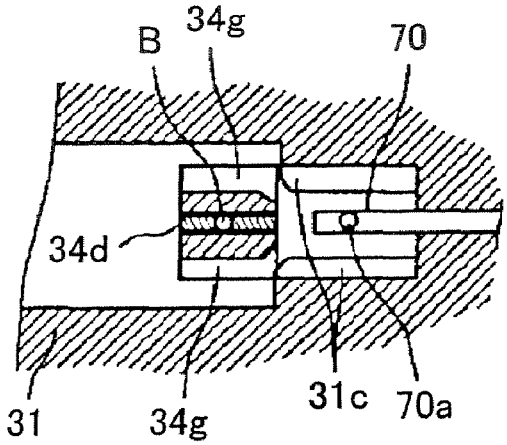
FIG. 30B is a schematic of the attachment of the toner container following the state of FIG. 29B.
Figure 31A:
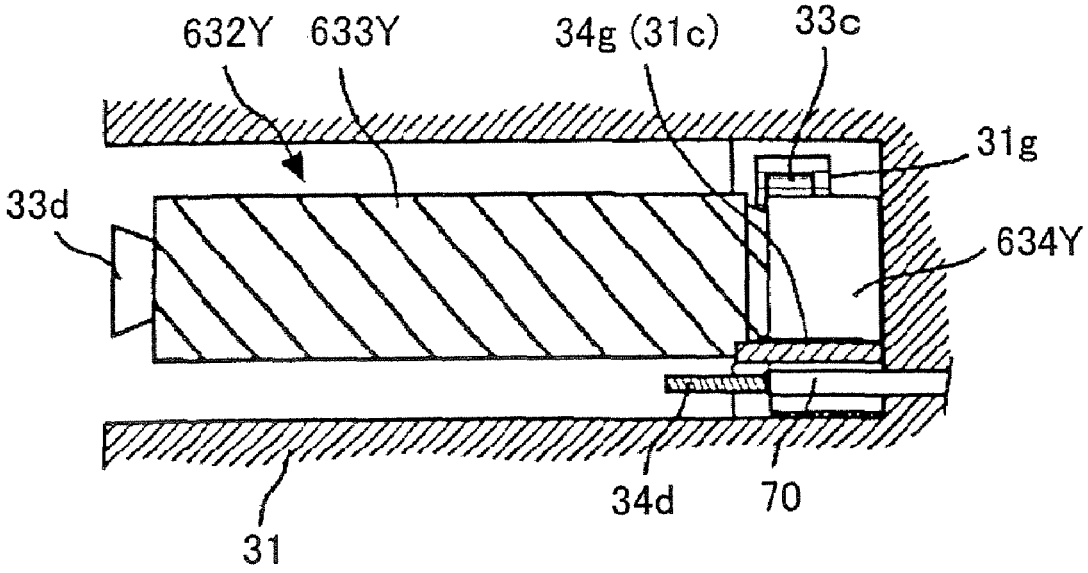
FIG. 31A is a schematic of the toner container attached to the toner-container holder.
Figure 31B:
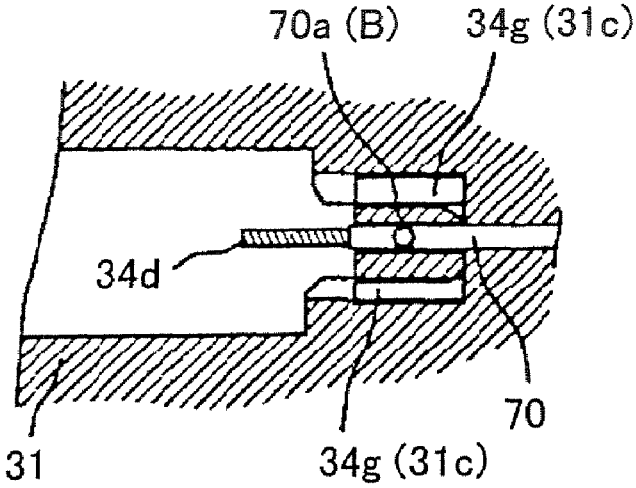
FIG. 31B is a schematic of the toner container attached to the toner-container holder.

The attachment/detachment operation of the toner container 632Y to/from the toner-container holder 31 is explained below with reference to FIGS. 29A, 29B to FIGS. 31A and 31B. FIG. 29A is a schematic of how the yellow toner container 632Y is attached to the toner-container holder 31 (movement in the arrow direction) when viewed from the longitudinal direction, and FIG. 29B is a schematic of a portion around the holder 34*c* of the held portion 634Y in that state when viewed from the upper side. FIG. 30A is a schematic of how the attachment of the toner container 632Y is progressed (positioning of the held portion 634Y is started) when viewed from the longitudinal direction, and FIG. 30B is a schematic of a portion around the holder 34*c* of the held portion 634Y in that state when viewed from the upper side. FIG. 31A is a schematic of the toner container 632Y attached to the toner-container holder 31 (attachment is completed) when viewed from the longitudinal direction, and FIG. 31B is a schematic of a portion around the holder 34*c* in that state when viewed from the upper side.

Provided in the toner-container holder 31 are four toner-container holders corresponding to the four toner containers 632Y, 632M, 632C, and 632K, respectively. Each of the four toner-container holders includes the sliding faces 31*a* and 31*b* along which the sliding portions 34*c*1 and 34*c*2 of the held portion slide; the holding portion 73 for fixing the position of the holder 34*c* of the held portion; the nozzle 70 (toner conveying pipe); the drive unit (where the drive gear 31*g* is provided) for transmitting a rotational driving force to a container body; and the communication circuit 74. The holding portion 73 includes the sliding faces 31*a* and 31*b* contacting the holder 34*c*, and the contact area (not shown) contacting a part of the cap cover 34*b*. Provided in the sliding face 31*b* (side face) of the holding portion 73 is the positioning member 31*c* for positioning in synchronization with the attachment operation of the held portion. The positioning member 31*c* is a convex portion extended along the attachment/detachment direction of the toner container.

When the toner container 632Y is attached to the toner-container holder 31 of the apparatus body 100, at first, the main-body cover (not shown) provided on the front face (the near side on the paper of FIG. 1) of the main body of the image forming apparatus 100 is opened to expose the toner-container holder 31 to the front side. Then, referring to FIG. 29A and FIG. 29B, the toner container 632Y is pushed into the toner-container holder 31 (movement in the arrow direction). More specifically, the toner container 632Y is attached to the toner-container holder 31 along the longitudinal direction of the container body 633Y (or the toner container 632Y) so that the held portion 634Y is located as the head of the container body 633Y.

At this time, the first sliding portion 34*c*1 slides along the sliding face 31*a* of the toner-container holder 31 at the head side of the toner container 632Y, and while sliding, the toner container 632Y is pushed into the toner-container holder 31 with sufficient balance by the user gripping the gripper 33*d* on the rear side of the toner container 632Y.

Referring to FIG. 30A and FIG. 30B, when the holder 34*c* of the toner container 632Y reaches the holding portion 73 of the toner-container holder 31, positioning of the held portion 634Y is started while the second sliding portions 34*c*2 are sliding along the sliding faces 31*b* in addition to the sliding of the first sliding portion 34*c*1 along the sliding face 31*a*. More specifically, the engaging portion 34*g* of the held portion 634Y and the positioning member 31*c* of the toner-container holder 31 start to be engaged with each other.

Thereafter, when the attachment operation of the toner container 632Y is further progressed, the plug member 34*d* starts to open the toner outlet B while the engaging portions 34*g* and the positioning members 31*c* are engaged with each other. More specifically, the plug member 34*d* is pushed by the nozzle 70 associated with insertion of the front end of the nozzle 70 into the hole of the holder 34*c*. Then, as shown in FIG. 31A and FIG. 31B, the position of the held portion 634Y is fixed in the position where the holder 34*c* butts against the holding portion 73 (reference position for butting), and at the same time, the plug member 34*d* fully opens the toner outlet B and the gear 33*c* of the toner container 632Y is engaged with the drive gear 31*g* of the drive unit of the toner-container holder 31. Furthermore, the ID chip 35 is connected to the communication circuit 74. In this manner, the toner outlet B of the toner container 632Y and the toner supply port 70*a* of the nozzle 70 communicate with each other, and the attachment operation of the toner container 632Y is completed.

As explained above, in the sixth embodiment, the positioning operation of the held portion 634Y (toner container 632Y) is started in synchronization with one action (except the open/close operation of the main-body door) such that the sliding portion 34*c*1 of the toner container 632Y slides along the sliding face 31*a*, and then, the insertion operation of the nozzle 70 is started, and finally, the engagement of the gear 33*c* with the drive gear 31*g* is completed. The nozzle 70 is preferentially inserted into the held portion 634Y at a location apart from the engagement position D of the gear 33*c*, and this can prevent such a failure that an unexpected external force, produced when the nozzle 70 does not come in contact with the plug member 34*d*, may be applied to the nozzle 70 to be deformed. In other words, if the connection of the gear 33*c* is preferentially performed near the held portion 634Y rather than the insertion of the nozzle 70 into the held portion 634Y, the toner container 632Y may be displaced caused by inappropriate engagement between the drive gear 31*g* and the gear 33*c*, which may cause the position where the nozzle 70 should be inserted to be displaced.

Movement of the nozzle 70 to the inside or the outside of the holder 34*c* and movement of the plug member 34*d* to the inside or the outside of the holder 34*c* are performed when both of the members slidably contact the lip of the packing 34*e* of the holder 34*c*. Therefore, such a failure that toner is leaked from the holder 34*c* due to insertion or removal of the nozzle 70 is prevented.

When the toner container 632Y is taken out (removed) from the toner-container holder 31 of the apparatus body 100, the operation is performed in the reverse of the attachment. At this time, the nozzle 70 also separates from the holder 34*c* in synchronization with the operation of the toner container 632Y separating from the holding portion 73, and the plug member 34*d* moves to the position for closing the toner outlet B by the biasing force of the compression spring 34*f*. In this manner, the detachment operation of the toner container 632Y is completed by one action (except the open/close operation of the main-body door) such that the sliding portion 34*c*1 of the toner container 632Y slides along the sliding face 31*a*.

The toner container 632Y according to the sixth embodiment includes the held portion 634Y with the toner outlet B provided vertically downward, and the toner outlet B is provided in the lower side lower than the opening A. And after the plug member 34*d* is surely positioned in synchronization with the attachment operation, the plug member 34*d* is pushed by the nozzle 70 to open the toner outlet B sealed with the packing 34*e*. Therefore, there is less toner stain in the toner outlet B, and such trouble that the user's hands become stained with toner by touching the toner outlet B is prevented.

The attachment/detachment operation of the toner container 632Y to/from the toner-container holder 31 is performed by one action associated with the sliding of the sliding portion 34*c*1, and therefore, the operability/workability upon replacement of the toner container 632Y is improved. Particularly, by providing the sliding portion 34*c*1 in the bottom of the held portion 634Y, the sliding portion 34*c*1 slides along the sliding face 31*a* while supporting the toner container 632Y. Moreover, the attachment operation of the toner container 632Y is performed by starting to slide the sliding portion 34*c*1 while the user directly grips the gripper 33*d*, starting positioning of the held portion 634Y associated with the sliding, starting insertion of the nozzle 70, and finishing the positioning of the held portion 634Y, the insertion of the nozzle 70, and the connection to the drive unit as soon as the sliding is finished. Therefore, the user gains a click feeling when the held portion 634Y is positioned at the same time when the sliding of the held portion 634Y (attachment operation by one action) is progressed, and feels certain that no erroneous operation occurs in the attachment operation.

Further, the toner container 632Y is not set in the toner-container holder 31 (apparatus body 100) from the upper side thereof, but the attachment/detachment is performed from the front face of the toner-container holder 31 (apparatus body 100), thus, enhancing the flexibility of layout for the upper side of the toner-container holder 31. For example, even if a scanner (document reader) is disposed right above the toner-container holder, the operability/workability upon attachment/detachment of the toner container 632Y does not deteriorate. Furthermore, the flexibility of layout for the engagement position D between the gear 33*c* of the toner container 632Y and the drive gear 31*g* of the apparatus body 100 is enhanced. The toner container 632Y is set in the apparatus body 100 with its longitudinal direction as the horizontal direction, and therefore, the toner capacity of the toner container 632Y is increased without any effect on the layout in the height direction of the whole image forming apparatus 100, which allows reduction in the replacement frequency.

Referring to FIG. 28, in the toner container 632Y according to the sixth embodiment, the toner outlet B is provided in a more rear side (left side of FIG. 28) than the container body 633Y (or the opening A) in the direction of the attachment to the toner-container holder 31. This allows the toner outlet B to be smoothly and unfailingly opened/closed in synchronization with the attachment/detachment operation of the toner container 632Y along its longitudinal direction. In other words, when the toner container 632Y is to be attached, the positioning of the held portion 634Y is started, and then the nozzle 70 and the plug member 34*d* are preferentially contacted with each other. Furthermore, because the toner supply portion including the nozzle 70 can be provided in the rear side in the attachment direction (left side of FIG. 28), the layout of the apparatus body 100 is simplified.

Further, in the toner container 632Y according to the sixth embodiment, the toner outlet B is provided in a more rear side (left side of FIG. 28), in the direction of the attachment to the toner-container holder 31, than the gear 33*c* which is disposed on the periphery of the container body 633Y and is near the opening A. This allows the toner outlet B to be smoothly and reliably opened/closed in synchronization with the attachment/detachment operation of the toner container 632Y along the longitudinal direction. In other words, when the toner container 632Y is to be attached, the positioning of the held portion 634Y is started, and then the nozzle 70 and the plug member 34*d* are preferentially contacted with each other, and thereafter, the gear 33*c* and the drive gear 31*g* are engaged with each other. Furthermore, in addition to the toner supply portion including the nozzle 70, the drive unit for transmitting a rotational drive force to the gear 33*c* can also be provided in the rear side in the attachment direction (left side of FIG. 28). Therefore, the layout of the apparatus body 100 can be simplified, and the toner supply portion and the drive unit can be maintained collectively from the rear side of the apparatus body 100.

As explained above, in the image forming apparatus according to the sixth embodiment, similarly to the fifth embodiment, the gear 33*c* of the container body 633Y is provided so that the gear 33*c* is engaged with the drive gear 31*g* of the main body of the image forming apparatus 100 at the position opposite in the vertical direction to the toner outlet B of the held portion 634Y via the opening A of the container body 633Y. Therefore, the operation such that the toner outlet B is opened or closed and the operation such that the gear 33*c* comes in contact with or separates from the drive gear 31*g* can be smoothly and surely performed in synchronization with the attachment/detachment operation of the toner container 632Y. This allows improvement of the operability/workability upon replacement of the toner container 632Y, and reliable reduction in the occurrence of toner stain. Furthermore, in the sixth embodiment, similarly to the fifth embodiment, the toner outlet B of the held portion 634Y is provided in a more rear side than the container body 633Y in the attachment direction, and hence, the toner outlet B can be smoothly and reliably opened/closed in synchronization with the attachment/detachment operation of the toner container 632Y. This allows improvement of the operability/workability upon replacement of the toner container 632Y, and reliable reduction in the occurrence of toner stain. Furthermore, in the sixth embodiment, similarly to the fifth embodiment, the toner outlet B of the held portion 634Y is provided in a lower side lower than the opening A of the container body 633Y in the vertical direction, and hence, the toner can be smoothly and reliably discharged from the toner outlet B which is opened in synchronization with the attachment operation of the toner container 632Y. This allows improvement of the operability/workability upon replacement of the toner container 632Y, and reliable reduction in the occurrence of toner stain.

Figure 32:
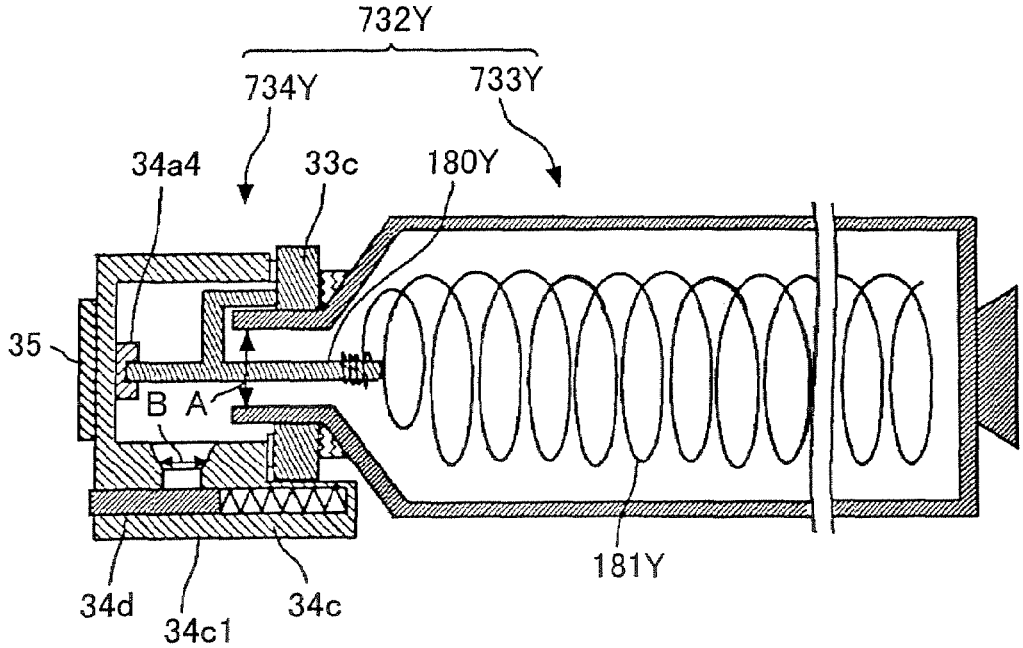
FIG. 32 is a cross-section of a toner container according to a seventh embodiment of the present invention.

A seventh embodiment of the present invention is explained in detail below with reference to FIG. 32. FIG. 32 is a cross-section of a toner container according to the seventh embodiment. The toner container according to the seventh embodiment has some points that a container body 733Y together with a held portion 734Y is held by the toner-container holder 31 in the non-rotating manner, and that the coil 181Y as the conveyor member is provided in the container body 733Y, and these points are different from the embodiments in which the container body rotates to convey the toner contained therein to the opening A.

As shown in FIG. 32, a toner container 732Y mainly includes the container body 733Y and the held portion 734Y. The opening A is provided in the head of the container body 733Y, and the gear 33*c* is rotatably provided around the outer periphery of the opening A. The gear 33*c* is engaged with the drive gear of the apparatus body 100 to rotate the coil 181Y.

The rotating axis 180Y is integrally formed with the gear 33*c*, and the spiral-shaped coil 181Y is connected to the rotating axis 180Y. One end of the rotating axis 180Y is supported by the bearing portion 34*a*4 of the held portion 734Y. The coil 181Y is extended from the opening A over the rear end (bottom) inside the container body 733Y. The gear 33*c* rotates around the container body 733Y to rotate the rotating axis 180Y and the coil 181Y.

Therefore, the toner contained in the container body 733Y is conveyed toward the opening A by the toner conveying force of the coil 181Y. Because the outer diameter of the coil 181Y is smaller than the internal diameter of the container body 733Y, the toner conveying force can be exerted on the toner near the rotational central axis which is far from the inner circumferential surface of the container body 733Y. Furthermore, the coil 181Y is comparatively flexible in shape and is supported only at one end thereof, thus, the position is swaying during rotation. This can totally exert the toner conveying force from the inner circumferential surface of the container body 733Y over the rotational central axis. Therefore, even if the large amount of toner is contained in the container body 733Y and toner aggregation occurs therein due to environmental changes or "being left too long", the aggregation status is weakened by the toner conveying force due to the coil 181Y, and reduction in the toner amount to be discharged can thereby be prevented.

Similarly to the embodiments, the toner container 732Y according to the seventh embodiment is also configured so that the held portion 734Y is biased downward by the force applied from the drive gear 31*g* to the gear 33*c* when the drive gear 31*g* rotates. Furthermore, the gear 33*c* of the container body 733Y is provided so that the gear 33*c* is engaged with the drive gear 31*g* of the main body of the image forming apparatus 100 at the position opposite in the vertical direction to the toner outlet B of the held portion 734Y via the opening A of the container body 733Y. Further, the toner outlet B of the held portion 734Y is provided in a more rear side than the container body 733Y in the attachment direction. Furthermore, the toner outlet B of the held portion 734Y is provided in a lower side lower than the opening A of the container body 733Y in the vertical direction.

As explained above, in the seventh embodiment, similarly to the embodiments, the operability/workability upon the replacement of the toner container 732Y is improved, and the occurrence of toner stain can be surely reduced. The coil 181Y is used as the conveyor member in the seventh embodiment, but a screw can also be used as the conveyor member. In this case also, the same effect as that of the seventh embodiment can be obtained.

Figure 33:
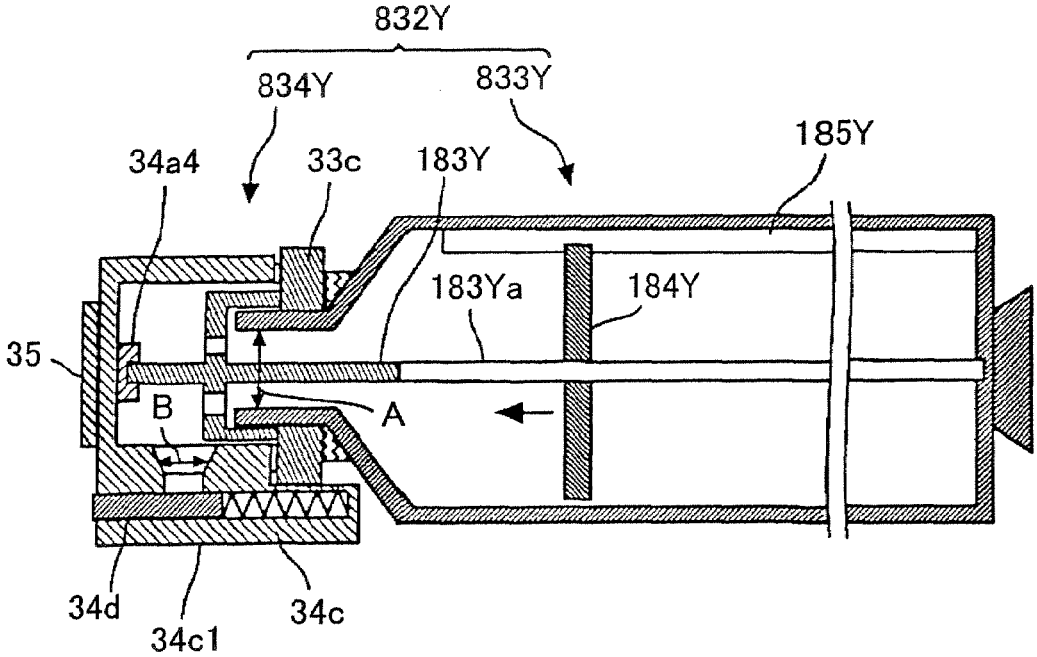
FIG. 33 is a cross-section of a toner container according to an eighth embodiment of the present invention.
Figure 34:
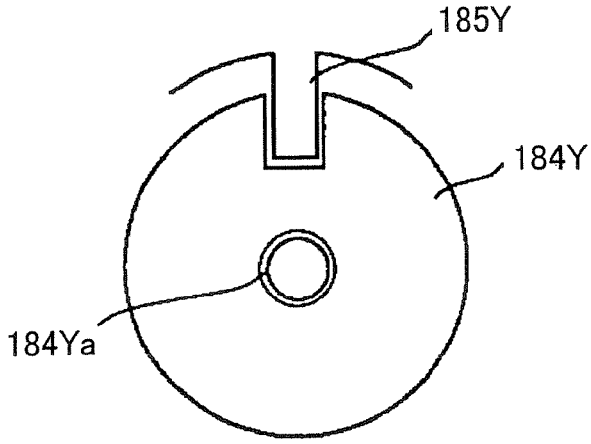
FIG. 34 is a front view of a plate member set in the toner container of FIG. 33.

An eighth embodiment of the present invention is explained in detail below with reference to FIG. 33 and FIG. 34. FIG. 33 is a cross-section of a toner container according to the eighth embodiment, which corresponds to FIG. 32 according to the seventh embodiment. The toner container according to the eighth embodiment is different from the seventh embodiment in that the plate member 184Y is used as the conveyor member.

As shown in FIG. 33, a toner container 832Y mainly includes a container body 833Y and a held portion 834Y. The opening A is provided in the head of the container body 833Y, and the gear 33*c* is rotatably provided around the outer periphery of the opening A. The gear 33*c* is engaged with the drive gear of the apparatus body 100 to be rotated, similarly to the seventh embodiment.

The threaded rod 183Y is integrally formed with the gear 33*c*, and the plate member 184Y is provided on the threaded rod 183Y. More specifically, the male screw portion 183Ya of the threaded rod 183Y is screwed with a female screw portion 184Ya in the plate member 184Y (see FIG. 34). Referring to FIG. 34, a notched portion is formed on the plate member 184Y, and this notched portion is engaged with the guide portion 185Y which is protruded from the inner circumferential surface of the container body 833Y.

Referring to FIG. 33, the threaded rod 183Y is supported at its one end by the bearing portion 34*a*4 of the held portion 834Y, and is supported at the other end by a bearing portion provided in the rear side of the container body 833Y. The gear 33*c* is made to rotate around the container body 833Y, and the threaded rod 183Y is also integrally rotated thereby. Therefore, the plate member 184Y engaged with the threaded rod 183Y moves along the screw feeding direction (movement in the arrow direction toward the opening A) while being guided by the guide portion 185Y (without being rotated following the threaded rod 183Y). The speed of the movement of the plate member 184Y is set comparatively slowly in accordance with the speed of toner consumption of the container body 833Y.

In this manner, the toner contained in the container body 833Y is conveyed to the opening A side by the toner conveying force of the plate member 184Y. Here, the outer diameter of the plate member 184Y is formed so as to be slightly smaller than the internal diameter of the container body 833Y, and the toner conveying force can be exerted on the toner near the rotational central axis A which is far from the inner circumferential surface of the container body 833Y. Therefore, even if the large amount of toner is contained in the container body 833Y and toner aggregation occurs therein due to environmental changes or "being left too long", the aggregation status is weakened by the toner conveying force due to the plate member 184Y, and reduction in the toner amount to be discharged can thereby be prevented.

Similarly to the embodiments, the toner container 832Y according to the eighth embodiment is also configured so that the held portion 834Y is biased downward by the force applied from the drive gear 31*g* to the gear 33*c* when the drive gear 31*g* rotates. Furthermore, the gear 33*c* of the container body 833Y is provided so that the gear 33*c* is engaged with the drive gear 31*g* of the main body of the image forming apparatus 100 at the position opposite in the vertical direction to the toner outlet B of the held portion 834Y via the opening A of the container body 833Y. Further, the toner outlet B of the held portion 834Y is provided in a more rear side than the container body 833Y in the attachment direction. Furthermore, the toner outlet B of the held portion 834Y is provided in a lower side lower than the opening A of the container body 833Y in the vertical direction.

As explained above, in the eighth embodiment, similarly to the embodiments, the operability/workability upon the replacement of the toner container 832Y is improved, and the occurrence of toner stain can be surely reduced.

A ninth embodiment of the present invention is explained in detail below with reference to FIG. 35 to FIG. 51. The configuration and the operation of the overall image forming apparatus are the same as those in FIG. 1 and FIG. 2, and therefore, explanation is given with reference to FIG. 35 and FIG. 36 by referring to FIG. 1, FIG. 2, and the explanation thereof.

Figure 35:
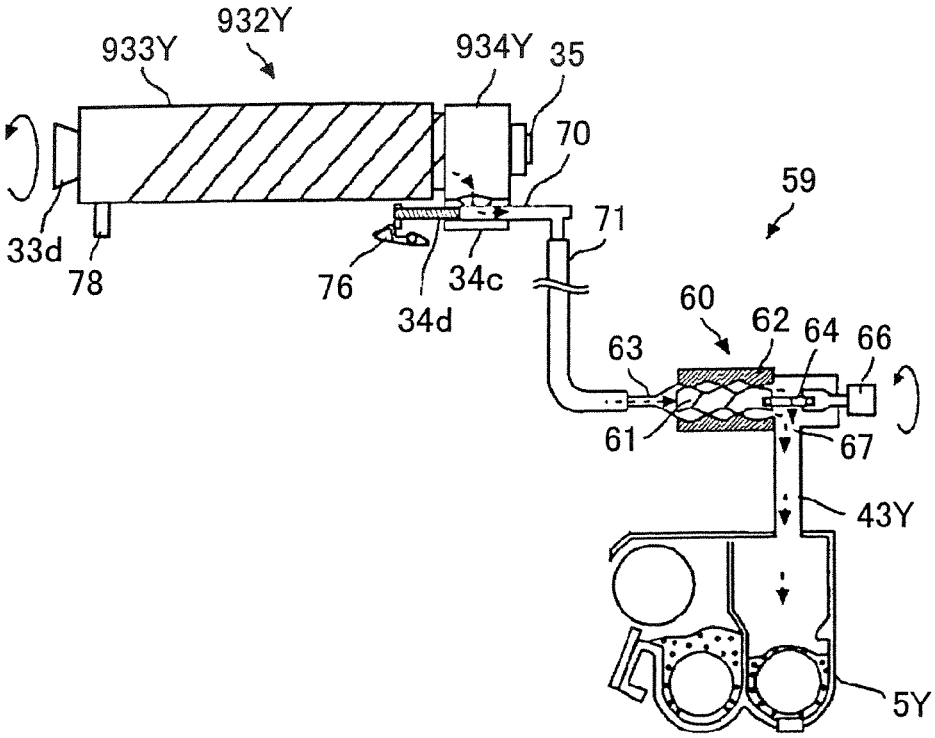
FIG. 35 is a schematic of a toner supply path according to a ninth embodiment of the present invention.
Figure 36:
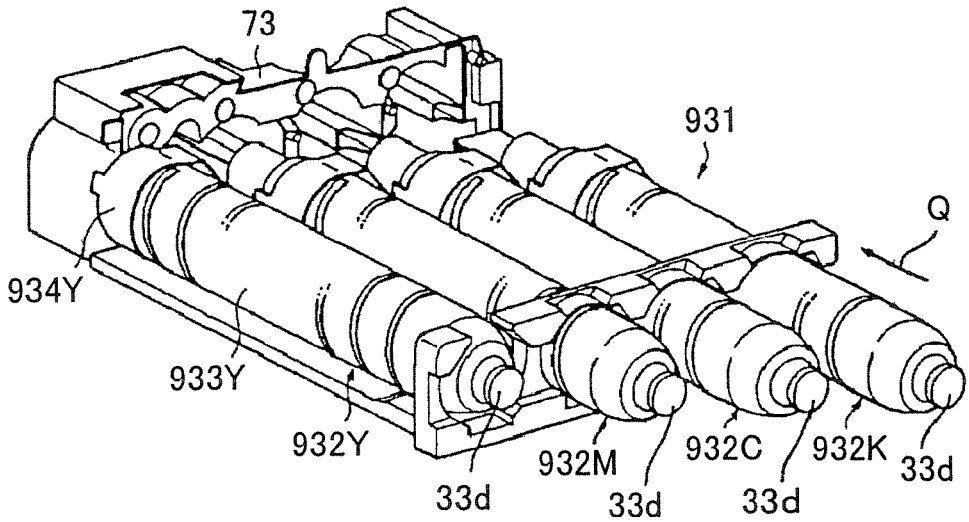
FIG. 36 is a perspective view of the toner-container holder when toner containers are set therein.

A toner supply device 59 that leads the toner contained in a toner container 932Y to the developing device 5Y is explained in detail below with reference to FIG. 35. For easy understanding, FIG. 35 depicts changed arrangement of the toner container 932Y, toner supply paths 43Y, 60, 70, and 71, and the developing device 5Y. Actually, in FIG. 35, the longitudinal direction of the toner container 932Y and part of the toner supply path is arranged in the vertical direction on the paper (see FIG. 1). Referring to FIG. 36, the toner in the toner container 932Y and toner containers 932M, 932C, and 932K which are arranged in a toner-container holder 931 of the apparatus body 100 is supplied to each of the developing devices if necessary through the toner supply paths provided for each toner color, according to each toner consumption in the developing devices for the colors. The four toner supply paths have almost the same configuration as one other except a different toner color used for each imaging process.

More specifically, the toner container 932Y is set in the toner-container holder 931 of the apparatus body 100 (see FIG. 37), and the nozzle 70 of the toner-container holder 931 is connected to a held portion 934Y of the toner container 932Y. At this time, the plug member 34*d* (open/close member) of the toner container 932Y is sandwiched between the nozzle 70 and the claw member 76, and opens the toner outlet of the held portion 934Y in this state. Furthermore, a container body 933Y of the toner container 932Y is rotatably supported by a support member 78 of the toner-container holder at a position on the rear side in the attachment direction. Then, the toner contained in the container body 933Y is discharged from the toner outlet through rotation of the container body 933Y of the toner container 932Y, and the toner discharged from the toner outlet is conveyed into the nozzle 70.

On the other hand, the other end of the nozzle 70 is connected to one end of the tube 71 as a conveyor tube. The tube 71 is made of a flexible material excellent in toner resistance, and the other end thereof is connected to the screw pump 60 (Mohno pump) of the toner supply device. The tube 71 being the conveyor tube is formed so that its internal diameter is 4 to 10 mm. The material of the tube 71 is allowed to use a rubber material such as polyurethane, nitrile, EPDM, and silicone, and a resin material such as polyethylene, and nylon. Such a flexible tube 71 is used to enhance flexibility of layout for the toner supply path, thus, downsizing the image forming apparatus.

The screw pump 60 is a suction-type uniaxial eccentric screw pump, and includes a rotor 61, a stator 62, a suction port 63, a universal joint 64, and a motor 66. The rotor 61, the stator 62, and the universal joint 64 are accommodated in a case (not shown). The stator 62 is a female screw member made of an elastic material such as rubber, and a spiral-shaped groove with double pitch is formed inside the stator 62. The rotor 61 is a male screw member in which an axis made of a rigid material such as metal is spirally formed, and is rotatably inserted in the stator 62. One end of the rotor 61 is rotatably joined to the motor 66 through the universal joint 64. In the ninth embodiment, the spiral direction (turning direction) and the rotational direction of the rotor 61 are set so as to match the spiral direction (turning direction) and the rotational direction of the projection 33*b* formed in the container body 933Y of the toner container 932Y.

The screw pump 60 configured in the above manner generates suction force at the suction port 63 (air in the tube 71 is sent out to generate a negative pressure in the tube 71) by rotating the rotor 61 of the stator 62 by the motor 66 in a predetermined direction (counterclockwise when viewed from the upstream side in the toner conveying direction). This allows the toner in the toner container 932Y with the air to be sucked to the suction port 63 through the tube 71. The toner sucked to the suction port 63 is sent into a gap between the stator 62 and the rotor 61, and is fed to the other end side of the screw pump 60 along the rotation of the rotor 61. The toner fed is discharged from a feed port 67 of the screw pump 60, to be supplied to the developing device 5Y through the toner conveying pipe 43Y (movement in the arrow direction indicated by a dotted line in FIG. 35).

In this manner, the suction force due to the screw pump 60 is used in the ninth embodiment, and the bore of the nozzle 70 (or the plug member 34*d*) can thereby be formed comparatively small, and the toner discharged from the toner outlet B of the toner container 932Y can be sufficiently transferred to the outside without being scattered. In the ninth embodiment, the rotor 61 of the screw pump 60 is made to rotate in the counterclockwise when viewed from the upstream side in the toner conveying direction. The spiral direction (turning direction) of the rotor 61 is set to be a rightward direction. This setting and the rotation of the rotor 61 cause a spiral air flow spiraling in clockwise to be created in the screw pump 60.

Figure 37:
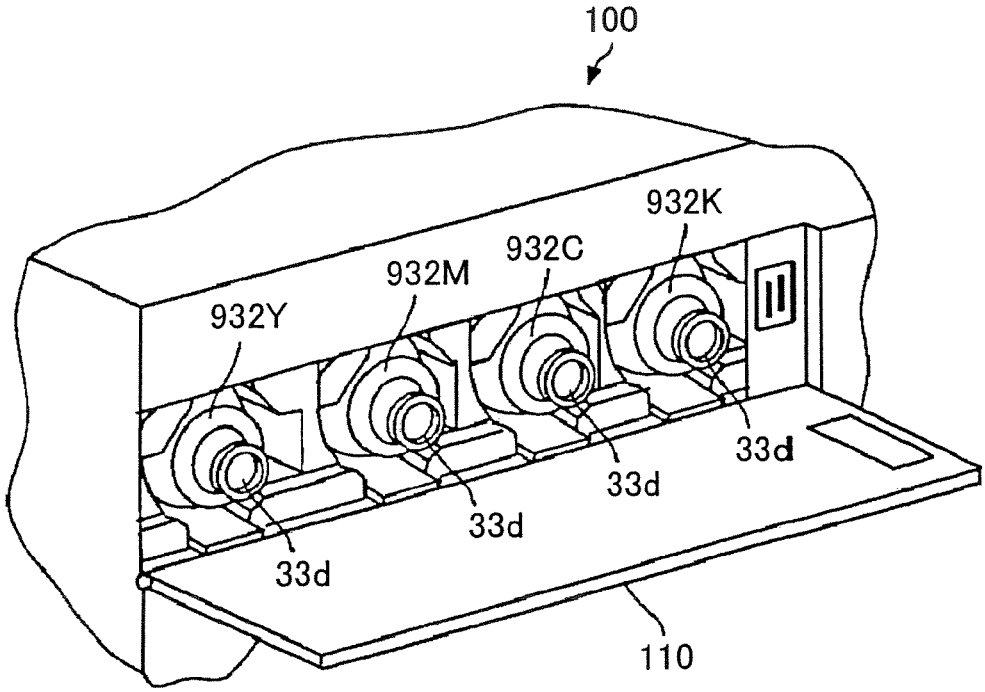
FIG. 37 is a perspective view of how the toner containers are set in the apparatus body.

As shown in FIG. 37, there are no drive mechanism for rotating the container body and a slip-off preventing mechanism for the toner container in the attachment/detachment direction, near the grippers 33*d* of the toner containers 932Y, 932M, 932C, and 932K set in the apparatus body 100 (or the toner-container holder 931) with its main-body cover 110 opened. Therefore, a space (space for the user's hand) required for the attachment/detachment operation can be sufficiently ensured near the grippers 33*d* of the toner containers 932Y, 932M, 932C, and 932K set in the apparatus body 100. Furthermore, the appearance near the grippers 33*d* of the toner containers 932Y, 932M, 932C, and 932K set in the apparatus body 100 can be made better. In other words, it is possible to provide an image forming apparatus with excellent operability and design. Such a configuration as above is achieved by arranging the drive mechanism for rotating the container body and the slip-off preventing mechanism (arm pair 80 explained later) for the toner container in the attachment/detachment direction, in the rear side of the apparatus body 100.

The toner container is explained below with reference to FIG. 38 to FIG. 41. As explained above, the four substantially cylindrical toner containers 932Y, 932M, 932C, and 932K (toner bottles) are detachably provided in the toner-container holder 931. The toner containers 932Y, 932M, 932C, and 932K are replaced with new ones when they come to the end of their lives (when almost all of toner contained is consumed and the container becomes empty). The toner of each color contained in the toner containers 932Y, 932M, 932C, and 932K is supplied as necessary to each developing device of the imaging units through each toner supply path explained with reference to FIG. 35.

Figure 38:
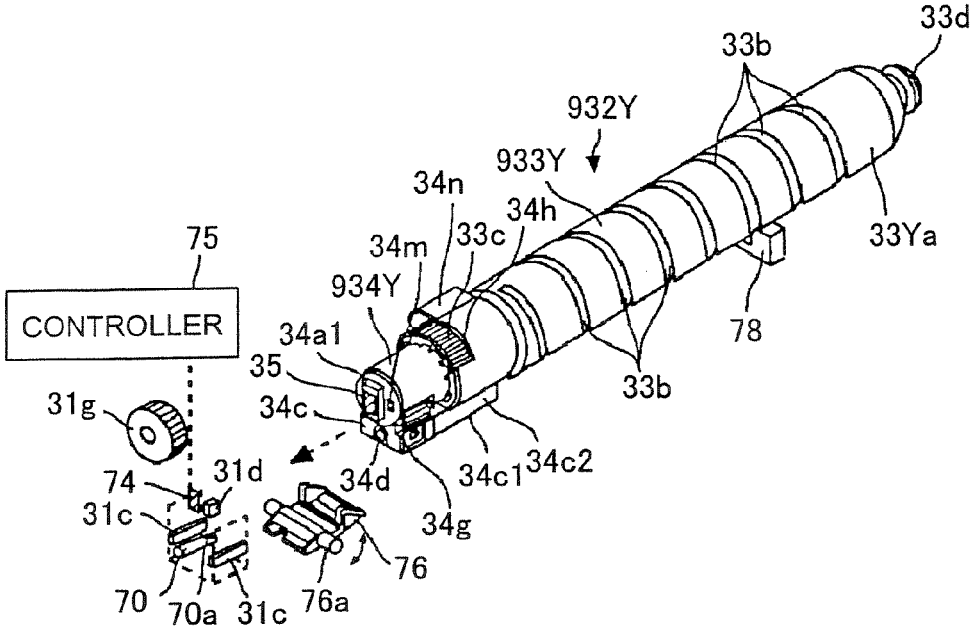
FIG. 38 is a perspective view of a toner container to be set in the toner-container holder.
Figure 39:
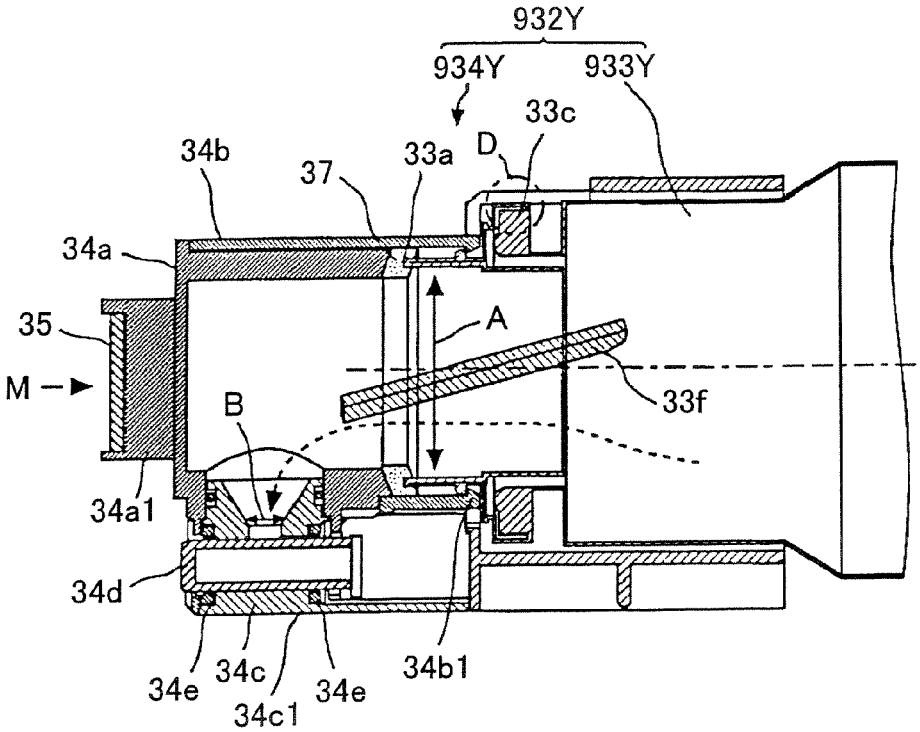
FIG. 39 is a cross-section of the head side of the toner container of FIG. 38.
Figure 40:
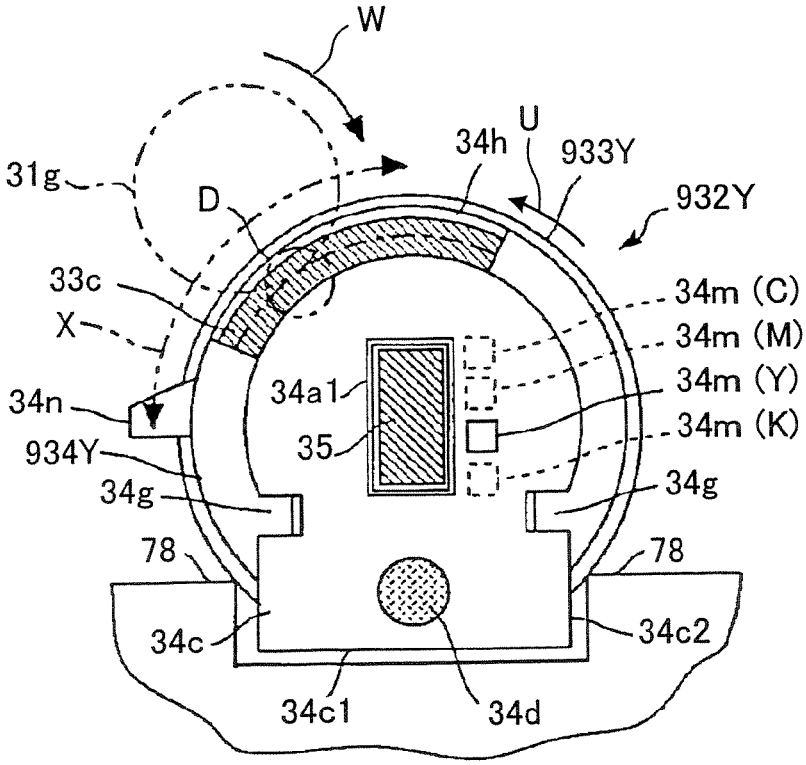
FIG. 40 is a front view of the toner container of FIG. 39 when viewed from the direction M.
Figure 41:
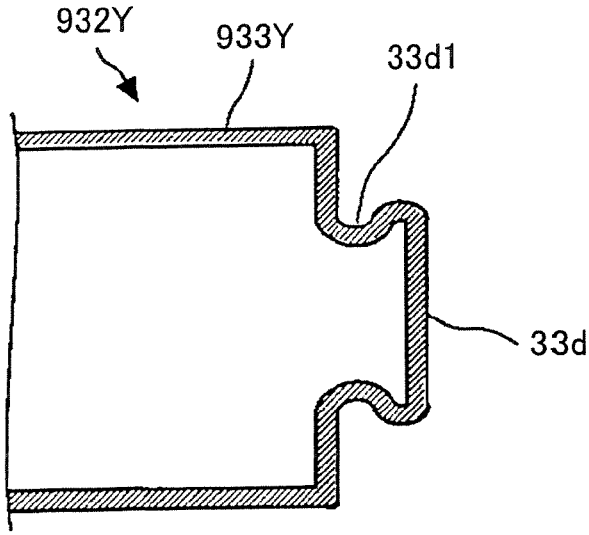
FIG. 41 is a cross-section of the rear side of the toner container.

FIG. 38 is a perspective view of the toner container 932Y. FIG. 39 is a cross-section of the head side (the side where the held portion 934Y is provided) of the toner container 932Y. FIG. 40 is a schematic of the toner container 932Y of FIG. 39 when viewed from the M direction. FIG. 41 is a cross-section of the rear side of the toner container 932Y. The other three toner containers 932M, 932C, and 932K have almost the same configuration as the toner container 932Y containing yellow toner, except different toner colors contained and locations of the concave portion 34*m* and the convex portion 34*n*. Hereinafter, explanation of the other three toner containers 932M, 932C, and 932K is omitted, and only the toner container 932Y containing yellow toner is explained below.

As shown in FIG. 38, the toner container 932Y mainly includes the container body 933Y and the held portion 934Y (bottle cap) provided in the head thereof. The head of the container body 933Y includes the gear 33*c* integrally rotating with the container body 933Y, and the opening A (see FIG. 39). The opening A is provided in the head of the container body 933Y (front end position when it is attached), and is used to discharge the toner contained in the container body 933Y into the space (cavity) of the held portion 934Y. The toner is conveyed (through rotation of the container body 933Y) from the container body 933Y into the space of the held portion 934Y as necessary so that the toner in the held portion 934Y does not lower below a predetermined load line.

The gear 33*c* is engaged with the drive gear 31*g* of the drive unit provided in the toner-container holder 931 of the apparatus body 100, to rotate the container body 933Y around its rotating axis (indicated by a chain line of FIG. 39). More specifically, the gear 33*c* is exposed from the notched portion 34*h* formed in the held portion 934Y and engaged with the drive gear 31*g* of the apparatus body 100 in the engagement position D shown in FIG. 39 and FIG. 40. The driving force is transmitted from the drive gear 31*g* to the gear 33*c*, and the container body 933Y is thereby made to rotate in the direction indicated by U of FIG. 40. In the ninth embodiment, the drive gear 31*g* and the gear 33*c* are spur gears.

In the ninth embodiment, the toner container 932Y and the apparatus body 100 are configured so that the held portion 934Y (or the container body 933Y) is biased downwardly by the force applied from the drive gear 31*g* to the gear 33*c* when the drive gear 31*g* rotates in the arrow direction of FIG. 40 (mainly during toner supply). More specifically, referring to FIG. 40, the engagement position D between the gear 33*c* and the drive gear 31*g* is provided in the range X from the uppermost portion of the gear 33*c* to the downstream side thereof turning ¼ rotation (which does not include the uppermost portion and the position of the gear 33*c* turning ¼ rotation). Based on the configuration above, component force acting downward in the vertical direction is produced in force such that the drive gear 31*g* vertically acts on the gear surface of the gear 33*c*. Therefore, seal capability for the nozzle 70 communicating with the toner outlet B is maintained without large vertical fluctuation of the held portion 934Y, thus preventing toner scattering from near the toner outlet B.

Referring to FIG. 38 and FIG. 41, the gripper 33*d* is provided in the rear end face (bottom in the rear side in the attachment direction) of the container body 933Y so that the user can grip it for attachment/detachment operation of the toner container 932Y. As shown in FIG. 41, a constricted portion 33*d*1 (hook portion) formed in the gripper 33*d* so that its outer diameter is getting smaller from the end face side over the side of the container body. The constricted part of the constricted portion 33*d*1 is formed so that fingers of an average person fit in the constricted part. With this formation, the user performs the attachment/detachment operation of the toner container 932Y while gripping the gripper without any uncomfortable feeling. Furthermore, the gripper 33*d* is provided so as to be on the front side (rear side in the attachment direction) of the main body of the image forming apparatus 100 where the user operates, and the operability/workability for the user is thereby improved.

The gripper 33*d* is formed so as to be point symmetry with respect to the center of the rear end face of the container body 933Y (which is the center of rotation and the position of almost gravity center) when viewed from the attachment/detachment direction. More specifically, the gripper 33*d* is formed into a substantial circle when viewed from the attachment/detachment direction. This form allows the posture of the gripper 33*d* with respect to the user, who performs the attachment/detachment operation, to be always fixed irrespective of any posture (rotation angle) of the container body 933Y in the rotational direction. In the ninth embodiment, the shape of the gripper 33*d* is the substantial circle when viewed from the attachment/detachment direction, but the shape of the gripper 33*d* may also be a gear shape or a petal shape when viewed from the attachment/detachment direction.

Moreover, the gripper 33*d* is formed so that its project plane orthogonal to the attachment/detachment direction does not exceed the project plane of the container body 933Y orthogonal to the attachment/detachment direction. This form allows smooth attachment/detachment operation of the toner container 932Y to the toner-container holder 931 without the gripper 33*d* being an obstacle (the gripper 33*d* is not caught by the toner-container holder 931). Furthermore, an attachment port provided in the toner-container holder 931 can be set to a minimum necessary size according to the size of the container body 933Y and the held portion 934Y.

The gripper 33*d* is formed on the rear end face of the container body 933Y and on the central axis of rotation of the container body 933Y (position being an almost center of gravity). The container body 933Y is thereby smoothly rotated. In other words, if the gripper 33*d* is disposed in a position displaced from the central axis of rotation, the rotational inertia force due to the gripper 33*d* unevenly acts on the container body 933Y.

The spiral-shaped projection 33*b* is provided in the inner circumferential surface of the container body 933Y (spiral-shaped groove when viewed from the outer circumferential side) The spiral-shaped projection 33*b* is used to discharge the toner from the opening A by rotating the container body 933Y in a predetermined direction. The container body 933Y configured in this manner together with the gripper 33*d* can be manufactured by blow molding after the gear 33*c* provided on its circumferential surface is formed by injection molding.

Figure 49:
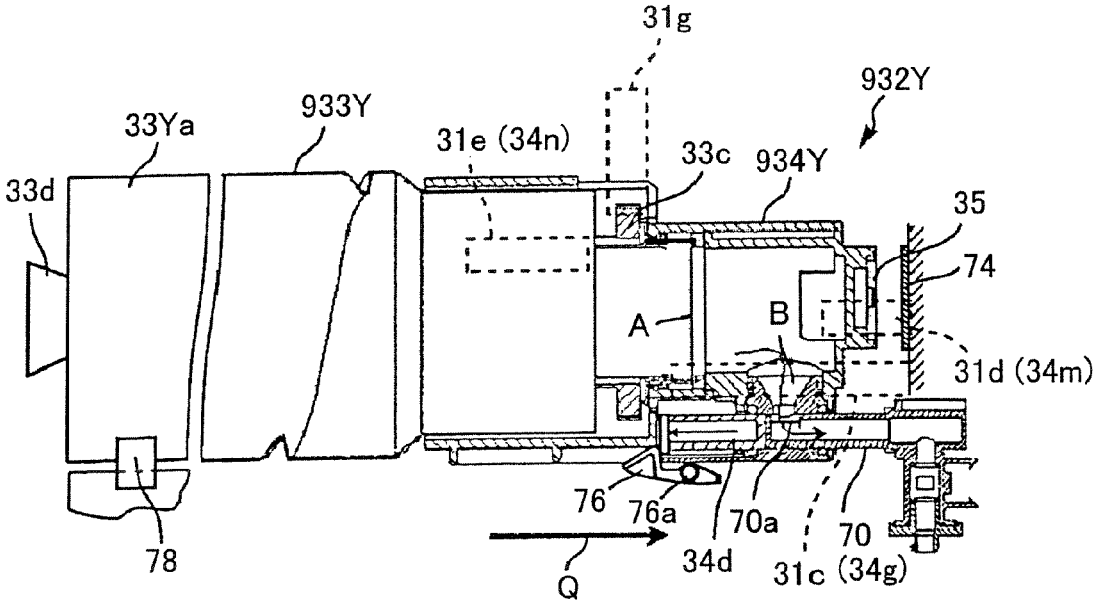
FIG. 49 is a schematic of the toner container attached to the toner-container holder.

The container body 933Y configured in this manner is supported by the support member 78, provided in the toner-container holder 931, at two points which are in an obliquely lower side of a rear position 33Ya of the container body 933Y in the attachment direction while the toner container 932Y is set in the toner-container holder 931 (see FIG. 40 and FIG. 49). The held portion 934Y is held by the holding portion 73 of the toner-container holder 931 in the non-rotating manner and the container body 933Y is rotatably supported by the support member 78 at the two points, the container body 933Y is rotated in this state when the toner is supplied. The container body 933Y is thereby rotated with good balance and low vibration to reduce the load upon the rotation, and the damage or abnormal sound of the drive unit or the toner scattering from the toner container 932Y can reliably be reduced. To cause the container body 933Y to rotate with further good balance and low vibration, a roller can also be used as the support member 78.

Here, the projection 33*b* is not formed in the area 33Ya (where the container body 933Y contacts the support member 78) where the container body 933Y is supported by the support member 78 when the toner container 932Y is set in the toner-container holder 931 (see FIG. 49). In other words, the projection 33*b* is not provided in the rear side of the container body 933Y, so that the outer circumferential surface in the rear side has no irregularity. Consequently, the container body 933Y is smoothly rotated without largely vibrating while being supported by the support member 78.

The toner container 932Y according to the ninth embodiment has the stirring member 33*f* rotating together with the container body 933Y provided in the opening A. The stirring member 33*f* is a rod-shaped member which is extended from the space in the held portion 934Y toward the container body 933Y and is provided at an angle to the rotating axis (indicated by the chain line in FIG. 39). Rotation of the stirring member 33*f* together with the container body 933Y allows improvement of the capability of discharging the toner from the opening A.

In the ninth embodiment, the container body 933Y of the toner container 932Y is made to rotate in the counterclockwise when viewed from the upstream side in the toner conveying direction. Moreover, the spiral direction (turning direction) of the projection 33*b* in the container body 933Y is set to a rightward direction. This setting and the rotation of the container body 933Y cause a spiral air flow spiraling in clockwise to be created in the toner container 932Y (the same direction as the rotational direction of the spiral air flow created in the screw pump 60).

Referring to FIG. 38 and FIG. 39, the held portion 934Y includes the cap 34*a*, the cap cover 34*b*, the holder 34*c*, the plug member 34*d* as the open/close member, the packing 34*e*, and the ID chip 35. Referring to FIG. 38 and FIG. 40, the engaging portion 34*g* (groove portion) in which the positioning member 31*c* of the toner-container holder 931 is engaged is provided on both sides of the held portion 934Y. The concave portion 34*m* in which the fitting member 31*d* of the toner-container holder 931 is fitted is provided on the end face of the held portion 934Y. The convex portion 34*n* fitting in another fitting member (not shown) of the toner-container holder 931 is provided on the circumferential surface of the held portion 934Y. Further, the notched portion 34*h* from which a part of the gear 33*c* is exposed is provided on the upper side of the held portion 934Y.

The held portion 934Y communicates with the container body 933Y through the opening A, and discharges the toner discharged from the opening A, from the toner outlet B (movement along the arrow direction indicated by the dotted line of FIG. 39). In the ninth embodiment, the cavity (space) formed inside the held portion 934Y is almost cylindrical. The toner discharge path (vertical path) from the almost cylindrical cavity formed inside the held portion 934Y up to the toner outlet B is formed into a mortar shape. With this shape, the toner discharged to the held portion 934Y through the rotation of the container body 933Y is efficiently delivered toward the toner outlet B. Therefore, toner conveyance capability of the toner which is discharged from the toner outlet B and moves along the inside of the tube 71 is improved.

The held portion 934Y does not follow the rotation of the container body 933Y, but is held in the non-rotating manner by the holding portion 73 (see FIG. 36 and FIG. 42) of the toner-container holder 931 while the engaging portions 34*g* are engaged with the positioning members 31*c*. The cap cover 34*b* of the held portion 934Y is bonded to the circumferential surface of the cap 34*a*. The claw 34*b*1 is provided in the front end of the cap cover 34*b*, and this claw 34*b*1 is engaged with the engaging member formed in the head of the container body 933Y, and the container body 933Y is thereby held relatively rotatably with respect to the held portion 934Y. To smoothly rotate the container body 933Y, the claw 34*b*1 of the held portion 934Y and the engaging member of the container body 933Y are engaged with each other by maintaining appropriate clearance therebetween.

The seal 37 is adhered to the area of the held portion 934Y that faces the front end 33*a* around the opening A of the container body 933Y. The seal 37 is used for sealing the gap which is around the opening A and is between the areas of the container body 933Y and the held portion 934Y that mutually face each other, and is made of an elastic material such as polyurethane foam.

The holder 34*c* is provided in the lower side of the held portion 934Y. Provided in the holder 34*c* is the plug member 34*d* (shutter) as the open/close member for opening/closing the toner outlet B in synchronization with the attachment/detachment operation of the toner container 932Y. More specifically, the plug member 34*d* is movably provided in the holder 34*c* in the horizontal direction of FIG. 38 so as to be surrounded by the sliding portions 34*c*1 and 34*c*2. A space (concave portion) is provided in the bottom face of the holder 34*c* so that the claw member 76 of the apparatus body 100 is engaged with the plug member 34*d* and the plug member 34*d* relatively moves in the space.

The packing 34*e* such as G seal is provided on the both sides of the plug member 34*d* to prevent toner leakage from near the plug member 34*d*. The lip portion of the packing 34*e* is in slidably contact with the outer circumferential surface of the plug member 34*d* and with the outer circumferential surface of the nozzle 70 which is in tight contact with the end face of the plug member 34*d* and relatively moves, and hence, the high sealing capability can be maintained even if the toner outlet B is opened or closed.

Furthermore, packing such as an O-ring is provided in the engaging portion between the holder 34*c* and the cap 34*a*, to prevent toner leakage from both of the gaps. The toner container 932Y is set in the toner-container holder 931, and then the claw member 76 (see FIG. 38 and FIG. 46) is engaged with the right side of the plug member 34*d*, the claw member 76 being the bias member for biasing the plug member 34*d* in the direction in which the toner outlet B is closed. This bias member corresponds to a plate spring 77 in a seventeenth embodiment shown in FIG. 77.

The ID chip 35 of the held portion 934Y is configured to face the communication circuit 74 of the toner-container holder 931 with a predetermined distance therebetween, in synchronization with the attachment operation of the toner container 932Y to the toner-container holder 931. More specifically, the ID chip 35 is provided on the protrusion portion 34*a*1 of the held portion 934Y which is protruded in the direction (the arrow direction of FIG. 38) in which the held portion 934Y is attached to the toner-container holder 931, and which is provided on the plane orthogonal to the attachment direction. The ID chip 35 performs non-contact communication (radio communication) with the communication circuit 74 of the apparatus body while the held portion 934Y is held in the toner-container holder 931.

The ID chip 35 previously stores various types of information related to the toner container 932Y. On the other hand, the communication circuit 74 of the toner-container holder 931 exchanges the information by radio with the ID chip 35 while the toner container 932Y is set in the toner-container holder 931. More specifically, the information stored in the ID chip 35 is transmitted to the controller 75 (see FIG. 38) of the apparatus body 100 through the communication circuit 74, or the information for the apparatus body 100 acquired by the controller 75 is transmitted to the ID chip 35 through the communication circuit 74 and stored therein.

The ID chip 35 stores information regarding toner such as a toner color, a serial number of toner (production lot), and a date of toner production, and information regarding recycling of the toner container 932Y such as number of times of recycling, dates of recycling, and recycling manufacturers. When the toner container 932Y is set in the toner-container holder 931, the information stored in the ID chip 35 is transmitted to the controller 75 of the apparatus body 100 through the communication circuit 74. The apparatus body 100 is optimally controlled based on these pieces of information. For example, if the toner color is different from the toner color that should be set in the toner-container holder, the operation of the toner supply device can be stopped, or imaging conditions can be changed according to the serial number or the recycling manufacturer.

Provided in the holder 34*c* of the held portion 934Y are the sliding portions 34*c*1 and 34*c*2 for sliding along the toner-container holder 931 following the attachment/detachment operation to/from the toner-container holder 931. More specifically, the first sliding portion 34*c*1 is a flat portion formed so as to be parallel with the sliding face 31*a* (upward face; see FIG. 42) of the toner-container holder 931, the flat portion being provided in the bottom of the held portion 934Y with which the attachment/detachment is operated. Furthermore, the second sliding portion 34*c*2 is a flat portion formed so as to be parallel with the sliding face (side face) of the toner-container holder 931, the flat portion being provided in the side portion of the held portion 934Y with which the attachment/detachment is operated.

Referring to FIG. 38 and FIG. 40, the concave portion 34*m* fitted with the fitting member 31*d* of the toner-container holder 931 is provided in the end face of the held portion 934Y and near the protrusion portion 34*a*1. The concave portion 34*m* is formed so as to be fitted with the corresponding fitting member 31*d* when the attachment operation thereof to the toner-container holder 931 is correct (when it is attached to the normal position of the toner-container holder 931).

More specifically, as shown in FIG. 40, positions of the concave portions 34*m* are differently arranged from one another according to each color of toner contained in the toner containers (container bodies). The concave portion 34*m* (C) of the toner container corresponding to cyan and a corresponding fitting member (not shown) of the toner-container holder are arranged in the uppermost side, and the concave portion 34*m* (M) of the toner container corresponding to magenta and a corresponding fitting member (not shown) of the toner-container holder are arranged in the upper side of the middle stage. The concave portion 34*m* (Y) of the toner container corresponding to yellow and the fitting member 31*d* of the toner-container holder are arranged in the lower side of the middle stage, and the concave portion 34*m* (K) of the toner container corresponding to black and a corresponding fitting member (not shown) of the toner-container holder are arranged in the lowermost side. This configuration allows prevention of such a failure that a toner container for an inappropriate color (e.g., toner container for yellow) is set in a toner-container holder for a predetermined color (e.g., cyan toner-container holder) to cause a desired color image not to be formed.

Likewise, referring to FIG. 38 and FIG. 40, the convex portion 34*n* fitted in another fitting member (not shown) is provided on the circumferential surface of the held portion 934Y. Similarly to the concave portion 34*m*, the convex portion 34*n* is configured so as to be fitted in a corresponding fitting member when the toner container is properly attached to the toner-container holder 931. It is configured that positions of the convex portions 34*n* are arranged differently from one other according to each color of toner contained in the toner containers (container bodies) although it is not shown. Such a configuration as above allows prevention of miss-setting of the toner container in the toner-container holder, similarly to the concave portion 34*m*.

In the ninth embodiment, as toner contained in the toner containers 932Y, 932M, 932C, and 932K, toner formed so that the following relations hold is used, where Dv(μm) is volume average particle size and Dn(μm) is number average particle size:

$$3 \leqq Dv \leqq 8 \quad (1)$$

$$1.00 \leqq Dv/Dn \leqq 1.40 \quad (2)$$

Therefore, toner particles are selected according to an image pattern in the developing process and excellent image quality is maintained, and satisfactory developing capability is maintained even if the toner is stirred for a long time in the developing device. Moreover, the toner can be efficiently and reliably conveyed without blocking the toner supply path such as the tube 71. The volume average particle size and the number average particle size of toner can be measured by using a typical device such as the Coulter Counter type particle size distribution measuring device: Coulter Counter-TA-II (manufactured by Coulter Electronics Limited) or Coulter Multisizer II (manufactured by Coulter Electronics Limited).

Furthermore, in the ninth embodiment, as toner contained in the toner containers 932Y, 932M, 932C, and 932K, substantially spherical toner is used, the toner being formed so that the shape factor SF-1 is in a range of 100 to 180 and the shape factor SF-2 is in a range of 100 to 180. This allows suppression of reduction in cleaning performance while high transfer efficiency is maintained. Moreover, the toner can be efficiently and reliably conveyed without blocking the toner supply path such as the tube 71. Herein, the shape factor SF-1 indicates the sphericity of a toner particle, and it is determined by the following equation.

$$SF\text{-}1=(M^2/S)\times(100\pi/4)$$

In the equation, M is the maximum particle size (the largest particle size in uneven particle sizes) in a project plane of the toner particle, and S is a project area of the toner particle. Therefore, the toner particle whose shape factor SF-1 is 100 is perfectly spherical, and the degree of sphericity lowers as it becomes greater than 100.

The shape factor SF-2 indicates the irregularities of a toner particle, and it is determined by the following equation.

$$SF\text{-}2=(N^2/S)\times(100/4\pi)$$

In the equation, N is a circumferential length in the project plane of the toner particle, and S is the project area of the toner particle. Therefore, the toner particle whose shape factor SF-2 is 100 has no irregularities, and the irregularities become larger as it becomes greater than 100. The shape factor SF-1 and the shape factor SF-2 are obtained by photographing a toner particle by a scanning electron microscope "S-800" (manufactured by Hitachi, Ltd.) and analyzing the photograph of the toner particle obtained, by an image analyzer "LUSEX3" (manufactured by Nireco Corp.).

Figure 42:
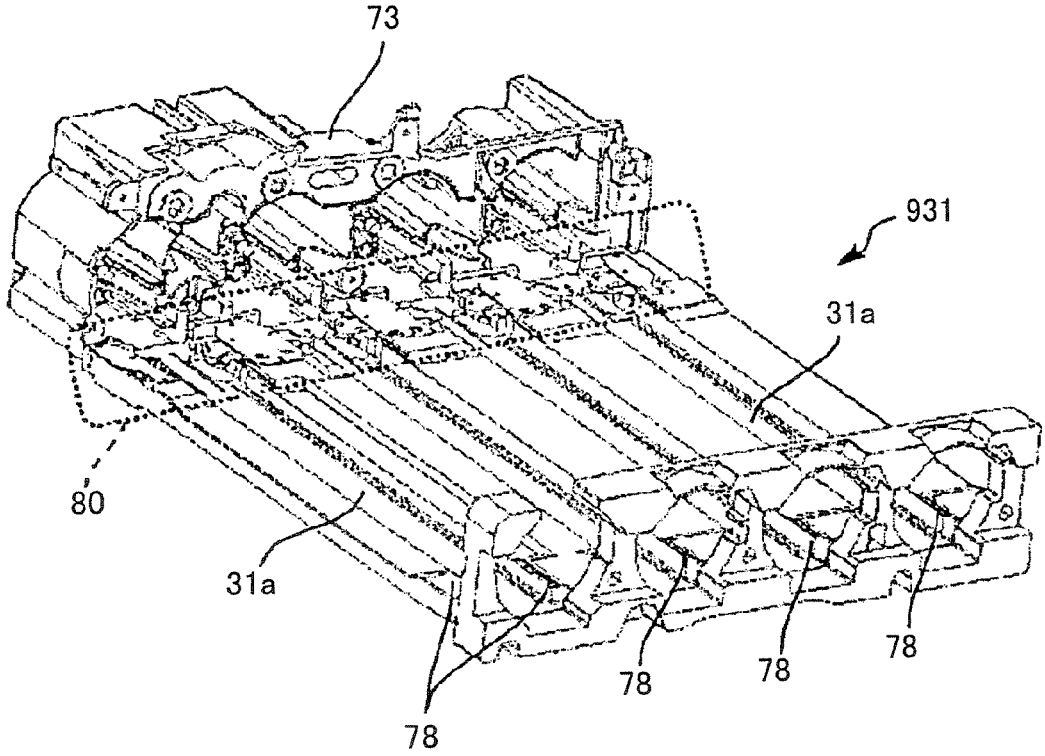
FIG. 42 is a perspective view of the toner-container holder when the toner containers are not set therein.

The configuration of the toner-container holder 931 is explained below with reference to FIG. 42 to FIG. 44. Referring to FIG. 42, the toner-container holder 931 includes the sliding faces 31*a* along which the sliding portions in the respective held portions of the four toner containers 932Y, 932M, 932C, and 932K slide; the holding portion 73 for fixing the positions of the holders 34*c* of the held portions; the support members 78 for supporting each rear side of the container bodies; the nozzles 70; drive units (where each drive gear 31*g* is provided) for transmitting a rotational driving force to each of the container bodies; the communication circuits 74; the arm pairs 80 for biasing each of the held portions toward the holding portion 73 in synchronization with the attachment of each toner container; and the claw members (biasing members) 76 each for biasing the plug member 34*d* in the direction in which each toner outlet B of the toner containers is closed.

The holding portion 73 holds the held portions of the toner containers 932Y, 932M, 932C, and 932K each in the non-rotating manner. The holding portion 73 includes sliding faces contacting each holder 34*c*, and a contact area contacting a part of the cap cover 34*b*. Provided in the sliding faces (side faces) of the holding portion 73 are the positioning members 31*c* for positioning in synchronization with the attachment operation of the held portion 934Y (see FIG. 38). The positioning member 31*c* is a convex portion extended along the attachment/detachment direction of the toner container 932Y.

Provided in the sliding face (bottom) of the holding portion 73 is the claw member 76 for biasing the plug member 34*d* in the direction in which the toner outlet B is closed in synchronization with the detachment operation of the held portion 934Y (see FIG. 38, FIG. 45, FIG. 47, and FIG. 49). The claw member 76 is pivotally held by the toner-container holder 931 around the rotating spindle 76*a* in the direction of the double-pointed arrow of FIG. 38. More specifically, the claw member 76 is biased by a plate spring (not shown) in the direction in which the claw member 76 protrudes from a retracted position, which does not obstruct attachment/detachment of the held portion 934Y, to a position for engaging the plug member 34*d* (biasing in the direction of an arrow R2 of FIG. 47).

Furthermore, the communication circuit 74 and the fitting member 31*d* are provided on the plate of the holding portion 73 in its rear side. The nozzle 70 as shown in FIG. 9 is arranged in the holding portion 73 for each toner color. Provided in the nozzle 70 is the toner supply port 70*a* communicating with the toner outlet B which is formed in the held portion 934Y of the toner container 932Y.

Figure 43:
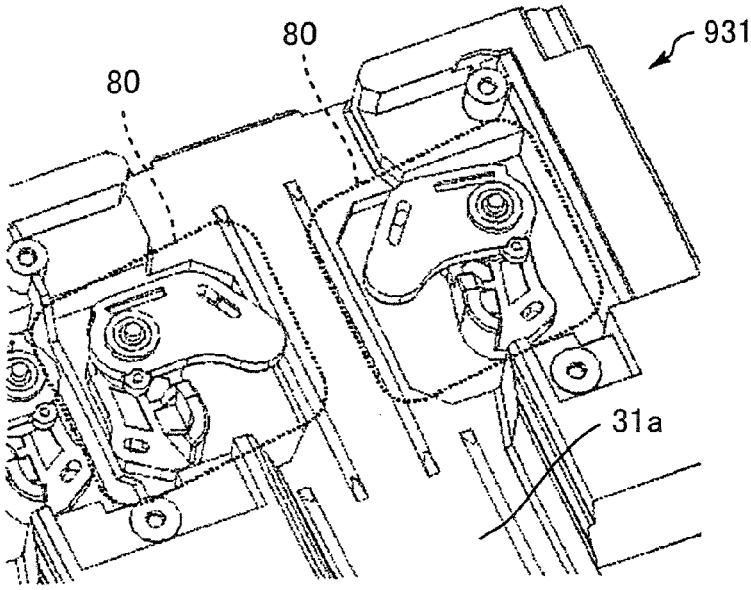
FIG. 43 is a perspective view of arm pairs in the toner-container holder.
Figure 44:
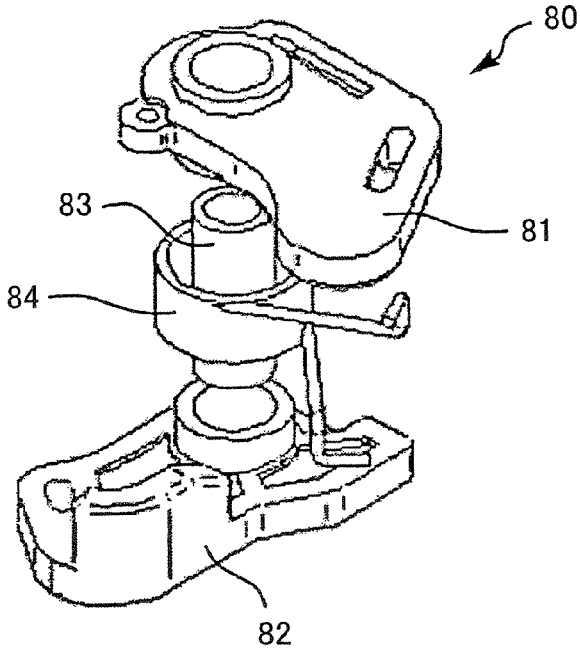
FIG. 44 is an exploded perspective view of the arm pair.

Referring to FIG. 42 and FIG. 43, the arm pairs 80 are provided for each toner color near the holding portion 73 in the toner-container holder 931 (the position right before the held portion of the toner container is inserted into the holding portion). As shown in FIG. 43, the arm pairs 80 are disposed on both sides sandwiching the held portion of the toner container. Referring to FIG. 44, the arm pair 80 includes a first arm 81, a second arm 82, a spindle 83, and a torsion spring 84. The arm pair 80 is integrally provided via the spindle 83, and affects the force on both directions in the direction of rotation around the spindle 83 by the torsion spring 84. More specifically, the first arm 81 and the second arm 82 affect the force on both directions in the direction of rotation around the spindle 83. The force increases more as an angle formed between the first arm 81 and the second arm 82 increases.

The arm pairs 80 configured in the above manner serve as a biasing member for biasing the held portion 934Y (toner container 932Y) toward the holding portion 73 (biasing it toward the direction of the arrow Q of FIG. 36) in synchronization with the attachment operation of the toner container 932Y. The arm pairs 80 also serve as a second biasing member for biasing the held portion 934Y (toner container 932Y) in the direction in which the held portion 934Y is separated from the holding portion 73 (the opposite direction to the arrow Q of FIG. 36) in synchronization with the detachment operation of the toner container 932Y.

The support member 78 is provided near the attachment port for the toner container 932Y in the toner-container holder 931. The toner container 932Y is supported by the support member 78 at two points which are in its obliquely lower side in the rear position 33Ya of the toner container 932Y while the toner container 932Y is set in the toner-container holder 931. And, the held portion 934Y of the toner container 932Y is held by the holding portion 73 in the non-rotating manner, and the container body 933Y is rotated when the toner is supplied while the container body 933Y of the toner container 932Y is rotatably supported by the support member 78 at the two points. The container body 933Y is thereby rotated with good balance and low vibration to reduce the load upon the rotation, and the toner scattering from the toner container 932Y can reliably be reduced.

Figure 45:
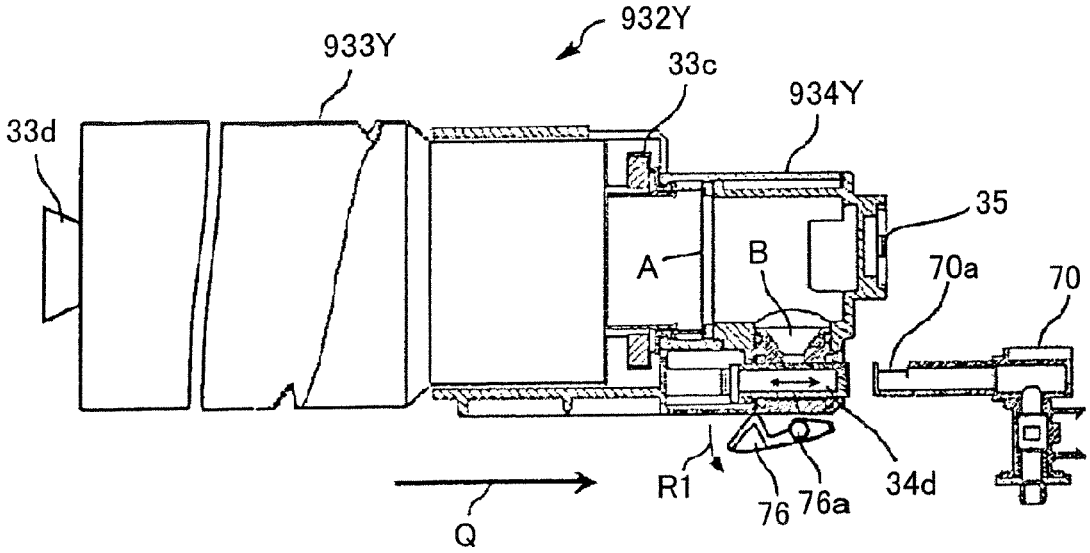
FIG. 45 is a schematic of how the toner container is attached to the toner-container holder.
Figure 46:
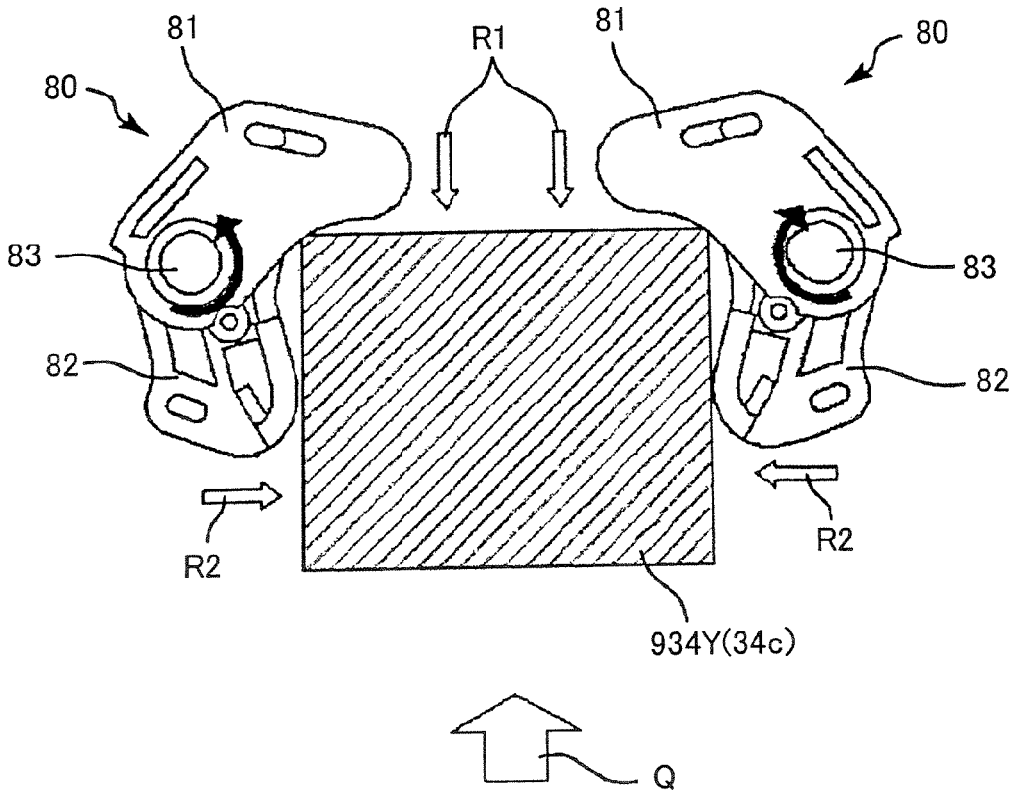
FIG. 46 is a schematic of the state of the arm pairs in FIG. 45.
Figure 47:
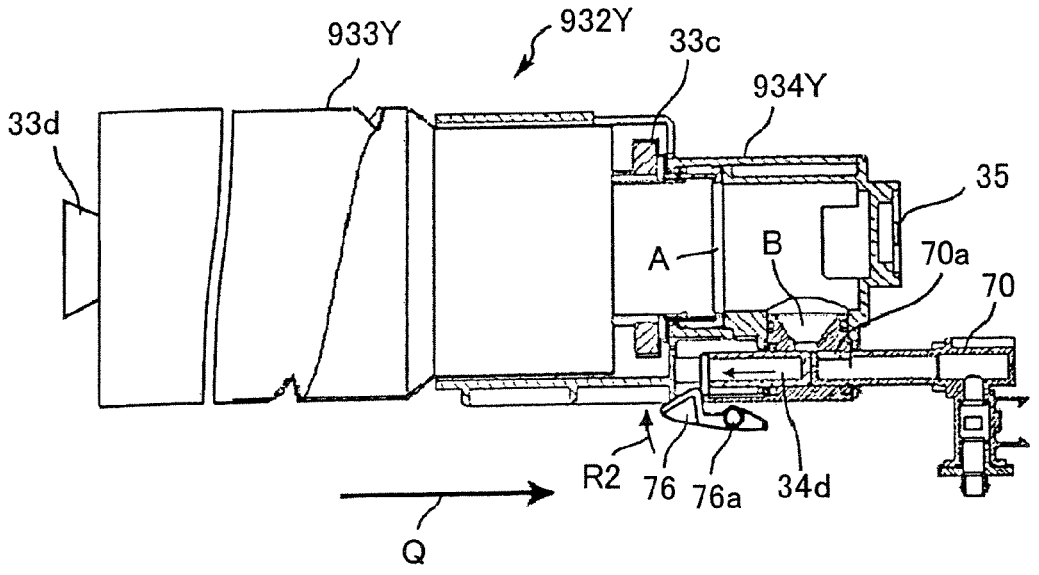
FIG. 47 is a schematic of the attachment of the toner container following the state of FIG. 45.
Figure 48:
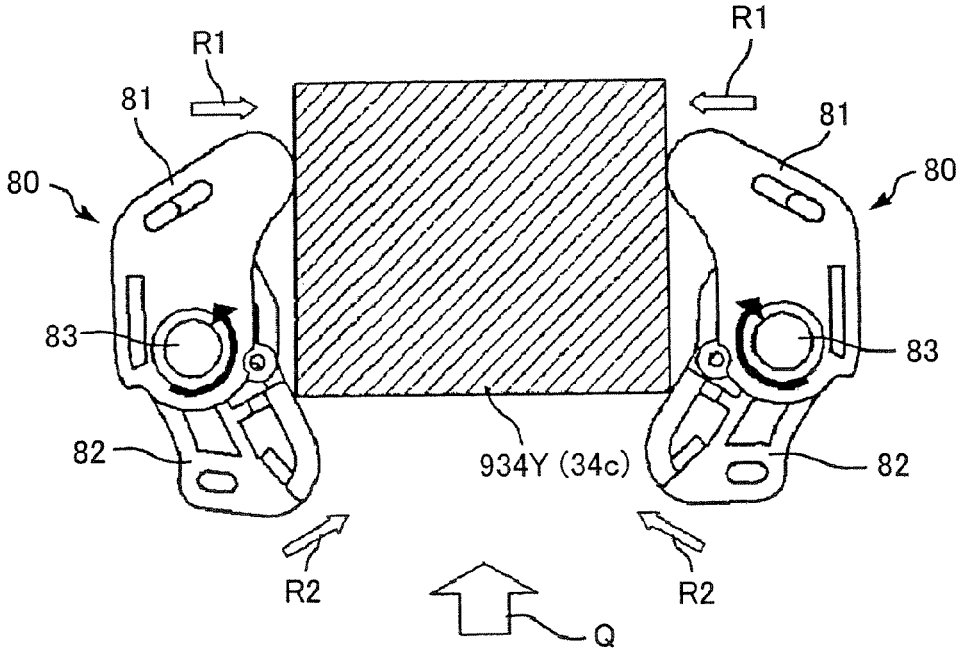
FIG. 48 is a schematic of the state of the arm pairs in FIG. 47.
Figure 50:
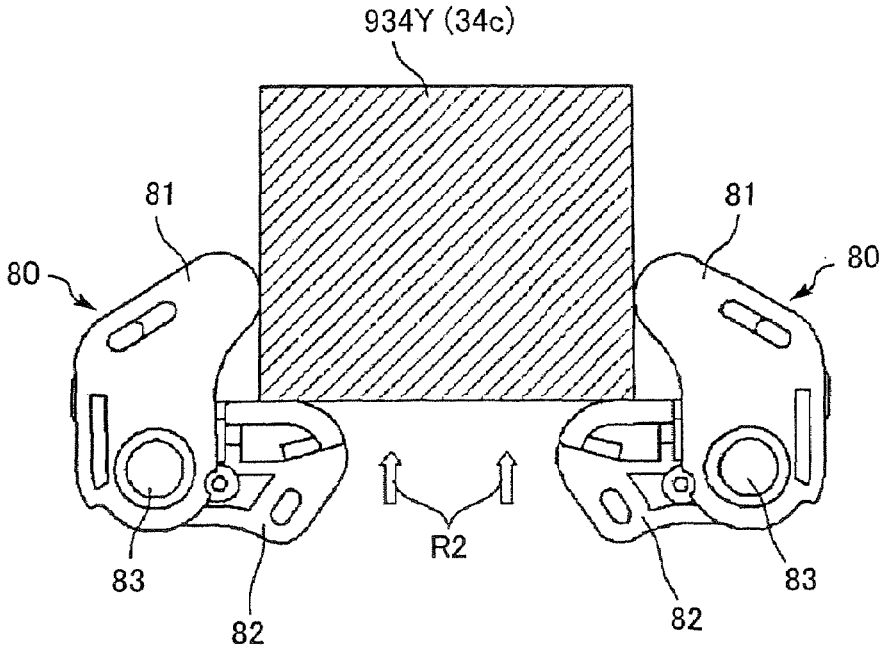
FIG. 50 is a schematic of the state of the arm pairs in FIG. 49.

The attachment/detachment operation of the toner container 932Y to/from the toner-container holder 931 is explained below with reference to FIG. 45 to FIG. 50. FIG. 45 is a schematic of how the toner container 932Y for yellow is attached to the toner-container holder 931 (movement in the direction of the arrow Q) when viewed from the longitudinal direction, and FIG. 46 is a schematic of a positional relationship between the arm pairs 80 and the held portion 934Y (holder 34*c*) in that state when viewed from the upper side. FIG. 47 is a schematic of how the attachment of the toner container 932Y is progressed (the toner outlet B starts to be opened) when viewed from the longitudinal direction, and FIG. 48 is a schematic of a positional relationship between the arm pairs 80 and the held portion 934Y (holder 34*c*) in that state when viewed from the upper side. FIG. 49 is a schematic of the toner container 932Y attached to the toner-container holder 931 (the opening of the toner outlet B is completed) when viewed from the longitudinal direction, and FIG. 50 is a schematic of a positional relationship between the arm pairs 80 and the held portion 934Y (holder 34*c*) in that state when viewed from the upper side.

When the toner container 932Y is attached to the toner-container holder 931 of the apparatus body 100, at first, the main-body cover 110 (see FIG. 37) provided on the front face (the near side on the paper of FIG. 1) of the main body of the image forming apparatus 100 is opened to expose the toner-container holder 931 to the front side. Then, referring to FIG. 45, the toner container 932Y is pushed into the toner-container holder 931 (movement in the direction of the arrow Q) by the user gripping the gripper 33*d*. More specifically, the toner container 932Y is attached to the toner-container holder 931 along the longitudinal direction of the container body 933Y (or the toner container 932Y) so that the held portion 934Y is located as the head of the container body 933Y.

At this time, the sliding portion 34*c*1 slides along the sliding face 31*a* of the toner-container holder 931 at the head side of the toner container 932Y, and while sliding, the toner container 932Y is pushed into the toner-container holder 931 with good balance by the user gripping the gripper 33*d* on the rear side in the attachment direction of the toner container 932Y.

Then, referring to FIG. 46, when the holder 34*c* (held portion 934Y) of the toner container 932Y reaches the position of the arm pairs 80 in the toner-container holder 931, the first arms 81 come in contact with the front end of the holder 34*c* (held portion 934Y) and the second arms 82 come in contact with the side faces of the holder 34*c* (held portion 934Y), and the arm pairs 80 are thereby widened in directions of respective black arrows of FIG. 46. Then, by widening the arm pairs 80 in the directions of the respective black arrows, the first arms 81 affect forces on the holder 34*c* in the direction of an arrow R1 and the second arms 82 affect forces thereon in directions of an arrow R2, by spring forces of the torsion springs 84. In this case, the second arms 82 face each other on both side faces of the holder 34*c*, and the forces from both directions indicated by the arrow R2 are cancelled out. Therefore, only the forces in the direction of the arrow R1 by the first arms 81 act on the held portion 934Y. These forces are a force in the direction in which the toner container 932Y is detached from the holding portion 73.

Here, the held portion 934Y (sliding portions 34*c*1 and 34*c*2) is configured so as not to come in contact with the support member 78 when it is attached/detached to/from the toner-container holder 931. More specifically, referring to FIG. 40, the toner container 932Y is configured so that the project plane of the held portion 934Y, which is orthogonal to the attachment/detachment direction thereof, does not exceed the project plane of the container body 933Y in the attachment/detachment direction thereof, near the support member 78. In other words, the toner container 932Y is configured so that when the toner container 932Y is viewed as a plane orthogonal to the attachment/detachment direction from the side of the held portion 934Y (FIG. 40), the contact portion between the support member 78 and the container body 933Y is visually observed (or so that the outline of the held portion 934Y matches the contact portion). The attachment/detachment operation of the toner container 932Y is thereby smoothly performed without the support member 78 being an obstacle (without the toner container 932Y being caught by the support member 78).

Thereafter, when the holder 34*c* of the toner container 932Y reaches the holding portion 73 of the toner-container holder 931, positioning of the held portion 934Y is started while the second sliding portions 34*c*2 are sliding along the sliding faces (side faces) in addition to the sliding of the first sliding portion 34*c*1 along the sliding face 31*a*. More specifically, the engaging portion 34*g* of the held portion 934Y and the positioning member 31*c* of the toner-container holder 931 start to be engaged with each other. During this time, the arm pairs 80 bias the held portion 934Y of the toner container 932Y toward the holding portion 73 (biasing in the direction of the arrow Q). Furthermore, during this time, the claw member 76 provided in the holding portion 73 of the toner-container holder 931 is retracted to the position that does not obstruct the attachment of the held portion 934Y (which is rotation in the direction of the arrow R1 around the rotating spindle 76*a*). That is, the claw member 76 is pushed down by the sliding portion 34*c*1 in the direction of resisting the biasing force of the plate spring.

Thereafter, when the attachment operation of the toner container 932Y is further progressed, the plug member 34*d* starts to open the toner outlet B while the engaging portions 34*g* and the positioning members 31*c* are engaged with each other (the state as shown in FIG. 47). More specifically, the plug member 34*d* is pushed by the nozzle 70 associated with insertion of the front end of the nozzle 70 into the hole of the holder 34*c*. At this time, the claw member 76 protrudes from the retracted position in FIG. 45 to the position for engaging with the plug member 34*d* (which is rotation around the rotating spindle 76*a* in the direction of an arrow R2). That is, the claw member 76 is released from the pushing by the sliding portion 34*c*1 and is pushed up to its default position by the biasing force of the plate spring (not shown).

The state as shown in FIG. 47 is such that the plug member 34*d* is held by the nozzle 70 and the claw member 76 and its position is fixed in the toner-container holder 931 (holding portion 73). If the toner container 932Y is further moved from the state of FIG. 47 in the attachment direction (direction of the arrow Q), the toner outlet B is opened while the position of the plug member 34*d* is fixed in the holding portion 73 (the plug member 34*d* relatively moves).

At this time, the held portion 934Y of the toner container 932Y is biased by the arm pairs 80, serving as the biasing member, toward the holding portion 73 (biasing in the direction of the arrow Q). More specifically, referring to FIG. 48, the first arms 81 are widened by the front end of the holder 34*c* (held portion 934Y) to come in contact with the side faces of the holder 34*c*. At the same time, the second arms 82 start to come in contact with the rear end of the holder 34*c*. During this operation, the forces by the first arms 81 from both directions indicated by the arrows R1 are cancelled out, and only the forces by the second arms 82 from the directions indicated by the arrows R2 are acted on the held portion 934Y. These forces are a force in the direction in which the toner container 932Y is biased toward the holding portion 73 (direction of the arrow Q). In this manner, in the ninth embodiment, the movement of the held portion 934Y to the holding portion 73 and the opening of the toner outlet B of the toner container 932Y are performed by the biasing forces of the arm pairs 80.

Then, referring to FIG. 49, the position of the held portion 934Y is fixed at the position where the holder 34*c* butts against the holding portion 73 (reference position for butting), and at the same time, the plug member 34*d* fully opens the toner outlet B and the gear 33*c* of the toner container 932Y is engaged with the drive gear 31*g* of the drive unit of the toner-container holder 931. The ID chip 35 as an electronic substrate faces the communication circuit 74 in the position for enabling radio communication. Further, the concave portion 34*m* and the convex portion 34*n* for securing non-compatibility of toner containers are fitted with the fitting members 31*d* and 31*e* of the apparatus body. Furthermore, the area 33Ya of the container body 933Y which does not include the spiral-shaped projection 33*b* is rotatably supported by the support member 78. The toner outlet B of the toner container 932Y communicates with the toner supply port 70*a* of the nozzle 70, and the attachment operation of the toner container 932Y is completed.

At this time, referring to FIG. 50, the first arms 81 are in contact with the side faces of the holder 34*c*, and the second arms 82 are in contact with the rear end of the holder 34*c*. With this situation, only the forces by the second arms 82 in the directions of the arrow R2 act on the held portion 934Y. These forces are a force (positioning force) for holding the held portion 934Y of the toner container 932Y in the holding portion 73.

In this manner, because the arm pairs 80 provided in the rear side of the apparatus body 100 reliably prevent the toner container 932Y from slipping off in the attachment/detachment direction, there is no need to install the mechanism, which prevents slip-off of the toner container 932Y in the attachment/detachment direction, near (the near side to the apparatus body 100) the gripper 33*d* of the toner container 932Y set in the toner-container holder 931. This enables to ensure a sufficient space required for the attachment/detachment operation, near the gripper 33*d* of the toner container 932Y set in the apparatus body 100. Furthermore, the appearance near the gripper 33*d* of the toner container 932Y set in the apparatus body 100 can thereby be improved.

Figure 51:
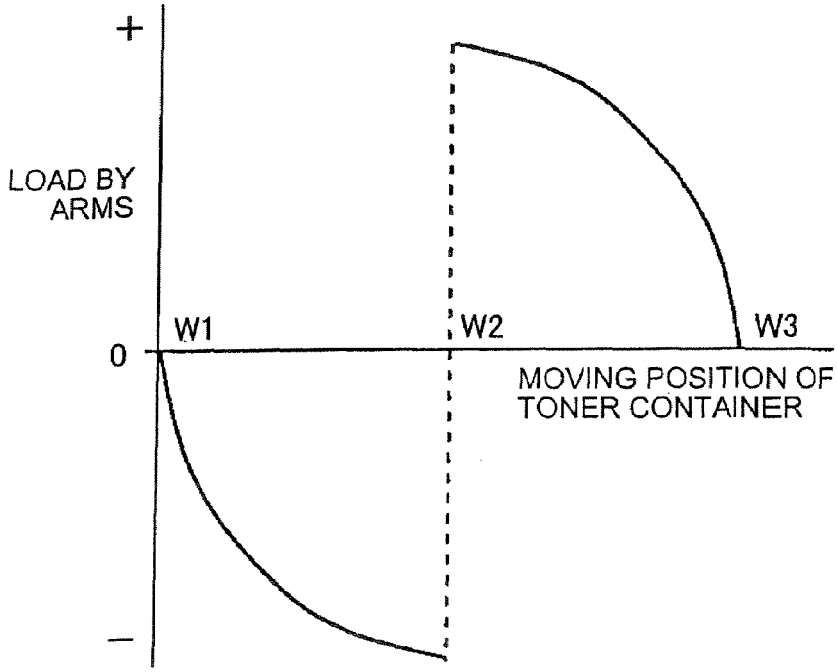
FIG. 51 is a graph indicating a change of a load applied from the arm pairs to a moving position of the toner container upon its attachment.

FIG. 51 is a graph indicating a relation between a moving position of the held portion 934Y (toner container 932Y) and a load applied from the arm pairs 80 to the held portion 934Y during the attachment operation of the toner container. As shown in FIG. 51, when the held portion 934Y moves to the position of W1 (positions in FIG. 45 and FIG. 46), the held portion 934Y undergoes the force in the opposite direction to the attachment direction (direction of the arrow Q). In other words, the force in the direction of separating the toner container 932Y from the holding portion 73 is applied to the toner container 932Y right before being biased by the arm pairs 80 toward the holding portion 73. This causes the user to push the toner container 932Y into the side of the holding portion 73 with the strength overcoming the force. Therefore, the pushing strength by the user is added to the biasing force by the arm pairs 80 applied afterward to the held portion 934Y, and the toner outlet B is thereby burst open.

When the held portion 934Y further moves to the position of W2 in FIG. 51 (positions in FIG. 47 and FIG. 48), the held portion 934Y undergoes the force (biasing force by the arm pairs 80) in the attachment direction (the direction of the arrow Q). At this time, an object to be sealed by the packing 34*e* of the held portion 934Y is switched from the plug member 34*d* to the nozzle 70. The switching speed is accelerated by the arm pairs 80, and this enables reduction of the time for which sealing capability is degraded due to switching between the objects to be sealed. The position of the held portion 934Y is fixed in the position of W3 (position in FIG. 49 and FIG. 50) in FIG. 51.

In this manner, in the ninth embodiment, the speed of opening the toner outlet B of the toner container 932Y is mechanically determined by the arm pairs 80 without being determined based on the user's operation speed (the speed of pushing the toner container). Therefore, the time for which the sealing capability in the held portion 934Y is degraded is not made extremely long, but made short almost constantly at any time, and toner scattered from near the toner outlet B is thereby reduced.

On the other hand, when the toner container 932Y is to be taken out (removed) from the toner-container holder 931 of the apparatus body 100, the operation is performed in the reverse of the attachment. At first, the plug member 34*d* is biased by the claw member 76 while the position of the plug member 34*d* in the holding portion 73 is fixed by the nozzle 70 and the claw member 76, in synchronization with separation of the toner container 932Y from the holding portion 73 (detachment operation) by the user gripping the gripper 33*d*, to close the toner outlet B (movement from the state of FIG. 49 to the state of FIG. 47). At this time, the end face of the plug member 34*d* (the right-hand side end face of FIG. 47) is fitted in the fitting portion formed in the held portion 934Y, and closing of the toner outlet B is completed by the plug member 34*d*. Thereafter, when the toner container 932Y further moves from the state of FIG. 47 in the separating direction (the direction opposite to the arrow Q), the claw member 76 moves to the position where the separation of the held portion 934Y is not obstructed (the state of FIG. 45). After the held portion 934Y is completely separated, the claw member 76 is released from the pushing by the sliding portion 34*c*1, to return to the default position by the biasing force of the plate spring. The detachment operation of the toner container 932Y is thereby smoothly performed without the support member 78 being an obstacle (without the toner container 932Y being caught by the support member 78).

As explained above, in the image forming apparatus according to the ninth embodiment, the attachment operation and the detachment operation of the toner container 932Y are completed by one action (except the open/close operation of the main-body door 110) such that the sliding portion 34*c*1 of the toner container 932Y slides along the sliding face 31*a*, performed while the user grips the gripper 33*d*. The toner container 932Y according to the ninth embodiment includes the held portion 934Y with the toner outlet B provided vertically downward, and the toner outlet B (or the plug member 34*d*) is provided in the lower side lower than the opening A in the vertical direction. And after the plug member 34*d* is surely positioned in synchronization with the attachment operation, the plug member 34*d* is pushed by the nozzle 70, to open the toner outlet B sealed with the packing 34*e*. Therefore, there is less toner stain in the toner outlet B, and such trouble that the user's hands become stained with toner by touching the toner outlet B is prevented.

The attachment/detachment operation of the toner container 932Y to/from the toner-container holder 931 is performed by one action associated with the sliding of the sliding portion 34*c*1, and therefore, the operability/workability upon replacement of the toner container 932Y is improved. Particularly, by providing the sliding portion 34*c*1 in the bottom of the held portion 934Y, the sliding portion 34*c*1 slides along the sliding face 31*a* while supporting the toner container 932Y. Furthermore, the attachment operation of the toner container 932Y is performed by starting to slide the sliding portion 34*c*1 while the user directly grips the gripper 33*d*, starting positioning of the held portion 934Y together with the biasing by the arm pairs 80, starting insertion of the nozzle 70, and finishing the positioning of the held portion 934Y, the insertion of the nozzle 70, and the connection to the drive unit as soon as the sliding is finished. Therefore, the user gains a click feeling when the held portion 934Y is positioned at the same time when the sliding of the held portion 934Y (attachment operation by one action) is progressed, and feels certain that no erroneous operation occurs in the attachment operation.

Furthermore, the toner container 932Y is not set in the toner-container holder 931 (apparatus body 100) from the upper side thereof, but the attachment/detachment is performed from the front face of the toner-container holder 931 (apparatus body 100), thus, enhancing the flexibility of layout for the upper side of the toner-container holder 931. For example, even if a scanner (document reader) is disposed right above the toner supply device, the operability/workability upon attachment/detachment of the toner container 932Y does not deteriorate. Furthermore, the flexibility of the layout for the engagement position D between the gear 33*c* of the toner container 932Y and the drive gear 31*g* of the apparatus body 100 is enhanced. Because the toner container 932Y is set in the apparatus body 100 with its longitudinal direction as the horizontal direction, the toner capacity of the toner container 932Y is increased without any effect on the layout in the height direction of the whole image forming apparatus 100, which allows reduction in the replacement frequency.

As explained above, in the image forming apparatus according to the ninth embodiment, when the toner container 932Y is attached/detached to/from the toner-container holder 931, the plug member 34*d* of the held portion 934Y opens/closes the toner outlet B in synchronization with the attachment/detachment operation along the longitudinal direction of the container body 933Y while the user grips the gripper 33*d* provided in the rear side of the container body 933Y. Therefore, the open/close operation of the toner outlet B is reliably and smoothly performed together with the attachment/detachment operation. Thus, the operability/workability upon replacement of the toner container 932Y is improved, and the occurrence of toner stain is surely reduced.

In the image forming apparatus according to the ninth embodiment, the toner container 932Y is configured in such a manner that the toner container 932Y is attached to the toner-container holder 931 along the longitudinal direction of the container body 933Y so that the held portion 934Y of the toner container 932Y is located as the head of the container body 933Y in the attachment direction and the container body 933Y is supported by the support member 78 of the toner-container holder 931 at the rear side position in the attachment direction. The posture of the whole toner container 932Y is thereby stabled even upon the attachment/detachment operation and upon toner supply, and the operability/workability upon replacement of the toner container 932Y is improved, to surely reduce the occurrence of toner stain.

In the ninth embodiment, the toner-container holder 931 is configured so that the arm pairs 80 (biasing member) bias the toner container 932Y toward the holding portion 73 of the toner-container holder 931 in synchronization with the attachment operation of the toner container 932Y. This allows reliable reduction in occurrence of toner scatter no matter how the user operates for replacement of the toner container 932Y, without reducing the toner amount to be discharged from the toner container 932Y and the operability upon the replacement.

In the ninth embodiment, only the toner is contained in each container body of the toner containers 932Y, 932M, 932C, and 932K, but in the case of the image forming apparatus that supplies two-component developer containing toner and carrier to each developing device, the two-component developer can also be contained in each container body of the toner containers 932Y, 932M, 932C, and 932K. Even in this case, the same effect as that of the ninth embodiment can be obtained.

In the ninth embodiment, the projection 33*b* is integrally formed in the inner circumferential surface of the container body 933Y, and the container body 933Y is made to rotate. On the other hand, a coil or a screw may also be rotatably held inside the container body 933Y, and the container body 933Y is not rotated but the coil or the screw can be rotated by the gear 33*c*. In this case also, the same effect as that of the ninth embodiment can be obtained.

In the ninth embodiment, the suction-type screw pump 60 for sending air to the inside of the tube 71 is provided in the toner supply device. At the same time, a discharge-type screw pump for sending air to the inside of the tube 71 can also be provided in the toner supply device. Furthermore, a diaphragm-type air pump can also be used as a pump connected to the tube 71. Even when these pumps are used, the same effect as that of the ninth embodiment can be obtained.

Figure 52:
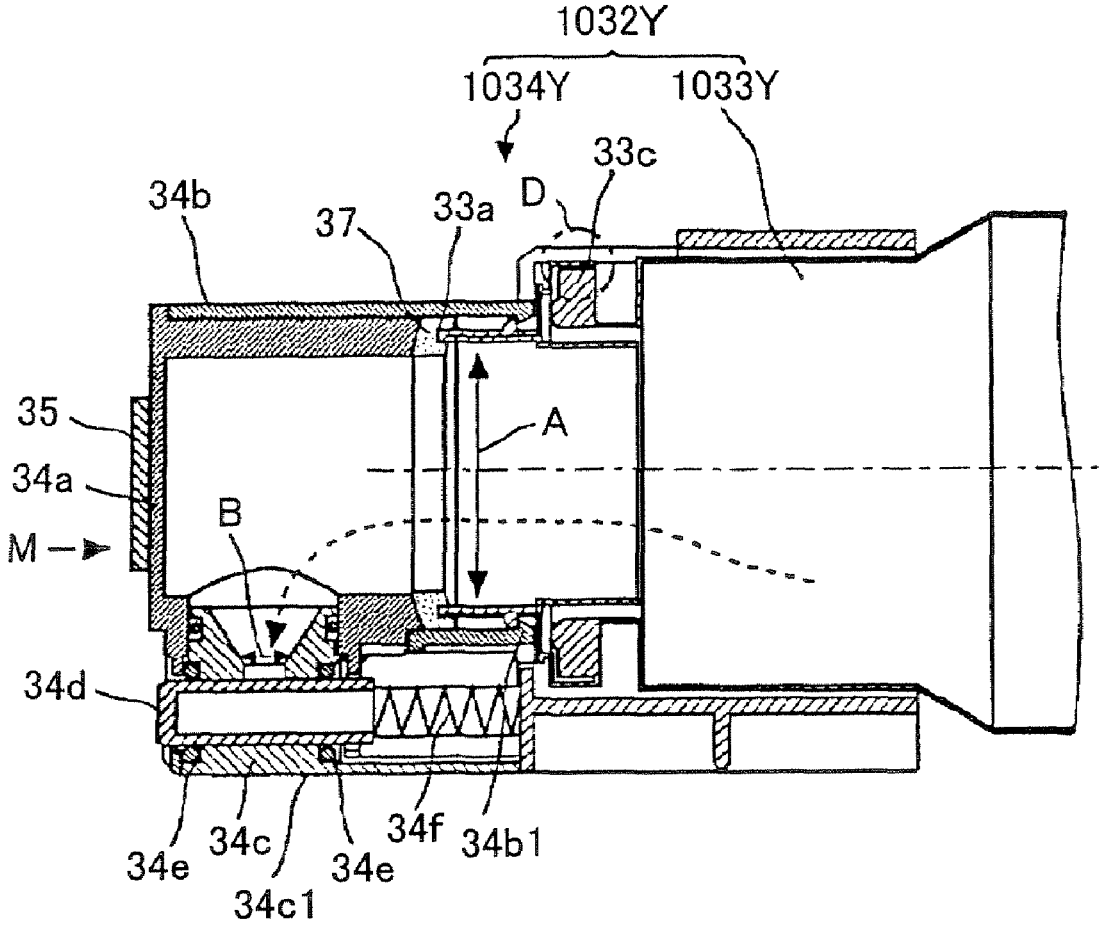
FIG. 52 is a cross-section of the head side of a toner container according to a tenth embodiment of the present invention.

A tenth embodiment of the present invention is explained in detail below with reference to FIG. 52 to FIG. 56A and FIG. 56B. FIG. 52 is a cross-section of the head side of a toner container according to the tenth embodiment, which corresponds to that of FIG. 39 according to the ninth embodiment.

Referring to FIG. 52, a toner container 1032Y according to the tenth embodiment is different from that of the ninth embodiment in a point that the compression spring 34*f* as a biasing member is provided in a held portion 1034Y. More specifically, the compression spring 34*f* (biasing member) for biasing the plug member 34*d* in the direction of closing the toner outlet B is provided on the right-hand side of the plug member 34*d*. The ID chip 35 as an electronic substrate (storage unit) is configured so as to directly contact the communication circuit (terminal) 74 of the apparatus body.

The ID chip 35 of the held portion 1034Y is configured so as to come in contact with or separate from the communication circuit 74 (connection terminal) of the toner-container holder 31 in synchronization with the attachment/detachment operation of the toner container 1032Y to/from the toner-container holder 31. More specifically, the ID chip 35 is provided on a location which is the plane of the held portion 1034Y orthogonal to the attachment/detachment direction (the arrow direction of FIG. 53A and FIG. 53B) with respect to the toner-container holder 31, and which faces the communication circuit 74 upon the attachment/detachment operation.

In this manner, the ID chip 35 comes in contact with the communication circuit 74 provided in the apparatus body 100 in synchronization with the attachment/detachment operation (linear operation) of the toner container 1032Y performed by one action, and this improves contact performance between the ID chip 35 and the communication circuit 74. More specifically, the surface of the ID chip 35 comes in contact linearly with the communication circuit 74 fixed in the apparatus body 100 (toner-container holder 31), and this prevents, before occurring, such a failure that the ID chip 35 comes in contact unevenly with the communication circuit 74 to cause contact failure, or that part of the ID chip 35 and the communication circuit 74 is worn out to give damage to some components.

Figure 53A:
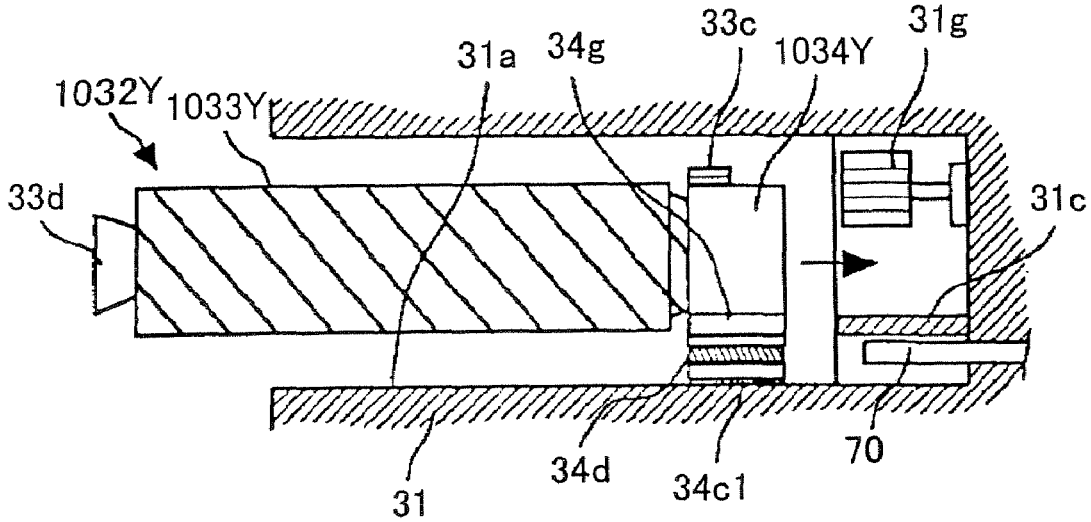
FIG. 53A is a schematic of how the toner container of FIG. 52 is attached to the toner-container holder.
Figure 53B:
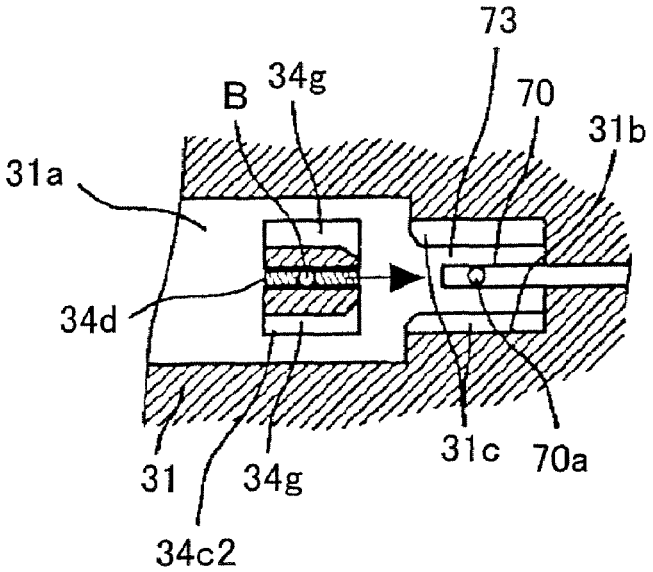
FIG. 53B is a schematic of how the toner container of FIG. 52 is attached to the toner-container holder.
Figure 54A:
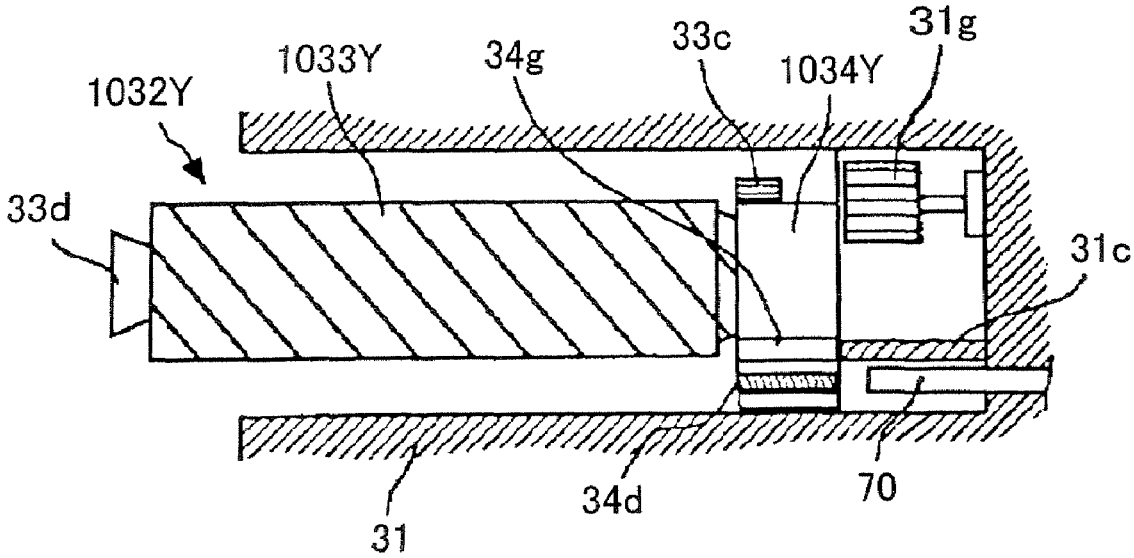
FIG. 54A is a schematic of the attachment of the toner container following the state of FIG. 53A.
Figure 54B:
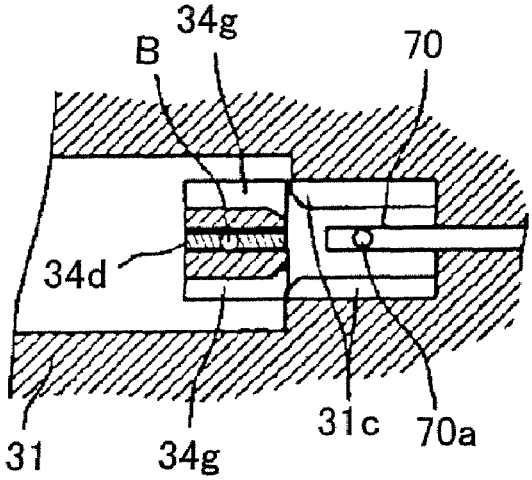
FIG. 54B is a schematic of the attachment of the toner container following the state of FIG. 53B.
Figure 55A:
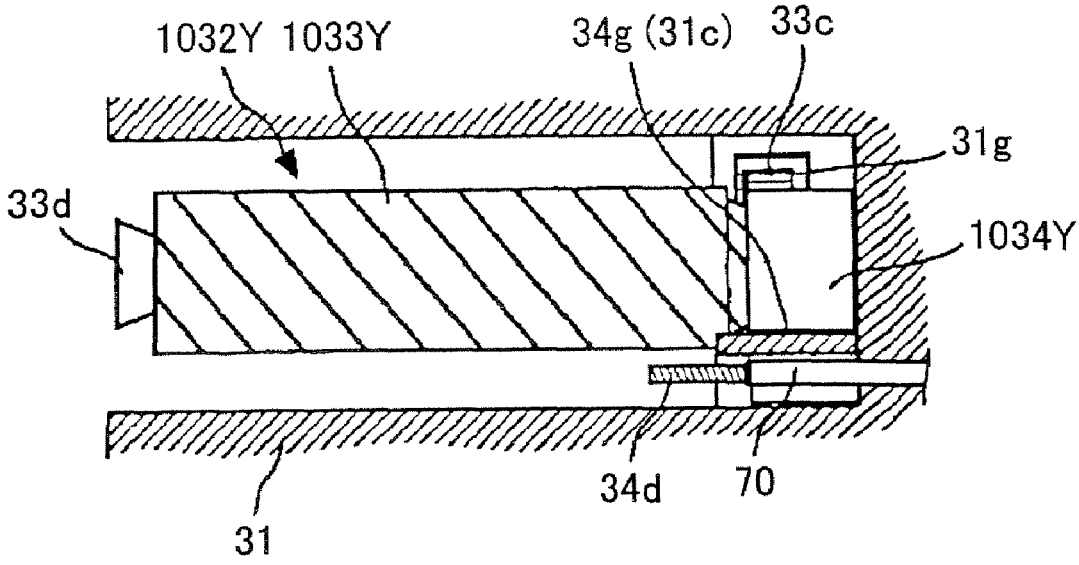
FIG. 55A is a schematic of the toner container attached to the toner-container holder.
Figure 55B:
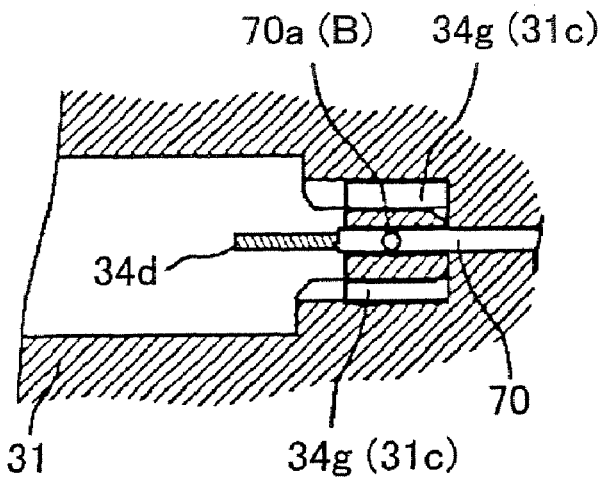
FIG. 55B is a schematic of the toner container attached to the toner-container holder.

The attachment/detachment operation of the toner container 1032Y to/from the toner-container holder 31 is explained below with reference to FIG. 53A and FIG. 53B to FIG. 55A and FIG. 55B. FIG. 53A is a schematic of how the toner container 1032Y for yellow is attached to the toner-container holder 31 (movement in the arrow direction) when viewed from the longitudinal direction, and FIG. 53B is a schematic of a portion around the holder 34*c* of the held portion 1034Y in that state when viewed from the upper side. FIG. 54A is a schematic of how the attachment of the toner container 1032Y is progressed (positioning of the held portion 1034Y is started) when viewed from the longitudinal direction, and FIG. 54B is a schematic of a portion around the holder 34*c* of the held portion 1034Y in that state when viewed from the upper side. FIG. 55A is a schematic of the toner container 1032Y attached to the toner-container holder 31 (attachment is completed), and FIG. 55B is a schematic of the portion of the holder 34*c* in that state when viewed from the upper side.

Provided in the toner-container holder 31 are four toner-container holders corresponding to four toner containers 1032Y, 1032M, 1032C, and 1032K, respectively. Each of the four toner containers includes the sliding faces 31*a* and 31*b* along which the sliding portions 34*c*1 and 34*c*2 of the held portion 1034Y slide; the holding portion 73 for fixing the position of the holder 34*c* of the held portion 1034Y; the nozzle (toner conveying pipe) 70; the drive unit (where the drive gear 31*g* is provided) for transmitting a rotational driving force to a container body 1033Y; and the communication circuit 74. The holding portion 73 includes the sliding faces 31*a* and 31*b* contacting the holder 34*c*, and the contact area (not shown) contacting a part of the cap cover 34*b*. Provided in the sliding face 31*b* (side face) of the holding portion 73 is the positioning member 31*c* for positioning in synchronization with the attachment operation of the held portion 1034Y. The positioning member 31*c* is a convex portion extended along the attachment/detachment direction of the toner container 1032Y.

When the toner container 1032Y is attached to the toner-container holder 31 of the apparatus body 100, at first, the main-body cover 110 (see FIG. 37) provided on the front face (the near side on the paper of FIG. 1) of the main body of the image forming apparatus 100 is opened to expose the toner-container holder 31 to the front side. Then, referring to FIG. 53A and FIG. 53B, the toner container 1032Y is pushed into the toner-container holder 31 (movement in the arrow direction). More specifically, the toner container 1032Y is attached to the toner-container holder 31 along the longitudinal direction of the container body 1033Y (or the toner container 1032Y) so that the held portion 1034Y is located as the head of the container body 1033Y.

At this time, the first sliding portion 34*c*1 slides along the sliding face 31*a* of the toner-container holder 31 at the head side of the toner container 1032Y, and while sliding, the toner container 1032Y is pushed into the toner-container holder 31 with good balance by the user gripping the gripper 33*d* on the rear side of the toner container 1032Y.

Referring to FIG. 54A and FIG. 54B, when the holder 34*c* of the toner container 1032Y reaches the holding portion 73 of the toner-container holder 31, the positioning of the held portion 1034Y is started while the second sliding portions 34*c*2 are sliding along the sliding faces 31*b* in addition to the sliding of the first sliding portion 34*c*1 along the sliding face 31*a*. More specifically, the engaging portion 34*g* of the held portion 1034Y and the positioning member 31*c* of the toner-container holder 31 start to be engaged with each other.

Then, the attachment operation of the toner container 1032Y is further progressed, and the plug member 34*d* starts to open the toner outlet B while the engaging portions 34*g* and the positioning members 31*c* are engaged with each other. In other words, the front end of the nozzle 70 is inserted into the hole of the holder 34*c*, and at the same time, the plug member 34*d* is pushed by the nozzle 70. As shown in FIG. 55A and FIG. 55B, the position of the held portion 1034Y is fixed at the position where the holder 34*c* butts against the holding portion 73 (reference position for butting), and at the same time, the plug member 34*d* fully opens the toner outlet B, and the gear 33*c* of the toner container 1032Y is engaged with the drive gear 31*g* of the drive unit of the toner-container holder 31. Further, the ID chip 35 is connected to the communication circuit 74. In this manner, the toner outlet B of the toner container 1032Y and the toner supply port 70*a* of the nozzle 70 communicate with each other, and the attachment operation of the toner container 1032Y is completed.

In this manner, in the tenth embodiment, the positioning operation of the held portion 1034Y (toner container 1032Y) is started in synchronization with one action (except the open/close operation of the main-body cover 110) such that the sliding portion 34*c*1 of the toner container 1032Y slides along the sliding face 31*a*, and then, the insertion operation of the nozzle 70 is started, and finally, the engagement of the gear 33*c* with the drive gear 31*g* is completed. The nozzle 70 is preferentially inserted into the held portion 1034Y at a location apart from the engagement position D of the gear 33*c*, and this can prevent such a failure that an unexpected external force, produced when the nozzle 70 does not come in contact with the plug member 34*d*, may be applied to the nozzle 70 to deform the nozzle 70. In other words, if the connection of the gear 33*c* is preferentially performed rather than the insertion of the nozzle 70 into the held portion 1034Y, the toner container 1032Y may be displaced caused by inappropriate engagement between the drive gear 31*g* and the gear 33*c*, which may cause the position where the nozzle 70 is inserted to be displaced.

Movement of the nozzle 70 to the inside or to the outside of the holder 34*c* and movement of the plug member 34*d* to the inside or to the outside of the holder 34*c* are performed when both of the members slidably contact the lip of the packing 34*e* of the holder 34*c*. Therefore, such a failure that toner is leaked from the holder 34*c* due to insertion or removal of the nozzle 70 is prevented.

When the toner container 1032Y is to be taken out (removed) from the toner-container holder 31 of the apparatus body 100, the operation is performed in the reverse of the attachment. In other words, the user holds the gripper 33*d* and pulls the toner container 1032Y toward the user's side. In this case, the nozzle 70 also separates from the holder 34*c* in synchronization with the operation such that the toner container 1032Y separates from the holding portion 73, and the plug member 34*d* is moved to the position for closing the toner outlet B by the biasing force of the compression spring 34*f*. In this manner, the detachment operation of the toner container 1032Y is completed by one action (except the open/close operation of the main-body door 110) such that the sliding portion 34*c*1 of the toner container 1032Y slides along the sliding face 31*a*.

The toner container 1032Y according to the tenth embodiment includes the held portion 1034Y with the toner outlet B provided vertically downward, and the toner outlet B is provided in the lower side lower than the opening A in the vertical direction. And after the plug member 34*d* is surely positioned in synchronization with the attachment operation, the plug member 34*d* is pushed by the nozzle 70, to open the toner outlet B sealed with the packing 34*e*. Therefore, there is less toner stain in the toner outlet B, and such trouble that the user's hands become stained with toner by touching the toner outlet B is prevented.

The attachment/detachment operation of the toner container 1032Y to/from the toner-container holder 31 is performed by one action associated with the sliding of the sliding portion 34*c*1, and therefore, the operability/workability upon replacement of the toner container 1032Y is improved. Particularly, by providing the sliding portion 34*c*1 in the bottom of the held portion 1034Y, the sliding portion 34*c*1 slides along the sliding face 31*a* while supporting the toner container 1032Y. Furthermore, the attachment operation of the toner container 1032Y is performed by starting to slide the sliding portion 34*c*1 while the user directly grips the gripper 33*d*, starting positioning of the held portion 1034Y while sliding, starting insertion of the nozzle 70, and finishing the positioning of the held portion 1034Y, the insertion of the nozzle 70, and the connection to the drive unit as soon as the sliding is finished. With these operations, the user gains a click feeling when the held portion 1034Y is positioned at the same time when the sliding of the held portion 1034Y (attachment operation by one action) is progressed, and feels certain that no erroneous operation occurs in the attachment operation.

Furthermore, the toner container 1032Y is not set in the toner-container holder 31 (apparatus body 100) from the upper side thereof, but the attachment/detachment is performed from the front face of the toner-container holder 31 (apparatus body 100), thus, enhancing the flexibility of layout for the upper side of the toner-container holder 31. For example, even if a scanner (document reader) is disposed right above the toner-container holder, the operability/workability upon attachment/detachment of the toner container 1032Y does not deteriorate. The flexibility of the layout for the engagement position D between the gear 33*c* of the toner container 1032Y and the drive gear 31*g* of the apparatus body 100 is also enhanced. Because the toner container 1032Y is set in the apparatus body 100 with its longitudinal direction as the horizontal direction, the toner capacity of the toner container 1032Y is increased without any effect on the layout in the height direction of the whole image forming apparatus 100, which allows reduction in the replacement frequency.

Figure 56A:
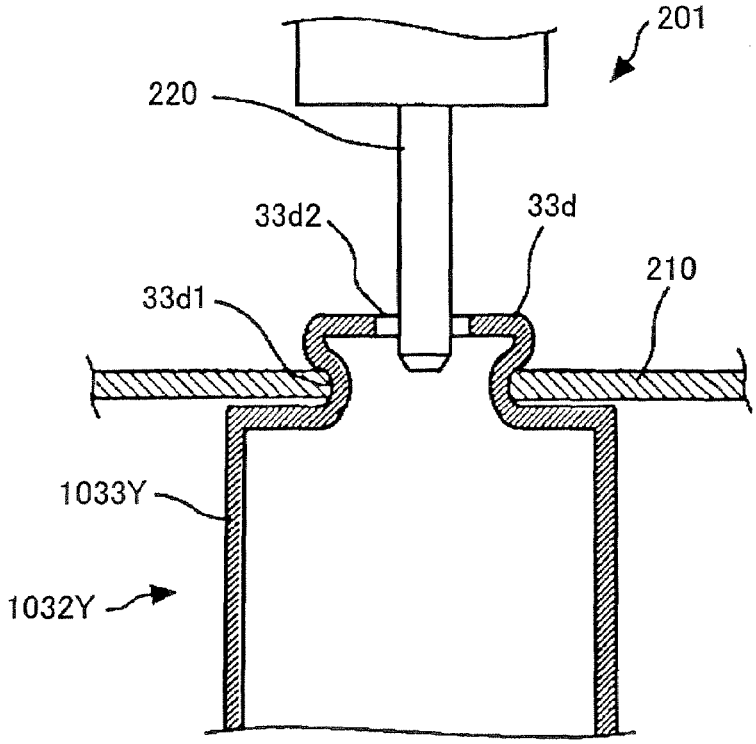
FIG. 56A is a schematic of a manufacturing process when the toner container is recycled.

A manufacturing process when the toner container 1032Y is recycled is explained below with reference to FIG. 56A and FIG. 56B. At first, a hole 33*d*2 (through hole) communicating with the container body 1033Y is formed in the gripper 33*d* of the toner container 1032Y, which has been used, recovered to a recycling plant (machining process). Then, a cleaning nozzle is inserted through the hole 33*d*2 to clean the inside of the container body 1033Y. Thereafter, referring to FIG. 56A, the toner container 1032Y with the hole 33*d*2 formed is set in a filling machine 201. More specifically, the constricted portion 33*d*1 as the hook portion of the gripper 33*d* is fitted on a support portion 210 of the filling machine 201, and the toner container 1032Y is hung thereon so that the gripper 33*d* is positioned upward. Further, a nozzle 220 of the filling machine 201 is inserted into the toner container 1032Y through the hole 33*d*2 thereof, to fill the toner container 1032Y with toner from the filling machine 201 (filling process).

Figure 56B:
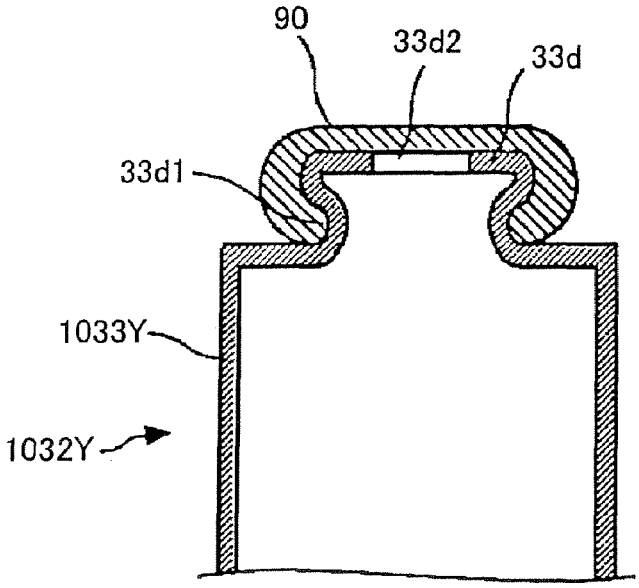
FIG. 56B is a schematic of another manufacturing process when the toner container is recycled.

Referring to FIG. 56B, after the filling with the toner is completed, the hole 33*d*2 is sealed with a cap 90 as a seal member. With this operation, the sealing capability of the toner container 1032Y after being filled with toner can be ensured. In the tenth embodiment, the cap 90 covering the gripper 33*d* is used as the seal member, but a plug inserted into the hole 33*d*2 may also be used as the seal member, or a seal such as polyurethane foam covering the hole 33*d*2 can also be used as the seal member. As explained above, in the tenth embodiment, during manufacture for recycling of the toner container 1032Y, the toner container 1032Y can be filled with toner without disassembling the held portion 1034Y from the container body 1033Y. This can improve the operability upon manufacture for recycling thereof.

As explained above, in the tenth embodiment, similarly to the ninth embodiment, because the gripper 33*d* is provided in the opposite side in the longitudinal direction to the position where the opening A is formed, the attachment/detachment operation of the toner container 1032Y can be smoothly and reliably performed while the user holds the gripper 33*d*, and the manufacturing work of the toner container 1032Y can efficiently be performed by using the gripper 33*d*. Thus, the operability/workability upon replacement of the toner container 1032Y and its manufacture is improved, and the occurrence of toner stain can be surely reduced.

Figure 57:
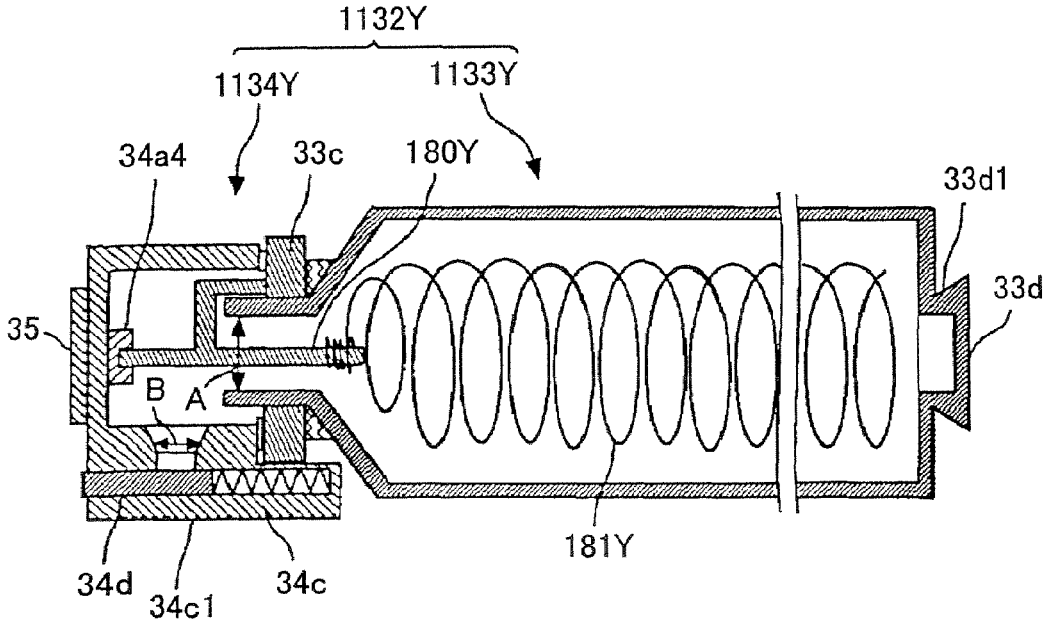
FIG. 57 is a cross-section of a toner container according to an eleventh embodiment of the present invention.

An eleventh embodiment of the present invention is explained in detail below with reference to FIG. 57. FIG. 57 is a cross-section of a toner container according to the eleventh embodiment. The toner container according to the eleventh embodiment has some points that a container body 1133Y together with a held portion 1134Y is held by the toner-container holder 31 in the non-rotating manner, and that the coil 181Y as the conveyor member is provided in the container body, and these points are different from the embodiments in which the container body rotates to convey the toner contained therein to the opening A.

As shown in FIG. 57, a toner container 1132Y mainly includes the container body 1133Y and the held portion 1134Y. The opening A is provided in the head of the container body 1133Y, and the gear 33*c* is rotatably provided around the outer periphery of the opening A. The gear 33*c* is engaged with the drive gear of the apparatus body 100 to rotate the coil 181Y.

The rotating axis 180Y is integrally formed with the gear 33*c*, and the spiral-shaped coil 181Y is connected to the rotating axis 180Y. One end of the rotating axis 180Y is supported by the bearing portion 34*a*4 of the held portion 1134Y. The coil 181Y is extended from the opening A over the rear end (bottom) inside the container body 1133Y. The gear 33*c* rotates around the container body 1133Y to rotate the rotating axis 180Y and the coil 181Y.

Therefore, the toner contained in the container body 1133Y is conveyed toward the opening A by the toner conveying force of the coil 181Y. Because the outer diameter of the coil 181Y is smaller than the internal diameter of the container body 1133Y, the toner conveying force can be exerted on the toner near the rotational central axis which is far from the inner circumferential surface of the container body 1133Y. Furthermore, the coil 181Y is comparatively flexible in shape and only one end thereof is supported, thus, the position is swaying during rotation. This can totally exert the toner conveying force from the inner circumferential surface of the container body 1133Y over the rotational central axis. Therefore, even if the large amount of toner is contained in the container body 1133Y and toner aggregation occurs therein due to environmental changes or "being left too long", the aggregation state is weakened by the toner conveying force due to the coil 181Y, and reduction in the toner amount to be discharged can thereby be prevented.

The toner container 1132Y according to the eleventh embodiment, similarly to those of the embodiments, is also provided with the gripper 33*d* in the opposite side in the longitudinal direction to the position where the opening A is formed. When the toner container 1132Y is attached/detached to/from the toner-container holder 31, the plug member 34*d* of the held portion 1134Y opens/closes the toner outlet B in synchronization with the attachment/detachment operation performed along the longitudinal direction of the container body 1133Y while the user is holding the gripper 33*d* provided in the rear side of the container body 1133Y. Moreover, the toner container 1132Y is configured so that the held portion 1134Y of the toner container 1132Y is attached to the toner-container holder 31 along the longitudinal direction of the container body 1133Y so as to be located as the head of the container body 1133Y in the attachment direction, and so that the container body 1133Y is supported by the support member 78 of the toner-container holder 31 at the rear position in the attachment direction of the container body 1133Y. Furthermore, the toner-container holder 31 is configured so that the toner container 1132Y is biased by the arm pairs 80 (biasing member) toward the holding portion 73 of the toner-container holder 31 in synchronization with the attachment operation of the toner container 1132Y.

As explained above, in the eleventh embodiment, similarly to the embodiments, the operability/workability upon replacement and manufacture of the toner container 1132Y is increased, and the occurrence of toner stain can be surely reduced. Although the coil 181Y is used as the conveyor member in the eleventh embodiment, a screw can also be used as the conveyor member. In this case, the same effect as that of the eleventh embodiment can also be obtained.

Figure 58:
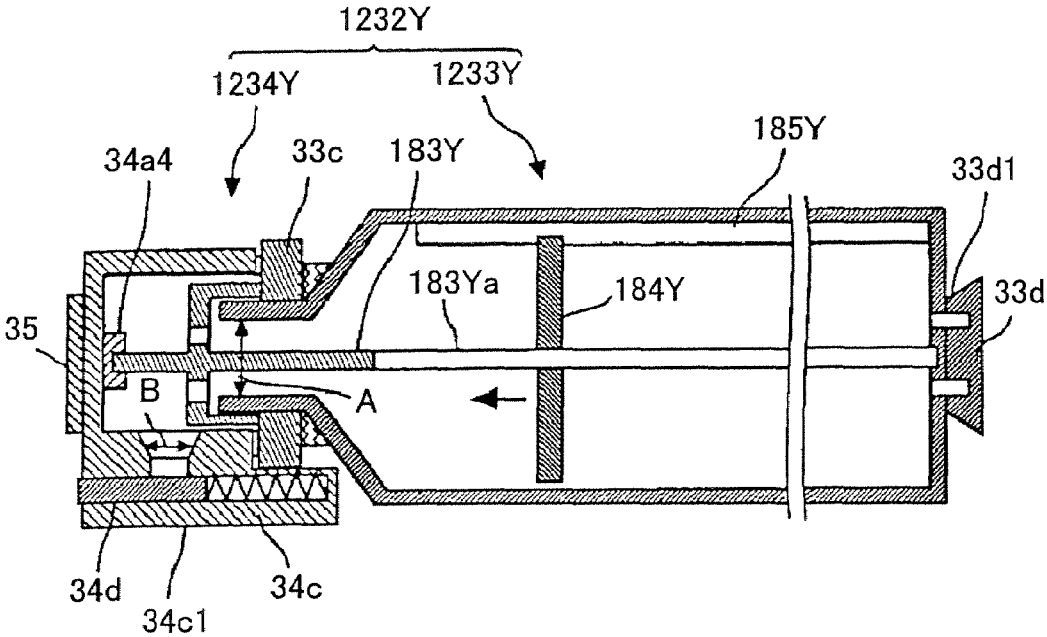
FIG. 58 is a cross-section of a toner container according to a twelfth embodiment of the present invention.
Figure 59:
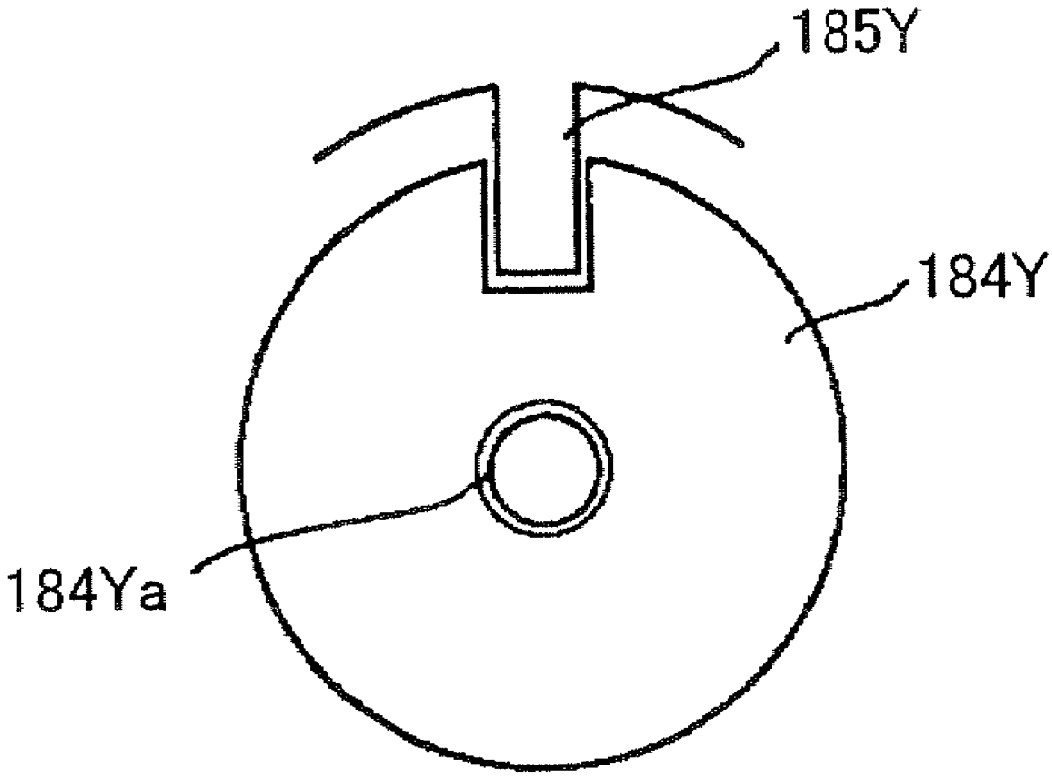
FIG. 59 is a front view of a plate member set in the toner container of FIG. 58.

A twelfth embodiment of the present invention is explained in detail below with reference to FIG. 58 and FIG. 59. FIG. 58 is a cross-section of a toner container according to the twelfth embodiment, which corresponds to FIG. 57 according to the eleventh embodiment. The toner container according to the twelfth embodiment is different from the eleventh embodiment in that the plate member 184Y is used as the conveyor member.

As shown in FIG. 58, a toner container 1232Y mainly includes a container body 1233Y and a held portion 1234Y. The opening A is provided in the head of the container body 1233Y, and the gear 33*c* is rotatably provided around the outer periphery of the opening A. The gear 33*c* is engaged with the drive gear of the apparatus body 100 to be rotated, similarly to the eleventh embodiment.

The threaded rod 183Y is integrally formed with the gear 33*c*, and the plate member 184Y is provided on the threaded rod 183Y. More specifically, the male screw portion 183Ya of the threaded rod 183Y is screwed with the female screw portion 184Ya in the plate member 184Y (see FIG. 59). Referring to FIG. 59, a notched portion is formed on the plate member 184Y, and this notched portion is engaged with the guide portion 185Y which is protruded from the inner circumferential surface of the container body 1233Y.

Referring to FIG. 58, the threaded rod 183Y is supported at its one end by the bearing portion 34*a*4 of the held portion 1234Y, and is supported at the other end by a bearing portion provided in the rear side of the container body 1233Y. The gear 33*c* is made to rotate around the container body 1233Y, and the threaded rod 183Y is also integrally rotated thereby. Therefore, the plate member 184Y engaged with the threaded rod 183Y moves along the screw feeding direction (movement in the arrow direction toward the opening A) while being guided by the guide portion 185Y (without being rotated following the threaded rod 183Y). The speed of the movement of the plate member 184Y is set comparatively slowly in accordance with the speed of toner consumption of the container body 1233Y.

In this manner, the toner contained in the container body 1233Y is conveyed to the side of the opening A by the toner conveying force of the plate member 184Y. Here, the outer diameter of the plate member 184Y is formed so as to be slightly smaller than the internal diameter of the container body 1233Y, and the toner conveying force can be exerted on the toner near the rotational central axis A which is far from the inner circumferential surface of the container body 1233Y. Therefore, even if the large amount of toner is contained in the container body 1233Y and toner aggregation occurs therein due to environmental changes or "being left too long", the aggregation state is weakened by the toner conveying force due to the plate member 184Y, and reduction in the toner amount to be discharged can thereby be prevented.

The toner container 1232Y according to the twelfth embodiment, similarly to those of the embodiments, is also provided with the gripper 33*d* in the opposite side in the longitudinal direction to the position where the opening A is formed. When the toner container 1232Y is attached/detached to/from the toner-container holder 31, the plug member 34*d* of the held portion 1234Y opens/closes the toner outlet B in synchronization with the attachment/detachment operation performed along the longitudinal direction of the container body 1233Y while the user is holding the gripper 33*d* provided in the rear side of the container body 1233Y. Moreover, the toner container 1232Y is configured so that the held portion 1234Y of the toner container 1232Y is attached to the toner-container holder 31 along the longitudinal direction of the container body 1233Y so as to be located as the head of the container body 1233Y in the attachment direction, and so that the container body 1233Y is supported by the support member 78 of the toner-container holder 31 at the rear position in the attachment direction of the container body 1233Y. Furthermore, the toner-container holder 31 is configured so that the toner container 1232Y is biased by the arm pairs 80 (biasing member) toward the holding portion 73 of the toner-container holder 31 in synchronization with the attachment operation of the toner container 1232Y.

As explained above, in the twelfth embodiment, similarly to the embodiments, the operability/workability upon replacement and manufacture of the toner container 1232Y is increased, and the occurrence of toner stain can be surely reduced.

Figure 60A:
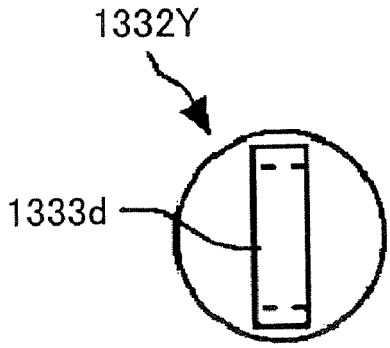
FIG. 60A is a schematic of a toner container according to a thirteenth embodiment of the present invention.
Figure 60B:
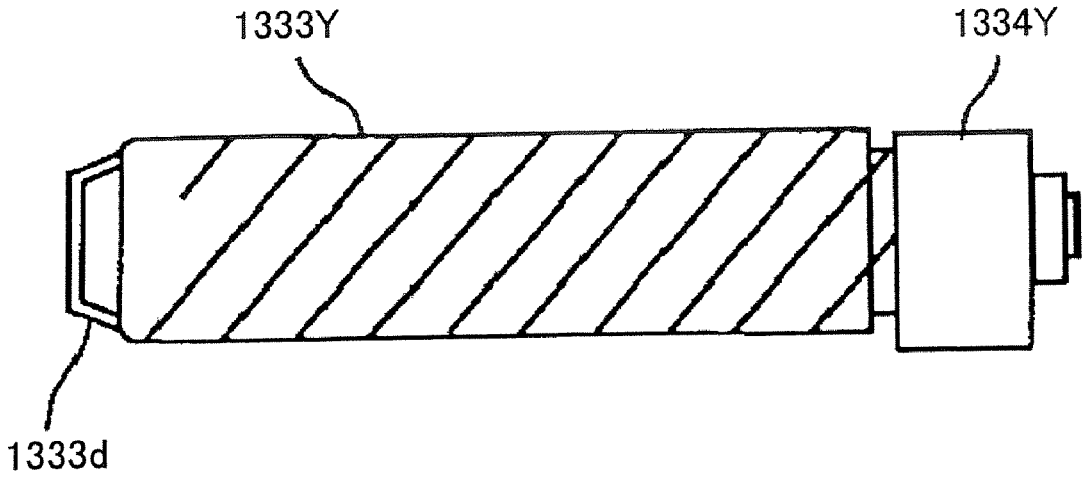
FIG. 60B is a schematic of the toner container according to the thirteenth embodiment of the present invention.
Figure 61A:
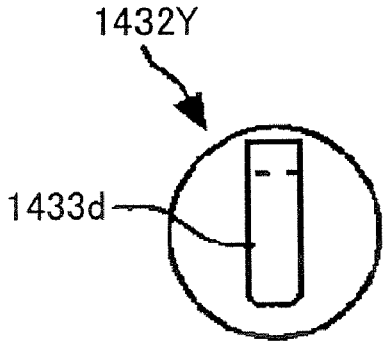
FIG. 61A is a schematic of another type of the toner container.
Figure 61B:
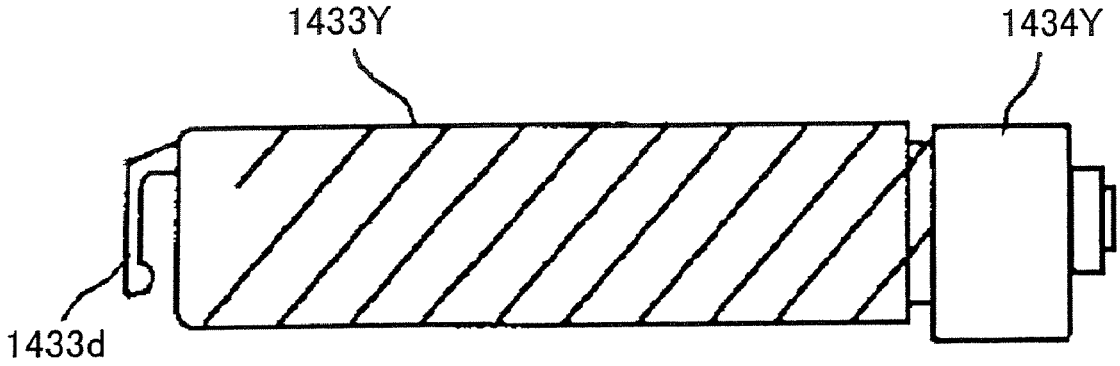
FIG. 61B is a schematic of the another type of the toner container.
Figure 62A:
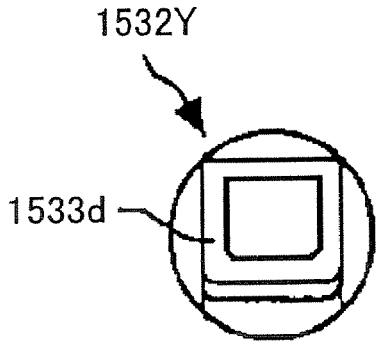
FIG. 62A is a schematic of still another type of the toner container.
Figure 62B:
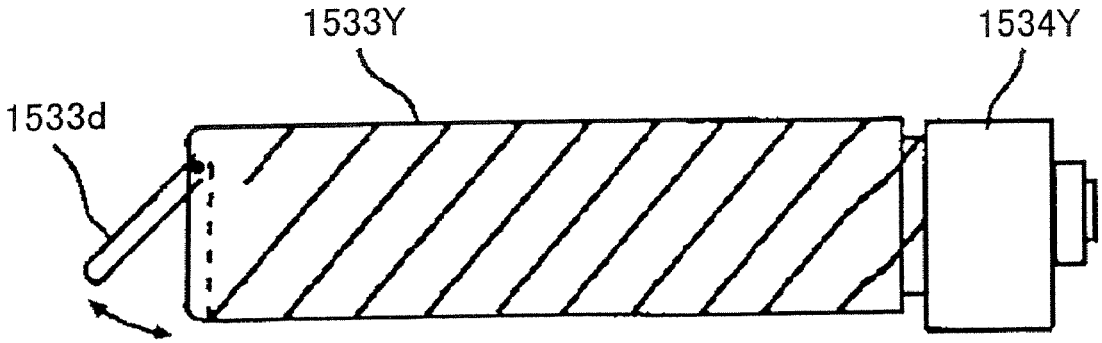
FIG. 62B is a schematic of the still another type of the toner container.

A thirteenth embodiment of the present invention is explained in detail below with reference to FIG. 60A and FIG. 60B to FIG. 62A and FIG. 62B. FIG. 60A and FIG. 60B to FIG. 62A and FIG. 62B are schematics of toner containers according to the thirteenth embodiment. More specifically, FIG. 60A is a schematic of a toner container when viewed from its rear side, and FIG. 60B is a schematic of the toner container when viewed from its longitudinal direction. FIG. 61A is a schematic of another type of the toner container when viewed from its rear side, and FIG. 61B is a schematic of the another type of the toner container when viewed from its longitudinal direction. FIG. 62A is a schematic of still another type of the toner container when viewed from its rear side, and FIG. 62B is a schematic of the still another type of the toner container when viewed from its longitudinal direction. The gripper 1333*d* of the toner container according to the thirteenth embodiment is different in shape from that of the embodiments.

As shown in FIG. 60A and FIG. 60B, the gripper 1333*d* is provided in the rear end face (bottom in the rear side in the attachment direction) of a container body 1333Y of a toner container 1332Y so that the user holds it for performing attachment/detachment operation of the toner container 1332Y. The gripper 1333*d* is formed into a horseshoe shape. This shape of the gripper 1333*d* is not limited to that of the FIG. 60A and FIG. 60B, and so, as shown in FIG. 61A and FIG. 61B, the gripper 1433*d* may be formed into a handle shape. Furthermore, as shown in FIG. 62A and FIG. 62B, the gripper 1533*d* can be formed so as to be retractable into the bottom of the container body 1533Y (the gripper 1533*d* is retracted in the arrow direction in FIG. 62B). When the gripper 31533*d* is formed so as to be retractable into the bottom of the container body 1533Y in the above manner, the space used for the gripper 1533*d* upon setting of the body can be reduced, and the position of the bottom of the container body 1533Y can be extended accordingly to the near side (the side of the main-body cover 110) of the apparatus body. This allows an increase in the capacity (toner amount to be contained) of the container body 1533Y.

The toner container 1332Y according to the thirteenth embodiment, similarly to those of the embodiments, is also provided with the gripper 1333*d* in the opposite side in the longitudinal direction to the position where the opening A is formed. When the toner container 1332Y is attached/detached to/from the toner-container holder 31, the plug member 34*d* of the held portion 1334Y opens/closes the toner outlet B in synchronization with the attachment/detachment operation performed along the longitudinal direction of the container body 1333Y while the user is holding the gripper 1333*d* provided in the rear side of the container body 1333Y. Moreover, the toner container 1332Y is configured so that the held portion 1334Y of the toner container 1332Y is attached to the toner-container holder 31 along the longitudinal direction of the container body 1333Y so as to be located as the head of the container body 1333Y in the attachment direction, and so that the container body 1333Y is supported by the support member 78 of the toner-container holder 31 at the rear position in the attachment direction of the container body 1333Y. Furthermore, the toner-container holder 31 is configured so that the toner container 1332Y is biased by the arm pairs 80 (biasing member) toward the holding portion 73 of the toner-container holder 31 in synchronization with the attachment operation of the toner container 1332Y.

As explained above, in the thirteenth embodiment, similarly to the embodiments, the operability/workability upon replacement and manufacture of the toner container is increased, and the occurrence of toner stain can be surely reduced.

Figure 63:
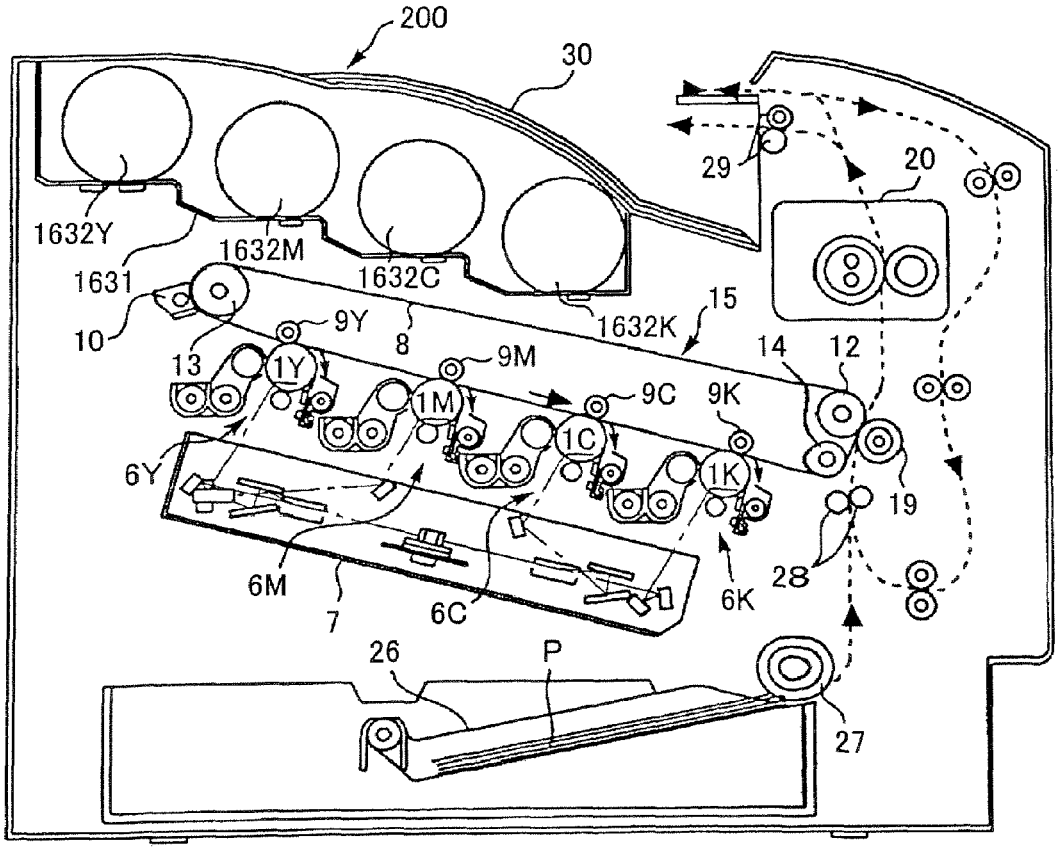
FIG. 63 is an overall schematic of an image forming apparatus according to a fourteenth embodiment of the present invention.

A fourteenth embodiment of the present invention is explained in detail below with reference to FIG. 63 to FIG. 69A and FIG. 69B. At first, the configuration and the operation of a whole image forming apparatus are explained below with reference to FIG. 63 to FIG. 65. FIG. 63 is an overall schematic of a printer as the image forming apparatus, FIG. 64 is a cross-section of an imaging unit thereof, and FIG. 65 is a schematic of a toner supply portion thereof.

As shown in FIG. 63, four toner bottles 1632Y, 1632M, 1632C, and 1632K correspond to colors (yellow, magenta, cyan, and black) respectively, and are detachably (replaceably) arranged in a bottle holder 1631 which is provided in the upper side of the main body of an image forming apparatus 200. Provided in the lower side of the bottle holder 1631 is the intermediate transfer unit 15. The imaging units 6Y, 6M, 6C, and 6K corresponding to the colors (yellow, magenta, cyan, and black) are arranged in a tandem manner so as to face the intermediate transfer belt 8 of the intermediate transfer unit 15.

Figure 64:
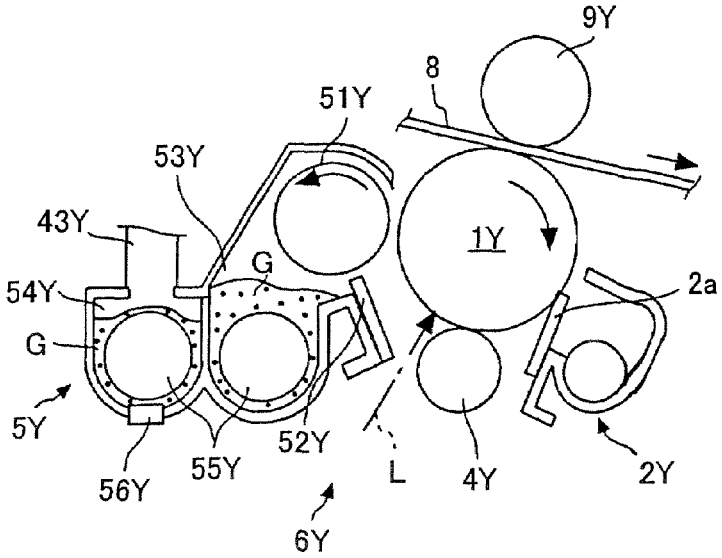
FIG. 64 is a cross-section of an imaging unit in the image forming apparatus of FIG. 63.
Figure 65:
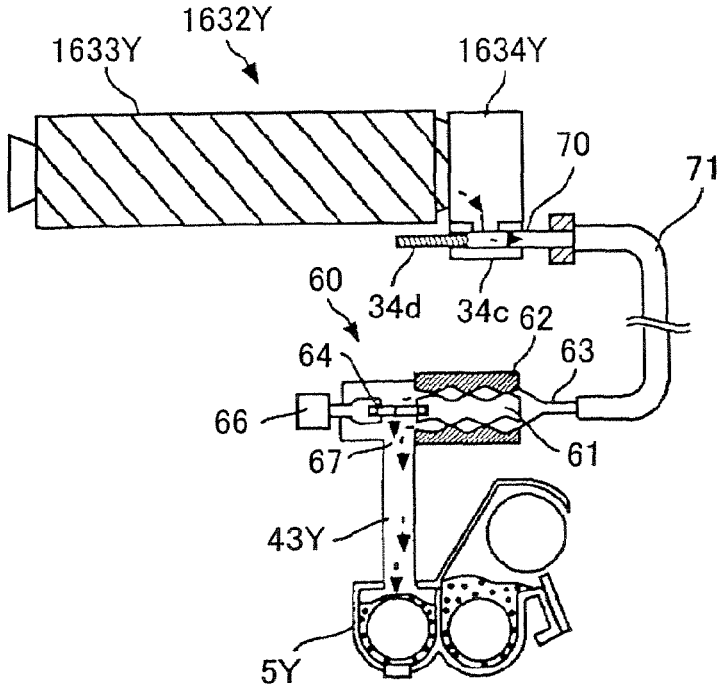
FIG. 65 is a schematic of a toner supply portion in the image forming apparatus of FIG. 63.

Referring to FIG. 64, the imaging unit 6Y corresponding to yellow includes the photosensitive drum 1Y, and also includes the charger 4Y, the developing device 5Y (developing unit), the cleaning unit 2Y, and the decharger (not shown), which are arranged around the photosensitive drum 1Y. Imaging processes (charging process, exposing process, developing process, transfer process, and cleaning process) are preformed on the photosensitive drum 1Y, and an yellow image is formed on the photosensitive drum 1Y.

The other three imaging units 6M, 6C, and 6K have almost the same configuration as the imaging unit 6Y corresponding to yellow, except different toner colors to be used, and images corresponding to the respective toner colors are formed. Hereinafter, explanation of the other three imaging units 6M, 6C, and 6K is omitted, and only the imaging unit 6Y for yellow is explained below.

Referring to FIG. 64, the photosensitive drum 1Y is made to rotate in the clockwise in FIG. 64 by a drive motor (not shown). The surface of the photosensitive drum 1Y is uniformly charged at the position of the charger 4Y (charging process). Thereafter, the surface of the photosensitive drum 1Y reaches the position for radiating a laser light L emitted from the exposing device 7 (see FIG. 63), where an exposing light is scanned to form an electrostatic latent image for yellow (exposing process).

Thereafter, the surface of the photosensitive drum 1Y reaches the position facing the developing device 5Y, where the electrostatic latent image is developed and a yellow toner image is formed (developing process). Then, the surface of the photosensitive drum 1Y reaches the position facing the intermediate transfer belt 8 and the primary-transfer bias roller 9Y, where the toner image on the photosensitive drum 1Y is transferred to the intermediate transfer belt 8 (primary transfer process). At this time, a slight amount of non-transferred toner remains on the photosensitive drum 1Y.

Thereafter, the surface of the photosensitive drum 1Y reaches the position facing the cleaning unit 2Y, where the non-transferred toner remaining on the photosensitive drum 1Y is mechanically collected by the cleaning blade 2*a* (cleaning process). The surface of the photosensitive drum 1Y finally reaches the position facing the decharger (not shown), where the residual potential on the photosensitive drum 1Y is removed. In this manner, the series of imaging processes on the photosensitive drum 1Y is completed.

The imaging processes are performed on the other imaging units 6M, 6C, and 6K in the same manner as those of the yellow imaging unit 6Y. In other words, the laser light L based on image information is radiated from the exposing device 7 provided in the lower side of the imaging unit toward each photosensitive drum of the imaging units 6M, 6C, and 6K. More specifically, the exposing device 7 emits the laser light L from its light source, and radiates the laser light L onto the photosensitive drum through a plurality of optical elements while scanning the laser light L by a polygon mirror which is rotated.

Then, respective color toner images formed on the photosensitive drums through the developing process are superposedly transferred on the intermediate transfer belt 8. In this manner, a color image is formed on the intermediate transfer belt 8.

Referring to FIG. 63, the intermediate transfer unit 15 includes the intermediate transfer belt 8, the four primary-transfer bias rollers 9Y, 9M, 9C, and 9K, the secondary-transfer backup roller 12, the cleaning backup roller 13, the tension roller 14, and the intermediate-transfer cleaning unit 10. The intermediate transfer belt 8 is stretched and supported by three rollers 12 to 14, and is endlessly moved in the direction of the allow of FIG. 63 by the rotation of the roller 12.

The four primary-transfer bias rollers 9Y, 9M, 9C, and 9K sandwich the intermediate transfer belt 8 with the photosensitive drums 1Y, 1M, 1C, and 1K, to form each primary transfer nip. And the transfer bias inverse to the polarity of the toner is applied to the primary-transfer bias rollers 9Y, 9M, 9C, and 9K. Then, the intermediate transfer belt 8 moves along the arrow direction and sequentially passes through the primary transfer nips of the primary-transfer bias rollers 9Y, 9M, 9C, and 9K. In this manner, the toner images of the colors on the photosensitive drums 1Y, 1M, 1C, and 1K are sequentially superposed on the intermediate transfer belt 8 to perform primary transfer.

Thereafter, the intermediate transfer belt 8 with the toner images of the colors superposedly transferred reaches the position facing the secondary transfer roller 19. At this position, the secondary-transfer backup roller 12 sandwiches the intermediate transfer belt 8 with the secondary transfer roller 19 to form a secondary transfer nip. The four-color toner images formed on the intermediate transfer belt 8 are transferred to the transferred material P such as a transfer paper conveyed to the position of the secondary transfer nip. At this time, non-transferred toner which has not been transferred to the transferred material P remains on the intermediate transfer belt 8.

Thereafter, the intermediate transfer belt 8 reaches the position of the intermediate-transfer cleaning unit 10, where the non-transferred toner on the intermediate transfer belt 8 is collected. In this manner, a series of the transfer process performed on the intermediate transfer belt 8 is completed.

The transferred material P conveyed to the position of the secondary transfer nip is conveyed thereto from the paper feed unit 26 provided in the lower side of the apparatus body 200 through the paper feed roller 27 and the registration roller pair 28. More specifically, a plurality of the transferred materials P such as transfer paper are stored in the paper feed unit 26. When the paper feed roller 27 is made to rotate in the counterclockwise of FIG. 63, the uppermost transferred material P is fed to between the registration roller pair 28.

The transferred material P conveyed to the registration roller pair 28 once stops at the position of a roller nip between the registration roller pair 28 that stops its rotation. Then, the registration roller pair 28 is rotated in synchronization with the color images on the intermediate transfer belt 8, and the transferred material P is conveyed toward the secondary transfer nip. In this manner, a desired color image is transferred to the transferred material P.

Then, the transferred material P with the color image transferred at the position of the secondary transfer nip is conveyed to the fixing unit 20, where the color image transferred to the surface of the transferred material P is fixed on the transferred material P under heat and pressure by a fixing roller and a pushing roller. Thereafter, the transferred material P is ejected to the outside of the apparatus through between the paper-discharge roller pair 29. The transferred materials P ejected to the outside of the apparatus by the paper-discharge roller pair 29 are sequentially stacked on the stack portion 30, as output images. In this manner, a series of the imaging processes in the image forming apparatus is completed.

The configuration and the operation of the developing device in the imaging unit are explained in further detail below with reference to FIG. 64. The developing device 5Y includes the developing roller 51Y that faces the photosensitive drum 1Y, the doctor blade 52Y that faces the developing roller 51Y, two conveyor screws 55Y provided in the developer storage units 53Y and 54Y, and the density detection sensor 56Y for detecting toner density in the developer. The developing roller 51Y includes a magnet fixed inside thereof and a sleeve rotating around the magnet. The two-component developer G containing carrier and toner is stored in the developer storage units 53Y and 54Y. The developer storage unit 54Y communicates with the toner conveying pipe 43Y through the opening formed in the upper side of the developer storage unit 54Y.

The developing device 5Y configured in the above manner operates as follows. The sleeve of the developing roller 51Y rotates in the arrow direction of FIG. 64. The developer G carried on the developing roller 51Y by the magnetic field formed by the magnet moves along the developing roller 51Y associated with rotation of the sleeve.

The developer G in the developing device 5Y is controlled so that the proportion (toner density) of the toner in the developer is in a predetermined range. More specifically, the toner contained in the toner bottle 1632Y is supplied to the developer storage unit 54Y through the toner supply portions 43Y, 60, 70, and 71 according to toner consumption in the developing device 5Y. It is noted that the configuration and the operation of the toner bottle 1632Y are explained in detail later.

Thereafter, the toner supplied to the developer storage unit 54Y circulates (movement in the vertical direction on the paper of FIG. 64) in the two developer storage units 53Y and 54Y while being mixed with the developer G and stirred by the two conveyor screws 55Y. The toner in the developer G is attracted to the carrier by frictional charge with the carrier, and is carried on the developing roller 51Y together with the carrier by the magnetic force formed on the developing roller 51Y.

The developer G carried on the developing roller 51Y is conveyed in the arrow direction of FIG. 64 to reach the position of the doctor blade 52Y. At this position, the amount of developer is made appropriate, and then the developer G on the developing roller 51Y is conveyed to the position (developing region) which faces the photosensitive drum 1Y. The toner is attracted to the latent image formed on the photosensitive drum 1Y by the electric field formed in the developing region. Then, the developer G remaining on the developing roller 51Y reaches the upper side of the developer storage unit 53Y associated with the rotation of the sleeve, where the developer G is separated from the developing roller 51Y.

The toner supply portions 43Y, 60, 70, and 71 that guide the toner contained in the toner bottle 1632Y set in the bottle holder 1631 to the developing device 5Y is explained in detail below with reference to FIG. 65. For easy understanding, FIG. 65 depicts changed arrangement of the toner bottle 1632Y, the toner supply portions 43Y, 60, 70, and 71, and the developing device 5Y. Actually, in FIG. 65, the longitudinal direction of the toner bottle 1632Y and part of the toner supply portions is arranged in the vertical direction on the paper. The toner supply portions are arranged in the apparatus body 200 for each toner color. The four toner supply portions have almost the same configuration as one another except a different toner color used for each imaging process.

The toner supply portions supply the toner in the toner bottle 1632Y set in the bottle holder 1631 of the apparatus body 200 into the developing device 5Y as necessary according to toner consumption in the developing device 5Y. More specifically, the toner bottle 1632Y is set in the bottle holder 1631 of the apparatus body 200, and the toner conveying pipe 70 (nozzle) of the bottle holder 1631 is connected to a case 1634Y of the toner bottle 1632Y. At this time, the shutter 34*d* (open/close member) of the toner bottle 1632Y opens the toner outlet of the case 1634Y. This allows the toner contained in the bottle body 1633Y of the toner bottle 1632Y to be conveyed into the toner conveying pipe 70 through the toner outlet.

On the other hand, the other end of the toner conveying pipe 70 is connected to one end of the tube 71. The tube 71 is made of a flexible rubber material having a low affinity for toner, and the other end thereof is connected to the powder pump 60 (screw pump) of the toner supply portion. The powder pump 60 includes the rotor 61, the stator 62, the suction port 63, the universal joint 64, and the motor 66. The rotor 61 is formed so that a shaft made of a metal material is spirally formed. The one end of the rotor 61 is rotatably connected to the motor 66 through the universal joint 64. The stator 62 is made of a rubber material, and a hole thereof is formed so that its oval cross-section is spirally formed. The rotor 61 is inserted into the hole of the stator 62.

The powder pump 60 configured in the above manner causes the motor 66 to rotate the rotor 61 in the stator 62 to suck the toner in the toner bottle 1632Y to the suction port 63 through the tube 71. The toner sucked to the suction port 63 is sent into a gap between the stator 62 and the rotor 61 and fed to the other end along the rotation of the rotor 61. The toner fed is discharged from the feed port 67 of the powder pump 60, to be supplied to the developing device 5Y through the toner conveying pipe 43Y (movement in the arrow direction indicated by a dotted line in FIG. 65).

The toner bottle characteristic in the fourteenth embodiment is explained below with reference to FIG. 66 to FIG. 69A and FIG. 69B. As explained with reference to FIG. 63, the four toner bottles 1632Y, 1632M, 1632C, and 1632K are detachably provided in the bottle holder 1631. The toner bottles 1632Y, 1632M, 1632C, and 1632K are replaced with new ones when they come to the end of their lives (when almost all of toner contained is consumed and the container becomes empty). The toner of the colors contained in the toner bottles 1632Y, 1632M, 1632C, and 1632K is supplied as necessary to each developing device of the imaging units 6Y, 6M, 6C, and 6K through the toner supply portions explained with reference to FIG. 65.

Figure 66:
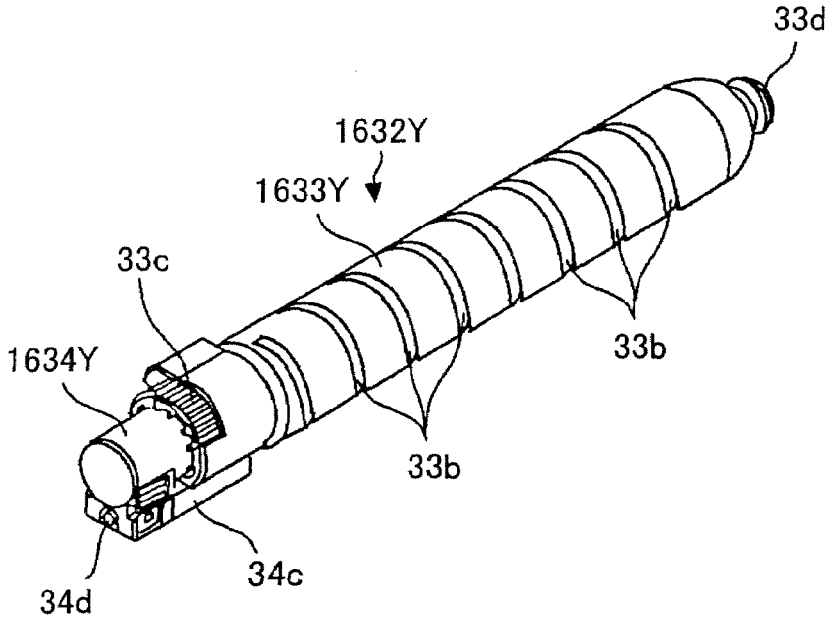
FIG. 66 is a perspective view of a toner bottle to be set in the image forming apparatus of FIG. 63.
Figure 67:
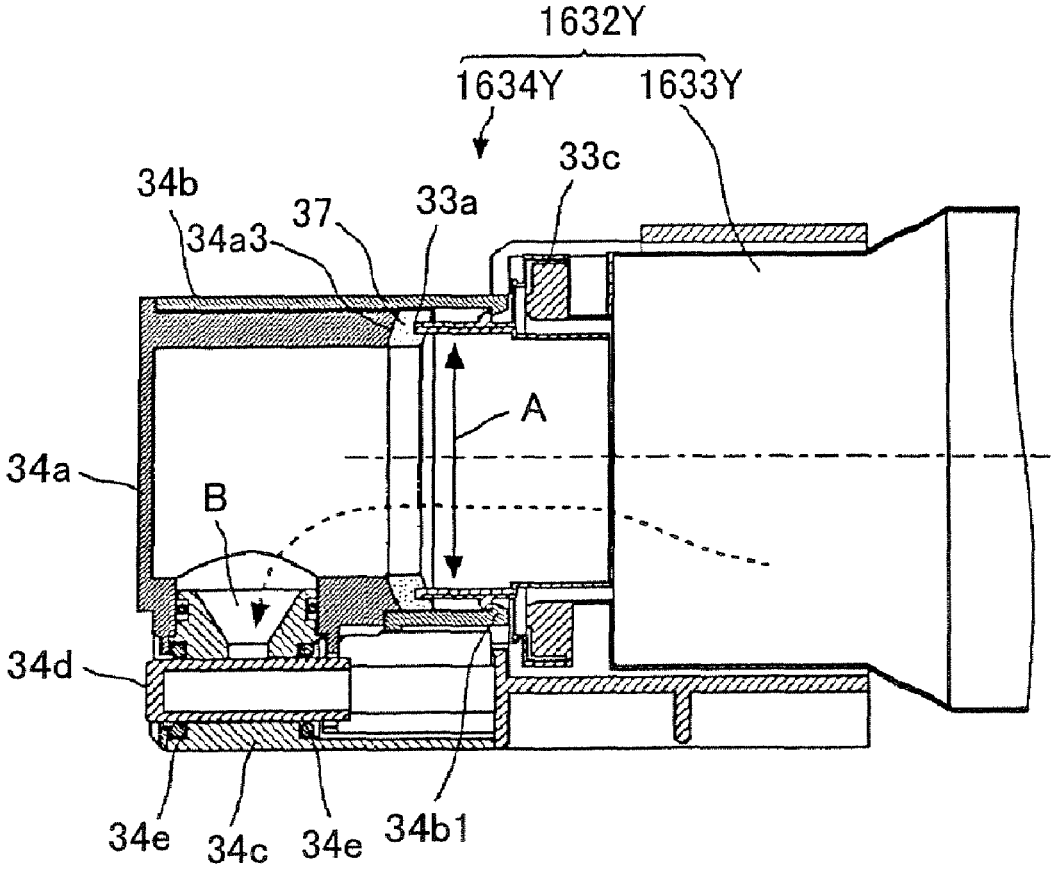
FIG. 67 is a cross-section of the head side of the toner bottle of FIG. 66.

FIG. 66 is a perspective view of the toner bottle 1632Y. FIG. 67 is a cross-section of the head side (the side where the case 1634Y is provided) of the toner bottle 1632Y. The other three toner bottles 1632M, 1632C, and 1632K have almost the same configuration as the toner bottle 1632Y containing yellow toner, except different toner colors contained. Hereinafter, explanation of the other three toner bottles 1632M, 1632C, and 1632K is omitted, and only the toner bottle 1632Y containing yellow toner is explained below.

As shown in FIG. 66, the toner bottle 1632Y mainly includes the bottle body 1633Y and the case 1634Y (bottle cap) provided in the head thereof. The head of the bottle body 1633Y includes the gear 33*c* integrally rotating with the bottle body 1633Y, and the opening A (see FIG. 67). The gear 33*c* is engaged with the drive gear of the drive unit (not shown) provided in the toner holder 1631 of the apparatus body 200, to rotate the bottle body 1633Y around its rotating axis (indicated by the chain line of FIG. 67). The opening A is used to discharge the toner contained in the bottle body 1633Y into the space of the case 1634Y.

Referring to FIG. 66, the gripper 33*d* is provided in the bottom of the bottle body 1633Y so that the user can grip it for attachment/detachment of the toner bottle 1632Y. The spiral-shaped projection 33*b* is provided from the outer circumferential surface to the inner circumferential surface of the bottle body 1633Y. The spiral-shaped projection 33*b* is used to discharge the toner from the opening A by rotating the bottle body 1633Y. The bottle body 1633Y configured in this manner and the gear 33*c* can be manufactured by blow molding.

Referring to FIG. 66 and FIG. 67, the case 1634Y includes the cap 34*a*, the cap cover 34*b*, the shutter holder 34*c*, the shutter 34*d* as the open/close member, and the packing 34*e*. The case 1634Y communicates with the bottle body 1633Y through the opening A, and discharges the toner discharged from the opening A, from the toner outlet B (movement along the arrow direction indicated by the dotted line of FIG. 67). The case 1634Y does not follow the rotation of the bottle body 1633Y, but is held by the holding portion of the bottle holder 1631.

The cap cover 34*b* of the case 1634Y is bonded to the circumferential surface of the cap 34*a*. The claw 34*b*1 is provided at the front of the cap cover 34*b*. The claw 34*b*1 is engaged with an engaging member formed in the head of the bottle body 1633Y, and the bottle body 1633Y is thereby held relatively rotatably with respect to the case 1634Y. To smoothly rotate the bottle body 1633Y, the claw 34*b*1 of the case 1634Y and the engaging member of the bottle body 1633Y are engaged with each other by maintaining appropriate clearance therebetween.

The shutter holder 34*c* is provided in the lower side of the case 1634Y. Provided in the shutter holder 34*c* is the shutter 34*d* (plug) as the open/close member for opening/closing the toner outlet B in synchronization with the attachment/detachment operation of the toner bottle 1632Y. The packing 34*e* is provided on the both sides of the shutter 34*d* to prevent toner leakage from near the shutter 34*d*. A compression spring for biasing the shutter 34*d* in the direction of closing the toner outlet B is provided in the right side of the shutter 34*d*.

The case 1634Y includes an adhesive area 34*a*3 for bonding the seal 37 thereto as a seal member. The adhesive area 34*a*3 is an area (one of opposite areas) which faces the front end 33*a* (the other one of the opposite areas) around the opening A of the bottle body 1633Y, and is formed at the front of the cap 34*a*. The seal 37 being the seal member is used to seal the gap which is around the opening A and is between the front end 33*a* of the bottle body 1633Y and the adhesive area 34*a*3 of the case 1634Y that mutually face each other, and is made of an elastic material such as polyurethane foam.

The adhesive area 34*a*3 with the seal 37 adhered serves as a control portion for controlling vibration in the radial direction of the opening A. More specifically, the adhesive area 34*a*3 of the case 1634Y is formed so as not to be parallel with the front end 33*a* of the bottle body 1633Y which faces this adhesive area. To be more specific, the adhesive area 34*a*3 is not a plane substantially vertical with respect to the direction of the rotating axis of the bottle body 1633Y but is tapered. Furthermore, the area of the adhesive area 34*a*3 as one of the opposite areas is formed so as to be larger than the area of the front end 33*a* being the other opposite area.

Based on the configuration above, even if the front end 33*a* (opening A) is about to vibrate in the radial direction (direction orthogonal to the rotating axis) associated with the rotation of the bottle body 1633Y, the adhesive area 34*a*3 with the seal 37 adhered controls this movement. For example, even if the front end 33*a* is going to move upward in FIG. 67, the force (force through the seal 37), in the direction of pulling the front end 33*a* downward, acts on the front end 33*a* in the upper side of the adhesive area 34*a*3, and this causes the upward movement of the front end 33*a* to be controlled.

The vibration in the radial direction of the opening A of the bottle body 1633Y is prevented, and a deformed shape (shape to seal the gap) of the seal 37 having elasticity is thereby fixed, to allow stable maintenance of the sealing capability of the seal 37 over time without reduction in its restoring force. In other words, such trouble that some clearance occurs in a seal region of the seal 37 due to the vibration in the radial direction of the opening A is prevented. As a result, toner leakage from the seal 37 is suppressed to prevent, before occurring, waste of toner and toner contamination in the main body of the image forming apparatus 200 associated with the toner leakage.

Figure 68A:
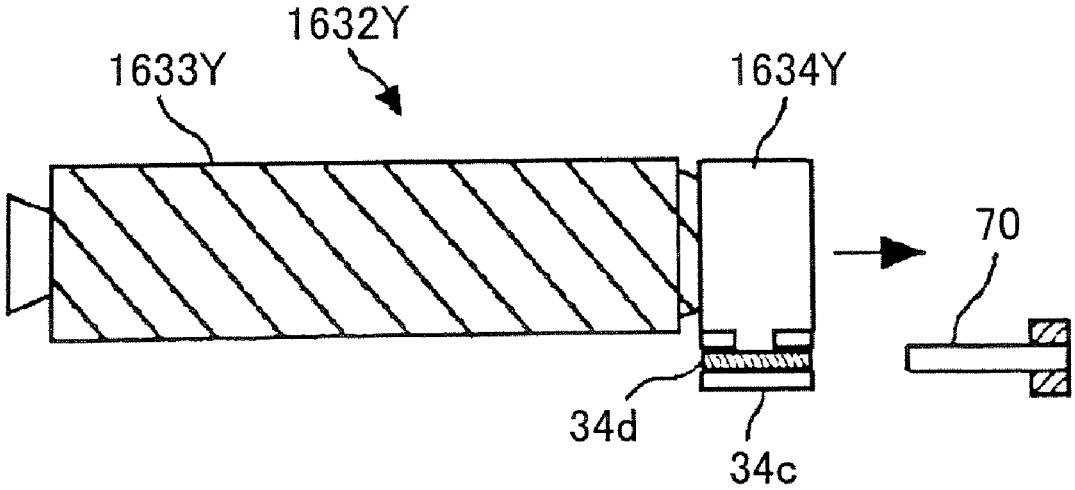
FIG. 68A is a schematic of how the toner bottle is attached to a bottle holder.
Figure 68B:
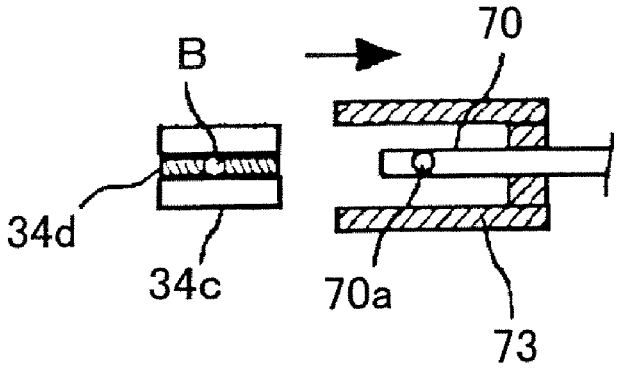
FIG. 68B is a schematic of how the toner bottle is attached to the bottle holder.
Figure 69A:
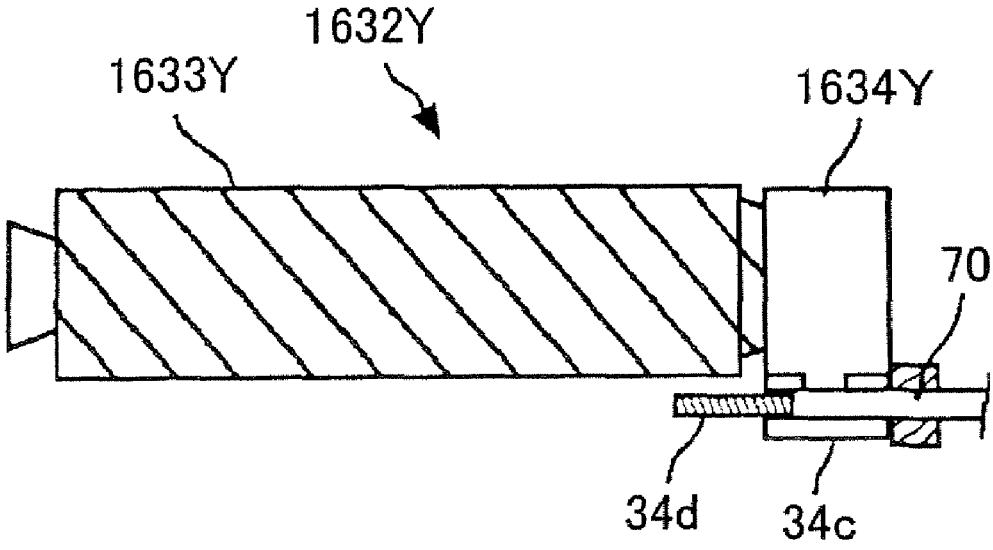
FIG. 69A is a schematic of the toner bottle attached to the bottle holder.
Figure 69B:
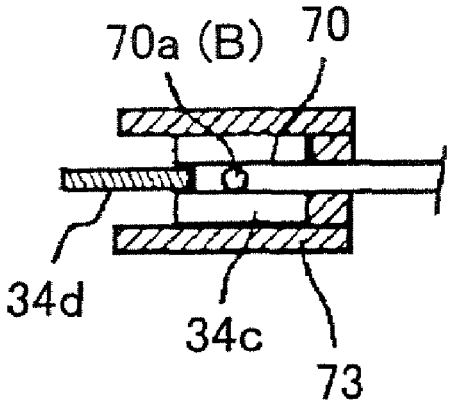
FIG. 69B is a schematic of the toner bottle attached to the bottle holder.

The attachment/detachment operation of the toner bottle 1632Y to/from the bottle holder 1631 is explained below with reference to FIG. 68A and FIG. 68B, and FIG. 69A and FIG. 69B. FIG. 68A is a schematic of how the toner bottle 1632Y for yellow is attached to the bottle holder 1631 (movement in the arrow direction) when viewed from the longitudinal direction, and FIG. 68B is a cross-section of a portion around the shutter holder 34*c* of the case 1634Y in that state when viewed from the upper side. FIG. 69A is a schematic of the toner bottle 1632Y attached to the bottle holder 1631 (attachment is completed) when viewed from the longitudinal direction, and FIG. 69B is a cross-section of the portion of the shutter holder 34*c* in that state when viewed from the upper side.

The bottle holder 1631 includes four bottle holders corresponding to the four toner bottles 1632Y, 1632M, 1632C, and 1632K, respectively. Each of the bottle holders includes the holding portion 73 for fixing the position of the shutter holder 34*c* of the case 1634Y, the toner conveying pipe 70, and the drive unit (not shown) for transmitting the rotational drive force to the bottle body 1633Y.

When the toner bottle 1632Y is attached to the bottle holder 1631 of the apparatus body 200, at first, the main-body cover (not shown) provided on the front face (the near side on the paper of FIG. 63) of the main body of the image forming apparatus 200 is opened to expose the bottle holder 1631. Then, referring to FIG. 68A and FIG. 68B, the toner bottle 1632Y is pushed into the bottle holder 1631 (movement in the arrow direction). Then, the toner bottle 1632Y is moving to the rear side of the bottle holder 1631 while both ends of the shutter holder 34*c* of the toner bottle 1632Y are guided by the holding portion 73. The shutter 34*d* is moved so as to be pushed out by the toner conveying pipe 70 associated with insertion of the front end of the toner conveying pipe 70 into the through hole of the shutter holder 34*c*. The position of the case 1634Y is fixed at the position where the shutter holder 34*c* butts against the holding portion 73, and at the same time, the shutter 34*d* fully opens the toner outlet B. With this operation, as shown in FIG. 69A and FIG. 69B, the toner outlet B of the toner bottle 1632Y and the toner supply port 70*a* of the toner conveying pipe 70 communicate with each other, and the attachment operation of the toner bottle 1632Y is completed.

When the toner bottle 1632Y is to be taken out of the bottle holder 1631 of the apparatus body 200, the operation is performed in the reverse of the attachment. In this case, the toner conveying pipe 70 also separates from the shutter 34*d* in synchronization with the operation such that the toner bottle 1632Y separates from the holding portion 73, and the shutter 34*d* is moved to the position for closing the toner outlet B by the biasing force of the compression spring.

As explained above, the fourteenth embodiment is provided with the adhesive area 34*a*3 for controlling, together with the seal 37, the vibration in the radial direction of the opening A of the bottle body. Therefore, the operability/workability upon replacement of the toner bottle is improved, and toner leakage (toner scatter) which may occur with time can be prevented even if a large amount of toner is contained in the toner bottle.

In the fourteenth embodiment, only the toner is contained in each bottle body of the toner bottles 1632Y, 1632M, 1632C, and 1632K, but in the case of the image forming apparatus that supplies two-component developer containing toner and carrier to each developing device, the two-component developer can also be contained in each bottle body of the toner bottles 1632Y, 1632M, 1632C, and 1632K. Even in this case, by providing the adhesive area 34*a*3 for controlling, together with the seal 37, the vibration in the radial direction of the opening A of the bottle body, it is possible to prevent leakage of the developer from the toner bottle.

In the fourteenth embodiment, the control portion 34*a*3 is provided on the side of the case 1634Y, but the control portion can also be provided on the side of the bottle body 1633Y. Furthermore, the seal 37 can also be adhered to the front end 33*a* of the bottle body 1633Y. Even in these cases, the same effect as that of the fourteenth embodiment can be obtained.

Figure 70:
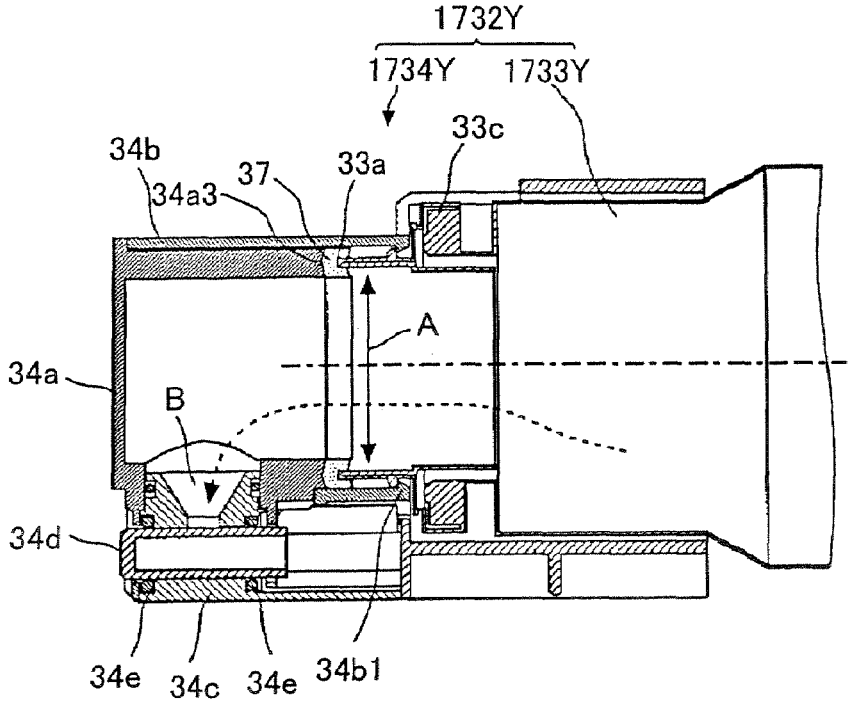
FIG. 70 is a cross-section of part of a toner bottle according to a fifteenth embodiment of the present invention.

A fifteenth embodiment of the present invention is explained in detail below with reference to FIG. 70. FIG. 70 is a cross-section of part of a toner bottle according to the fifteenth embodiment, which corresponds to that of FIG. 67 according to the fourteenth embodiment. The fifteenth embodiment is different from the fourteenth embodiment in the shape of the adhesive area 34*a*3 as the control portion.

As shown in FIG. 70, a toner bottle 1732Y according to the fifteenth embodiment includes a bottle body 1733Y and a case 1734Y, similarly to the fourteenth embodiment. Furthermore, the case 1734Y has the adhesive area 34*a*3 (control portion) for bonding the seal 37 thereto as the seal member. The adhesive area 34*a*3 according to the fifteenth embodiment is formed into a V shape, which is different from that of the fourteenth embodiment. The adhesive area 34*a*3 with the seal 37 bonded thereto serves as the control portion for controlling the vibration in the radial direction of the opening A.

More specifically, the adhesive area 34*a*3 formed into the V shape is formed so as not to be parallel with the front end 33*a* of the bottle body 1733Y which faces this adhesive area, and so as to be larger than the area of the front end 33*a*. Based on the configuration above, the adhesive area 34*a*3 with the seal 37 adhered thereto controls the movement of the front end 33*a* (opening A) which is about to vibrate in the radial direction following the rotation of the bottle body 1733Y. For example, even if the front end 33*a* is about to move upward in FIG. 70, the force (force through the seal 37) in the direction of pulling the front end 33*a* downward is acted on the front end 33*a* at one end of the V shape of the adhesive area 34*a*3, and this controls the upward movement of the front end 33*a*.

The vibration in the radial direction of the opening A is controlled in this manner, to thereby enable stable maintenance of the sealing capability of the seal 37 even after time passes. As a result, toner leakage from the seal 37 is suppressed to prevent, before occurring, waste of toner and toner contamination in the main body of the image forming apparatus 200 associated with the toner leakage.

As explained above, the fifteenth embodiment is also provided with the adhesive area 34*a*3 for controlling, together with the seal 37, the vibration in the radial direction of the opening A of the bottle body 1733Y. Therefore, the operability/workability upon replacement of the toner bottle 1732Y is improved, and toner leakage (toner scatter) which may occur with time can be prevented even if a large amount of toner is contained in the toner bottle 1732Y.

Figure 71:
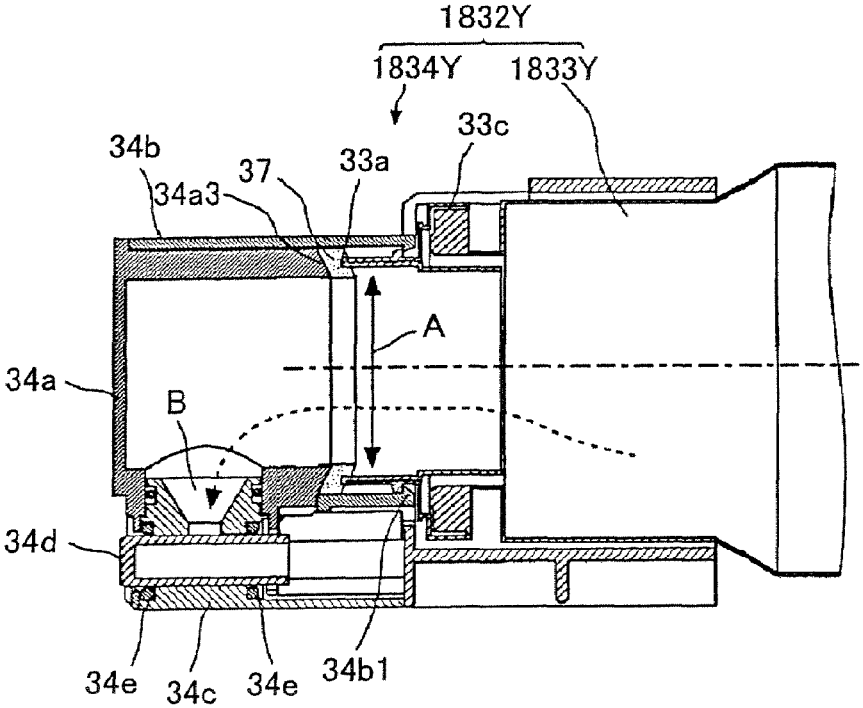
FIG. 71 is a cross-section of part of a toner bottle according to a sixteenth embodiment of the present invention.

A sixteenth embodiment of the present invention is explained in detail below with reference to FIG. 71. FIG. 71 is a cross-section of part of a toner bottle according to the sixteenth embodiment, which corresponds to that of FIG. 67 according to the fourteenth embodiment. The sixteenth embodiment is different from the fourteenth embodiment in the shape of the adhesive area 34*a*3 as the control portion.

As shown in FIG. 71, a toner bottle 1832Y according to the sixteenth embodiment includes a bottle body 1833Y and a case 1834Y, similarly to the fourteenth embodiment. Furthermore, the case 1834Y has the adhesive area 34*a*3 (control portion) for bonding the seal 37 thereto as the seal member. The adhesive area 34*a*3 according to the sixteenth embodiment is tapered similarly to that of the fourteenth embodiment, but the direction of the tapered portion is formed differently from that of the fourteenth embodiment. The adhesive area 34*a*3 with the seal 37 adhered thereto serves as the control portion for controlling the vibration in the radial direction of the opening A.

More specifically, the adhesive area 34*a*3 formed into the taper is formed so as not to be parallel with the front end 33*a* of the bottle body 1833Y which faces this adhesive area, and so as to be larger than the area of the front end 33*a*. Based on the configuration above, the adhesive area 34*a*3 with the seal 37 adhered thereto controls the movement of the front end 33*a* (opening A) even if it is about to vibrate in the radial direction following the rotation of the bottle body 1833Y. For example, even if the front end 33*a* is about to move upward in FIG. 71, the force in the direction of pulling the front end 33*a* downward is acted on the front end 33*a* in the lower side of the adhesive area 34*a*3, and this controls the upward movement of the front end 33*a*.

The vibration in the radial direction of the opening A is controlled in this manner, to thereby enable stable maintenance of the sealing capability of the seal 37 even after time passes. As a result, the toner leakage from the seal 37 is suppressed to prevent, before occurring, waste of toner and toner contamination in the main body of the image forming apparatus 200 associated with the toner leakage.

As explained above, the sixteenth embodiment is also provided with the adhesive area 34*a*3 for controlling, together with the seal 37, the vibration in the radial direction of the opening A of the bottle body 1833Y. Therefore, the operability/workability upon replacement of the toner bottle 1832Y is improved, and toner leakage (toner scatter) which may occur with time can be prevented even if a large amount of toner is contained in the toner bottle 1832Y.

Figure 72:
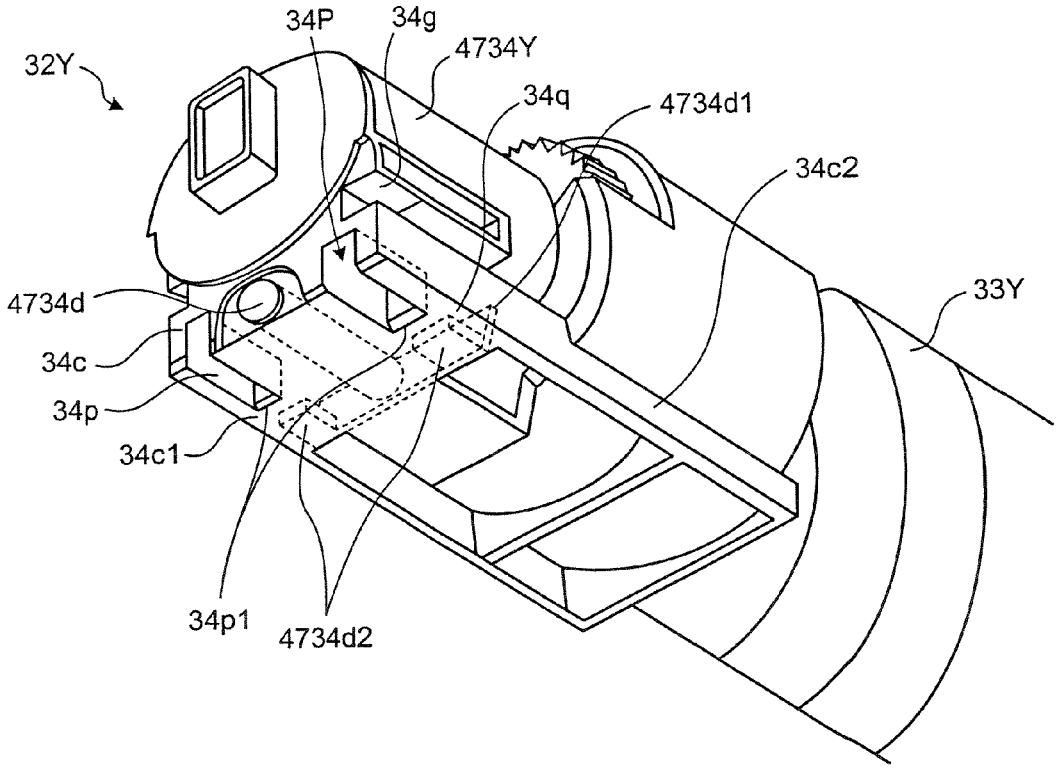
FIG. 72 is a schematic of the toner container in which a plug member closes the toner outlet when viewed from the holder.
Figure 73:
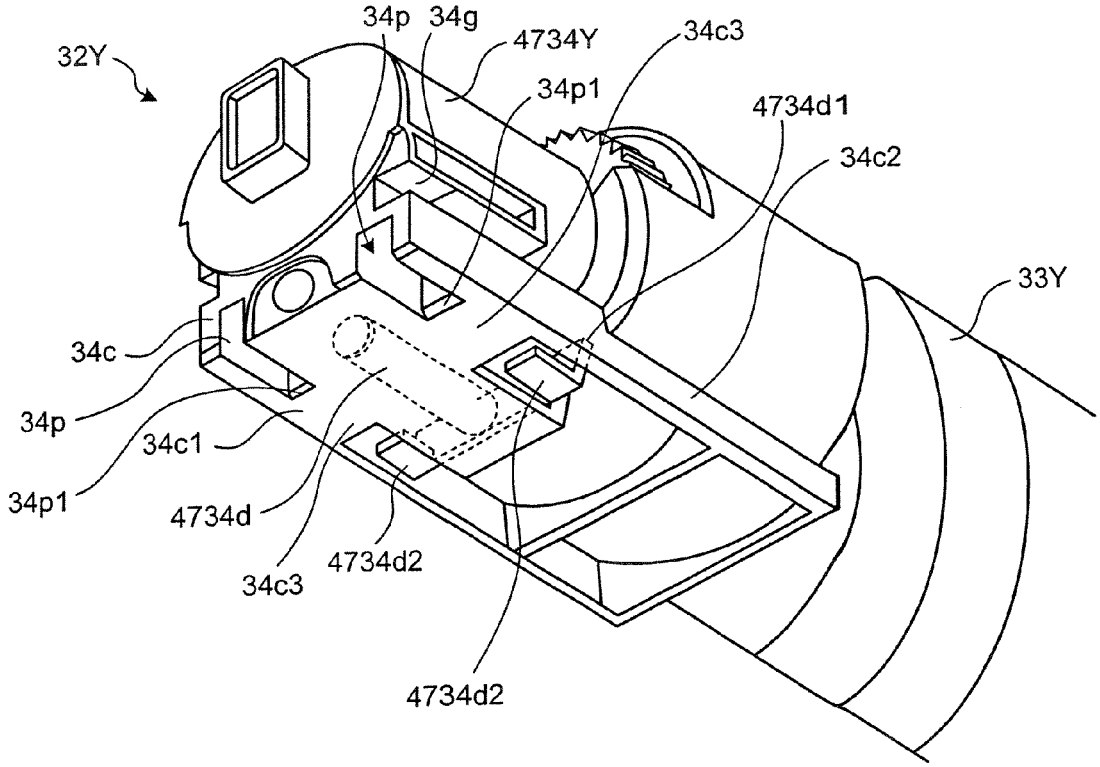
FIG. 73 is a schematic of the toner container when attached to the toner-container holder and the plug member opens the toner outlet when viewed from the holder.
Figure 74:
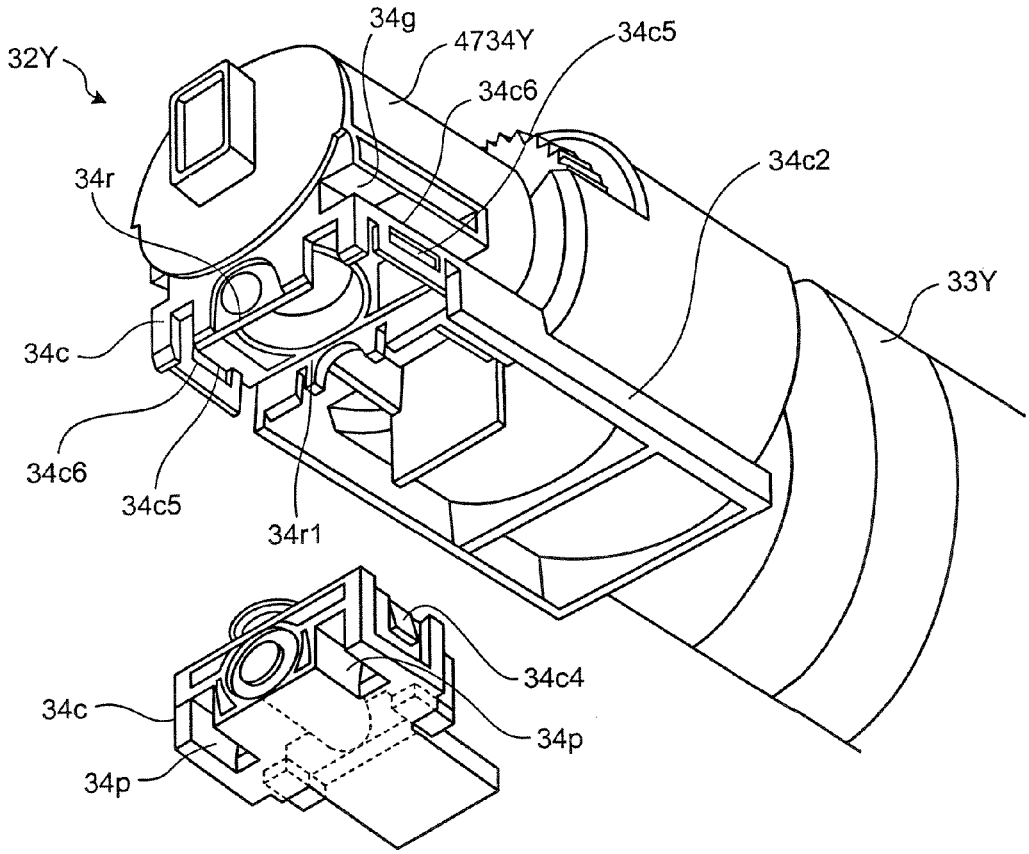
FIG. 74 is a schematic of the holder and a snap mechanism for engaging the holder with the held portion.
Figure 75:
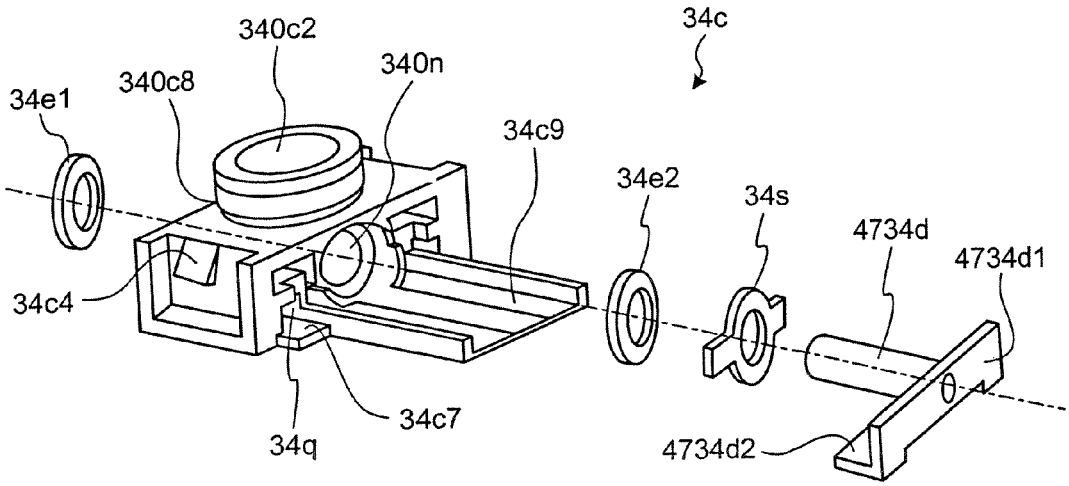
FIG. 75 is a perspective view of details of the components of the holder.

A seventeenth embodiment is explained below with reference to FIG. 72 to FIG. 75. FIG. 72 is a schematic of the toner container 1032Y in which a plug member 4734*d* closes the toner outlet B, and FIG. 73 shows the same view when the plug member 4734*d* opens the toner outlet B. Although FIG. 72 and FIG. 73 are nearly the same as FIG. 38 that shows the cap 34 of the ninth embodiment viewed from a downward oblique point there are points mainly different from the ninth embodiment. The points are such that grooves 34*p* are formed in a held portion 4734Y, which corresponds to the cap 34*a* in the first embodiment, and the plug member 4734*d*, which corresponds to the plug member 34*d* in the first embodiment, is differently shaped. FIG. 74 is a schematic of the holder 34*c* provided separately from the held portion 4734Y and not shown in FIG. 72 and FIG. 73, and of a snap mechanism for engaging the holder 34*c* with the held portion 4734Y, to make the configuration of the plug member 4734*d* easy to see. FIG. 75 is an exploded perspective view of the holder 34*c* to explain details of the components of the holder 34*c*. The configuration of the holder 34*c* is the same as that of the first embodiment. The details of these configurations and the effect due to these configurations are explained below.

The groove 34*p* opened downwardly is formed at two positions which are in a path of the claw member 76. These grooves allow the claws of the claw member 76 to move into or move back along the respective grooves 34*p* during the attachment/detachment operation. A corner portion 34*p*1, against which the claw member 76 butts, and a wall surface 34*c*3 (a part of the sliding portion 34*c*1) are provided at the rear end of the groove 34*p*. Specifically, the wall surface 34*c*3 is used when the claw member 76 changes its posture after butting against the corner portion 34*p*1 and moves while the claws of the claw member 76 are in contact with the wall surface 34*c*3.

FIG. 73 shows how the plug member 4734*d* which is pushed by the nozzle 70 opens the toner outlet B. The claw member 76 engages with the back of a protrusion portion 4734*d*1, as explained below. The details and the effect of the protrusion portion 4734*d*1 will be explained later with reference to FIG. 75 to FIG. 77. Further, the operation of the toner container 1032Y in which the claw member 76 is engaged with the protrusion portion 4734*d*1 and the effect thereof will be explained later with reference to FIG. 78A to FIG. 78B.

Similarly to the configuration of the ninth embodiment, the plug member 4734*d* of FIG. 72 has a plate ((hereinafter, "protrusion portion 4734*d*1") which is an engaging portion for engaging the claw member 76, and is extended and protruded to both sides of the axis of the cylinder portion of the plug member 4734*d*, the both sides being perpendicular to the axial direction of the cylinder portion. The plug member 4734*d* also has two plates (hereinafter, "second protrusion portions 4734*d*2") protruded from near the both ends of the protrusion portion 4734*d*1 so as to form planes perpendicular to the plate surface of the protrusion portion 4734*d*1. Similarly to the ninth embodiment, the protrusion portion 4734*d*1 is extended and projected to the both sides from the axis of the cylinder portion of the plug member 4734*d*, and the protrusion portion 4734*d*1 is engaged with the claw member 76 at symmetrical two positions. Therefore, the force to move the plug member 4734*d* by the claw member 76 can be imparted evenly on both sides, and as a result, the closing operation of the toner outlet B can be smoothly performed. In addition to or as an alternative, a spring may be used to urge the plug member 4734*d* towards the closed position.

The backside 34*c*7 of the wall surface 34*c*3 has two storage portions 34*q*, one on each side of the plug member 4734*d*, as shown in FIG. 75. More specifically, the storage portion 34*q* stores both the protrusion portion 4734*d*1 and the second protrusion portion 4734*d*2 when the toner outlet B is completely closed by the plug member 4734*d* such that the claw member 76 does not contact 4734*d*1 and 4734*d*2 as the toner 7 container is being mounted into the image forming device. By providing the storage portion 34*q* for storing the protrusion portion 4734*d*1, the protrusion portion 4734*d*1 is not exposed to the outside when the toner outlet B is closed. Therefore, it is possible to prevent failure by the plug member 4734*d* being accidentally opened by erroneous operation by the user, namely, caused by the protrusion portion 4734*d*1 catching any projection or being moved by a user.

Figure 76:
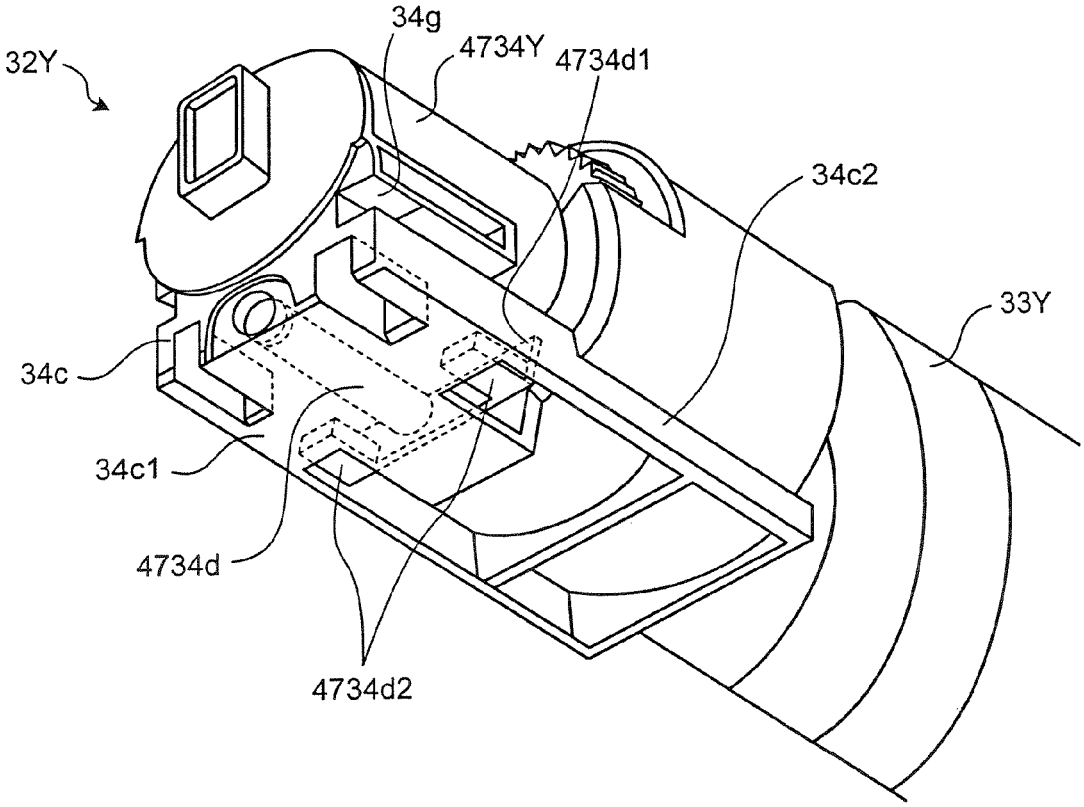
FIG. 76 is a schematic of how the plug member is displaced and the protrusion portion slightly moves to the side where the toner outlet is opened.
Figure 77:
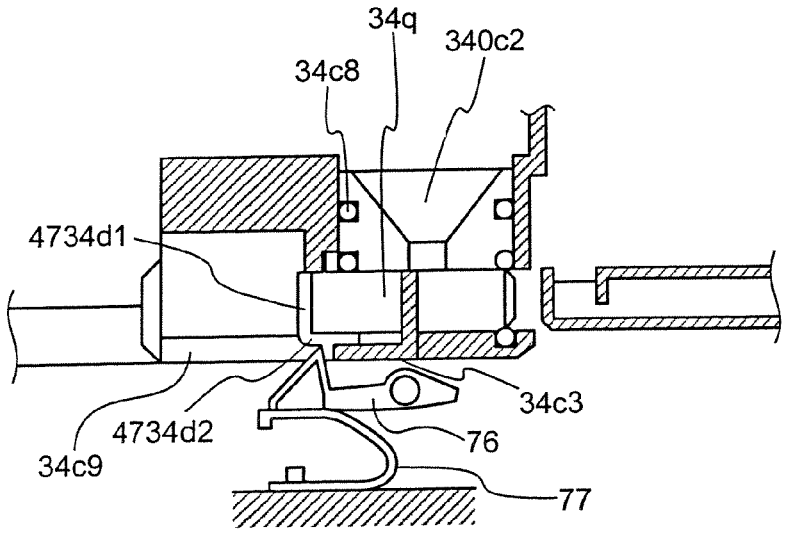
FIG. 77 is a schematic of how a second protrusion portion closes a space between the storage portion and the protrusion portion.

Further, the effect due to provision of the second protrusion portion 4734*d*2 is explained below with respect to FIG. 76 and FIG. 77. FIG. 76 is a schematic of how the plug member 4734*d* is displaced and the protrusion portion 4734*d*1 moves back when the protrusion portion 4734*d*1 is pushed inwardly by the nozzle 70 of the image forming apparatus, thus causing the toner outlet to open. FIG. 52 is a schematic of how the second protrusion portion 4734*d*2 closes a space between the storage portion 34*q* and the protrusion portion 4734*d*1. As shown in FIG. 51, even if the user starts the attachment operation when the plug member 4734*d* is partly displaced to the open position such that the protrusion portion 4734*d*1 is partly moved back and the toner outlet B is partly opened, the second protrusion portion 4734*d*2 closes the space between the storage portion 34*q* and the protrusion portion 4734*d*1 as shown in FIG. 52. Thus, when the plug member 4734*d* is partly pushed in as the toner container is being mounted, the claw member 76 slides along the bottom surface 34*c*3, then slides along the bottom of the second protrusion portion 4734*d*2 until the claw member 76 slides past the protrusion portion 4734*d*1. Therefore, it is possible to prevent a failure in the mounting process which opens the toner outlet B, or failure in closing thereof by the plug member 4734*d*, thus preventing toner scatter.

The configuration of the holder 34*c* formed with another component different from the held portion 4734Y is explained in detail below with reference to FIG. 74 and FIG. 75. Independent components are the plug member 4734*d* made of resin having slidability such as polyacetal and the packing 34*e* made of rubber, of which material is different from that of the holder 34*c*. And, these independent components are set in the holder 34*c* explained in the first, fifth and ninth embodiments upon assembly. Therefore, it is desired that the held portion 4734Y and the holder 34*c* be different components. As an alternative, these components can be integrally formed and/or be the same component. For the setting, as shown in FIG. 74, the holder 34*c* includes two convex claws 34*c*4 for the snap mechanism at the positions on both sides of the plug member 4734*d*. The held portion 4734Y is formed with a thin plate so as to cause the positions corresponding to the convex claws 34*c*4 to have elasticity, and the thin plate has engaging portions 34*c*6 for the snap mechanism in which holes 34*c*5 are formed so that the convex claws 34*c*4 can be engaged in the holes. By fitting the holder 34*c* in the held portion 4734Y from its lower side so that the convex claws 34*c*4 and the holes 34*c*5 are respectively engaged with each other, the holder 34*c* and the held portion 4734Y can be assembled. The assembled state in which the convex claws 34*c*4 are respectively engaged in the holes 34*c*5 is shown in FIG. 5 related to the first embodiment, in FIG. 22 related to the fifth embodiment, and in FIG. 38 related to the ninth embodiment.

The configuration of the holder 34*c* and the components disposed therein are explained below with reference to FIG. 75. The upper portion of the holder 34*c* has the mortar-shaped or funnel-shaped vertical path (opening 340*c*2) that forms the toner outlet B, which is explained in the first, fifth, and ninth embodiments, and the packing (O-ring 34*c*8) is provided around the path so as to keep the tightness between the holder 34*c* and the held portion 4734Y. The opening 340*c*2 has the nozzle hole 340*n* into which the nozzle 70 is inserted and which is provided in its lower part in the horizontal direction, and two pieces of packing are provided in both ends of the nozzle hole 340*n*. A packing 34*e*1, also considered to be a pliable element or washer, out of the two pieces of packing, located in the side of the nozzle 70 across the holder 34*c*, can be fixed in such a manner that the front side around the packing is pressed by a member 34*r* of the held portion 4734Y. On the other hand, a packing 34*e*2 located in the side of the protrusion portion 4734*d*1 of the plug member 4734*d* across the holder 34*c* is pressed by an arch-shaped member 34*r*1 formed in the held portion 4734Y so as to avoid the cylinder portion of the plug member 4734*d* when the holder 34*c* is set in the held portion 4734Y from the lower side. As a member for supporting the pressing, there is a pressing support member 34*s* made of resin, which includes a ring and a plate protruded in the horizontal direction and is disposed between the packing 34*e*2 and the arch-shaped member 34*r*1. To temporarily fix the packing 34*e*1, the packing 34*e*2, and the pressing support member 34*s* to the holder 34*c* upon assembly, the cylinder portion of the plug member 4734*d* is previously inserted into these components, and the holder 34*c* is simply set in the held portion 4734Y from the lower side as shown in FIG. 74.

Further, plate member 34*c*9 that is concave-shaped in cross section extends in the axis direction of the nozzle hole 340*n* from the holder 34*c*. This plate member 34*c*9 is configured to be moved by being sandwiched by the two second protrusions 34*d*2 of the plug member 34*d*, and to prevent the plug member 34*d* from rotating.

The effect of the pressing support member 34*s* is explained below. To set the holder 34*c* in the held portion 4734Y from the lower side, the held portion 4734Y needs to have an arch-shaped space as explained above. In this case, if the pressing support member 34*s* is not provided, there is no member for pressing the packing 34*e*2 in the lower side of the periphery thereof. If there is no such member, the packing 34*e*2 may curl up due to friction caused by the sliding operation of the plug member 4734*d*, which leads to failure in toner conveyance and causes toner scatter. Therefore, by providing the pressing support member 34*s*, the whole periphery of the packing 34*e*2 can also be pressed, similarly to the packing 34*e*1.

The relationship between the positioning operation of the held portion 4734Y and the operation of the claw member 76 is explained below. The claw member 76 receives an upward force (force in the R2 direction of FIG. 47) by the plate spring 77 shown in FIG. 77 which is the second biasing member. The upward force acts so as to push the held portion 4734Y upward when the claw member 76 is pushed downward to the position where the attachment of the held portion 4734Y is not obstructed. Therefore, the attachment operation may be unsuccessful depending on the arrangement of the claw member 76 in the toner-container holder 31 and the upward force of the plate spring 77.

In other words, there is a case where the claw member 76 is engaged with the sliding portion 34*c*1 provided on the undersurface of the held portion 4734Y before the positioning members 31*c* of the toner-container holder 31 are engaged with the engaging portions 34*g* of the held portion 4734Y. In this case, if the upward force is strong, the engaging portions 34*g*, with which the positioning members 31*c* of the holding portion 73 on the main body of the image forming apparatus are engaged, are turned obliquely upward, and the positioning members 31*c* are inserted into the engaging portions 34*g* in that state. It is also possible for the positioning members 31*c* to fail to engage with the engaging portions 34*g*. In either situation, the positioning members 31*c* are not properly engaged with the engaging portions 34*g*, which causes a failure in the attachment.

In order to prevent improper mounting due to movement or rotation of the held portion 4734Y, according to ninth embodiment, the relative positions of the positioning members 31*c* and the claw member 76 are arranged so that during the mounting process, the positioning members engage with the engaging portions 34*g* before the claw member 76 is engaged with or pushes upwarwardly on the held portion 4734Y. Alternatively, the spring 77 which pushes up on the claw member 76 can be selected so that it has less bias on the claw member 76. Such a smaller amount of bias or spring strength will reduce or eliminate the issue of the rotation or lifting of the held portion 4734Y. When the toner container, or cap or held portion thereof initially contacts the claw member 76, the weaker spring will allow the claw member 76 to move and not change the orientation or angle of the toner container.

Alternative ways of keeping the toner container from rotating upwardly so that container can be properly mounted include mounting a stopping or blocking device above the toner container or above the cap of the toner container within the image forming device to keep the toner container stable during mounting. The stopping device could be a flat and horizontal blocking device, for example. Alternatively, a rounded stopping device which corresponds to the shape of the cap can be installed within the image forming device to keep the toner container from raising or rotating upwardly.

Additionally or alternatively, the cap can be molded, machined, cut, or otherwise constructed so that it has gutters, channels, grooves or slots on the under-face, as illustrated in FIGS. 72-81B which are part of the thirteenth embodiment. With such a construction, portions of the claw member 76 do not exert any or sufficient upward pressure to move the toner container upwardly until the positioning members 31*c* which are part of the image forming device, engage with the corresponding slots, gutters, or channels 34*g* which are engaging portions and part of the cap of the toner container.

In the seventeenth embodiment, two grooves 34*p* into which the claw member 76 can enter are formed on the plane that faces the nozzle 70 upon the attachment of the held portion 4734Y. Consequently, the connection to the held portion is performed in such a manner that the positioning members 31*c* first start to engage the engaging portions 34*g*. Then, the claw member 76 contacts the held portion and exerts an upward pressure thereon. The interaction of the positioning members 31*c* and engaging portions 34*g* prevent upward movement of the container or held portion, and thus during insertion, the claw member 76 is pushed downward so as not to obstruct the attachment, and thereafter, the claw member 76 engages the plug member 4734*d*, and the nozzle 70 comes in contact with the plug member 4734*d* slightly afterward. The effect of the grooves 34*p* is explained below with reference to FIG. 53A to FIG. 56B.

Figure 78A:
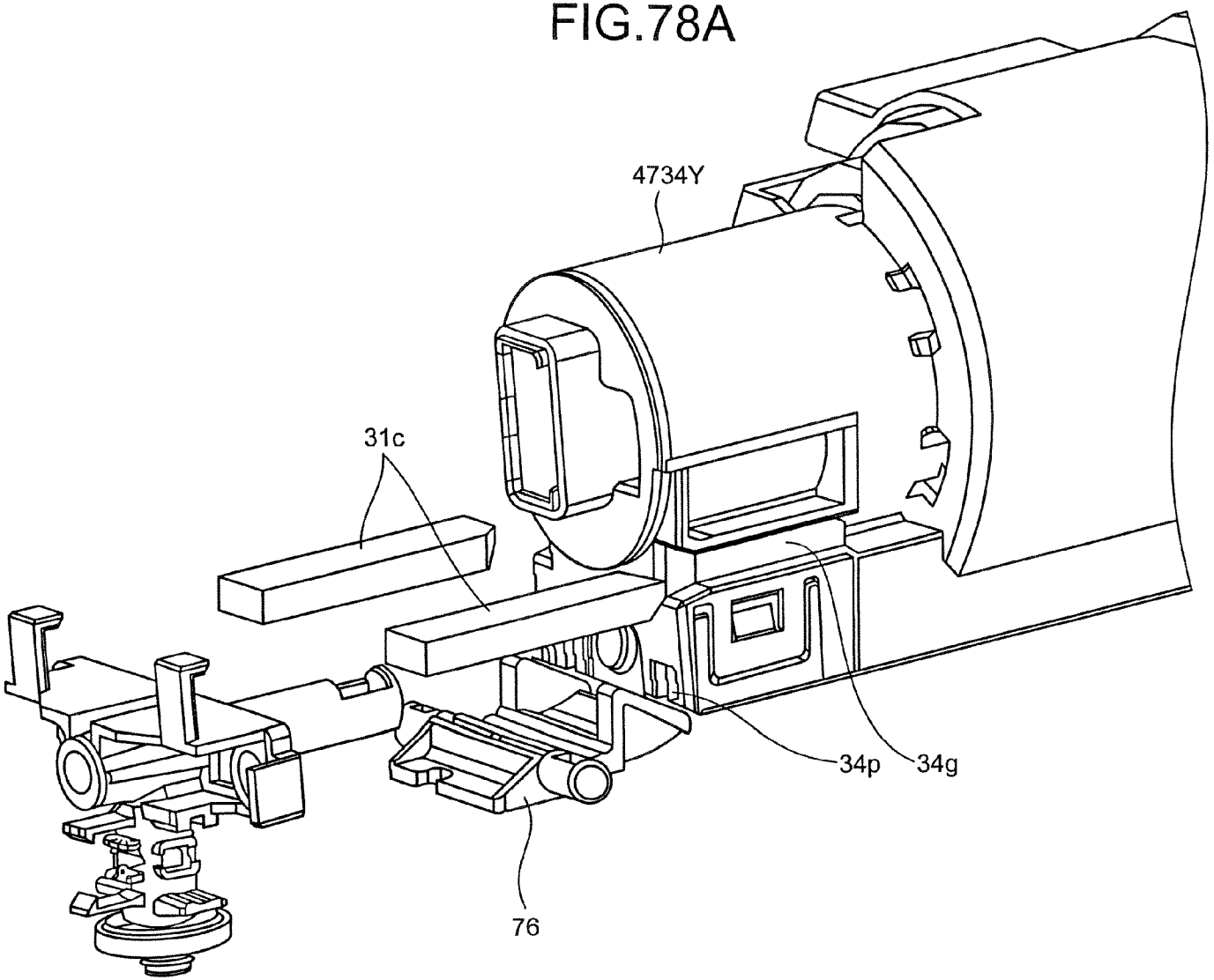
FIG. 78A is a perspective view of how the engaging portions of the toner container face the positioning members of the toner-container holder.
Figure 78B:
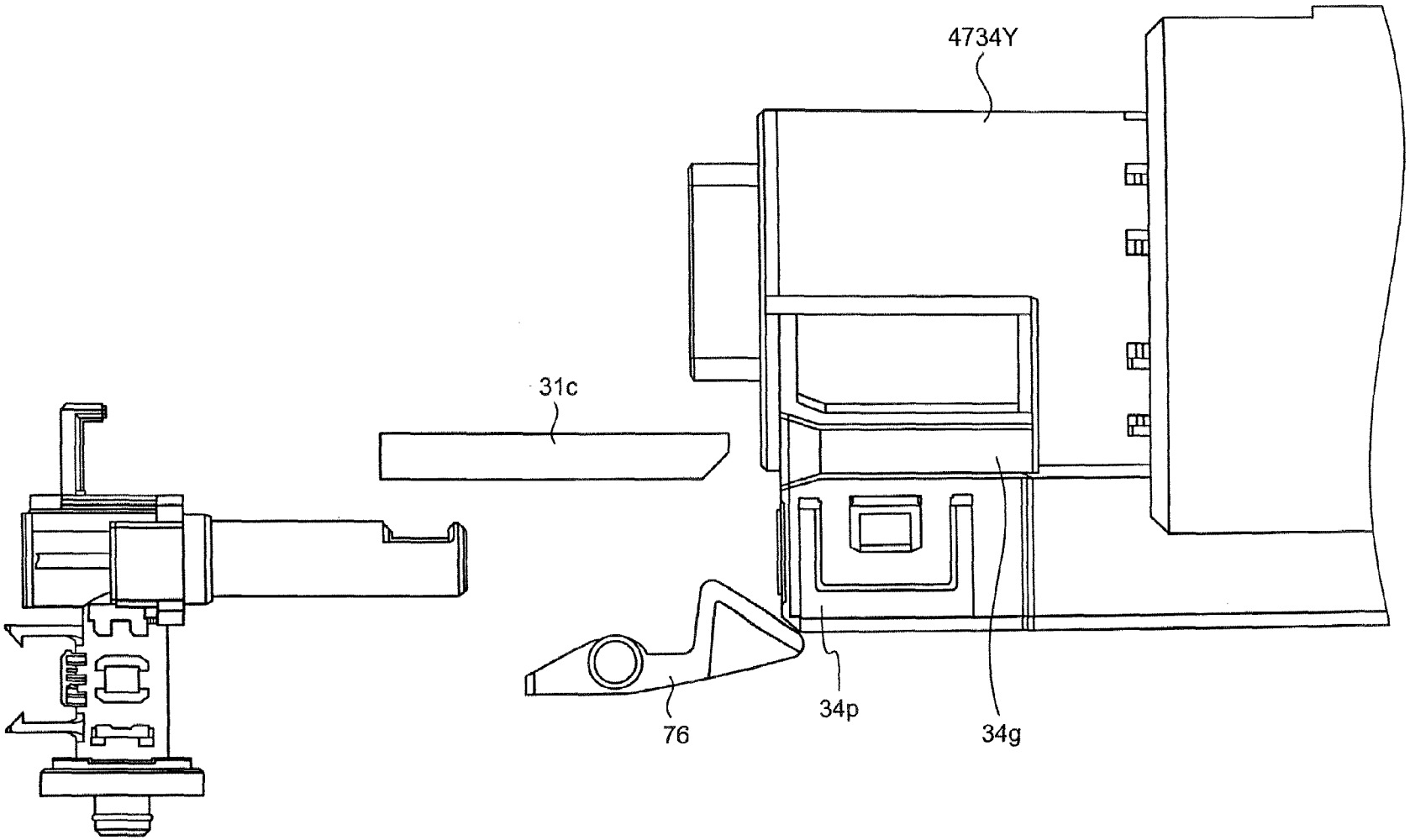
FIG. 78B is a side view of how the engaging portion of the toner container faces the positioning member of the toner-container holder.
Figure 79A:
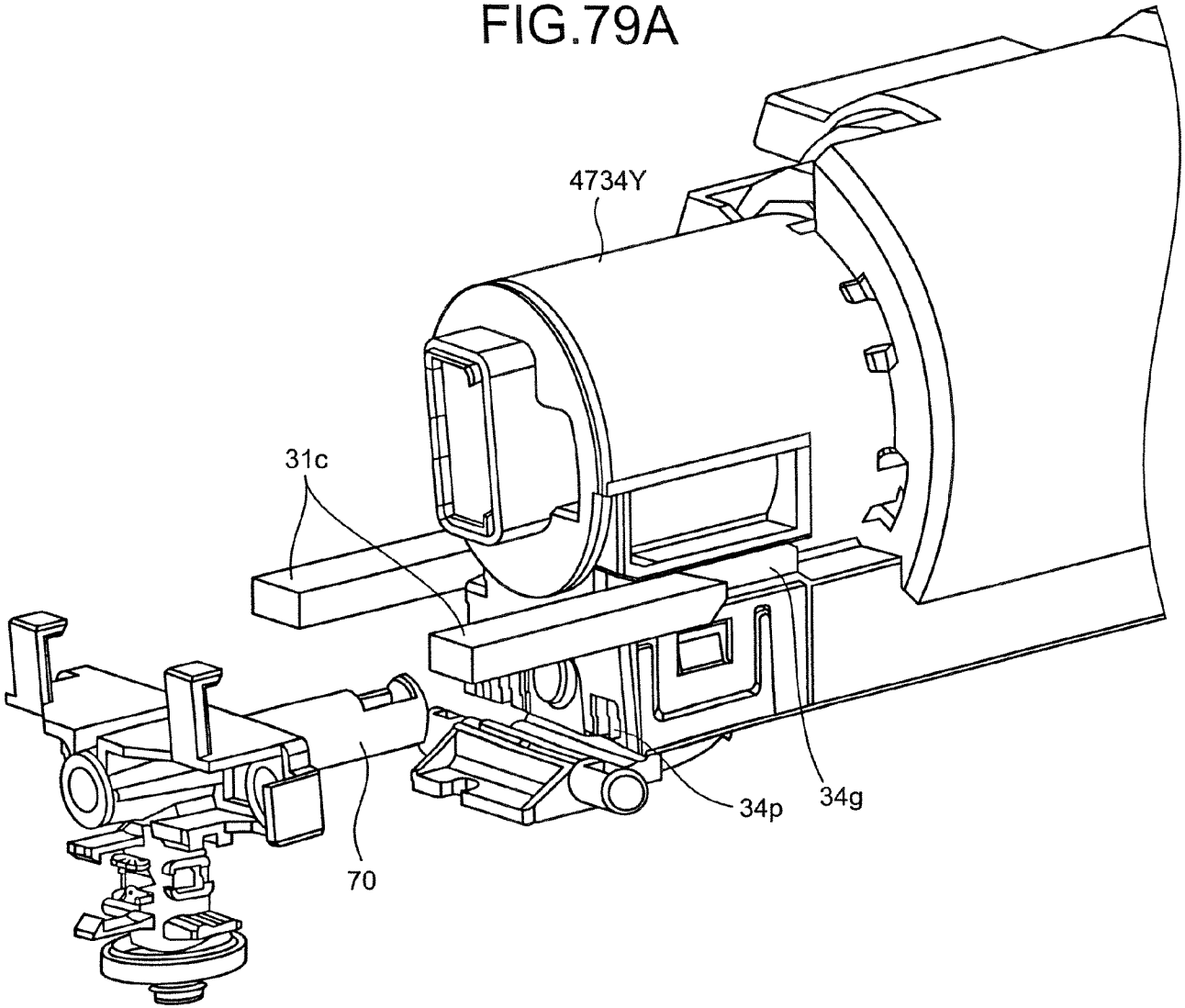
FIG. 79A is a perspective view of how the held portion starts to be engaged with the positioning members.
Figure 79B:
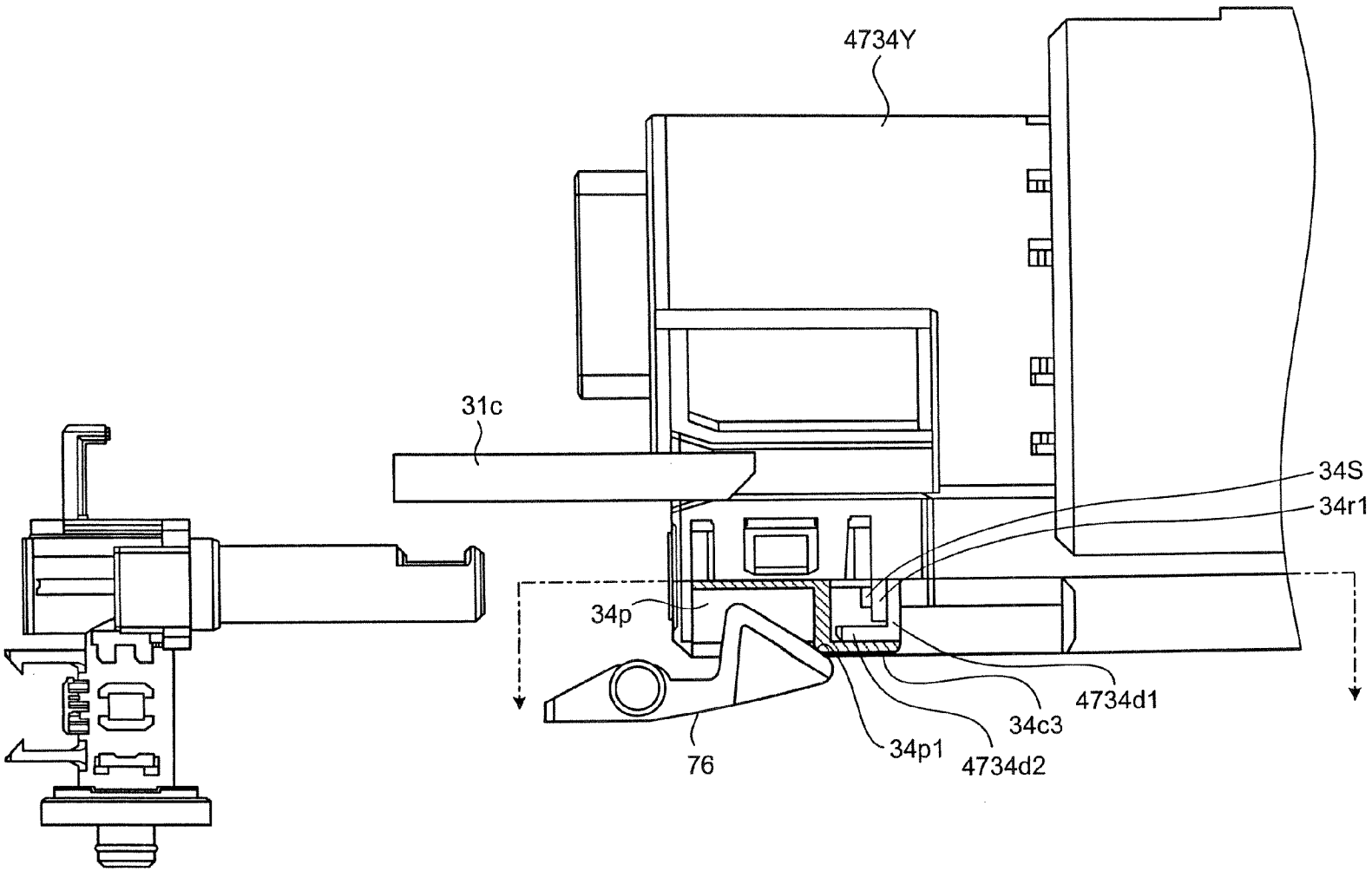
FIG. 79B is a partially cross-sectional side view of how the held portion starts to be engaged with the positioning members.
Figure 80A:
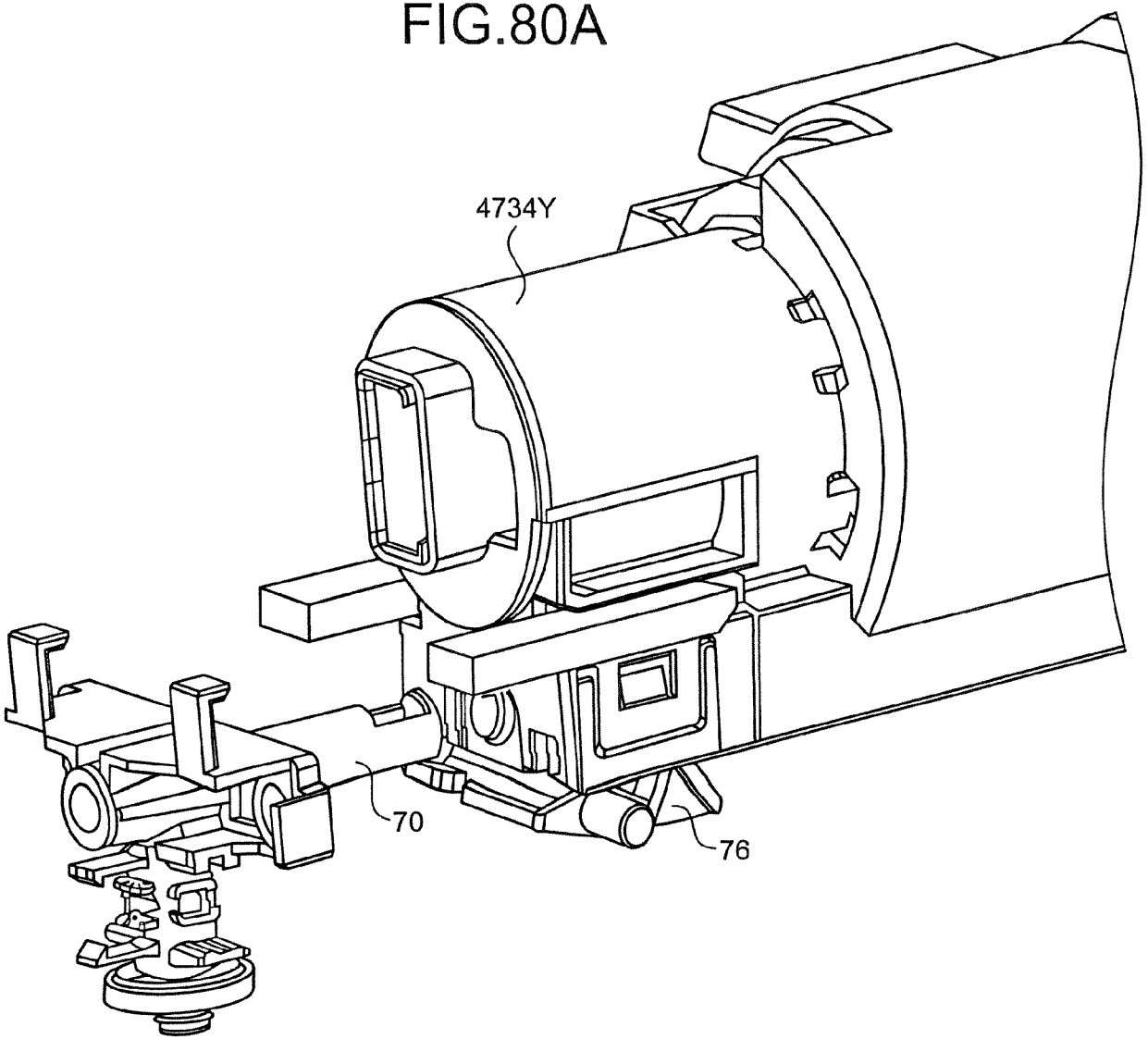
FIG. 80A is a perspective view of how the claw member is pushed downward to a position where the attachment of the held portion is not obstructed.
Figure 80B:
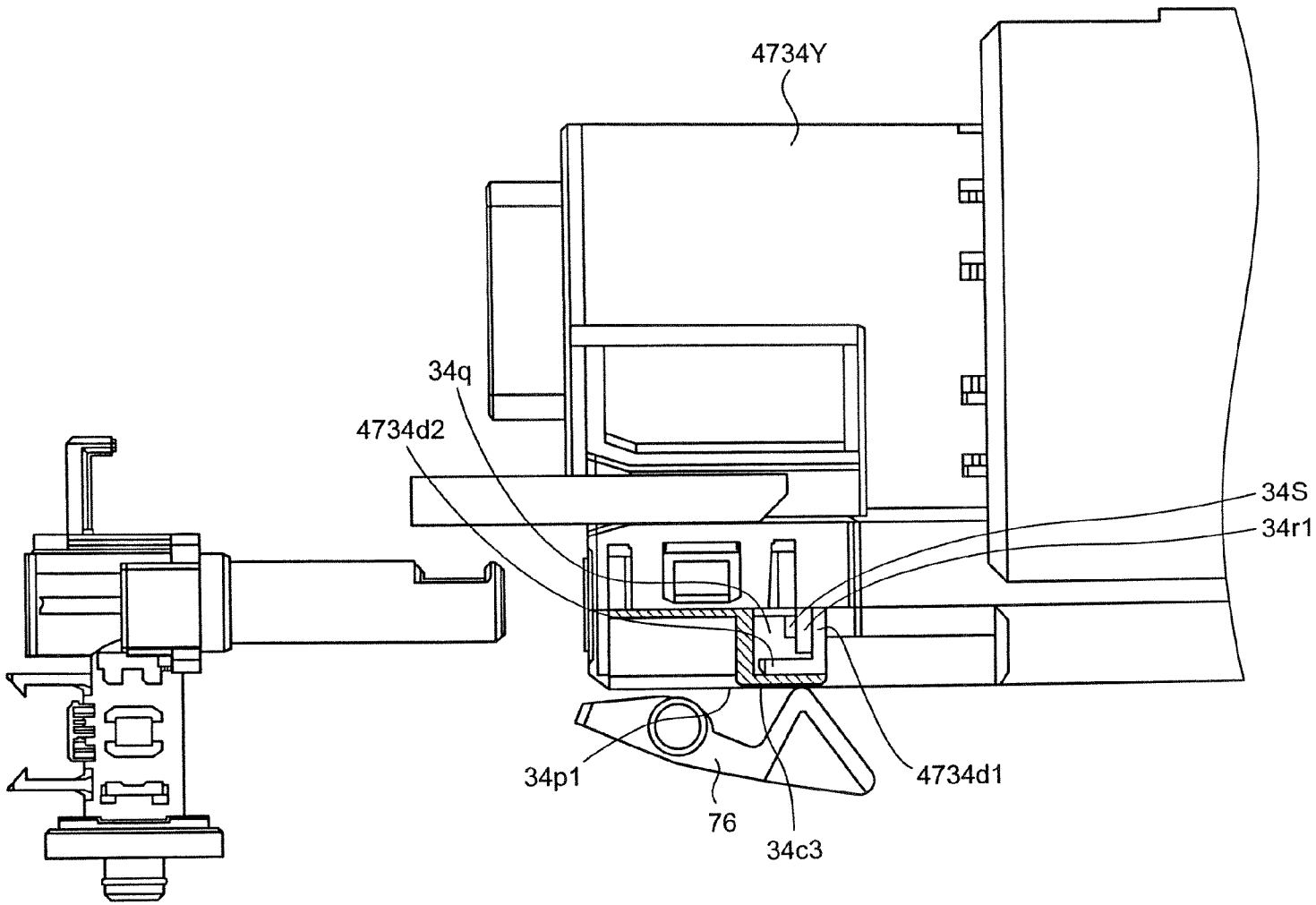
FIG. 80B is a partially cross-sectional side view of how the claw member is pushed downward to the position where the attachment of the held portion is not obstructed.
Figure 81A:
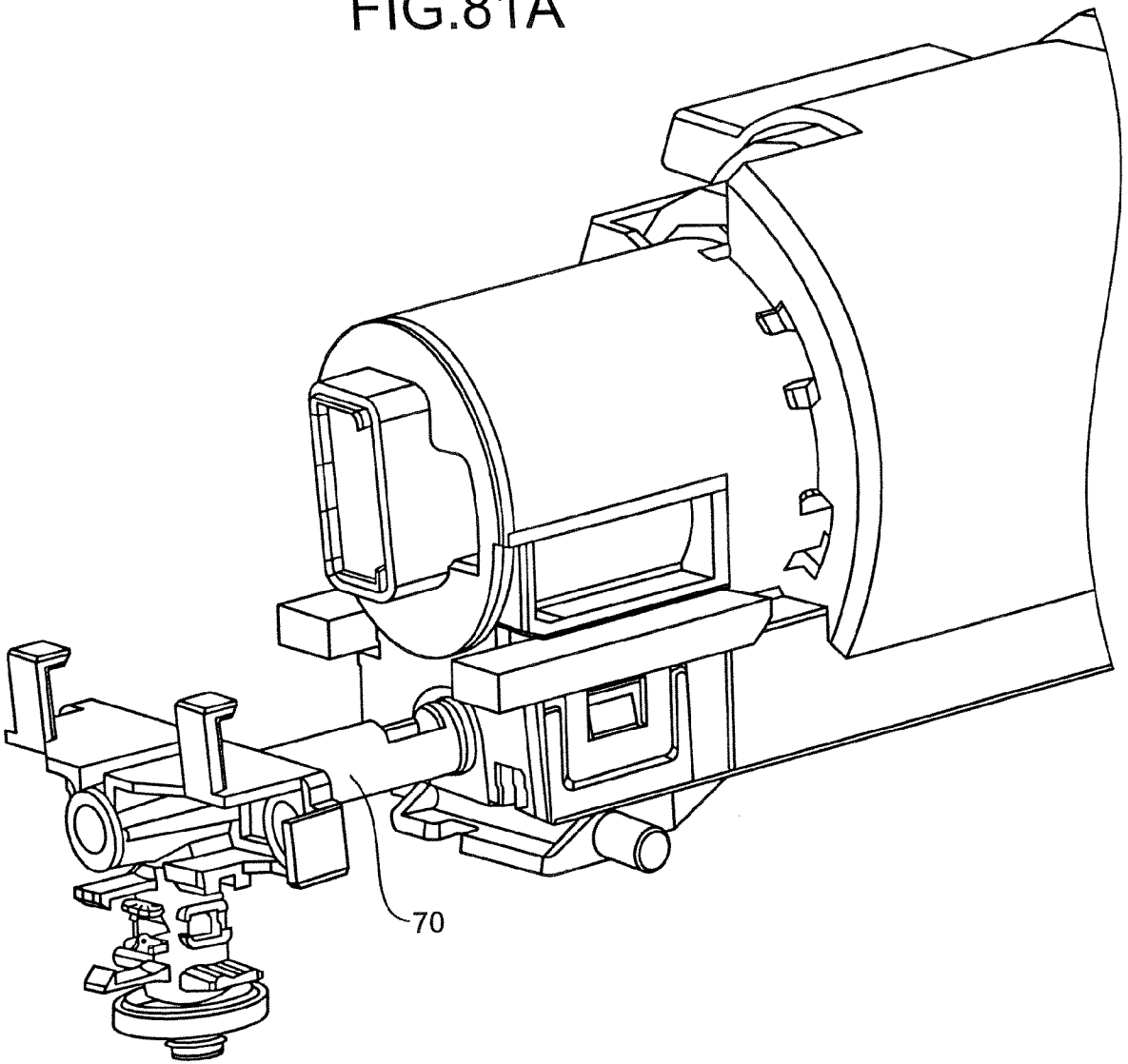
FIG. 81A is a perspective view of how the claw member returns to the default position so that the claw member is engaged with the engaging portion of the plug member after the push shown in FIG. 80A and FIG. 80B.
Figure 81B:
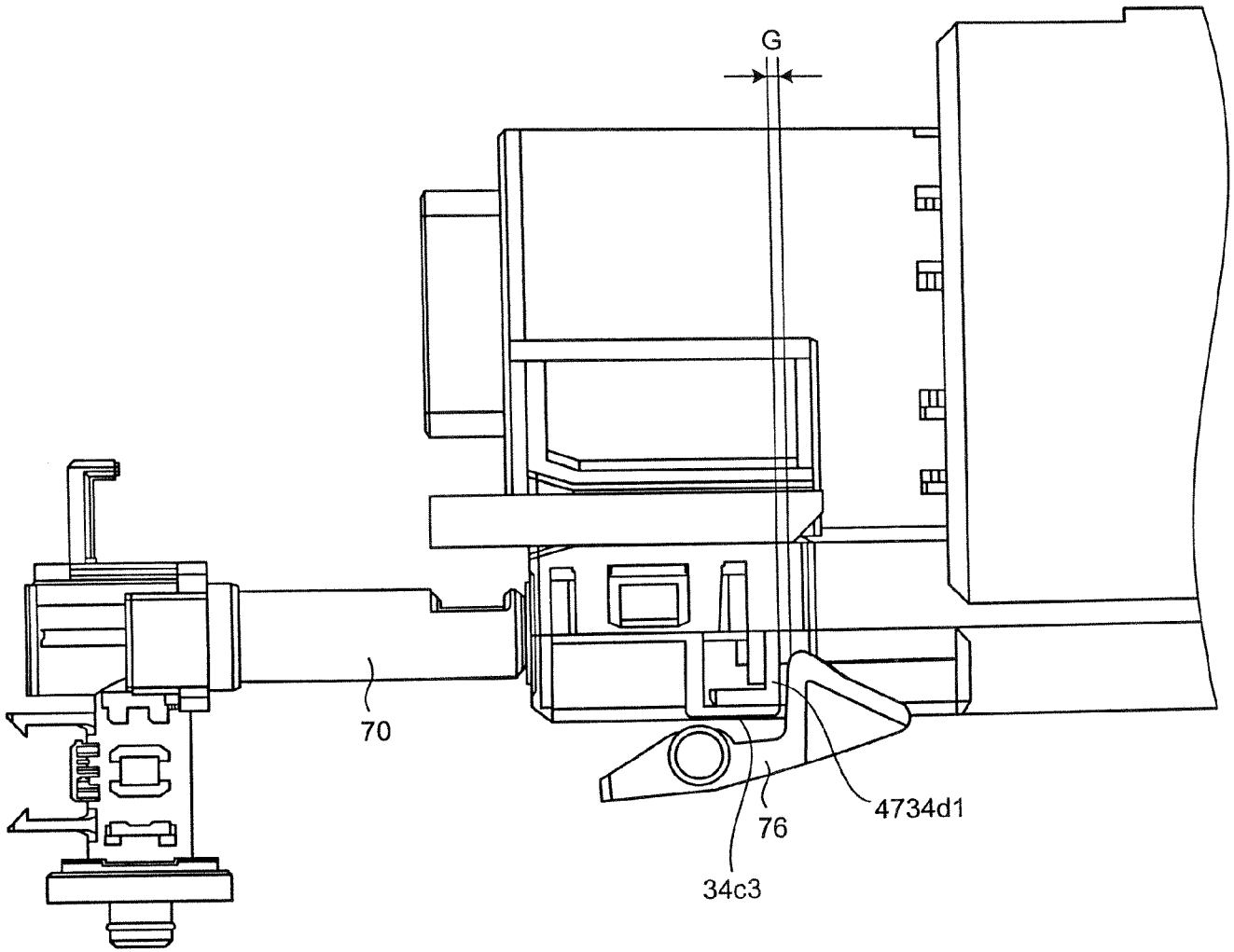
FIG. 81B is a partially cross-sectional side view of how the claw member returns to the default position so that the claw member is engaged with the engaging portion of the plug member after the push shown in FIG. 80A and FIG. 80B.

FIG. 78A is a perspective view of how the engaging portions 34*g* of the toner container 1032Y align with the positioning members 31*c* of the toner-container holder 31 during mounting of the toner container, and FIG. 78B is a side view of the same. FIG. 79A is a perspective view of how a held portion 4743Y starts to be engaged with the positioning members 31*c* and FIG. 79B is a partial cross-sectional side view of the same. FIG. 80A is a perspective view of how the claw member 76 is pushed down during the installation of the toner container and FIG. 80B is a partial cross-sectional side view of the same. FIG. 81A is a perspective view of how the claw member 76 returns to the default position so that the claw member 76 engages the engaging portion of the plug member 4734*d* during mounting of the toner container, and FIG. 81B is a partial cross-sectional side view of the same.

In FIG. 78B which shows how the positioning member 31*c* faces the engaging portion 34*g* of the toner container 32Y when viewed from the side, it looks as if the claw member 76 touches the lower corner of the held portion 4734Y, but actually, as shown in the perspective view of FIG. 78A, the groove 34*p* prevents the claw member 76 from contacting the corner.

Thereafter, in FIG. 79A and FIG. 79B which show how the attachment is progressed, the claw member 76 is further moving into the grooves 34*p* while maintaining its default position to come in contact with the corner portions 34*p*1 at the respective rear ends of the grooves 34*p*. At this time, the positioning members 31*c* already are partially engaged with the engaging portions 34*g*. Therefore, even if the upward force is applied to the positioning members 31*c* in this state from the claw member 76, the held portion 4734Y is not rotated or turned obliquely upward because of the rigidity of the positioning members 31*c*. However, the held portion 4734Y may rise slightly due to a gap of a fit tolerance between the positioning member 31*c* and the engaging portion 34*g*, but this does not cause any trouble in the insertion operation of the nozzle 70 performed afterward.

Then, as shown in FIG. 80A and FIG. 80B, the claw member 76 butts against the corner portions 34*p*1 at the rear ends of the grooves 34*p* in the entry direction of the claw member 76, and then, the claw member 76 goes onto the wall surface 34*c*3 and slides thereon. This causes the claw member 76 to maintain its posture such that it is pressed downward where the attachment of the held portion 4734Y is not obstructed.

At this time, however, the nozzle 70 does not yet contact the plug member 4734*d*. Therefore, the plug member 4734*d* is still in the closed position, and the protrusion portion 4734*d*1 and the second protrusion portions 4734*d*2 are also stored in the storage portions 34*q*. Accordingly, the claw member 76 does not push the protrusion portion 4734*d*1 before the nozzle 70 contacts the plug member 4734*d*. Thus, the erroneous-operation preventing function of the storage portions 34*q* is fulfilled.

Lastly, as shown in FIG. 81A and FIG. 81B, the claw member 76 is engaged with the back of the protrusion portion 4734*d*1 when viewed from the nozzle 70, and then, the nozzle 70 contacts the plug member 4734*d* slightly afterward and starts pushing so as to open the toner outlet B. In FIG. 56B, because there is a slight gap G between the edge of the claw member 76 and the protrusion portion 4734*d*1 to be engaged with the claw member 76, the edge of the nozzle 70 does not contact the plug member 4734*d* by the gap G at the point in time (gap G is 0) when the edge starts to engage the protrusion portion 4734*d*1.

The plug member 4734*d* is held and fixed, at the state of FIG. 81A, by the nozzle 70 and the claw member 76 which are components of the toner-container holder 31, and the toner container is further pushed therein, so that the toner outlet B and the inner cylinder portion of the nozzle 70 communicate with each other.

Eighteenth Embodiment

Figure 82:
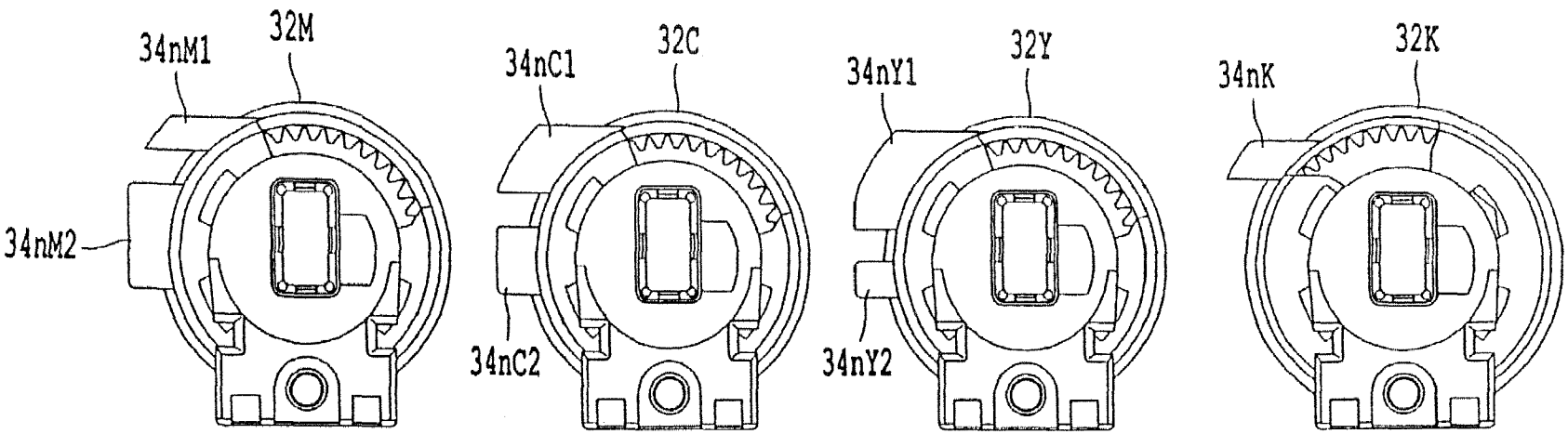
FIG. 82 is a schematic diagram of the front portion of four toner containers as arranged within an image forming apparatus.

Another feature of the invention which may be applied to any of the embodiments is explained below with reference to FIGS. 82-88. FIG. 82 is a schematic of toner containers filled with toners of colors such as yellow (Y), magenta (M), cyan (C), and black (K) respectively when viewed from the held portions 34 (Y, M, C, K) of the toner containers. As shown in FIG. 82, a convex portion (which corresponds to the convex portion 34*n* of the first embodiment) protruded from the side face of the held portion 34 is different from others in the position, the shape, and the number for each color container.

As shown in FIG. 82 which is to scale, the toner container 32K for black toner has one convex portion 34*nk* on the left side with respect to the held portion 34K. The convex portion 34*nk* is set so that the protrusion in the horizontal direction is slightly longer than that of the convex portions for the other colors at the same height. As a result, the toner container 32K is prevented from being inserted into the opening for insertion of another toner container.

The toner containers 32Y, 32M, and 32C for the other three colors have two convex portions each. Each upper-side end face of the convex portions of the toner containers is formed so as to be in a plane concentric with each container body of the toner containers, and each lower-side convex portion is formed into a cuboid. The caps or held portions are formed so that the widths of the upper-side convex portions in the vertical direction are different from one another, and that the widths of the lower-side convex portions in the vertical direction are also different from one another. In other words, the height of a space between the upper-side convex portion and the lower-side convex portion of one toner container is different from that of the others.

For the black toner container 32K, the single convex portion or projection is designated by 34*n*K, for the yellow toner container 32Y, the two convex portions or projections are designated by 34*n*Y1 and 34*n*Y2, for the cyan toner container 32C, the two convex portions or projections are designated by 34*n*C1 and 34*n*C2, and for the magenta toner container 32M, the two convex portions or projections are designated by 34*n*M1 and 34*n*M2.

Figure 83A:
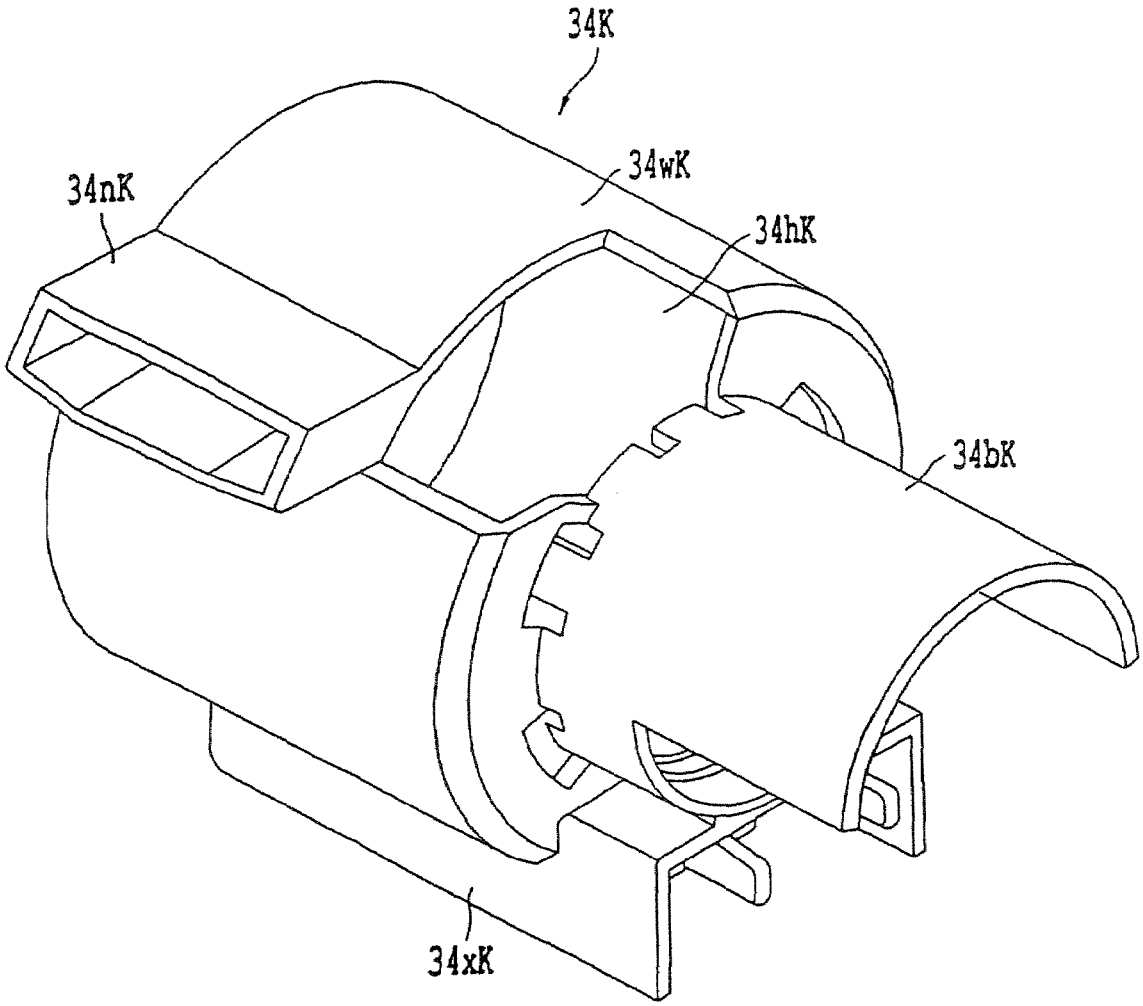
FIGS. 83A-83C are perspective views of a cap or held portion of a black toner container.

FIG. 83A is a perspective view of the held portion or cap 34K which is utilized with a container, also be referred to as a volume or bottle, which holds black toner. While a bottle has been illustrated in the figures, other types of volumes may be utilized. For each of the embodiments and colors, the invention includes both empty toner containers which do not contain toner, and toner containers which are filled with toner. While toner is the preferred substance to go in the containers, any desired material which is utilized to form an image on a page may be utilized including combinations including toner and developer, or ink, or any other substance which can be utilized to form an image. The cap or held portions 34 are illustrated in the shape that they are manufactured, but it is not necessary to manufacture such a held portion as shown. For example, the front portion of the held portion 34K or cap may be formed on the front thereof and need not be separately formed. Moreover, any style or manufacturing process may be used, as long as the features expressly recited in the claims are included.

In FIG. 83A, the held portion or cap 34K includes a notched portion 34*h*K through which a gear of a toner bottle protrudes or is accessible in order to drive or rotate the toner bottle within the held portion or cap. There is a cylindrical portion 34*w*K which has the convex portion or protrusion 34*n*K connected thereto. Regarding the convex portions or protrusions, "connected thereto" covers both integral forming of the convex portion with the held portion, or forming the convex portion or held portion separately and attaching these two elements together, for example through an adhesive, epoxy, bolts, lamination, attachment by heat, or screws, or any other manner.

Figure 83B:
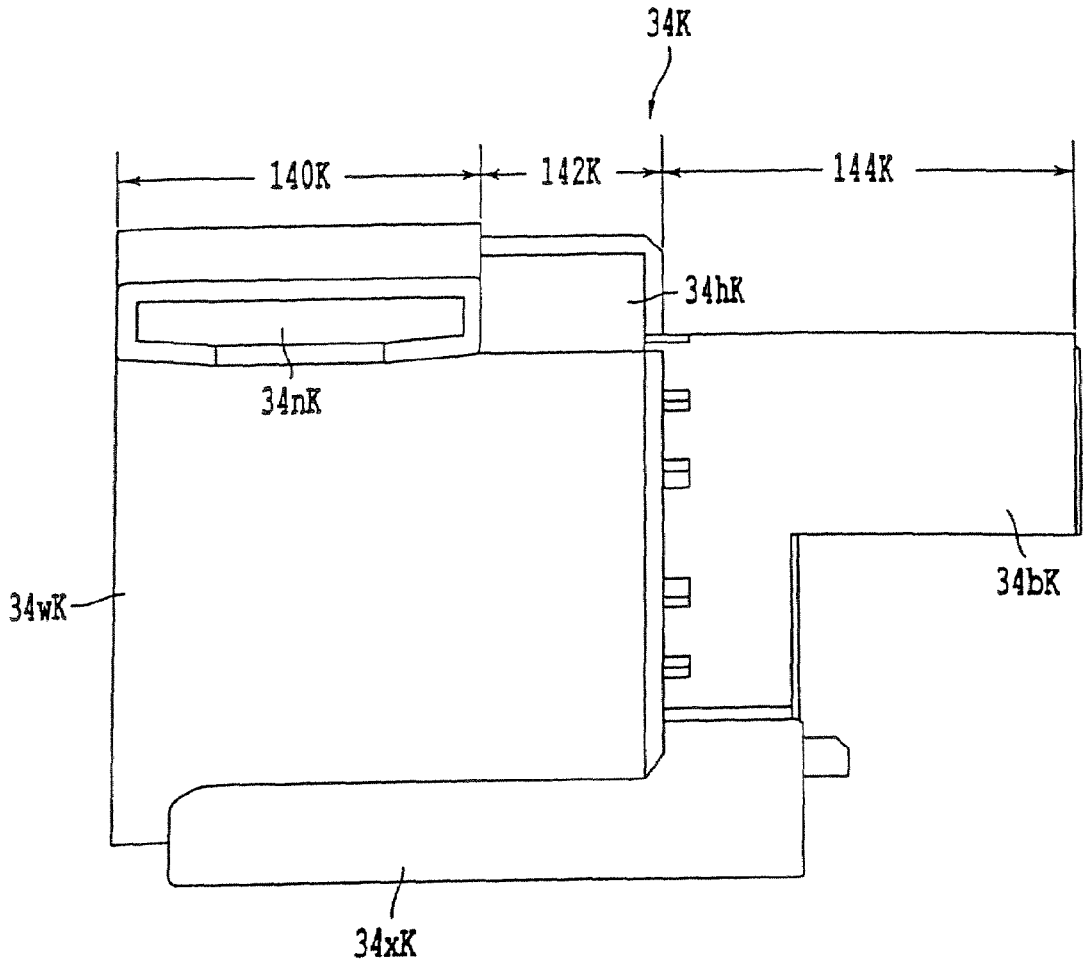

Preventing the wrong color toner from being inserted into the image forming device prevents the contamination of the image forming apparatus, prevents avoidable service calls, and results in properly formed images. In this embodiment, the dimensions of the toner container including the held portion 34K are set in order to prevent improper mounting by restricting the held portion 34K from passing through the improper opening of the enclosure plate. The length of the convex portion or protrusion 34*n*K along the axis of rotation of the storage volume is designated by 140K. The length between the leading edge of the convex portion 34*n*K and the front of the cylindrical portion 34*w*K is 142K. The length of the cap cover 34*b*K is designated by 144K. As illustrated in FIG. 83B, the edges of the convex portion 34*n*K are tapered in the vertical direction in order to assist in the insertion and removal of the toner container. Further, there may be a tapering of the convex portion 34*n*K so that as the distance from the center of the projection along the lengthwise direction increases, the distance from the center of the cylindrical portion decreases. For example, such tapering may reduce the distance from the center by 1 or 2 mm.

Figure 83C:
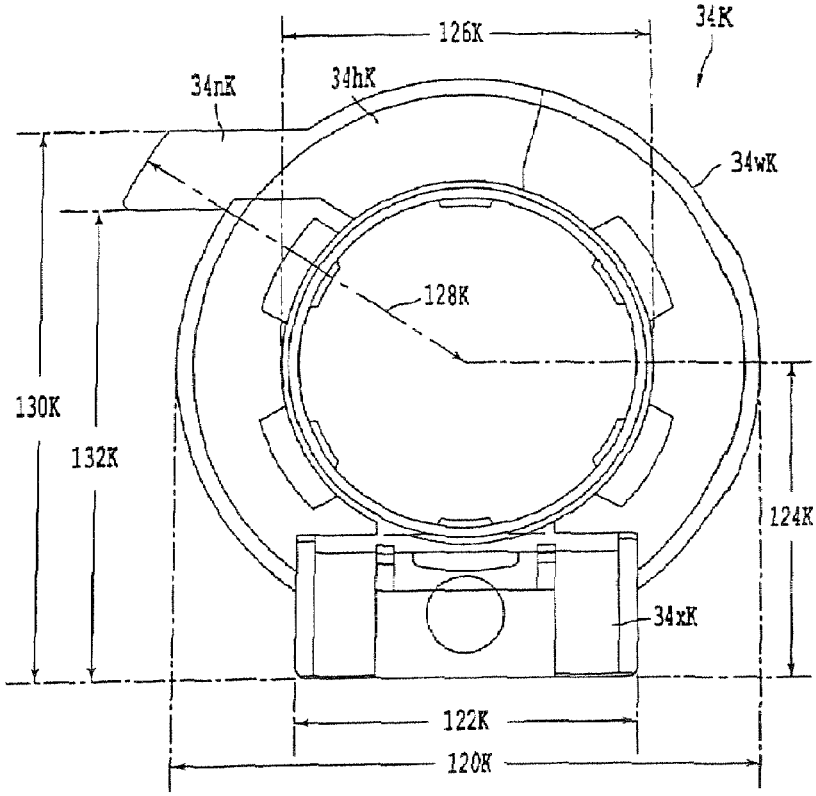

FIG. 83C illustrates various dimensions of the front of the black container. 120K designates the diameter of the cap or held portion at the cylindrical portion 34*w*K, 122K designates the width of the base, 124K designates the height from the bottom of the base 34*x*K to the center of the container, also referred to as the axis of rotation. 126K designates the diameter of the front of the cap, 128K is the radius from the axis of rotation to the center of the projection 34*n*K. If desired, this radius may decrease at the edges of the projection, for example, by 1 mm both at the top and bottom portion of the projection, for example. 130K designates the height from the base of the container to the top of the projection 34*n*K, and 132K designates the height from the bottom of the container base to the bottom of the projection. The thickness of the projection (in the vertical direction) is 130K minus 132K. The various dimensions set forth in FIGS. 83B and 83C are set forth in the below table.

Black Container

| Description | Ref. No. | Size (mm) |
|---|---|---|
| diameter of cap | 120K | 65 |
| width of base | 122K | 38 |
| height to center of container | 124K | 36.3 |
| diameter of front of cap | 126K | 42 |
| radius to projection | 128K | 43 |
| height to top of projection | 130K | 63.5 |
| height to bottom of project. | 132K | 54.5 |
| thickness of projection | | 9 |
| length of projection | 140K | 37 |
| | 142K | 19 |
| | 144K | 42.3 |

FIGS. 83A-83C, 84A-84C, 85A-85C, 86A-86C, 88A and 88B are drawn to scale. Therefore, any measurement not contained in any of the tables or otherwise described can be determined by appropriately measuring the drawings.

Figure 83D:
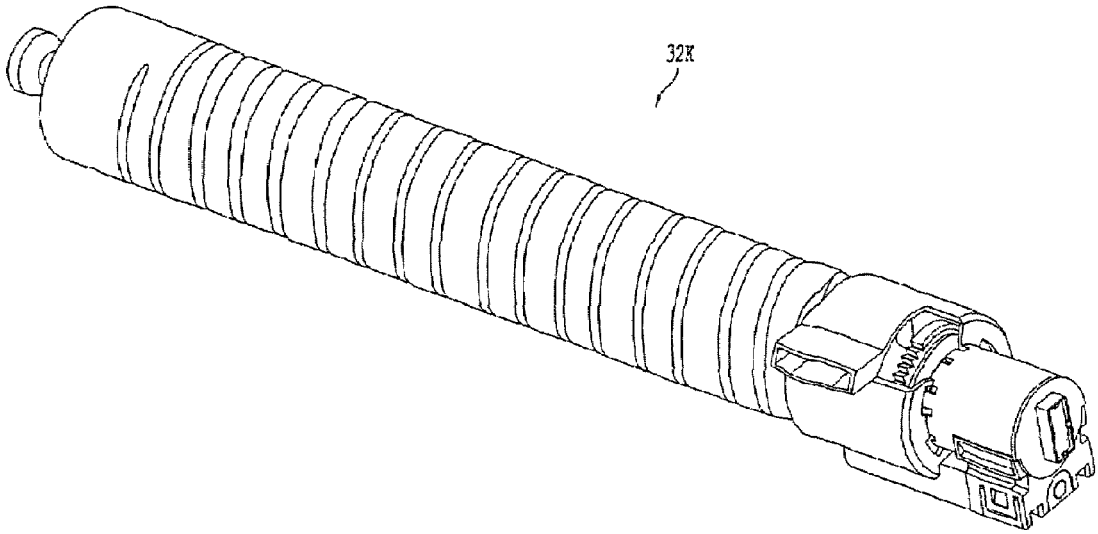
FIG. 83D is a perspective view of a black toner container.
Figure 84A:
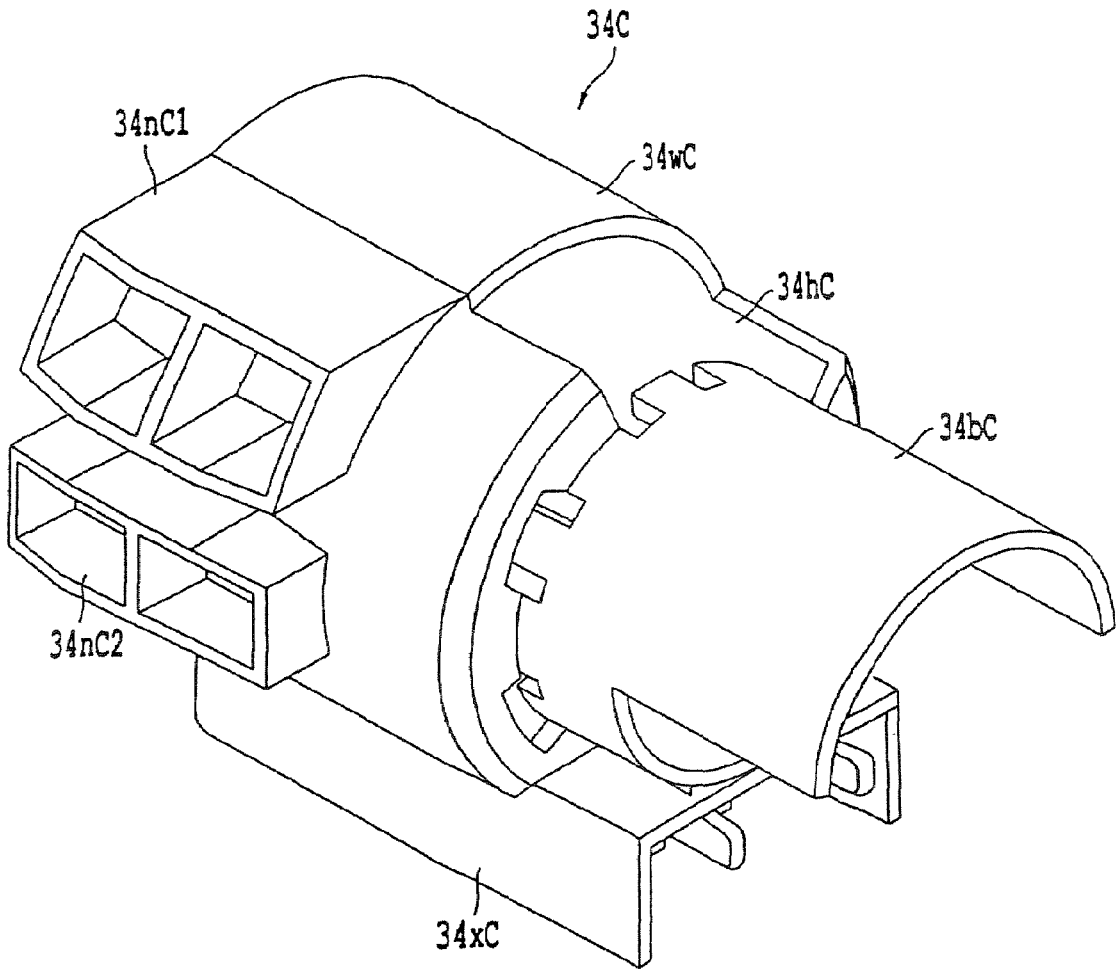
FIGS. 84A-84C are perspective views of a cap or held portion of a cyan toner container.
Figure 84B:
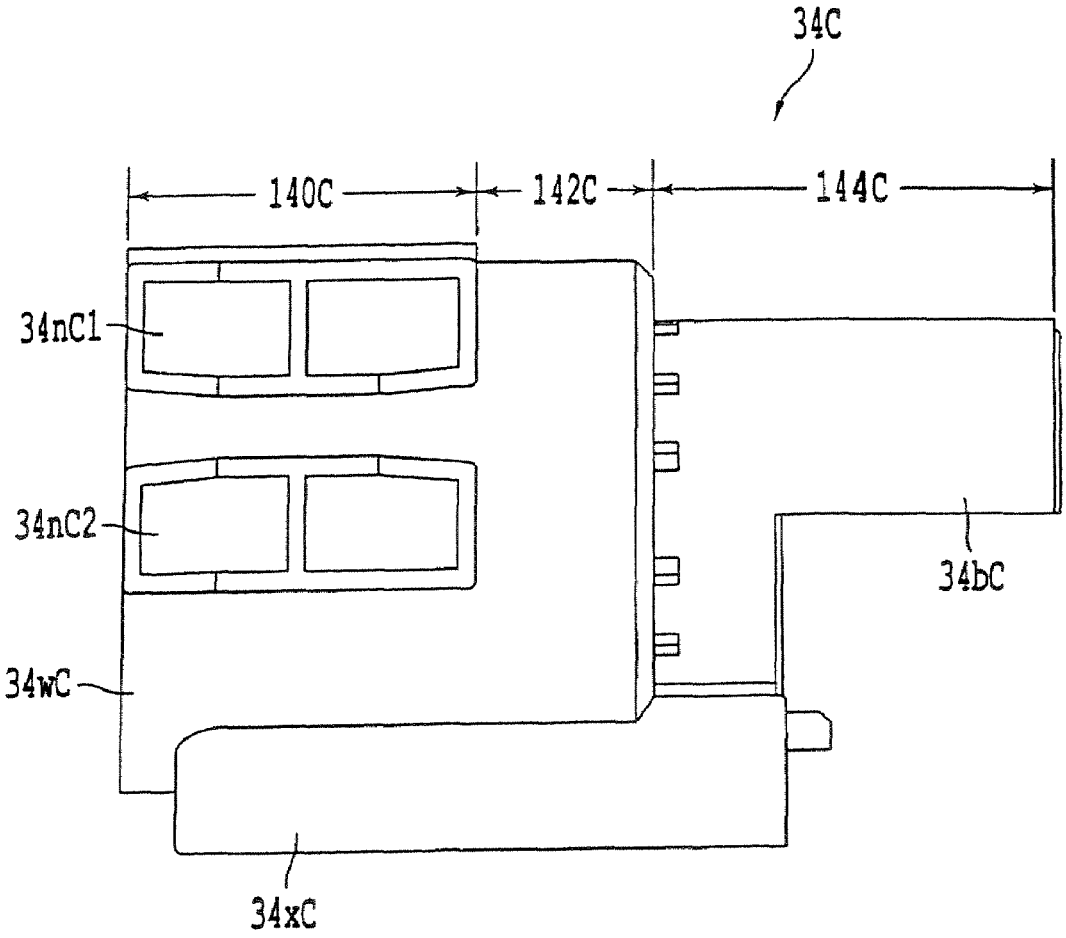
Figure 84C:
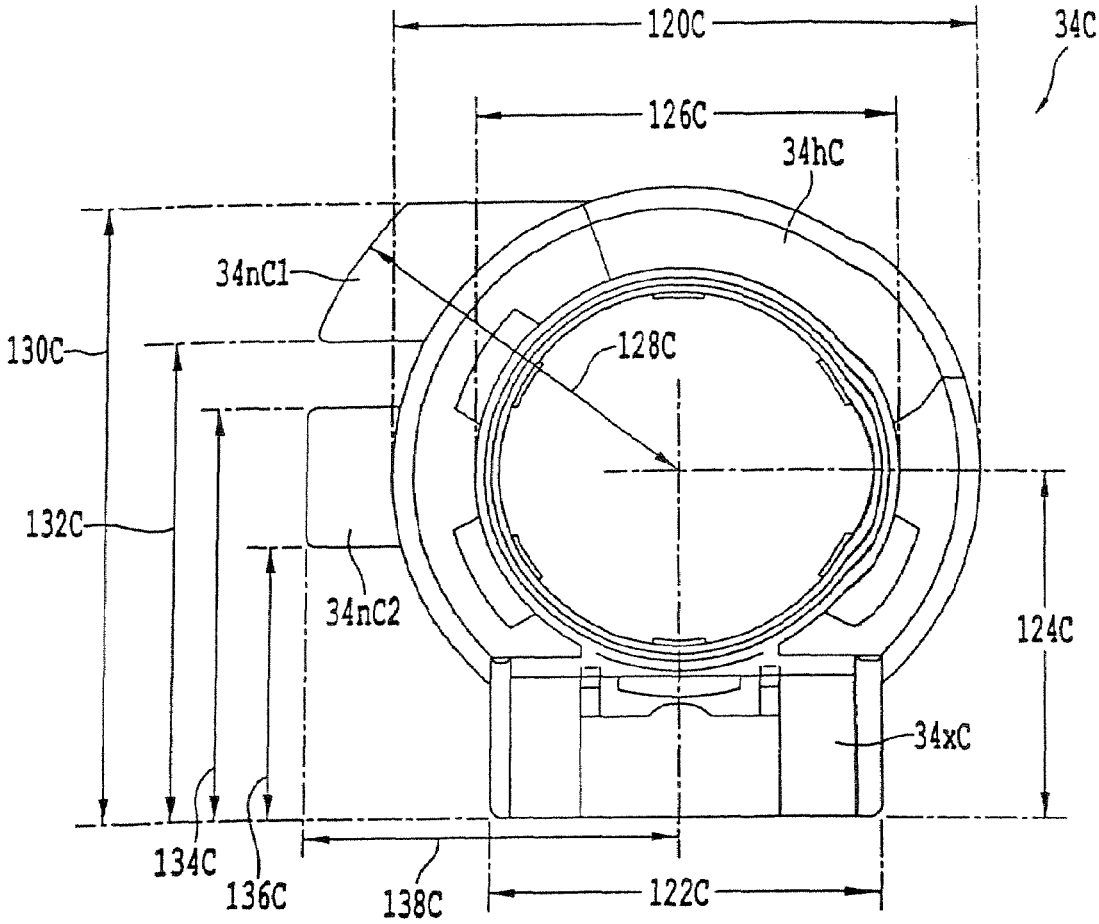
Figure 84D:
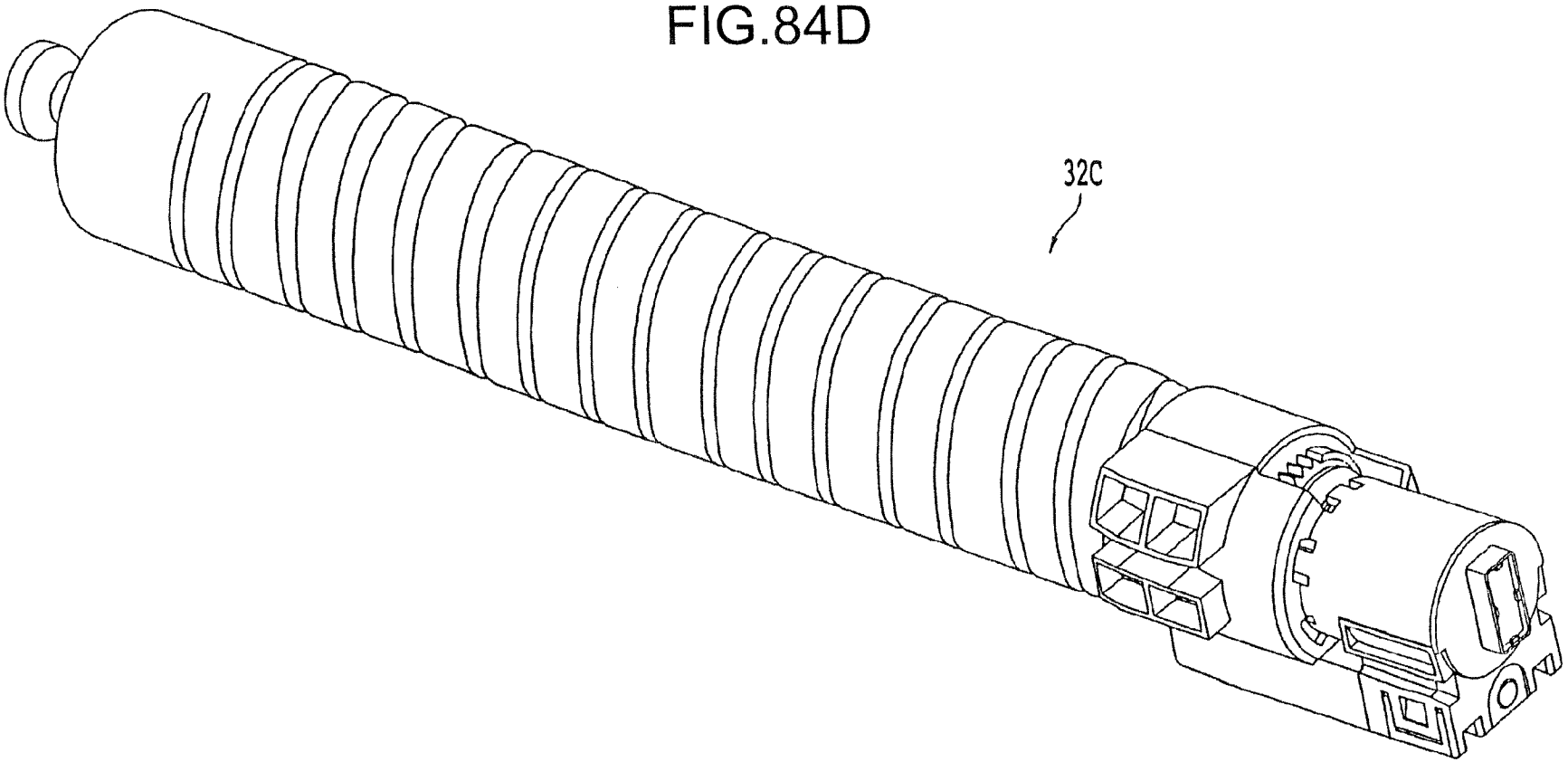
FIG. 84D is a perspective view of a cyan toner container.
Figure 85A:
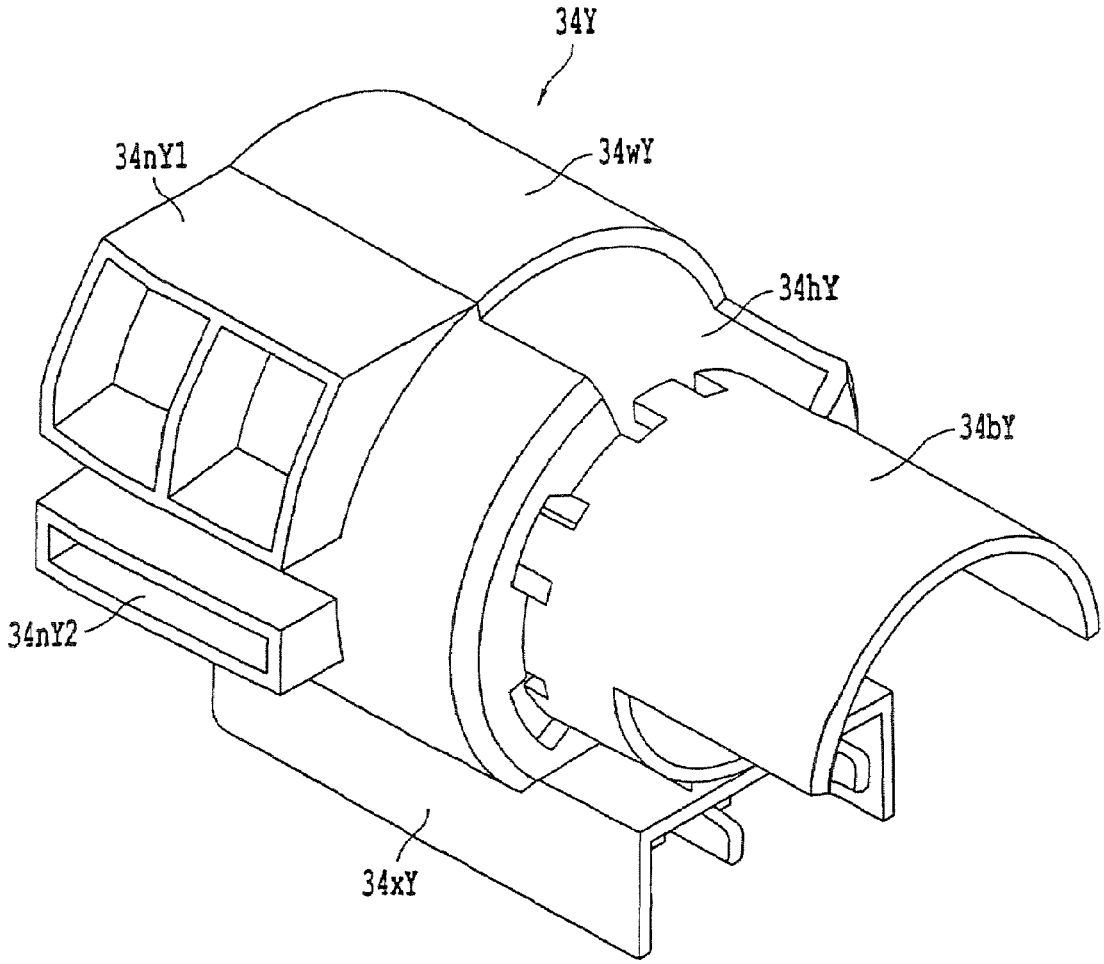
FIGS. 85A-85C are perspective views of a cap or held portion of a yellow toner container.
Figure 85B:
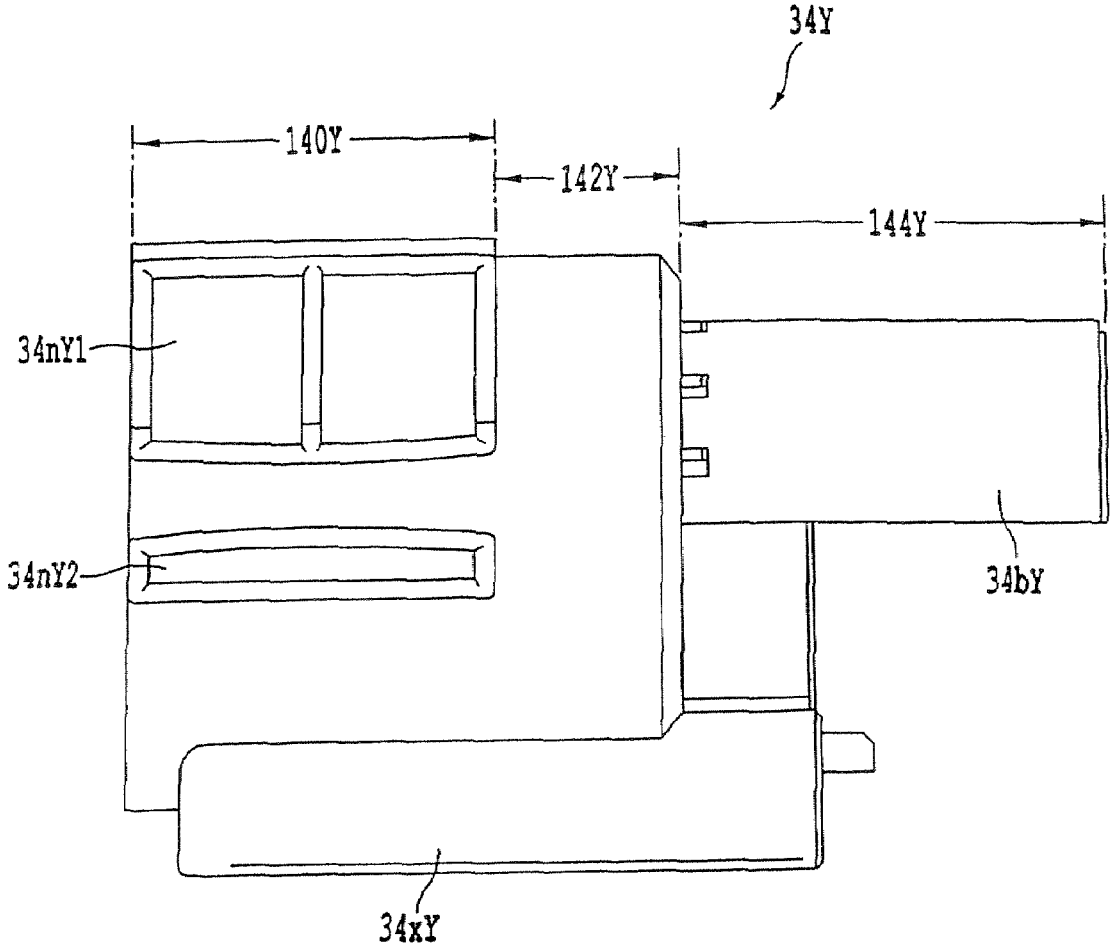
Figure 85C:
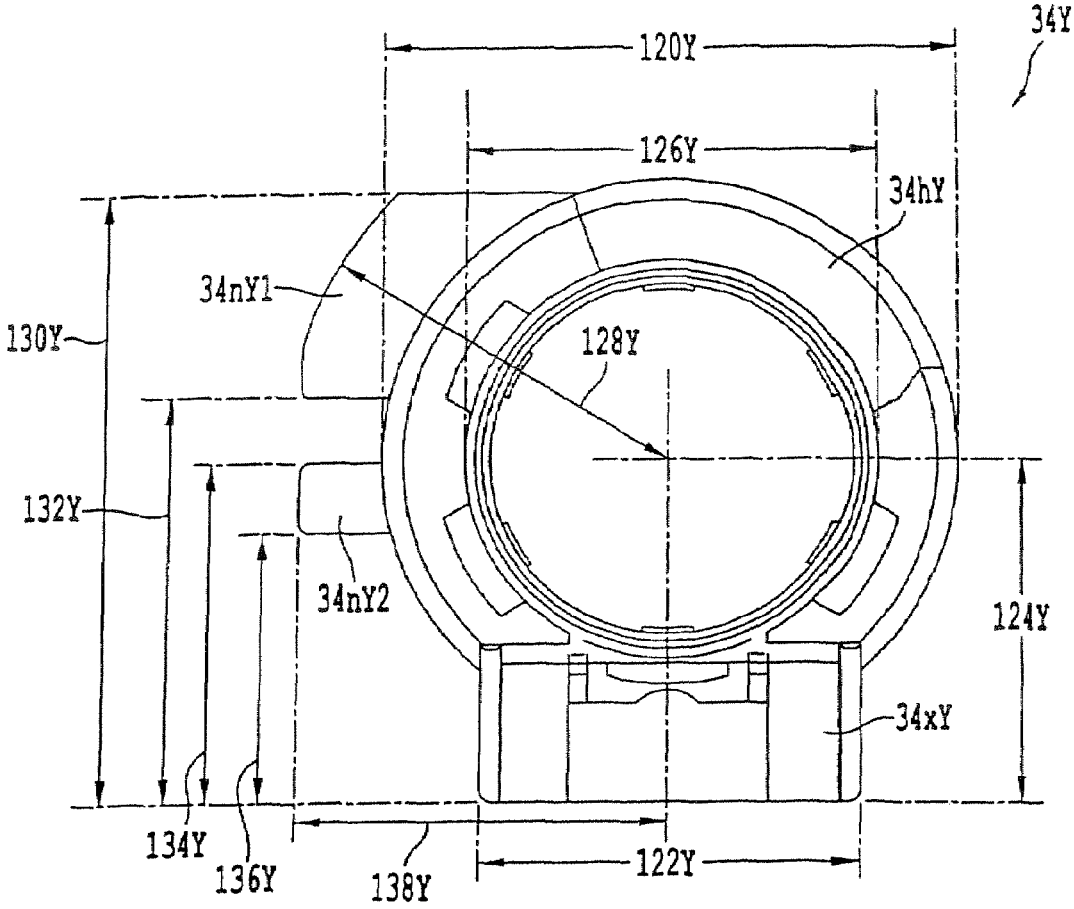
Figure 85D:
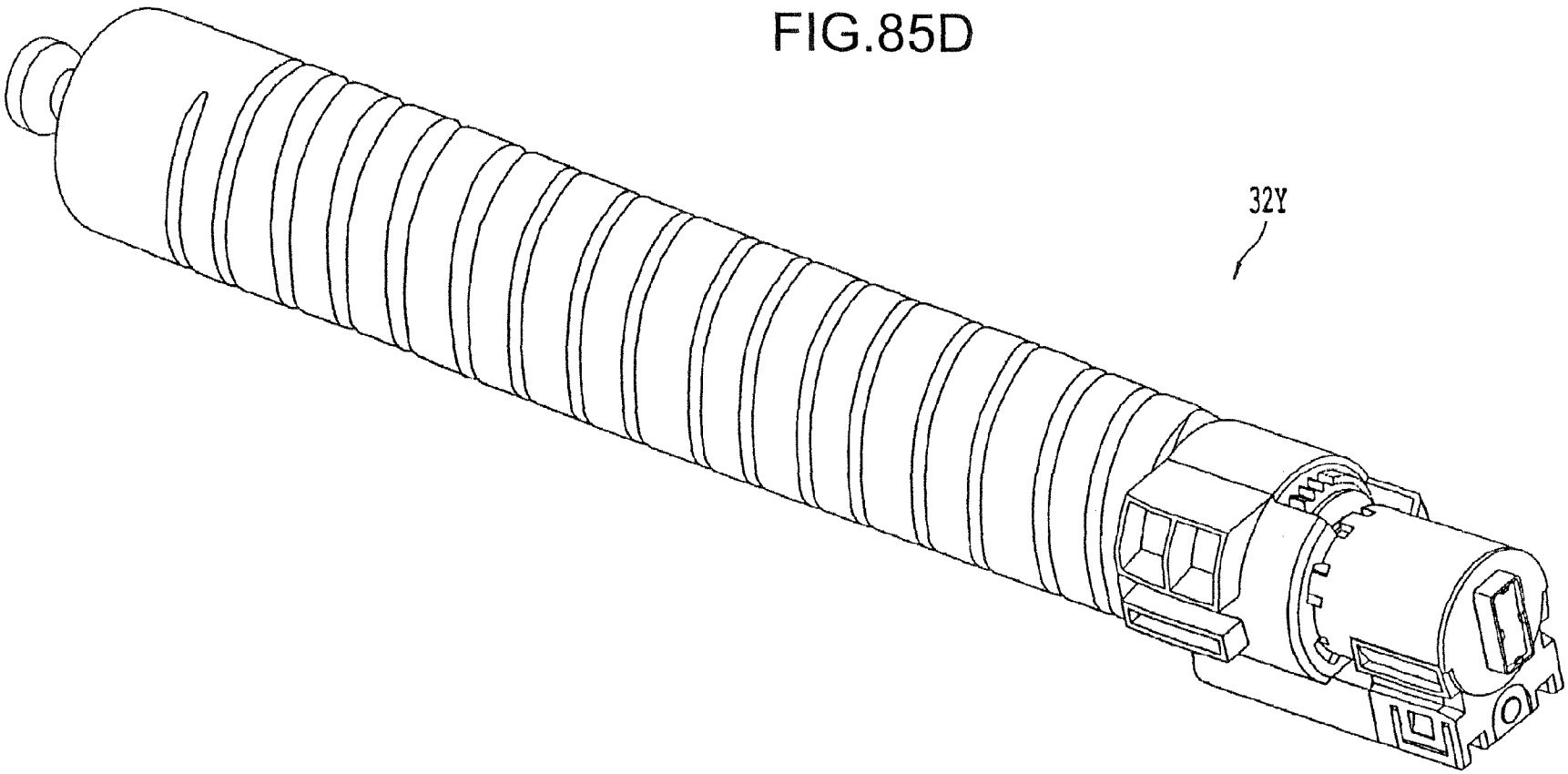
FIG. 85D is a perspective view of a yellow toner container.
Figure 86A:
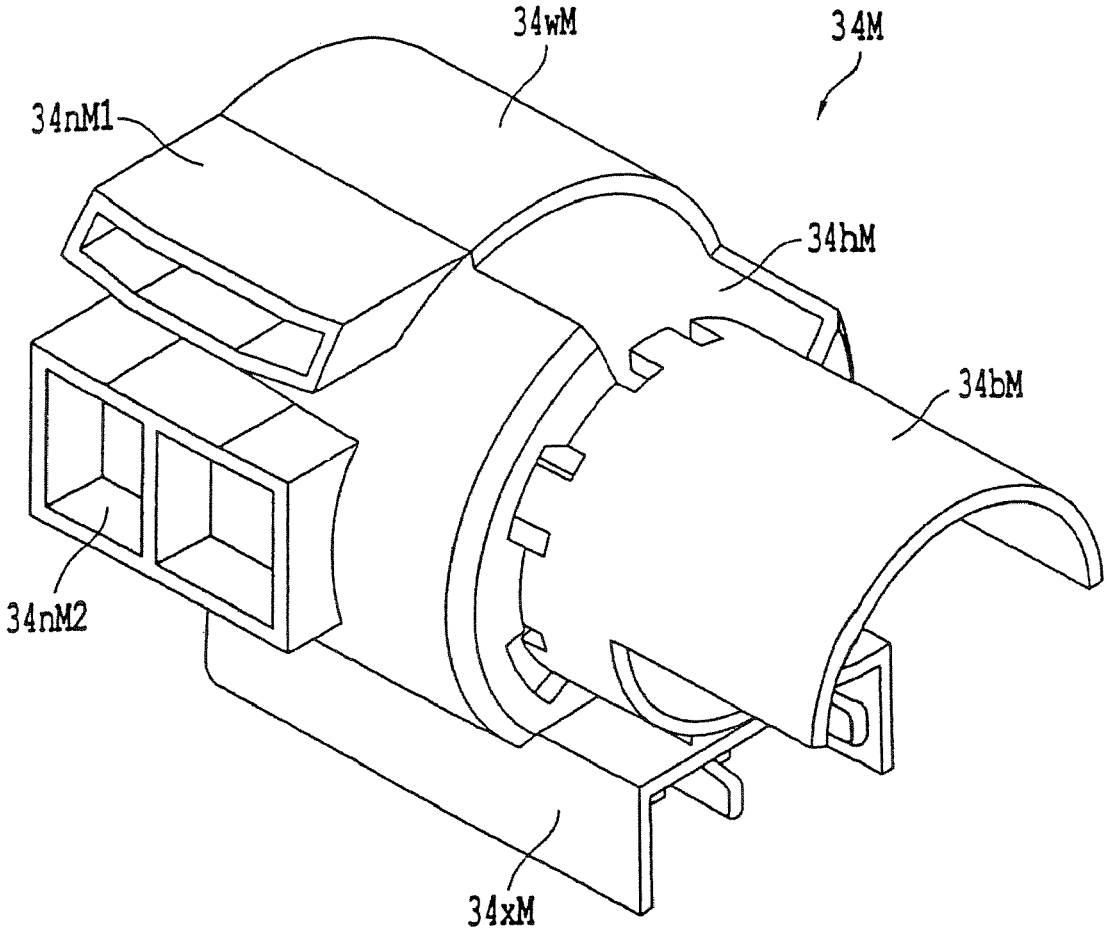
FIGS. 86A-86C are perspective views of a cap or held portion of a magenta toner container.
Figure 86B:
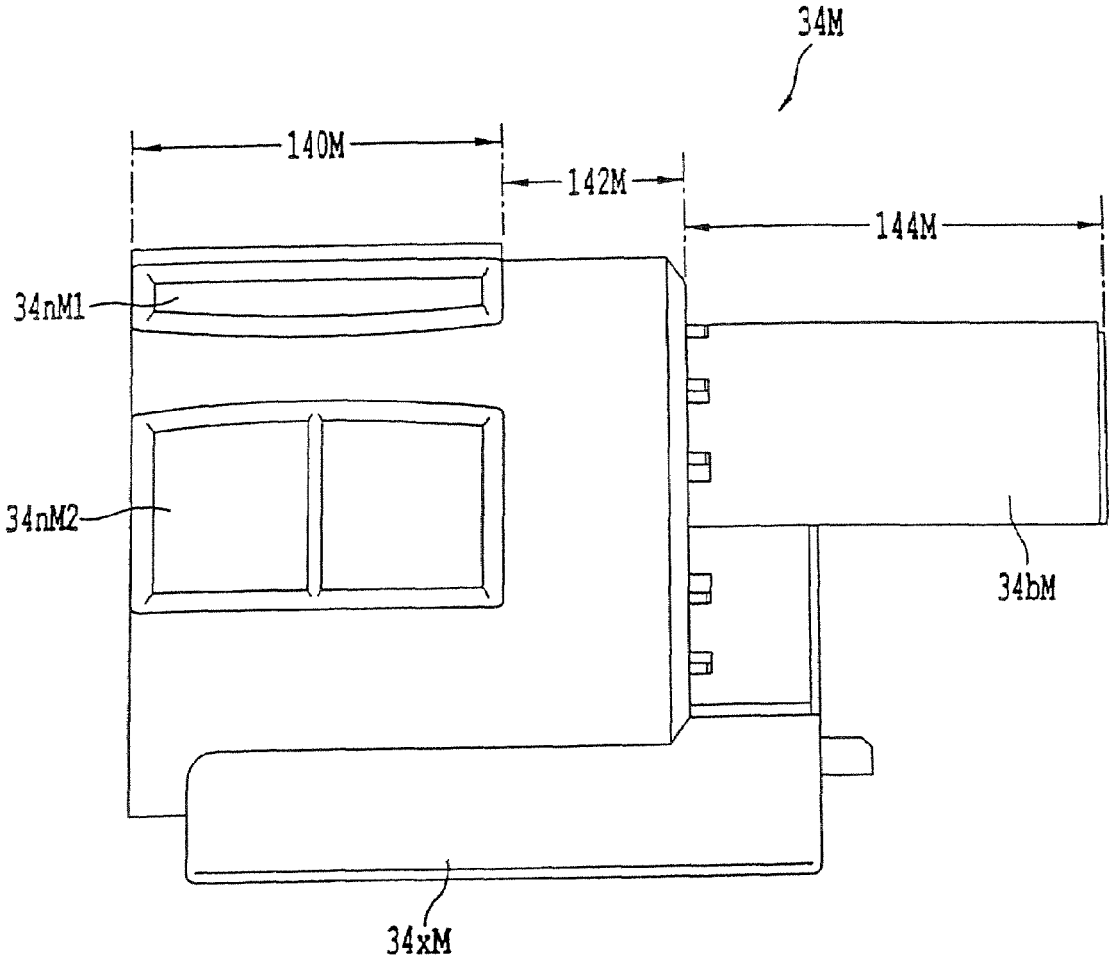
Figure 86C:
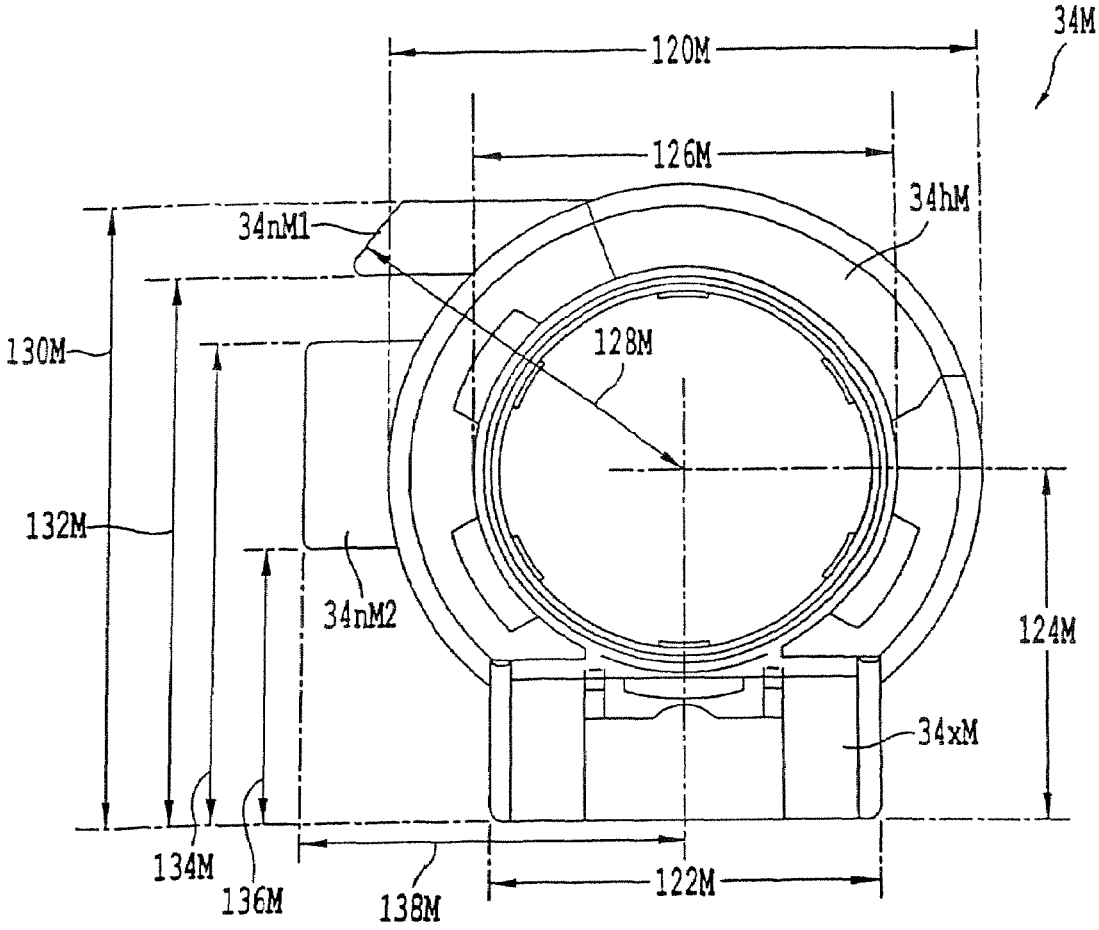
Figure 86D:
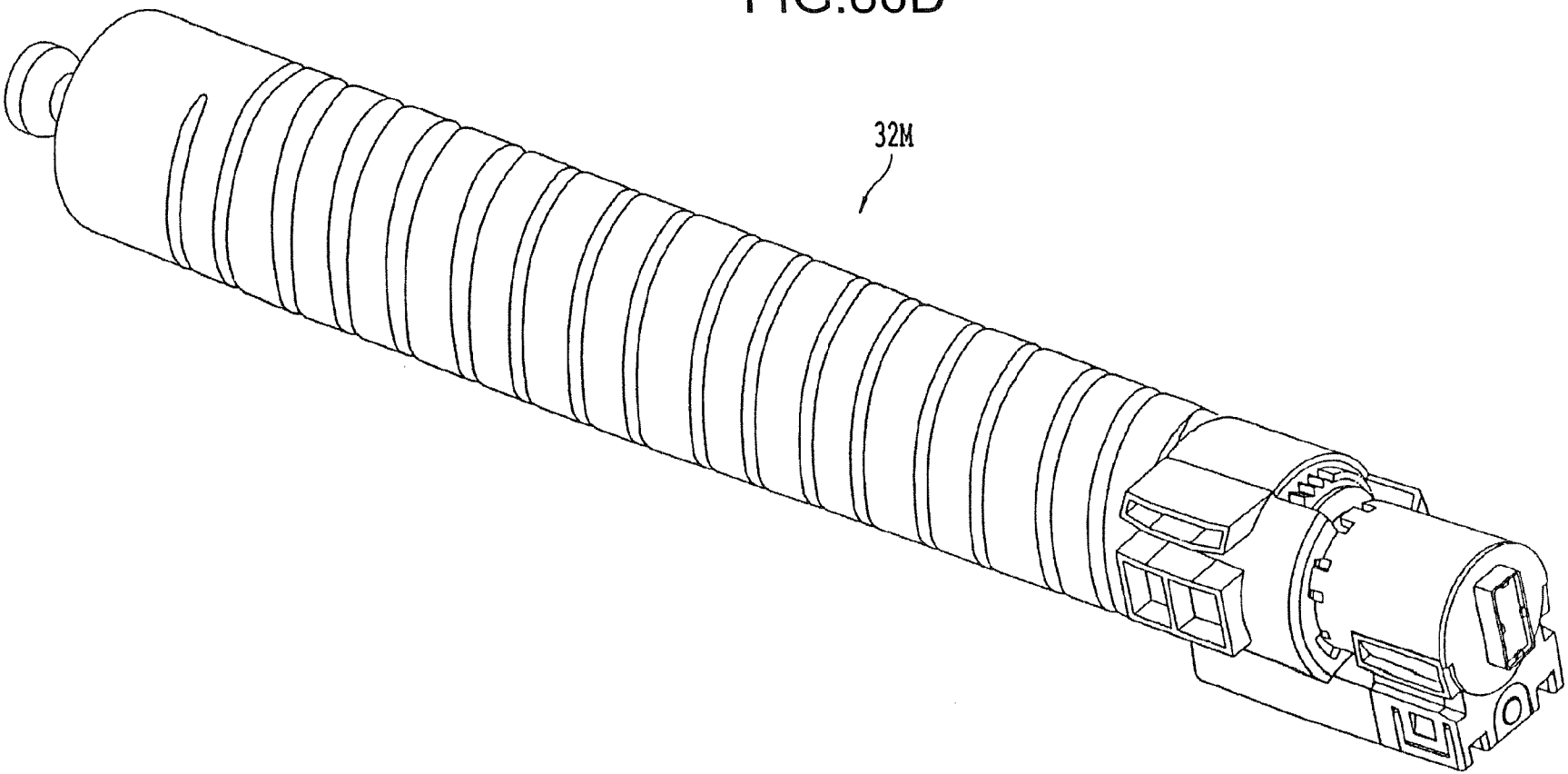
FIG. 86D is a perspective view of a magenta toner container.

FIG. 83D is a perspective view of the black toner container.

FIGS. 84A-84D are a cap for a cyan toner container and the cyan toner container, and generally correspond to FIGS. 83A-83D and explanations of the same components are omitted. A difference between the cyan toner container and the black toner container is that the cyan toner container includes two convex protrusions or projections 34*n*C1 and 34*n*C2 whereas the black toner container includes one projection 34*n*K. The dimensions for the cyan toner container are set forth below.

Cyan Container

| Description | Ref. no. | Size (mm) |
|---|---|---|
| diameter of cap | 120C | 59 |
| width of base | 122C | 38 |
| height to center of container | 124C | 36.3 |
| diameter of front of cap | 126C | 42 |
| radius to projection | 128C | 40 |
| height to top of projection 1 | 130C | 64.5 |
| height to bottom of project. 1 | 132C | 50 |
| thickness of projection 1 | | 14.5 |
| height to top of projection 2 | 134C | 43 |
| height to bottom of project. 2 | 136C | 28.5 |
| thickness of projection 2 | | 14.5 |
| Distance of outer edge of projection 2 from center | 138C | 38 |
| length of projections | 140C | 37 |
| | 142C | 19 |
| | 144C | 42.3 |

FIGS. 85A-85D illustrate features of the yellow toner container and have the dimensions as set forth below.

Yellow Container

| Description | Ref. no. | Size (mm) |
|---|---|---|
| diameter of cap | 120Y | 59 |
| width of base | 122Y | 38 |
| height to center of container | 124Y | 36.3 |
| diameter of front of cap | 126Y | 42 |
| radius to projection | 128Y | 40 |
| height to top of projection 1 | 130Y | 64.5 |
| height to bottom of project. 1 | 132Y | 43 |
| thickness of projection 1 | | 21.5 |
| height to top of projection 2 | 134Y | 36 |
| height to bottom of project. 2 | 136Y | 28.5 |
| thickness of projection 2 | | 7.5 |
| Distance of outer edge of projection 2 from center | 138Y | 38 |
| length of projections | 140Y | 37 |
| | 142Y | 19 |
| | 144Y | 42.3 |

FIGS. 86A-86D illustrate features of the magenta toner container and descriptions of the same portions which have already been described above with respect to the other toner containers are omitted. The dimensions for the magenta toner container are as set forth below:

Magenta Container

| Description | Ref. no. | Size (mm) |
|---|---|---|
| diameter of cap | 120M | 59 |
| width of base | 122M | 38 |
| height to center of container | 124M | 36.3 |
| diameter of front of cap | 126M | 42 |

-continued

Magenta Container

| Description | Ref. no. | Size (mm) |
|---|---|---|
| radius to projection | 128M | 40 |
| height to top of projection 1 | 130M | 64.5 |
| height to bottom of project. 1 | 132M | 57 |
| thickness of projection 1 | | 7.5 |
| height to top of projection 2 | 134M | 50 |
| height to bottom of project. 2 | 136M | 28.5 |
| thickness of projection 2 | | 21.5 |
| Distance of outer edge of projection 2 from center | 138M | 38 |
| length of projections | 140M | 37 |
| | 142M | 19 |
| | 144M | 42.3 |

The perspective view of the toner container set forth in FIGS. 83D, 84D, 85D, and 86D may include bottles which have a substantially constant radius, or the radius may be different for different portions of the bottle.

Figure 87A:
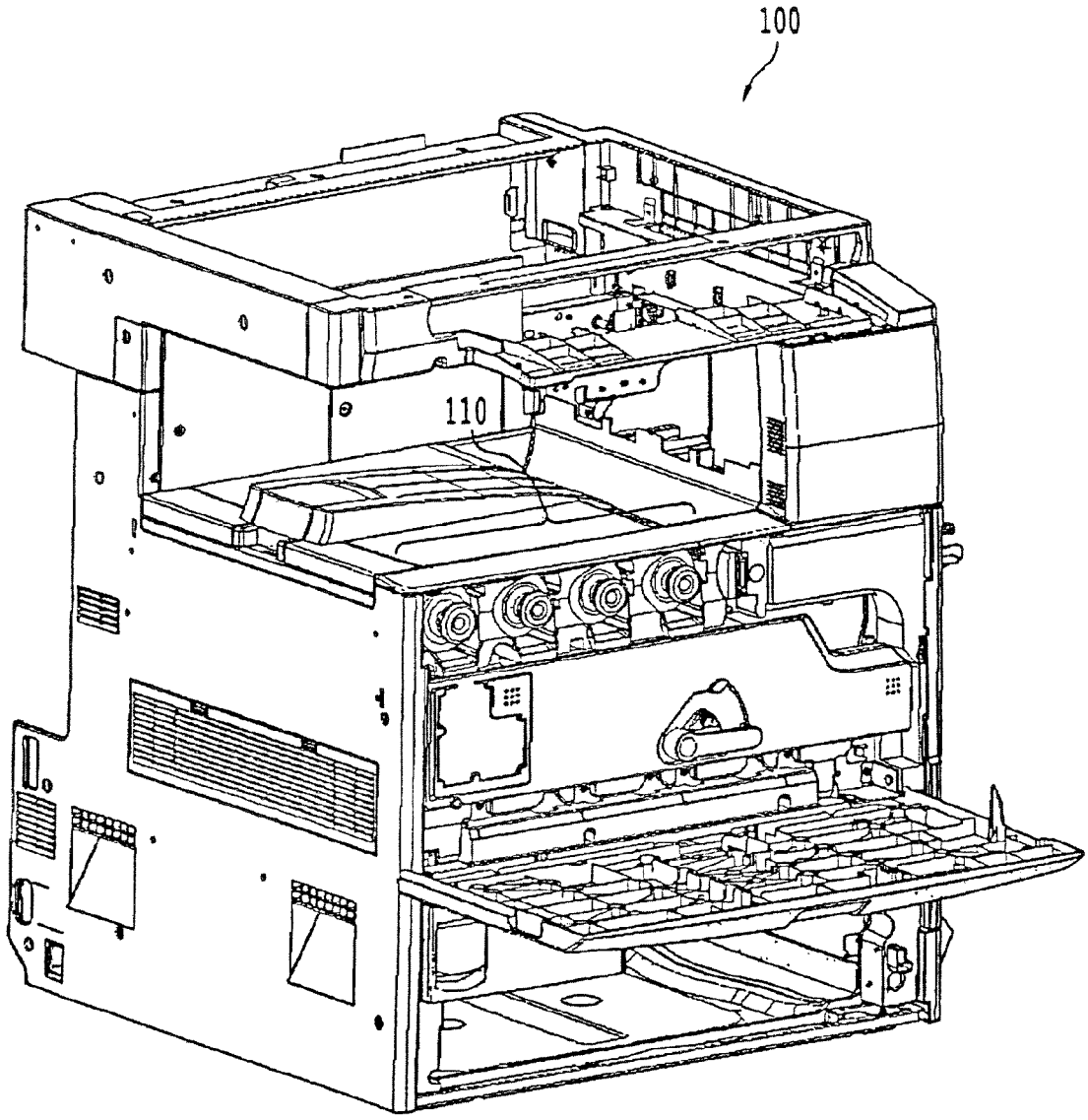
FIG. 87A is a perspective view of an exemplary image forming apparatus which receives the toner containers of the present invention.
Figure 87B:
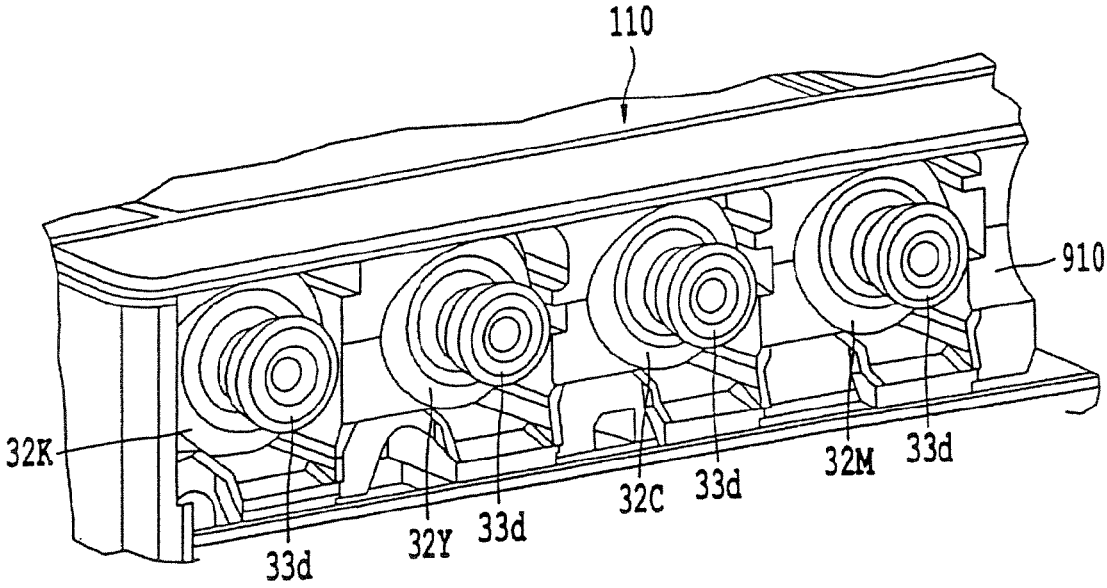
FIG. 87B is a close-up of a perspective view of the toner containers inserted into the image forming apparatus.

FIG. 87A illustrates an image forming apparatus which utilizes the toner containers of the invention. The opening 110 at the front portion is the region at which the toner containers are inserted into the image forming device 100. FIG. 87B is a close-up of the region 110 and shows the four toner containers 32K, 32Y, 32C, and 32M, each having a gripper 33*d* which allows a user to hold the rear of the toner container during the insertion and removal process. Also shown in FIG. 87B is a plate 910, discussed below with respect to FIGS. 85A and 88B which restricts which color toner container is inserted into which position.

Figure 88A:
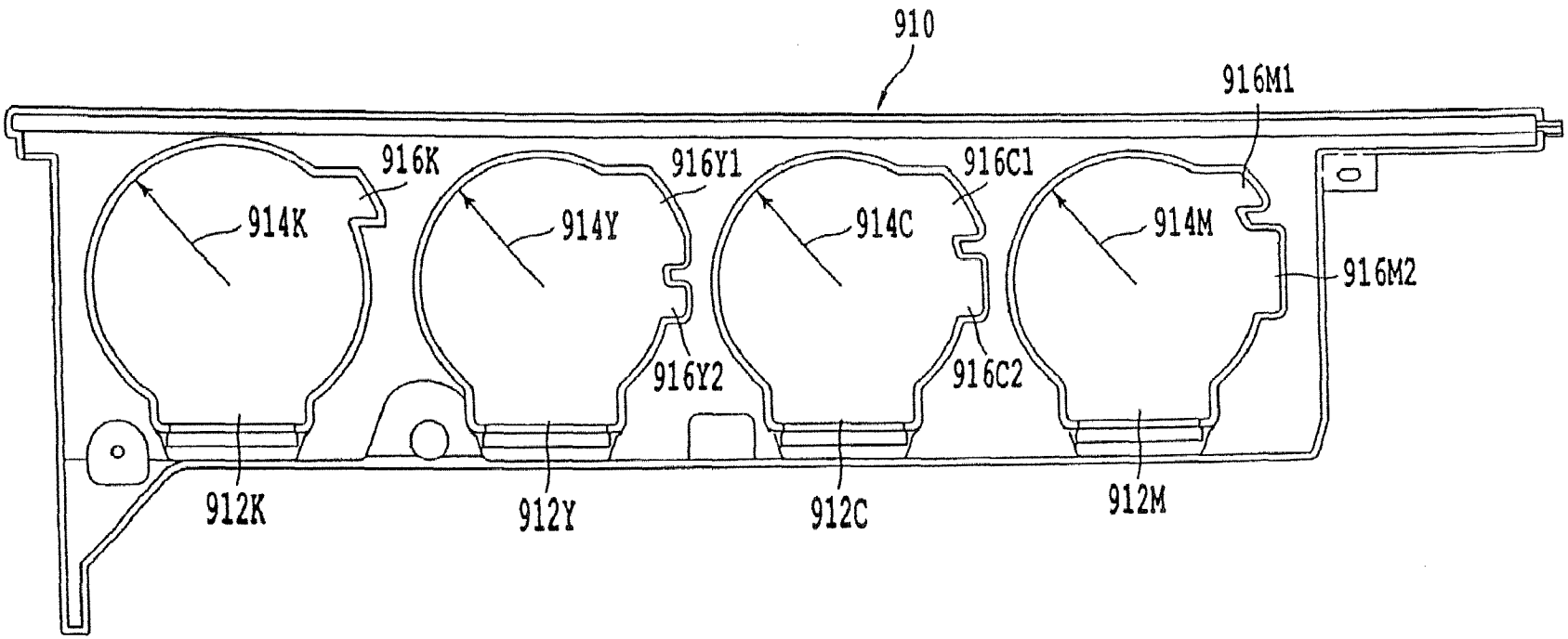
FIG. 88A is a schematic view of en enclosure plate.

FIG. 88A shows a front view of the plate 910. Because the image forming apparatus 100 uses four different color toner containers, the plate 910 has four openings for receiving the four different color toner containers, although the plate can be constructed to receive more or less toner containers, as desired.

The four openings in FIG. 88A are shown as 912K for the black container, 912Y for the yellow container, 912C for the cyan container, and 912M for the magenta. The opening 912K for the black container includes a protrusion portion 916K for accepting the one protrusion of the black toner container. The opening 912K contains a substantial portion which is circular in shape, and has a radius 914K which is designed to accommodate the black toner container, and also serves to restrict the other toner containers. The openings for the yellow, cyan, and magenta toner containers each include two projections for receiving a corresponding projections on the toner containers. The opening 912Y for the yellow container contains a radius of 914Y, and protrusion portions 916Y1 and 916Y2. The shapes and positions of the protrusion portions of the openings configured to receive the cyan and magenta containers also contain two protrusion portions, but the size and position of those protrusion portions are different for each toner container.

Figure 88B:
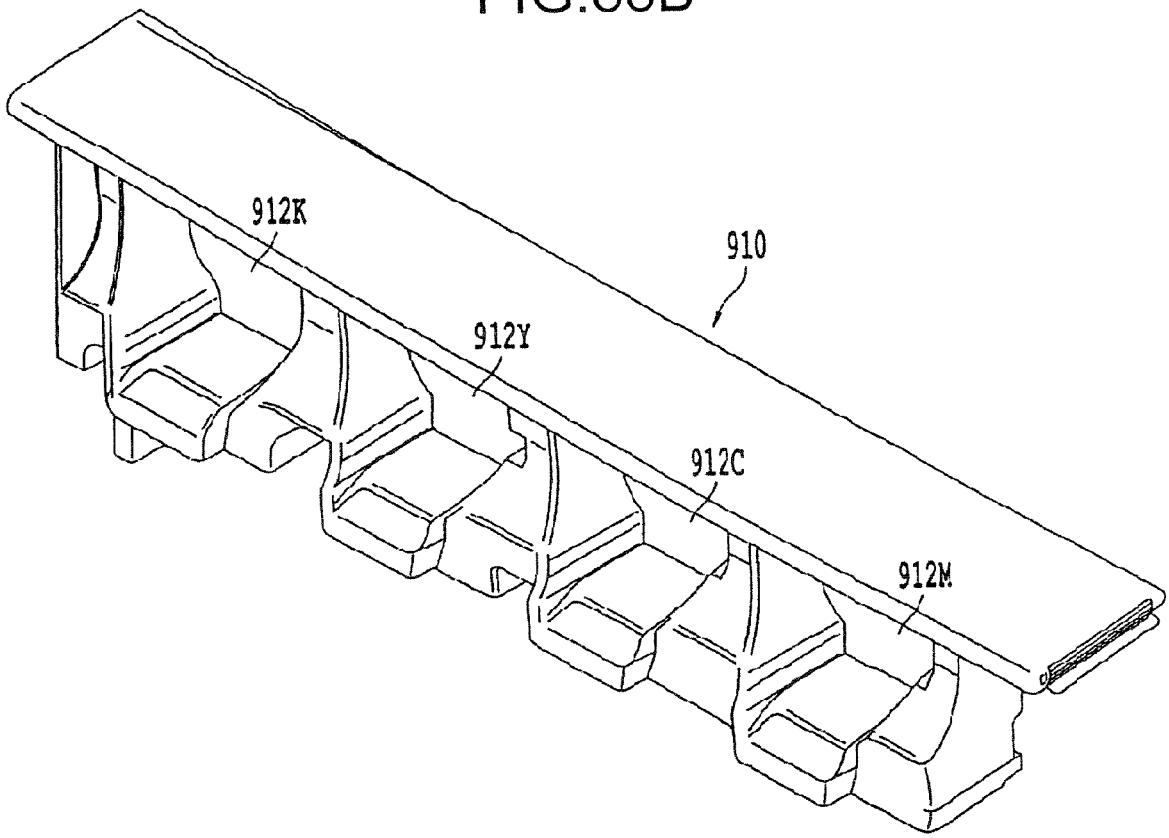
FIG. 88B is a perspective view of the enclosure plate.

A perspective view of the plate 910 is shown in FIG. 88B. Depending on the construction of the machine, the plate may have a substantially flat or two-dimensional structure, or may be constructed to have a three-dimensional structure, as shown in FIG. 88B. The plate 910 shown in FIG. 88B may be mounted at the front of the image forming apparatus, as shown in FIG. 87A, and the enlargement in FIG. 87B. Alternatively or additionally, the plate may be mounted at an interior portion of the image forming apparatus, for example, at or near a position which results in the protrusions of the toner containers remaining at an interior of the holes 912 of the plate 910 when the toner containers are in use.

According to an embodiment of the invention, the radius 914 of the holes 912 in the plate 910 are 32.5 mm for the cyan, magenta, and yellow holes, and 35.5 mm for the black hole in the plate 910. Also according to the preferred commercial embodiment, the radius of the cyan, magenta, and yellow container body or bottle is 31.5 mm and the radius of the black container body or bottle is 34.5 mm. Since black toner is generally consumed at a higher rate than the other colors, it is preferable for the black container to hold more toner. The present inventors have found that by setting the various dimensions of the frame to be 2 mm larger than the corresponding dimensions of the bottle and/or the cap, the toner container can be properly inserted into its corresponding opening in the image forming apparatus, while preventing the wrong color toner bottle from being inserted into a non-corresponding potion. However, as long as the relative sizes of the frame openings and the toner containers appropriately prevent a container from being inserted at an improper position, the differences between the toner container size and frame may be changed, as desired.

Various dimensions of the components of the invention have been provided herein, but those dimensions in relationships to each other are not required by the invention, unless specifically recited in the claims. Further, the invention includes a changing of any of the dimensions, for example, by increasing or decreasing any of the dimensions by 5%, 10%, 15%, 20%, 25%, 30%, or 35%, or any value in between, for example. Further, the dimensions and the relative relations can be changed even more, if desired, as long as the system functions in the desired manner.

Various dimensions and relations may be utilized in order to prevent the wrong color toner from being used in an improper position in the image forming apparatus. For example, for the cyan, yellow, and magenta color toner containers, there are two projections. When viewed in the vertical direction, the thickness of the projections (reference number 130 minus 132, and 134 minus 136) are configured such that a sum of a thickness of the two projections in the vertical direction is less than or equal to a radius of the cylindrical-shaped portion of the cap. Further, an outer edge of at least one of the projections has a minimum distance from a center of the cylindrical-shaped portion which is greater than a larger radius of a cylindrical-shaped portion of any other toner container used in the machine. Additionally, the container may be arranged such that a distance from the center of the cylindrical-shaped cap portion to an outer edge of each of the two projections is at least 15%, 25%, or 35% greater than the radius of the cylindrical-shaped portion. Further, for any embodiments of the invention, the invention includes both an empty toner container, and the toner container filled with toner and/or a mixture of toner and other components such as developer, agitating or mixing particles, charging particles, or any desired feature.

According to another embodiment of the invention, the projection on the exterior of the cap or held portion is configured such that a distance from a center of the cylindrical-shaped cap portion to an outer edge of the projection is at least 15% greater than a radius of a cylindrical-shaped portion. Moreover, a distance from a center of the cylindrical-shaped cap portion to an outer edge of projection on the cap is at least 15%, 25%, or 35% greater than a radius of the cylindrical-shaped portion. Moreover, the cap may include a second projection, and the distance from a center of the cylindrical-shaped cap portion to an outer edge of the second projection is at least 15% greater than the radius of the cylindrical-shaped portion. Moreover, a distance from a center of the cylindrical-shaped cap portion to an outer edge of each of the two projections may be arranged to be 25% or 35% greater than the radius of the cylindrical-shaped portion.

According to another embodiment of the invention, a thickness in the vertical direction of a first projection plus the thickness in the vertical direction of a second projection for each of the three containers is within 30%, 20%, 10%, or is even the same as a predetermined number. Thus, while the various projections of the cyan, yellow, and magenta toner containers are different, a sum of their thicknesses may be the same as each other, or within a predetermined tolerance.

According to yet another embodiment of the invention, there are least two toner containers used with the invention, each toner container having two projections. The thickness of the projection in the vertical direction of the first projection of the first toner container corresponds to the thickness in the vertical direction of the second or lower projection of the second container, and the same holds true for the upper projection of the second container and the lower projection of the first container. Moreover, these dimensions may vary by 30%, 20%, 10%, or be set to exactly the same.

Such features correspond to the magenta and yellow bottles disclosed herein.

According to yet another embodiment of the invention, the projection on the exterior of the cap corresponds to a particular color toner and the length of the projection along a line parallel to the axis of rotation of the toner bottle is within 25%, 15%, or 5% of a distance from the axis of rotation to an outer edge of the projection.

According to another embodiment of the invention, the projection of the cap of the toner container is arranged such that the toner container can only be inserted through a plate having an opening which corresponds to the shape of the projection. Further, the opening of the plate corresponds to a circumferential shape of the container. Moreover, there may be two projections, and these two projections correspond to the holes in the plate.

Further, the invention includes an image forming apparatus containing the toner containers and the plate having various features as described above.

Figure 89A:
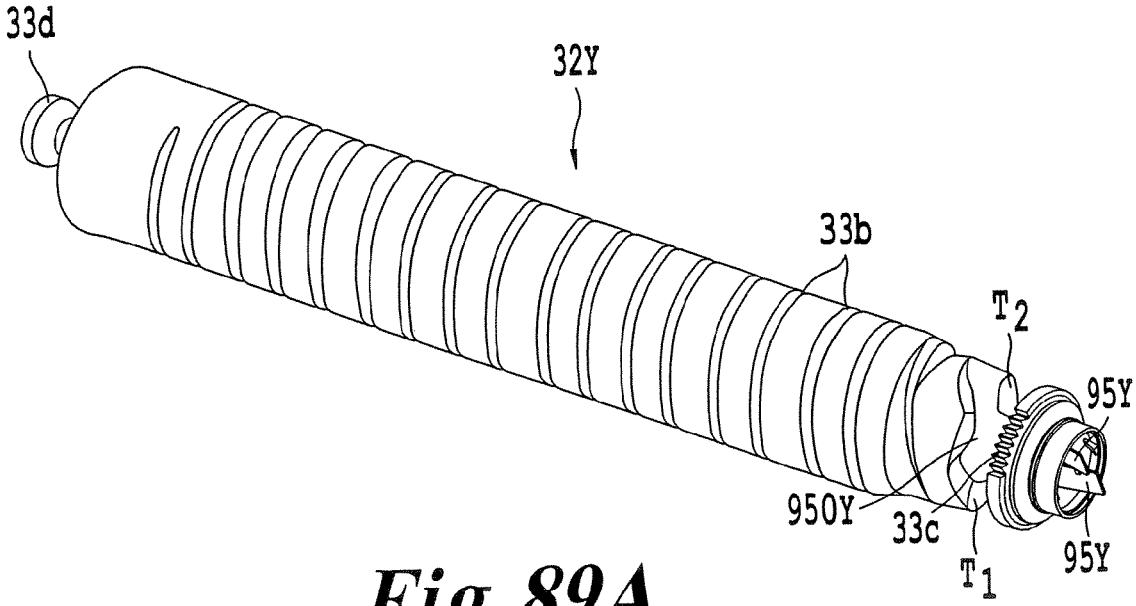
FIG. 89A is a perspective view of an embodiment of a toner bottle.
Figure 89B:
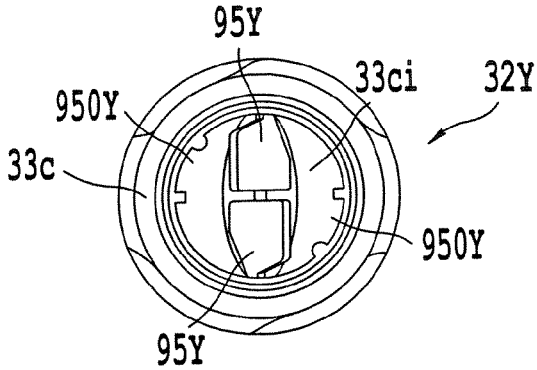
FIG. 89B is a front view of the toner bottle.

FIG. 89A and FIG. 89B are perspective and front views of an embodiment of the toner bottle 32Y. A bottle gear 33*c*, integrally molded with the bottle 32Y, is disposed near the opening of the toner bottle 32Y. Alternatively, the gear 33*c* may be formed separately from the bottle 32Y. As shown in FIG. 89B, when viewing the toner bottle 32Y from the bottle opening side, the portion of the bottle opening which has the smallest inner diameter is the opening (called the gear opening) 33*ci* at the bottle gear 33*c*. As an example, if the gear 33*c* is set back 1.5 centimeters (cm) from the opening end of the bottle 32Y, the gear opening 33*ci* will be set back inside of the bottle on the order of 1.5 cm from the opening end of the bottle.

The toner bottle of the present embodiment is provided with two toner guiding portions 95Y near the gear opening 33*ci*, and each toner guiding portion 95Y serves to move the toner from inside the toner bottle beyond the raised portion to the toner outlet when the bottle is rotated. The toner guiding portion 95Y is provided in the container to cause the toner inside the toner bottle to be moved to the toner outlet beyond the small-diameter portion of the bottle gear by rotation of the toner bottle. The toner guiding portions 95Y may be manufactured in any desired manner. For example, they may be integrally formed with the bottle or formed separately. The toner guiding portions 95Y may be formed together, and further formed to a ring which fits inside the mouth of the bottle 32Y in order to securely hold the toner guiding portions 95Y.

The construction of the bottle causes the toner to be scooped upwardly. Alternatively to or in addition to the scooping, the toner may be pushed forward and upward by grooves, such as the grooves 33*b*. A toner guiding inner wall 950Y is near the gear opening 33*ci* and the wall in toner bottle 32Y pushes out the toner, or allows the toner to slide thereon and to the toner guiding portions 95Y.

Features and descriptions of any one of the bottles shown in FIGS. 89A-91 are applicable to other bottles disclosed herein. A complete description of the reference numbers of the bottle shown in FIGS. 89A and 89B is provided below with respect to FIGS. 90A-91.

Figure 90A:
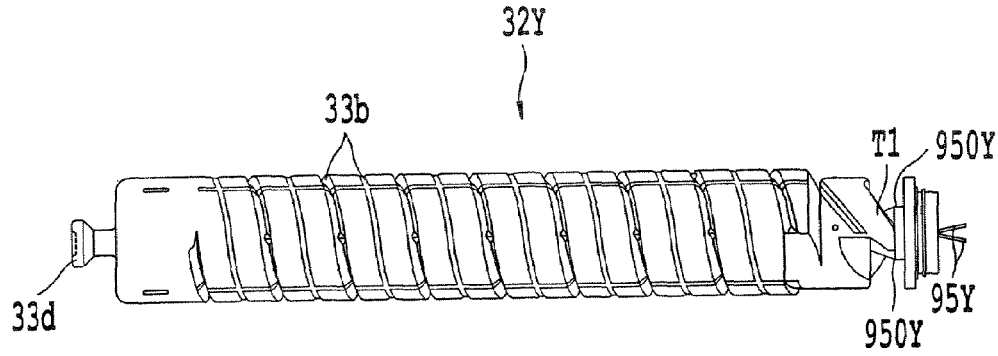
FIGS. 90A and 90B are side views of a toner bottle of the present invention.
Figure 90B:
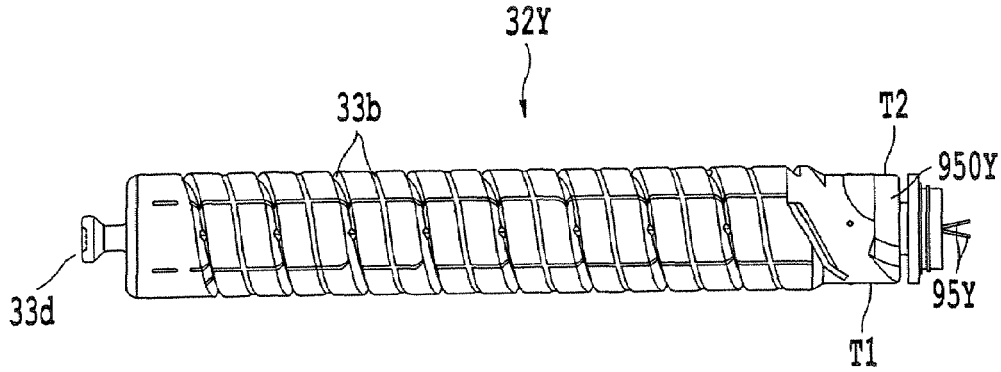

FIG. 90A and FIG. 90B are side views of different rotational orientations of the toner bottle 32Y. The toner guide 33*b* for toner delivery is formed by a double helix type of structure, and pushes toner towards the bottle opening parallel to the axis of rotation of the container.

It is desirable that the bottle gear 33*c* is formed so that its gear teeth do not project too much from the peripheral surface of the toner bottle 32Y. This is also desirable for device miniaturization. In addition, it is desirable for stabilization of the toner supply that the bottle gear 33*c* is provided near the toner outlet. For this reason, even if the diameter of the opening is smaller than the inner diameter of the toner bottle 32Y in the position of the bottle gear 33*c*, it is desirable for the toner to smoothly pass through the raised portion of the inner wall of the toner bottle.

From the grooves 33*b*, the toner is pushed to toner scoops T1 and T2, also referred to as toner conveyance devices or raised portions. The toner scoops T1 and T2 are raised outwardly, located at the shoulder portion of the bottle, and scoop or convey toner upwardly as the container is rotated.

Toner guiding inner walls 950Y are respectively formed along on each of inner wall surfaces of each of the raised portions T1 and T2. While FIGS. 89A, 90A, and 90B show reference characters 950Y, in these FIGS. 950Y is designating the outside or backside of the inner walls. The inner walls 950Y appear, when looking into the mouth of the bottle 32Y as viewed in FIG. 89B, as inward-raised portions that are raised inwardly when viewed from the bottle opening. With the use of the toner guiding inner walls 950Y in the toner guide 33*b*, it is possible for the toner inside the toner bottle to be moved to the toner outlet beyond the small-diameter portion of the bottle gear by rotation of the toner bottle. Even when the bottle gear 33*c* is provided near the toner outlet, the structure disclosed above such as the toner guide, scoop, inner walls, and/or the toner guiding portions enable the internal toner to transfer to the toner outlet beyond the gear opening 33*ci* by the rotation of the bottle. Summarizing toner conveyance within the bottle, toner is pushed forward within the main body of the bottle by the toner guide(s) 33*b*. From the end of the toner guides 33*b*, toner is scooped upwardly by the scoops T1 and T2 due to the rotation of the bottle. From the scoops T1 and T2, toner slides along the inner walls 950Y. From the inner walls 950Y, the toner slides to the toner guiding portions 95Y which convey the toner outside of the container.

Figure 91:
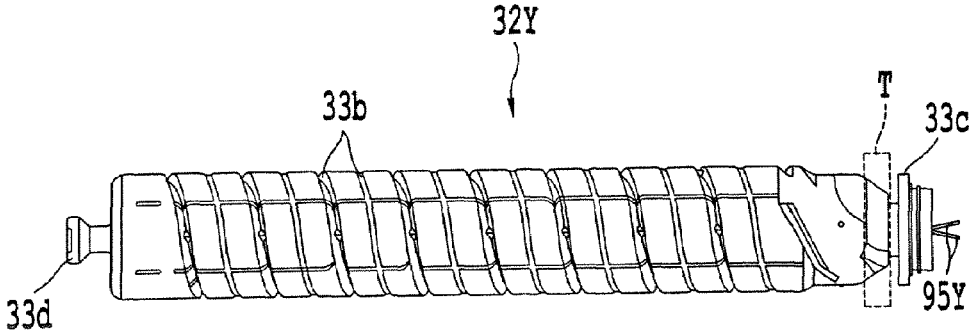
FIG. 91 is a side view of a variation of a toner bottle used with the invention.

FIG. 91 is a side view of a variation of the toner bottle 32Y, when viewed from the side surface of the 32Y. In this modification, the shoulder edge of the two raised portions T1 and T2 in the shoulder unit T of toner bottle 32Y shown in FIG. 90A and FIG. 90B is beveled, and has a sloping shoulder. Except for this sloping or beveling at the shoulder T, the bottle of FIG. 91 has the same construction as that illustrated in FIG. 89A and FIG. 89B, and a description thereof will be omitted. The toner bottle is not required to have the raised portion or scoops T1 and T2 as described in the above embodiments, but may alternatively or additionally have sloping-shoulders.

FIGS. 92A-92E are an alternative bottle, container, or volume that may be used with the invention. In FIGS. 92A-92E, 32 designates the bottle, 33*i* is a base portion, and 33*ct* are tabs on the bottle. A gear may be secured to the bottle so that it rests against the base portion 33*i* and is secured by the tabs 33*ct*. Alternatively and/or additionally, the gear may mount around the circumferential surface of the base portion 33*i* while being secured by the tabs 33*ct*.

Figure 92A:
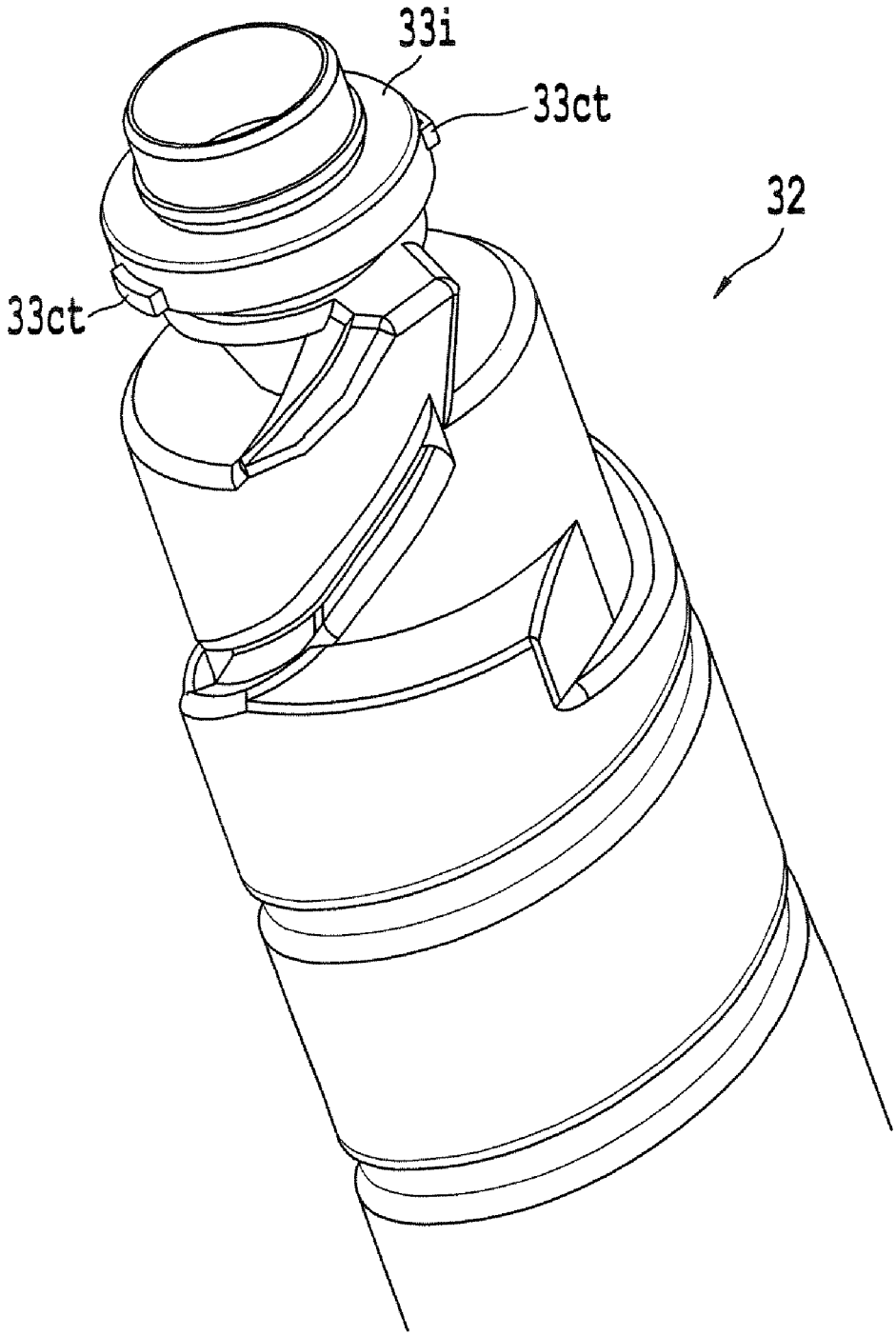
FIGS. 92A-92E are five views of another toner bottle which may be used with the invention.
Figure 92B:
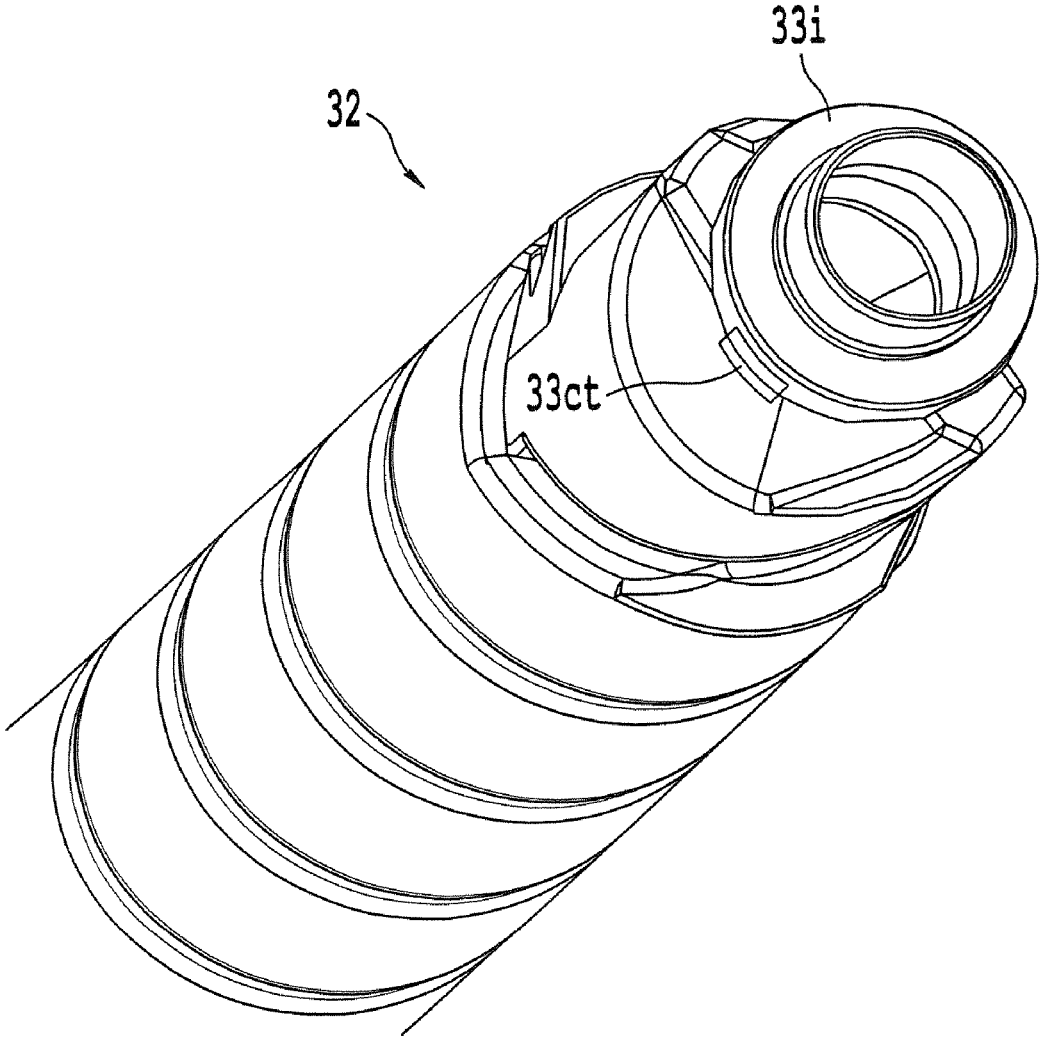
Figure 92C:
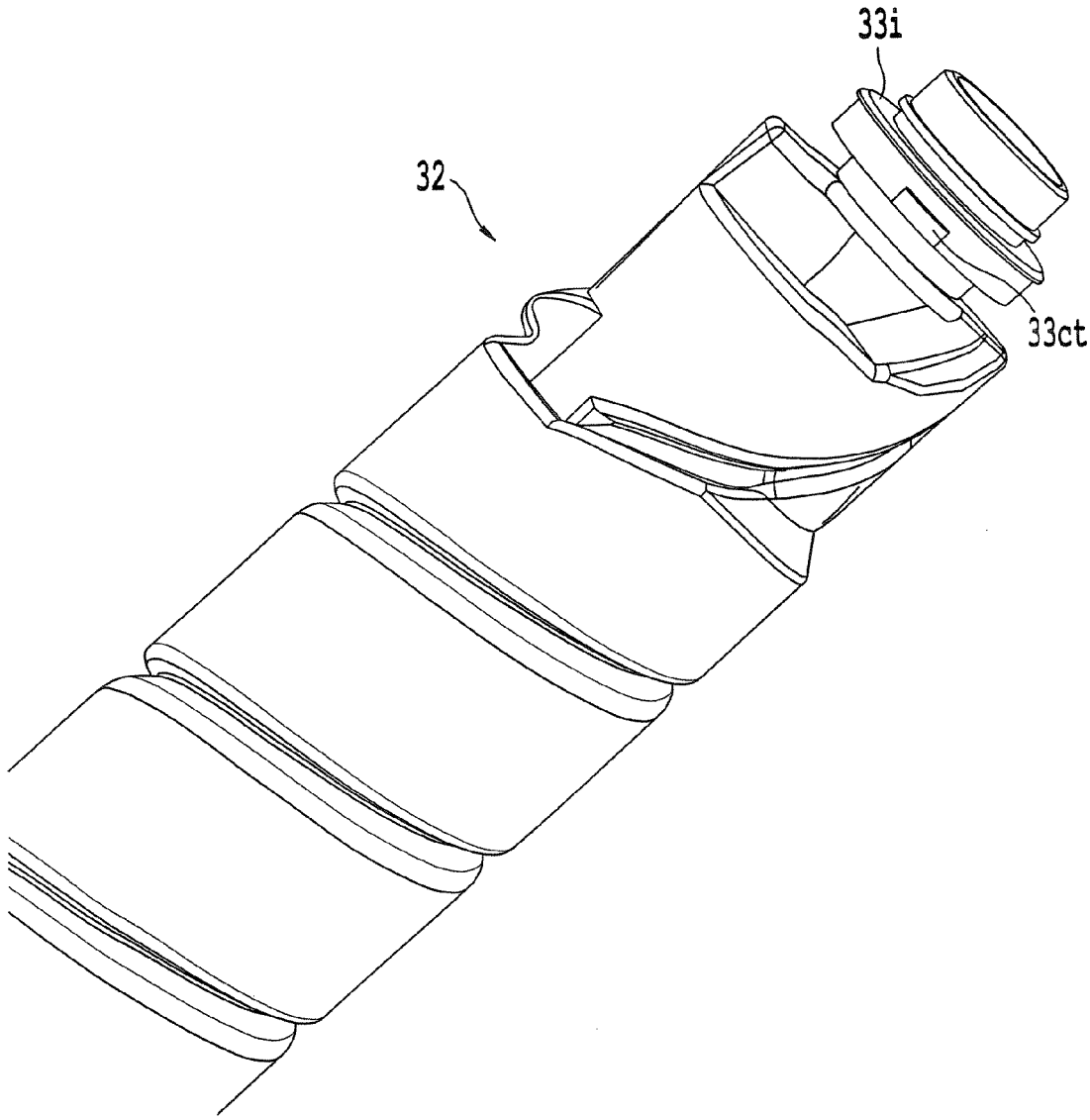
Figure 92D:
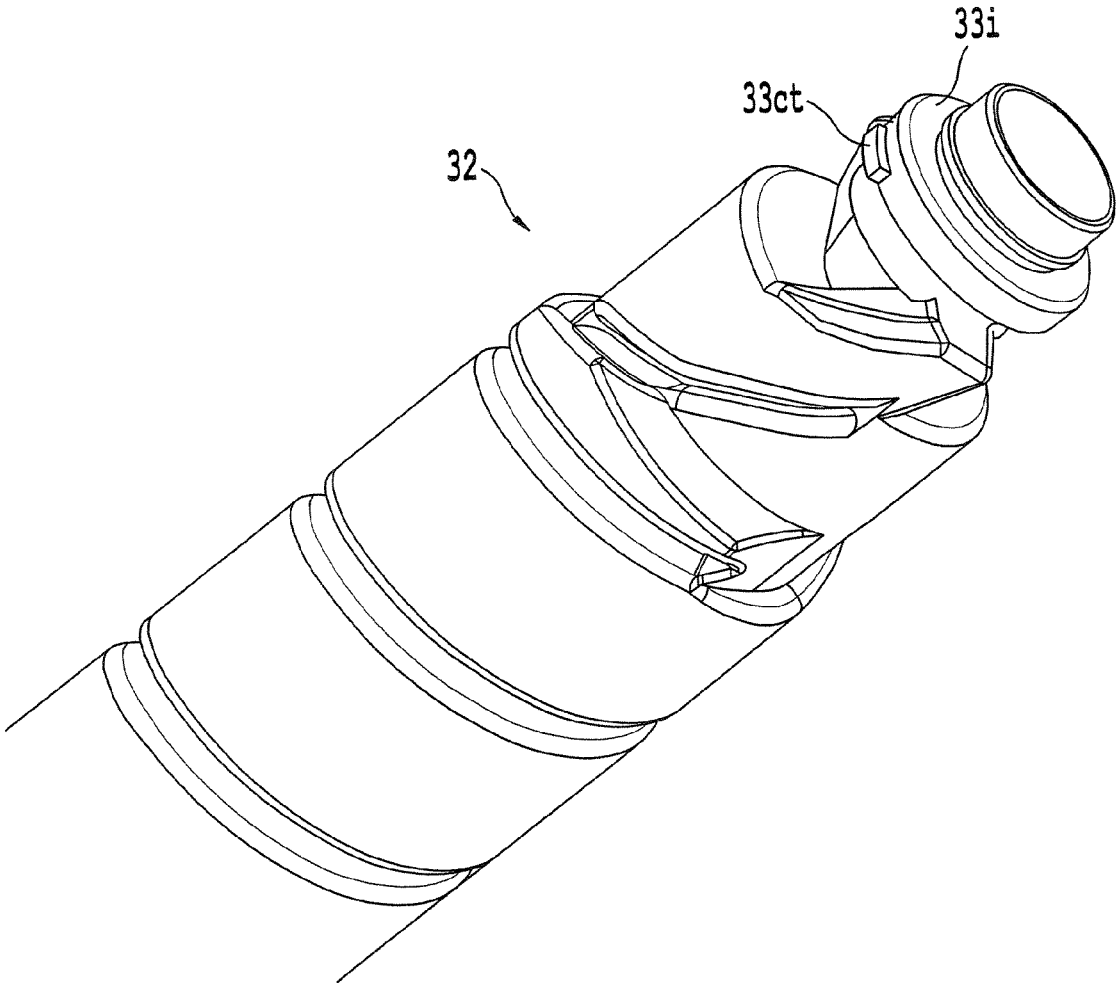
Figure 92E:
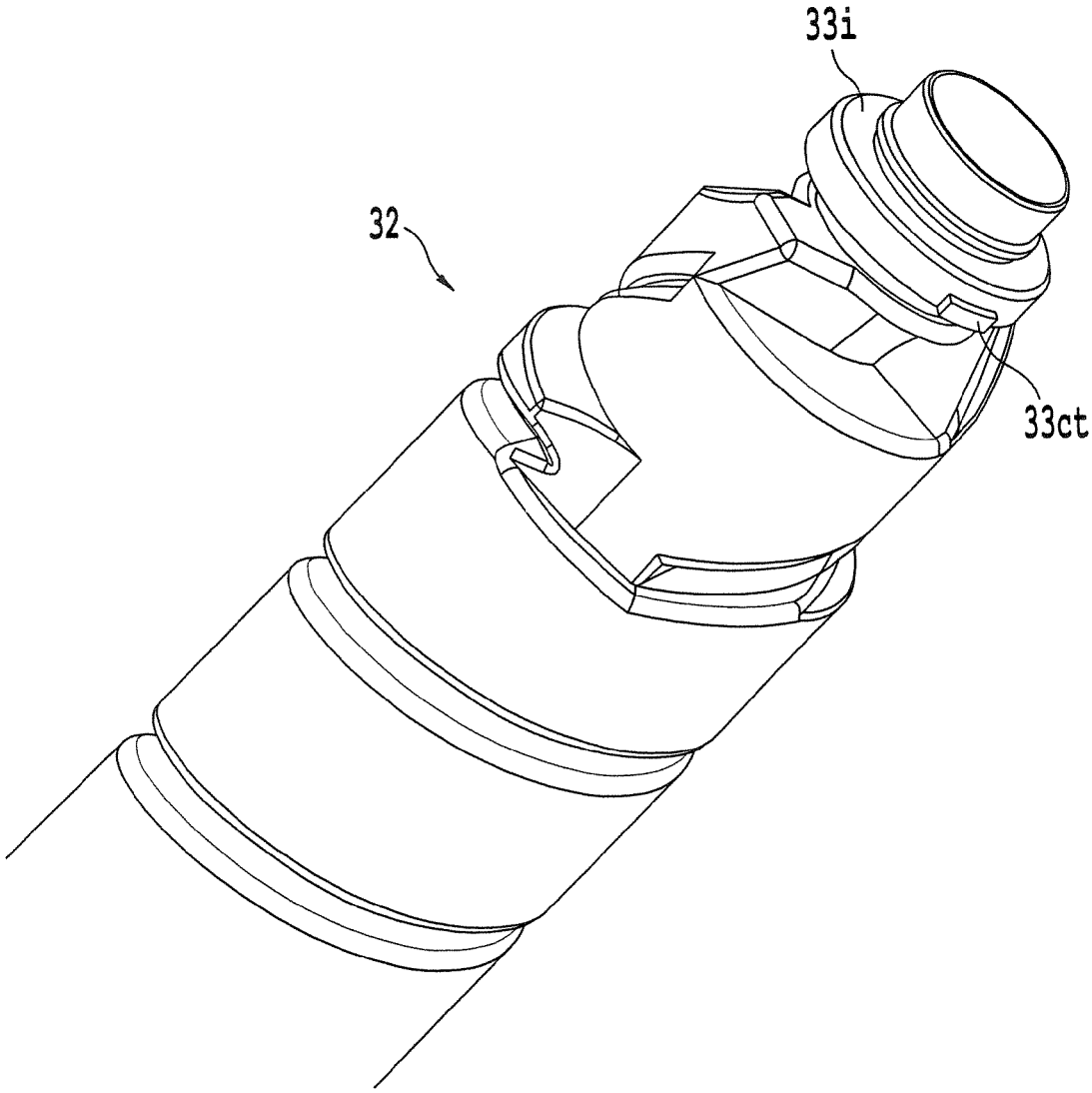
Figure 92G:
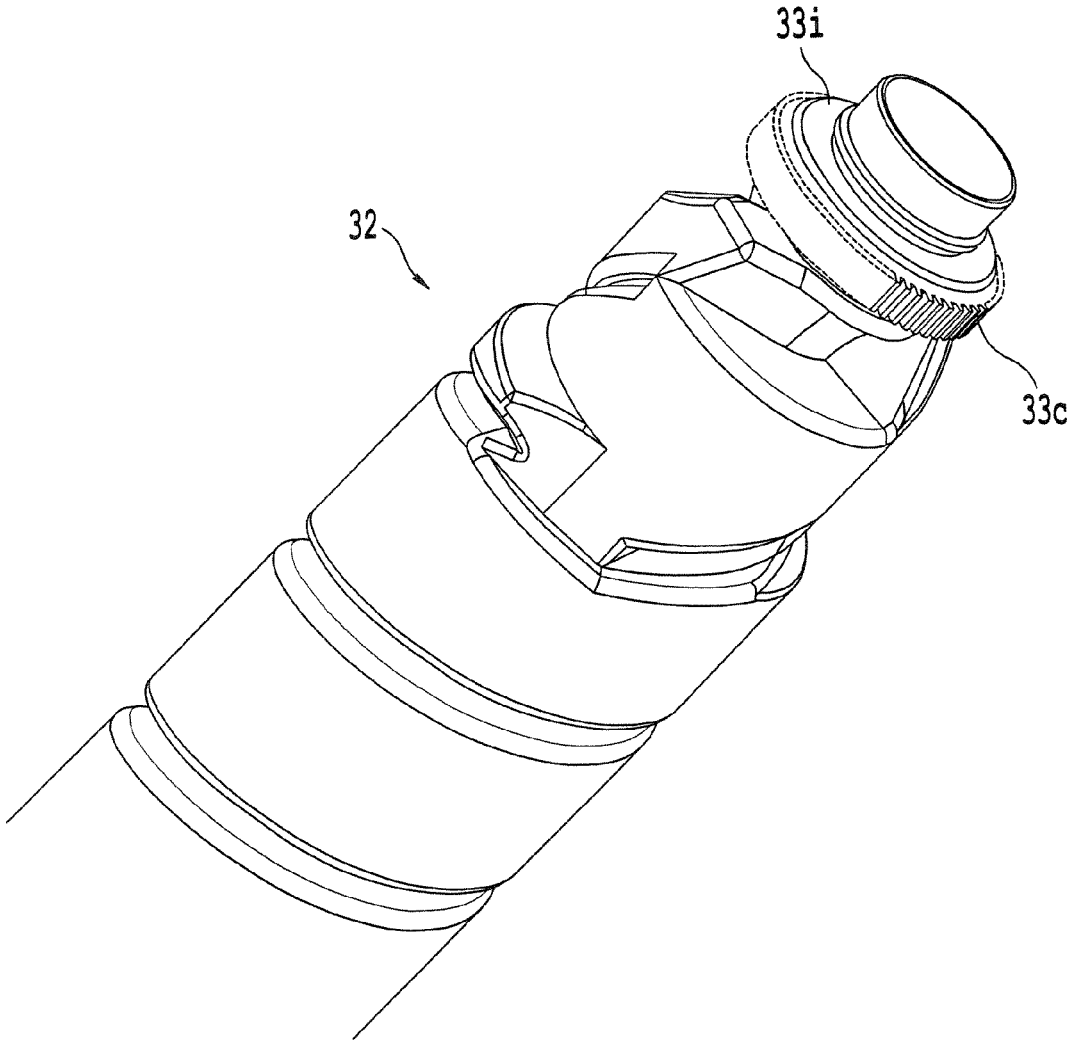
FIG. 92G shows the toner bottle of FIGS. 92A-92E having the gear of FIGS. 92F(1)-92F(3) mounted thereto.

FIGS. 92F(1)-92F(3) show the gear 33*c* which is secured to the base 33*i* of the bottle 32 shown in FIGS. 92A-92E. In FIGS. 92F(1)-92F(3), the gear 33*c* has two notches 33*cn* which respectively mate with the tabs 33*ct* of the bottle 32. The tabs 33*ct* snap into or interact with the notches 33*cn* in order to secure the gear 33*c* to the base 33*i* and the bottle 32.

FIG. 92F(1) shows a bottom view of the gear 33*c*. The bottom of the gear is the portion of the gear which first slips over the mouth of the bottle 32Y when the gear 33*c* is mounted to the bottle 32Y. FIG. 92F(2) shows a cross-section view of the gear 33*c* along the line 92F(2)-92F(2) of FIG. 92F(1). The left side of FIG. 92F(2) is the bottom of the gear 33*c*, and the right side is the top of the gear 33*c*. FIG. 92F(3) is a perspective view showing the top of the gear 33*c*. In FIG. 92F(3), one of the two notches 33*cn* is visible in the bottom portion of the gear.

The tabs 33*ct* and base portion 33*i*, while being part of this embodiment, are optional. Moreover, a gear such as the gear disclosed in other embodiments may be integrally formed with the bottle which would eliminate the need for the base 33*i* and separate gear 33*c*, and the tabs 33*ct* and notches 33*cn* which connect the gear 33*c* to the base 33*i*. While two notches 33*cn* and two tabs 33*ct* are used with this emobodiment, any number of notches/tabs may be used. Moreover, notches and tabs are not required to mount the gear to the bottle/base, and any other suitable and/or conventional structure can be used to secure the gear. For example, a press fit, a key/notch structure, and/or screws can be used to secure the gear to the bottle. The bottle of 92A-92E may be used with the held portion or cap 34K, 34Y, 34M, or 34C of this invention, may be used with any type of cap, or may be used without any cap.

Figure 93A:
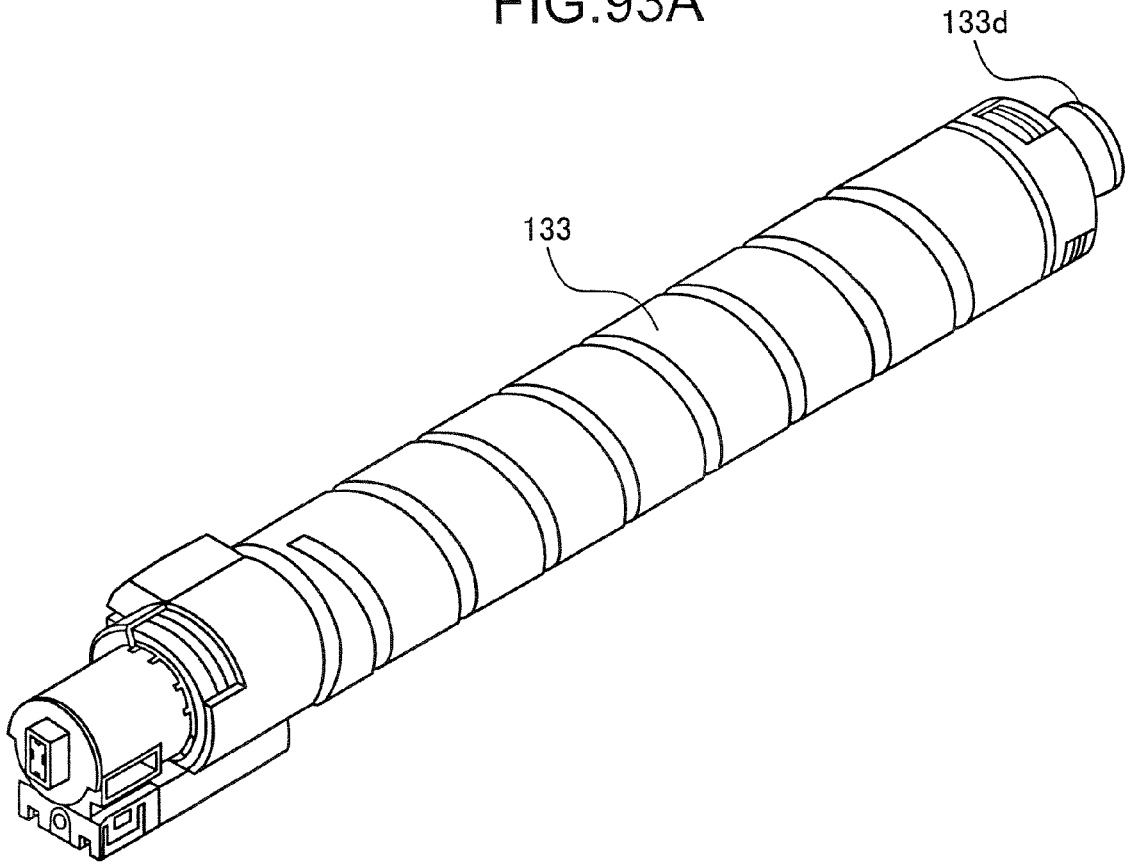
FIGS. 93A-93E are views of toner bottle according to another embodiment of the present invention.
Figure 93B:
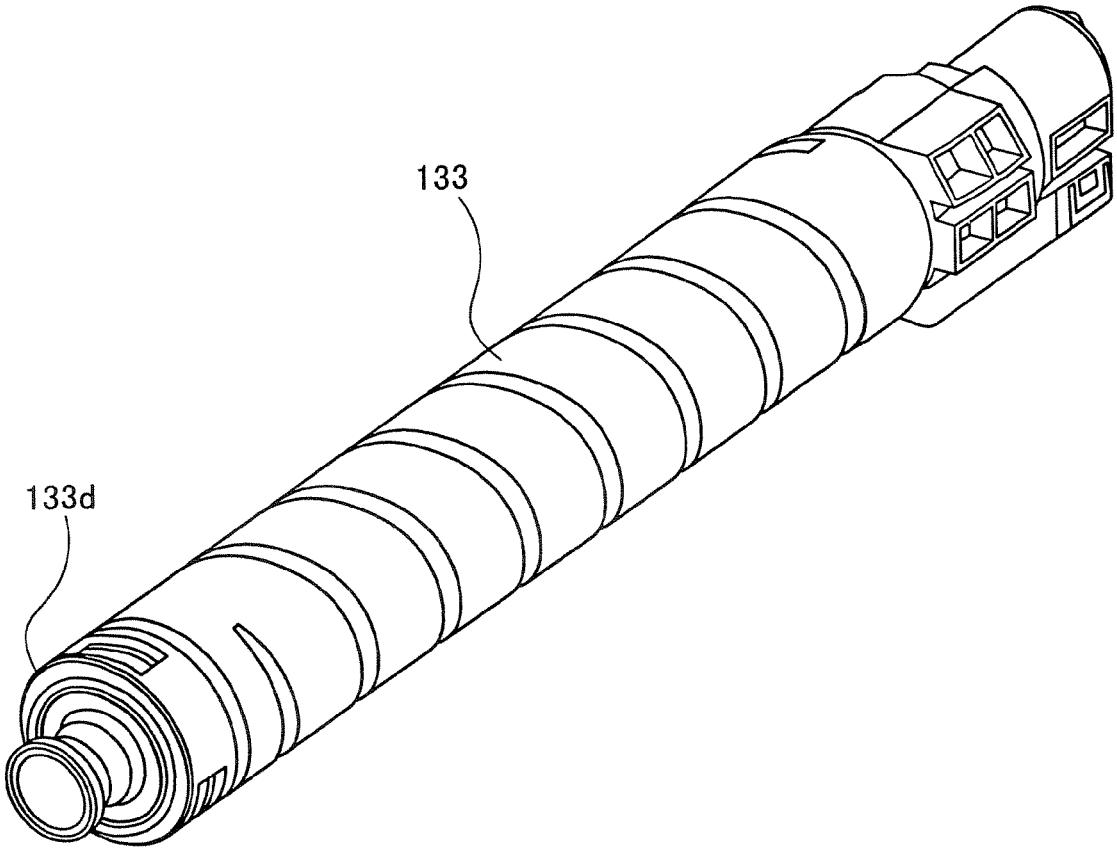
Figure 93C:
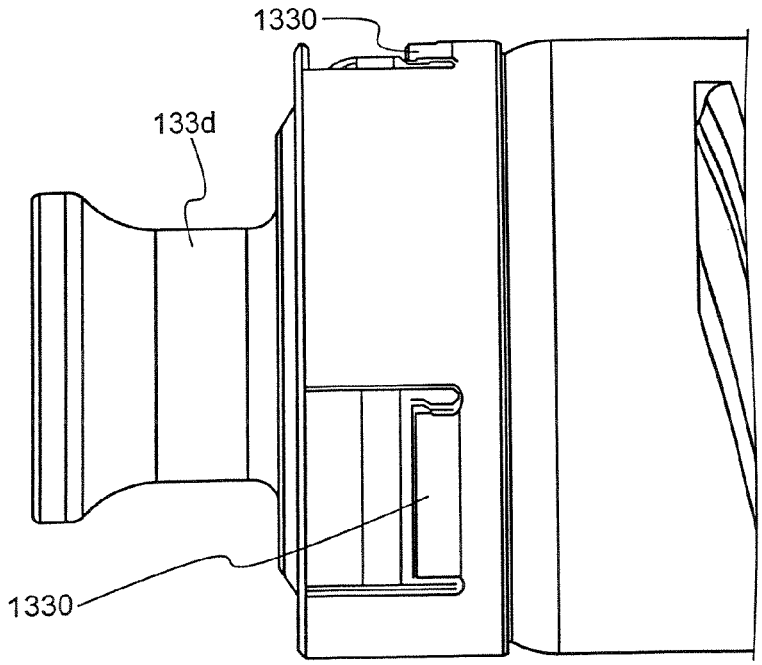
Figure 93D:
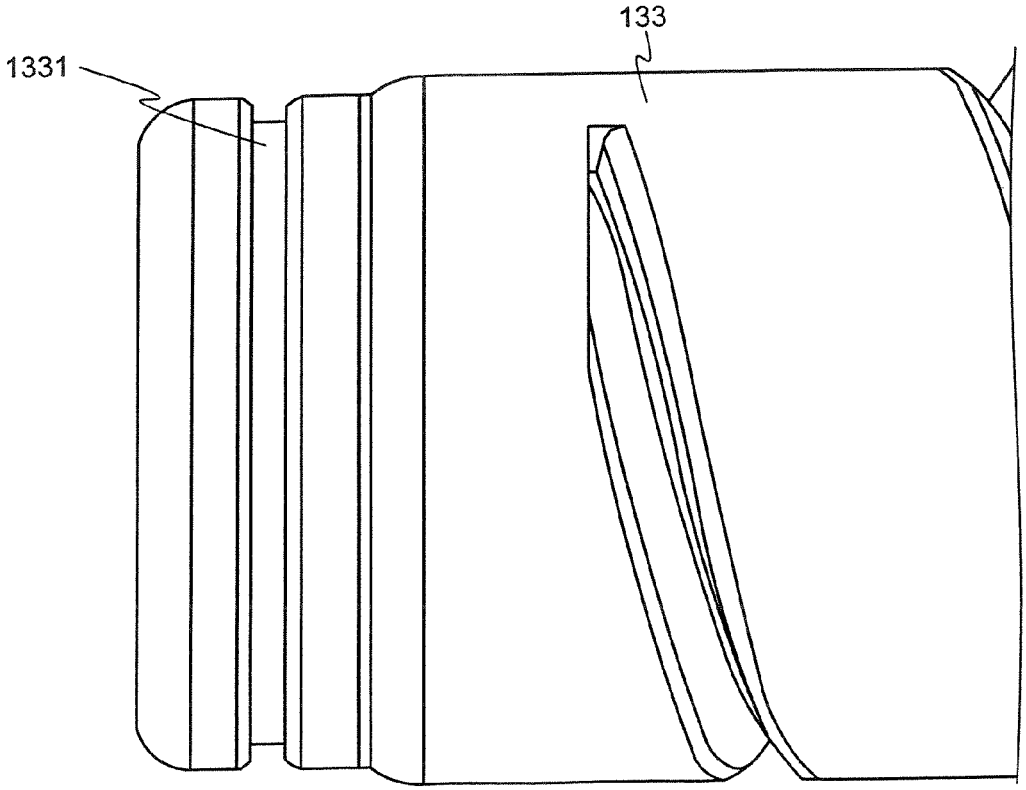
Figure 93E:
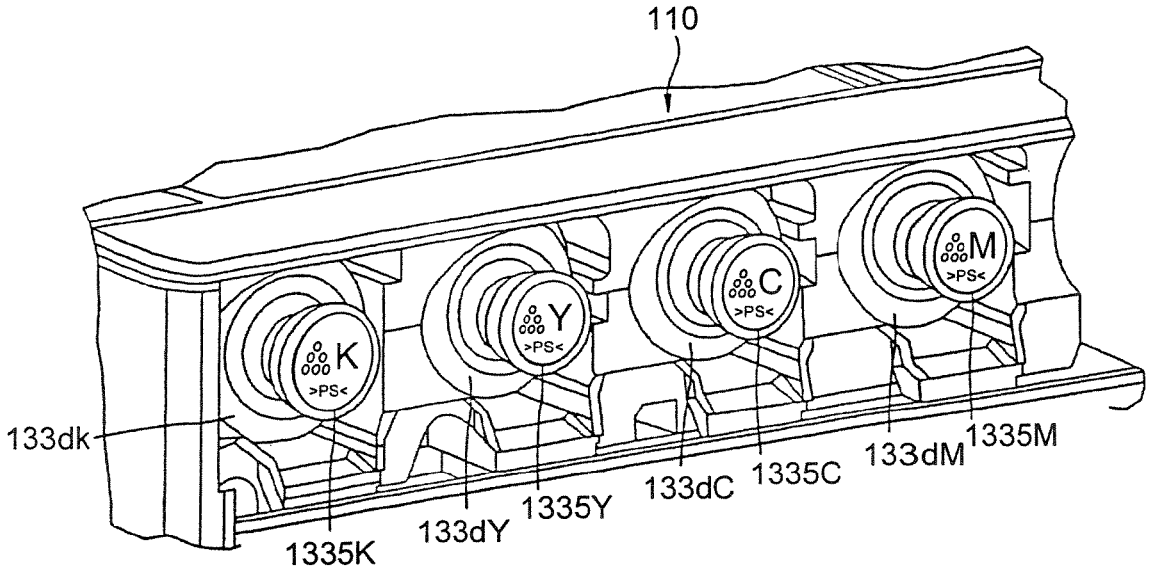

FIG. 93A to FIG. 93E represent another embodiment of the present invention. FIG. 93A is a perspective view of a toner bottle when viewed from its cap side. FIG. 93B is a perspective view of the toner bottle when viewed from a gripper 133*d*. FIG. 93C is a side view of the gripper 133*d*. FIG. 93D is a side view of an end portion of a container body before the gripper 133*d* is attached thereto. FIG. 93E is a perspective view of how toner containers are set in the main body of the image forming apparatus at an opening 110.

The toner container according to this embodiment has the gripper 133*d* separately formed from the toner bottle, as shown in FIG. 93C, and is fitted over the end portion of a container body 133 and into a groove 1331, as shown in FIG. 93D. According to other embodiments of the invention which have been explained above, the container body and the gripper are integrally formed as a single unit or component. According to this embodiment, an engagement claw 1330 of the gripper 133*d* is firmly engaged in the groove 1331 of the container body 133. The container body 133 and the gripper 133*d* may have the same color as each other, but alternatively, the container body 133 and the gripper 133*d* may have different colors in order to change the appearance of the toner container. It is thereby possible to improve the recognizability of the containers containing different colors of toner such that an operator can easily recognize the toner container when the toner container set in the main body of the image forming apparatus is replaced. In this case, by changing the color of the gripper 133*d* to one matching each of the toner colors, it is possible to prevent erroneous replacement which may occur between different toner containers having different toner colors.

Moreover, a decal, seal, label, or other indicia 1335 (representing 1335K, 1335Y, 1335C, and 1335M of FIG. 93E) indicating the color of toner contained within the bottle may be attached to or integrally formed on the end face of the gripper 133*d* (represented by 133*d*K, 133*d*Y, 133*d*C, and 133*d*M for the different toner bottles), as shown in FIG. 93E. The indication seal 1335 is, according to one embodiment, a round seal, preferably having the same color as the toner color within the container, and, according to one embodiment, has a sign with six circles triangularly arranged which represents toner, a letter representing a toner color (e.g., K, Y, C, or M), and ">PS<" indicating the container body and/or the gripper is made of polystyrene. The container body and the gripper 133*d* may be made out of other types of material such as As ABS (acrylonitrile-butadiene-styrene copolymer), PP (polypropylene), cardboard, paper, or any plastic, resin or metal. The seal 1335 also helps enhance the effect of recognizing the toner container when the toner container is replaced.

It is obvious that the present invention is not limited by the embodiments and that the embodiments can be changed as necessary, other than the suggestion in the embodiments, within the scope of the technological idea of the present invention. Furthermore, each number, position, and shape of the components are not limited by the embodiments, and therefore, these can be changed to those which are appropriate for implementation of the present invention.

The invention includes the assist element provided in the held portion to mechanically or electrically assist the attachment operation to the toner-container holder, and the assist element is provided in the upper side in the vertical direction with respect to the toner outlet.

The assist element is an electronic component that stores information related to the toner container.

The electronic component performs non-contact communication with the communication circuit provided in the toner-container holder while the held portion is held in the toner-container holder.

The electronic component is attached to the toner-container holder so as to be located more forward than the toner outlet.

The held portion includes the protrusion portion protruding in the direction of the attachment to the toner-container holder, and the electronic component is provided on the plane which is the protrusion portion and is orthogonal to the attachment direction.

The protrusion portion includes the wall portion covering around the electronic component.

The electronic component stores at least one of the information related to toner contained in the container body and the information related to recycling.

The assist element is an engaging portion engaged with the positioning member provided in the toner-container holder.

The engaging portion is engaged with the positioning member in synchronization with the attachment operation to the toner-container holder.

The engaging portion is provided near the toner outlet.

The assist element is the convex portion or the concave portion provided in a different position according to the type of toner container.

The convex portion or the concave portion is fitted with the fitting member provided in the toner-container holder when the attachment operation to the toner-container holder is correct.

The convex portion or the concave portion is provided in a different location according to a color of toner contained in the container body.

The package for packing the toner container is configured so as not to be stood on the horizontal plane with the longitudinal direction of the toner container packed therein as the vertical direction.

The end face of the package in the longitudinal direction is formed into any one of a slope, a sphere, and an angular head.

The manufacturing method for recycling the toner container includes the removal process for removing the held portion from the container body, the filling process for filling the inside of the container body with toner or developer after the removal process, and the fixing process for fixing the held portion to the container body after the filling process.

The other manufacturing method of recycling the toner container includes the machining process for forming a through hole in the container body, the filling process for filing the inside of the container body with toner or developer through the through hole, and the sealing process for sealing the through hole after the filling process.

The toner container detachably provided in the toner-container holder of the main body of the image forming apparatus includes the container body that discharges the toner contained therein from the opening and that has the gear engaged with the drive gear in the main body of the image forming apparatus; and the held portion that discharges the toner discharged from the opening of the container body, from the toner outlet and that is held by the toner-container holder in the non-rotating manner, in which the held portion is biased downwardly by the force applied from the drive gear to the gear when the drive gear rotates.

The gear of the container body and the drive gear are engaged with each other in any position in a range from the uppermost portion of the gear to a position thereof turning ¼ rotation.

The held portion includes the contact portion biased downwardly by the force applied to the gear to contact the toner-container holder.

The held portion includes the sliding portion sliding along the toner-container holder in synchronization with the attachment/detachment operation to/from the toner-container holder, and the contact portion is the sliding portion.

The toner container detachably provided in the toner-container holder of the main body of the image forming apparatus includes the container body that discharges the toner contained therein from the opening and has the gear engaged with the drive gear in the main body of the image forming apparatus; and the held portion that discharges the toner discharged from the opening of the container body, from the toner outlet and is held by the toner-container holder in the non-rotating manner, in which the gear is disposed so as to be engaged with the drive gear at the position on the opposite side in the vertical direction to the toner outlet through the opening.

The toner outlet is provided in the lower side with respect to the opening in the vertical direction, and the gear is provided so as to be engaged with the drive gear in the upper side with respect to the opening in the vertical direction.

The toner container detachably provided in the toner-container holder of the main body of the image forming apparatus includes the container body that discharges the toner contained therein from the opening; and the held portion that discharges the toner discharged from the opening of the container body, from the toner outlet and is held by the toner-container holder in the non-rotating manner, in which the toner outlet of the held portion is provided in a more rear side than the container body in the direction of the attachment to the toner-container holder.

The toner container detachably provided in the toner-container holder of the main body of the image forming apparatus includes the container body that discharges the toner contained therein from the opening; and the held portion that discharges the toner discharged from the opening of the container body, from the toner outlet and is held by the toner-container holder in the non-rotating manner, in which the toner outlet of the held portion is provided in a lower side lower than the opening of the container body in the vertical direction.

The held portion is attached to the toner-container holder so as to be located as the head of the container body.

The opening is provided at the position so as to be head of the container body upon the attachment operation to the toner-container holder.

The gear, to which the rotational drive force is transmitted from the main body of the image forming apparatus, is provided on the circumferential surface of the container body and near the opening.

The container body conveys the toner contained therein toward the opening in synchronization with the rotation of the gear by the rotational drive force transmitted thereto.

The container body includes a conveyor member for conveying the toner contained therein toward the opening in synchronization with the rotation of the gear by the rotational drive force transmitted thereto.

The toner is formed so that the following relations hold, $$3 \leqq Dv \leqq 8$$

$$1.00 \leqq Dv/Dn \leqq 1.40$$

where Dv(μm) is volume average particle size and Dn(μm) is number average particle size.

The toner is formed so that the shape factor SF-1 is in a range of 100 to 180 and the shape factor SF-2 is in a range of 100 to 180.

In the image forming apparatus, the toner container is detachably provided in the toner-container holder of the main body of the image forming apparatus.

The toner container detachably provided in the toner-container holder of the main body of the image forming apparatus includes the container body that discharges the toner contained therein from the opening; and the held portion that discharges the toner discharged from the opening of the container body, from the toner outlet and is held by the toner-container holder in the non-rotating manner, in which the container body is attached to the toner-container holder along the longitudinal direction of the container body so that the held portion is located as the head of the container body in the attachment direction, the held portion includes the open/close member for opening/closing the toner outlet in synchronization with the attachment/detachment operation to/from the toner-container holder, and the container body includes the gripper in the rear side in the attachment direction.

The gripper is provided in the rear end face of the container body.

The gripper is formed so as to be point symmetry with respect to the center of the rear end face when viewed from the attachment/detachment direction.

The gripper is formed so that the project plane thereof orthogonal to the attachment/detachment direction does not exceed the project plane of the container body orthogonal to the attachment/detachment direction.

The container body includes the spiral-shaped projection in the inner circumferential surface, is rotatable, and conveys the toner contained therein toward the opening in synchronization with its rotation, while the gripper is formed on the rotational central axis of the container body.

The toner container detachably provided in the toner-container holder of the main body of the image forming apparatus includes the container body that discharges the toner contained therein from the opening; and the held portion that discharges the toner discharged from the opening of the container body, from the toner outlet and is held by the toner-container holder in the non-rotating manner, in which the container body includes the gripper provided on the opposite side in the longitudinal direction to the position where the opening is provided.

The toner container is attached to the toner-container holder so that the held portion is located as the head of the container body and the gripper is in the rear end of the container body.

The gripper has a hole communicating with the inside of the container body.

The gripper has a seal member for sealing the hole.

The gripper includes a hook portion for hanging the container body on the filling machine when the container body is filled with toner through the hole.

The toner container detachably provided in the toner-container holder of the main body of the image forming apparatus includes the container body that discharges the toner contained therein from the opening; and the held portion that discharges the toner discharged from the opening of the container body, from the toner outlet and is held by the toner-container holder in the non-rotating manner, in which the toner container is attached to the toner-container holder along the longitudinal direction of the container body so that the held portion is located as the head of the container body in its attachment direction, and the container body is supported by the support member of the toner-container holder at a position on the rear side in the attachment direction.

The container body is attached to the toner-container holder with the longitudinal direction of the container body as the horizontal direction, and the support member supports the container body at two points which are in an obliquely lower side of the container body.

The held portion does not touch the support member when the attachment/detachment is performed to/from the toner-container holder.

The project plane of the held portion orthogonal to the attachment/detachment direction does not exceed the project plane of the container body in the attachment/detachment direction near the support member.

The container body includes the spiral-shaped projection in the inner circumferential surface, is rotatable, and conveys the toner contained therein toward the opening in synchronization with its rotation, while the container body has no projection in a region where it is rotatably supported by the support member.

The plug member relatively moves along the attachment/detachment direction of the held portion to open/close the toner outlet.

The plug member is provided in the lower side of the opening.

The held portion has packing slidably contacting the outer circumferential surfaces of the plug member and the nozzle.

The toner outlet is provided in a more rear side than the container body in the direction of the attachment to the toner-container holder.

The container body includes the gear on the circumferential surface of the container body and near the opening.

The method of manufacturing the toner container detachably provided in the toner-container holder of the main body of the image forming apparatus is such that the toner container includes the container body that discharges the toner contained therein from the opening; and the held portion that discharges the toner discharged from the opening of the container body, from the toner outlet and is held by the toner-container holder in the non-rotating manner, the container body includes the gripper provided on the opposite side in the longitudinal direction to the position where the opening is provided, and the method includes the machining process of forming a hole in the gripper so that the hole communicates with the inside of the container body; and the filling process of filling the container body with toner through the hole.

The method of manufacturing the toner container further includes the sealing process of sealing the hole after the filling process.

In the filling process, the toner container is hung on the filling machine using the hook portion of the gripper.

The toner bottle detachable provided in the bottle holder of the main body of the image forming apparatus includes the bottle body that is rotatable and conveys the toner contained therein toward the opening in synchronization with its rotation; the case that communicates with the bottle body through the opening, discharges the toner discharged from the opening, from the toner outlet, and is held by the bottle holder without following the rotation of the bottle body; the seal member that seals a gap which is around the opening and is between mutually opposite areas of the bottle body and the case; and the control portion for controlling, together with the seal member, the vibration in the radial direction of the opening.

The mutually opposite areas of the bottle body and the case are formed so as not to be parallel with each other, and are formed so that the area of one of the opposite areas is larger than the area of the other opposite area. The control portion is one of the opposite areas formed in the case or the bottle body, and controls, together with the seal member, the movement of the other opposite area in its radial direction.

One of the opposite areas is tapered.

One of the opposite areas is formed into a V shape.

The seal member is adhered to the control portion.

In the image forming apparatus, the toner bottle is detachably attached to the bottle holder of the main body of the image forming apparatus, and the bottle holder includes the holding portion for fixing the position of the case, and the drive unit for rotating the bottle body.

Because the present invention includes the standing inhibiting unit for inhibiting the toner container from being stood on the horizontal plane with the held portion directed vertically downward with respect to the container body, the present invention can provide the toner container and the image forming apparatus which prevent toner aggregation on the side of the held portion during stock of the toner container.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner container for detachably attaching to a toner-container holder of an image forming apparatus, the toner container comprising:

a longitudinal container body for containing toner, the container body having a first end and a second end distal to the first end in a length direction of the container body, the first end including an opening;

an end attached to the first end of the container body and configured to be detachably attached to the toner-container holder, the end including a toner outlet for discharging the toner from the container body, the end including:

a first cylindrical portion; and a second cylindrical portion which has a smaller diameter than a diameter of the first cylindrical portion, the first and second cylindrical portions having a common central axis; and an electric component, attached to the second cylindrical portion, that electrically communicates with a component in the image forming apparatus to detect whether the toner container is operatively set in the toner-container holder, the electric component being attached to the end such that when the end is attached to the toner-container holder, the electric component is located above the toner outlet with respect to a vertical direction.

2. The toner container according to claim 1, wherein the electric component includes a memory that stores therein at least one of information related to toner contained in the container body and information related to recycling.

3. The toner container according to claim 2, wherein the information related to the toner includes at least one of information of toner color, production number, and production date.

4. The toner container according to claim 1, wherein the electronic component includes a memory that stores information related to the toner container; and a communicating unit that performs non-contact communication with a communication circuit provided in the toner-container holder while the toner container is held by the toner-container holder.

5. The toner container according to claim 4, wherein the electric component is provided on a surface of the second cylindrical portion, the surface being orthogonal to a direction of attachment/detachment of the toner container to/from the toner-container holder, and the electric component is located at a position opposing the communication circuit when the toner container is attached to the toner-container holder.

6. The toner container according to claim 1, wherein the electronic component is attached to the second cylindrical portion so as to be located more forward than the toner outlet while the toner container is held by the toner-container holder.

7. The toner container according to claim 6, wherein the second cylindrical portion further includes a protrusion portion protruding in an attachment direction of the toner container to the toner-container holder, and the electronic component is provided on the protrusion portion and on a plane that is orthogonal to the attachment direction.

8. The toner container according to claim 7, wherein the protrusion portion further includes a wall portion around the electronic component.

9. The toner container according to claim 1, wherein the container body contains toner therein.

10. The toner container according to claim 9, wherein a ratio of filling volume/entire volume of the toner contained in the container body is 0.7 or less.

11. The toner container according to claim 9, wherein the container body further contain carrier.

12. The toner container according to claim 9, wherein a weight ratio of the carrier contained in the container body ranges from 3 wt % to 20 wt % with respect to the weight of the carrier and the toner.

13. The toner container according to claim 1, wherein the electric component includes an ID chip.

14. The toner container according to claim 1, wherein the container body is configured to rotate, and to feed the toner contained therein toward the opening along with rotation thereof.

15. The toner container according to claim 14, wherein the container body includes a gear provided on a circumferential surface thereof, and the gear transmits rotation drive force to the container body.

16. The toner container according to claim 15, wherein the first cylindrical portion covers at least part of the gear.

17. The toner container according to claim 14, wherein the container body has a spiral-shaped protrusion on an inner circumference thereof.

18. The toner container according to claim 1, wherein the container body has a conveying member that conveys the toner contained therein toward the opening.

19. The toner container according to claim 18, wherein the conveying member includes a coil that is configured to be rotatable.

20. The toner container according to claim 18, wherein the conveying member has a plated-form member that is configured to be movable in a longitudinal direction of the container body.

21. The toner container according to claim 1, further comprising:

a nozzle hole to receive a nozzle of the image forming apparatus which is parallel to a length of the longitudinal container body, the nozzle to receive the toner from the toner outlet while the nozzle is in the nozzle hole, wherein the electric component and the nozzle hole are provided on an orthogonal plane of the second cylindrical portion.

22. The toner container according to claim 1, wherein:

the common central axis penetrates the electrical component.

23. The toner container according to claim 22, wherein:

the electrical component is mounted to a front surface of the second cylindrical portion which is perpendicular to the common central axis.

* * * * *